US008863733B2

(12) United States Patent
Skilling

(10) Patent No.: US 8,863,733 B2
(45) **Date of Patent: *Oct. 21, 2014**

(54) PROJECTILE ACCELERATOR THAT EXPELS MULTIPLE PROJECTILES AT CONTROLLED VARYING ENERGY LEVELS IN AN INCONSISTENT MANNER

(71) Applicant: Jay Edward Skilling, San Antonio, TX (US)

(72) Inventor: Jay Edward Skilling, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/753,410

(22) Filed: Jan. 29, 2013

(65) Prior Publication Data

US 2014/0034036 A1 Feb. 6, 2014

Related U.S. Application Data

(63) Continuation of application No. 12/644,220, filed on Dec. 22, 2009, now Pat. No. 8,360,042.

(60) Provisional application No. 61/139,680, filed on Dec. 22, 2008.

(51) Int. Cl.

| | |
|---|---|
| ***F41B 11/32*** | (2006.01) |
| ***F41B 11/70*** | (2013.01) |
| ***F41A 1/06*** | (2006.01) |
| ***F41A 19/02*** | (2006.01) |
| ***F41A 19/03*** | (2006.01) |
| ***F41A 19/04*** | (2006.01) |
| ***F41A 19/65*** | (2006.01) |
| ***F41A 19/66*** | (2006.01) |
| ***F41A 19/67*** | (2006.01) |
| ***F41B 11/57*** | (2013.01) |
| ***F41B 11/72*** | (2013.01) |

(52) U.S. Cl.

CPC . *F41B 11/70* (2013.01); *F41A 1/06* (2013.01); *F41A 19/02* (2013.01); *F41A 19/03* (2013.01); *F41A 19/04* (2013.01); *F41A 19/65* (2013.01); *F41A 19/66* (2013.01); *F41A 19/67* (2013.01); *F41B 11/57* (2013.01); *F41B 11/72* (2013.01)

USPC ..... 124/71; 124/72

(58) Field of Classification Search

CPC ..... F41B 11/57; F41A 19/03

USPC ..... 124/71–77

See application file for complete search history.

(56) References Cited

U.S. PATENT DOCUMENTS

| | | | | | |
|---|---|---|---|---|---|
| 4,030,097 | A | * | 6/1977 | Gedeon | 342/115 |
| 4,184,156 | A | * | 1/1980 | Petrovsky et al. | 342/104 |
| 4,276,548 | A | * | 6/1981 | Lutz | 342/103 |
| 4,499,630 | A | * | 2/1985 | Harris et al. | 16/441 |
| 4,819,609 | A | * | 4/1989 | Tippmann | 124/72 |
| 4,881,707 | A | * | 11/1989 | Garfinkle | 248/222.12 |
| 5,081,901 | A | * | 1/1992 | Kemeny et al. | 89/8 |
| 5,333,594 | A | * | 8/1994 | Robinson | 124/73 |
| 5,383,442 | A | * | 1/1995 | Tippmann | 124/76 |

(Continued)

*Primary Examiner* — Michael David

(74) *Attorney, Agent, or Firm* — McConnell IP Law

(57) ABSTRACT

A projectile accelerating system that includes a projectile accelerator and/or associated projectile equipment configured to allow an informed user to more effectively engage opponents. The accelerating system includes an automatic and/or automated energy adjustment mechanism and/or method, configured to allow the projectile accelerator to effectively expel a plurality of projectiles at varying energy levels and/or settings. The adjustment mechanism and/or method includes a controller configured to allow the selective selection of energy levels and/or settings falling below an upper energy level or setting.

20 Claims, 76 Drawing Sheets

(56) References Cited

U.S. PATENT DOCUMENTS

| | | | | | |
|---|---|---|---|---|---|
| 5,462,042 | A * | 10/1995 | Greenwell | 124/76 |
| 5,570,094 | A * | 10/1996 | Armstrong | 342/107 |
| 5,613,483 | A * | 3/1997 | Lukas et al. | 124/73 |
| 5,727,538 | A * | 3/1998 | Ellis | 124/77 |
| 5,755,213 | A * | 5/1998 | Gardner et al. | 124/73 |
| 5,878,736 | A * | 3/1999 | Lotuaco, III | 124/71 |
| 5,947,100 | A * | 9/1999 | Anderson | 124/45 |
| 5,957,119 | A * | 9/1999 | Perry et al. | 124/73 |
| 5,967,133 | A * | 10/1999 | Gardner, Jr. | 124/77 |
| 6,003,504 | A * | 12/1999 | Rice et al. | 124/73 |
| 6,035,843 | A * | 3/2000 | Smith et al. | 124/77 |
| 6,065,460 | A * | 5/2000 | Lotuaco, III | 124/72 |
| 6,138,656 | A * | 10/2000 | Rice et al. | 124/73 |
| 6,142,137 | A * | 11/2000 | MacLaughlin | 124/72 |
| 6,311,682 | B1 * | 11/2001 | Rice et al. | 124/71 |
| 6,349,711 | B1 * | 2/2002 | Perry et al. | 124/73 |
| 6,378,367 | B1 * | 4/2002 | Dilz, Jr. | 73/488 |
| 6,474,326 | B1 * | 11/2002 | Smith et al. | 124/77 |
| 6,590,386 | B1 * | 7/2003 | Williams | 324/178 |
| 6,615,814 | B1 * | 9/2003 | Rice et al. | 124/71 |
| 6,637,421 | B2 * | 10/2003 | Smith et al. | 124/77 |
| 6,644,295 | B2 * | 11/2003 | Jones | 124/77 |
| 6,644,296 | B2 * | 11/2003 | Gardner, Jr. | 124/77 |
| 6,658,982 | B2 * | 12/2003 | Cherry | 89/1.42 |
| 6,708,685 | B2 * | 3/2004 | Masse | 124/75 |
| 6,748,938 | B2 * | 6/2004 | Rice et al. | 124/77 |
| 6,810,871 | B2 * | 11/2004 | Jones | 124/77 |
| 6,860,259 | B2 * | 3/2005 | Rice et al. | 124/77 |
| 6,898,971 | B2 * | 5/2005 | Dilz, Jr. | 73/488 |
| 6,901,923 | B2 * | 6/2005 | Jones | 124/77 |
| 6,904,902 | B2 * | 6/2005 | Axelsson | 124/73 |
| 6,941,693 | B2 * | 9/2005 | Rice et al. | 42/71.01 |
| 6,966,313 | B1 * | 11/2005 | Yokota et al. | 124/32 |
| 6,973,748 | B2 * | 12/2005 | Rice | 42/69.01 |
| 7,069,922 | B1 * | 7/2006 | Orr | 124/73 |
| 7,594,502 | B1 * | 9/2009 | Anderson | 124/71 |
| 7,806,113 | B2 * | 10/2010 | Skilling | 124/73 |
| 7,926,408 | B1 * | 4/2011 | Kley | 89/41.17 |
| 2002/0017287 | A1 * | 2/2002 | Rice et al. | 124/71 |
| 2002/0020402 | A1 * | 2/2002 | Kotsiopoulos | 124/76 |
| 2003/0106545 | A1 * | 6/2003 | Verini | 124/74 |
| 2003/0131834 | A1 * | 7/2003 | Rice et al. | 124/32 |
| 2004/0065310 | A1 * | 4/2004 | Masse | 124/75 |
| 2004/0074487 | A1 * | 4/2004 | Christopher et al. | 124/56 |
| 2004/0134475 | A1 * | 7/2004 | Jong | 124/52 |
| 2006/0185657 | A1 * | 8/2006 | Gabrel | 124/73 |
| 2007/0017496 | A1 * | 1/2007 | Hill | 124/73 |
| 2007/0017497 | A1 * | 1/2007 | Masse | 124/73 |
| 2007/0028909 | A1 * | 2/2007 | Wood | 124/73 |
| 2007/0068502 | A1 * | 3/2007 | Jones et al. | 124/77 |
| 2007/0107711 | A1 * | 5/2007 | Leal et al. | 124/71 |
| 2007/0131209 | A1 * | 6/2007 | Campo et al. | 124/56 |
| 2008/0105245 | A1 * | 5/2008 | Cole | 124/77 |
| 2008/0115660 | A1 * | 5/2008 | Hensel | 89/136 |
| 2009/0025701 | A1 * | 1/2009 | Douglas et al. | 124/77 |
| 2009/0199830 | A1 * | 8/2009 | Skilling | 124/3 |
| 2009/0199834 | A1 * | 8/2009 | Skilling | 124/77 |
| 2011/0017189 | A1 * | 1/2011 | Skilling | 124/73 |

* cited by examiner

PROJECTILE ACCELERATOR THAT EXPELS MULTIPLE PROJECTILES AT CONTROLLED VARYING ENERGY LEVELS IN AN INCONSISTENT MANNER

CROSS-REFERENCE TO RELATED APPLICATIONS

The present application claims priority to and the benefit of U.S. Provisional Application No. 61/139,680 filed on Dec. 22, 2008 entitled Compressed Gas Projectile Accelerator and U.S. Utility patent application Ser. No. 12/644,220 filed on Dec. 22, 2009 entitled Compressed Gas Projectile Accelerating Linked System For Loading And Expelling Multiple Projectiles At Controlled Varying Velocities, which is hereby incorporated by reference in its entirety.

BACKGROUND

The present invention relates generally to compressed gas projectile accelerators and associated projectile equipment. More particularly, configuring compressed gas projectile accelerators and/or the associated projectile equipment to allow users to more effectively engage differing targets and/or opponents.

In the sport of paintball, the maximum velocity at which projectiles are permitted to be expelled from the barrel of a paintball gun or marker is tightly controlled in both recreational and tournament play. Most tournaments and recreational paintball venues only permit a paintball marker to shoot paintballs at a maximum speed of 300 feet per second ("FPS"). All markers are subjected to testing by chronographs before and sometimes after a tournament round or match. Some tournaments even randomly take chronograph readings of players' markers during actual tournament play. Shooting a hot marker, one that shoots paintballs at over 300 FPS, can subject a player or team to disqualification, a loss of points, or the player not being allowed on the field.

Current paintball markers provide various methods to adjust the speed at which a projectile is expelled from the marker. However, once the speed of the marker is adjusted to just below the maximum permitted velocity setting, the marker is not capable of being easily readjusted without the use of a tool, such as an allen wrench. Carrying tools that can be used to adjust marker velocity settings onto the field is strictly prohibited. As such, the paintball marker is only capable of being adjusted to operate on the field at one set velocity setting.

Further, current paintball markers do not provide a method to adjust the speed of the projectiles that is automatic and/or automated. Furthermore, current paintball markers do not provide an automatic and/or automated velocity adjustment method that does not allow the user to exceed a selected upper velocity limit.

Also, current paintball marker barrels do not provide a method to adjust and/or control the speed of the expelled projectile. As such, current paintball markers with current barrels are only capable of expelling projectiles at one velocity setting.

While current paintball markers and/or current associated projectile equipment provide various methods to load or feed projectiles, with some of these methods compensating for a side to side tilt (i.e.—left/right tilt) and some others even force feeding the projectiles. None provide an automatic and/or automated compensation for a forward/backward tilt that is inherit in lobbing a projectile at a target/opponent.

In the sport of paintball, as the proficiency of the players grows, the pace of the game has increased. There by, amplifying the need for quick and easily understandable operational information and/or game information. While some current paintball markers and/or current associated equipment provide some operational and/or game information, none provide the user their overall information picture, a means of selecting the prudent information, and/or an effective means of receiving it.

SUMMARY

One embodiment of the present application discloses a projectile accelerator and associated projectile equipment that enables a user to effectively engage differing targets and/or opponents that are screened by differing obstacles. Other embodiments include unique apparatus, devices, systems, means, operational modes and/or methods for allowing an informed user to effectively engage targets/opponents with projectiles from a projectile accelerator at user selected and/or self selected varying energy saving levels so that users are capable of lobbing projectiles at targets as well as shooting straight at targets. Further embodiments, forms, objects, features, advantages, aspects, and benefits of the present application shall become apparent from the detailed description and figures included herewith.

BRIEF DESCRIPTION OF THE DRAWINGS

The figures are not necessarily to scale, emphasis instead being placed upon illustrating the principles of the invention. Moreover, in the figures, like reference numerals designate corresponding parts throughout the different views.

DETAILED DESCRIPTION

Figure 1:
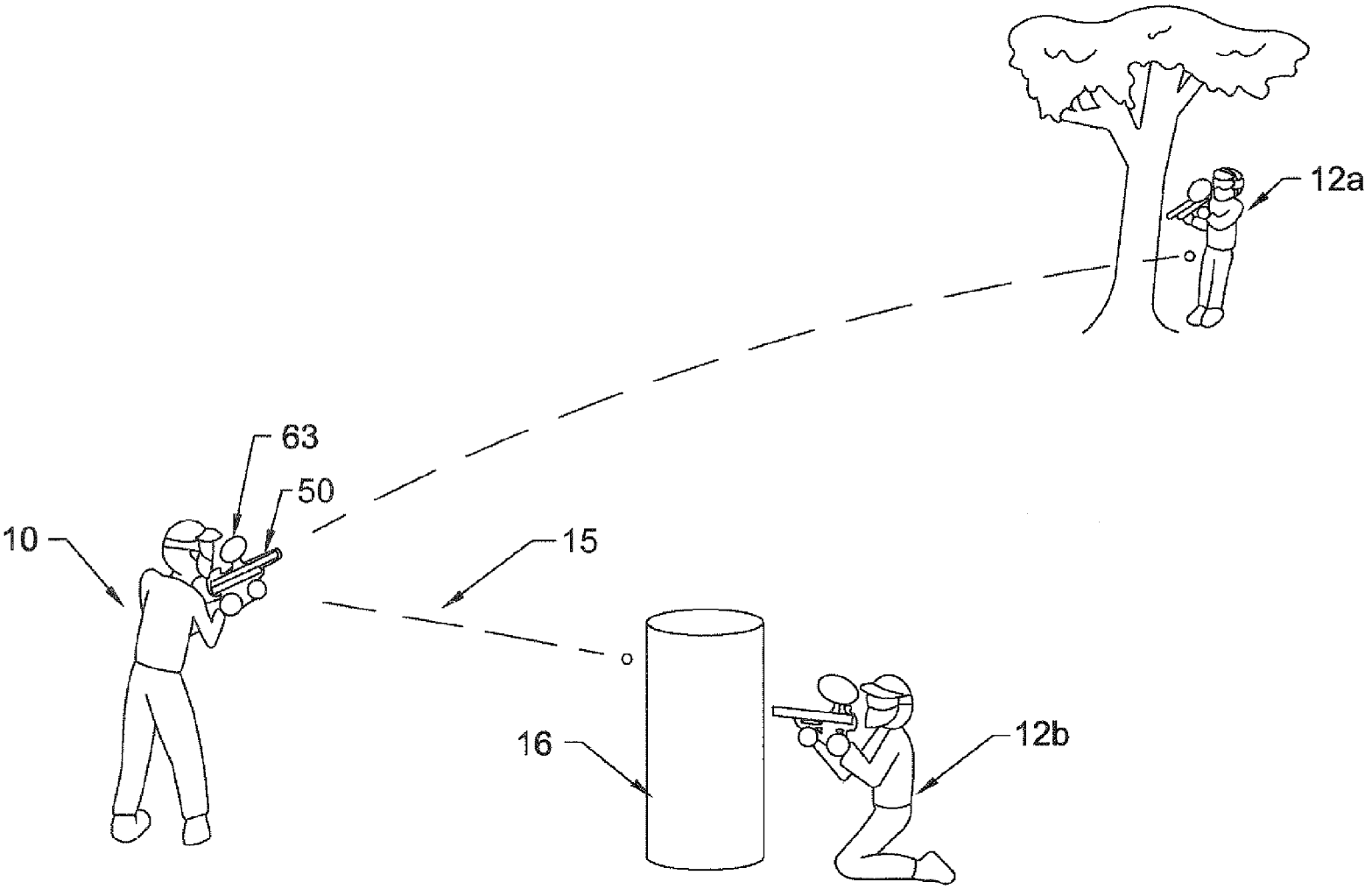
FIG. 1 illustrates a player shooting projectiles at targets on a paintball playing field using a compressed gas projectile accelerator.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention is illustrated therein being contemplated as would normally occur to one skilled in the art to which the invention relates.

Referring to FIG. 1, a user 10 is illustrated firing projectiles or paintballs at two respective targets 12*a*, 12*b* using a compressed gas projectile accelerator or paintball marker 50. User 10 is shooting at target 12*a* with a marker 50 that is set or configured to expel paintballs at target 12*a* at an upper velocity setting, which can comprise the maximum allowable velocity setting of 300 FPS. As illustrated, since user 10 is a substantial distance from target 12*a*, thus requiring the paintball to travel a greater distance (e.g. –200 feet), the paintball tends to travel along somewhat of an arced path after traveling a predetermined distance due to the force of gravity on the paintball.

As further illustrated, user 10 is somewhat closer to target 12*b* who is hiding behind an obstacle 16, which is illustrated as a barrel for representative purposes only. Also illustrated, user 10 firing paintballs at target 12*b* with marker 50 set at the upper velocity setting. Obstacle 16 is providing cover for target 12*b* making it extremely difficult, if not impossible, for user 10 to hit target 12*b*. This is because the paintball will travel along a relatively straight path 15 toward target 12*b* thereby causing the paintball to strike obstacle 16 and not target 12*b*. Despite the effect that gravity has on the paintball, at the maximum allowed velocity setting, paintballs are expelled from the marker 50 along a relatively straight path over short distances.

Referring to FIG. 2, again user 10 is illustrated firing projectiles at two respective targets 12*a*, 12*b* using a compressed gas projectile accelerator 50. User 10 is shooting at target 12*a* with a marker 50 that is set or configured to expel paintballs at target 12*a* at an upper velocity setting, as described above.

Figure 2:
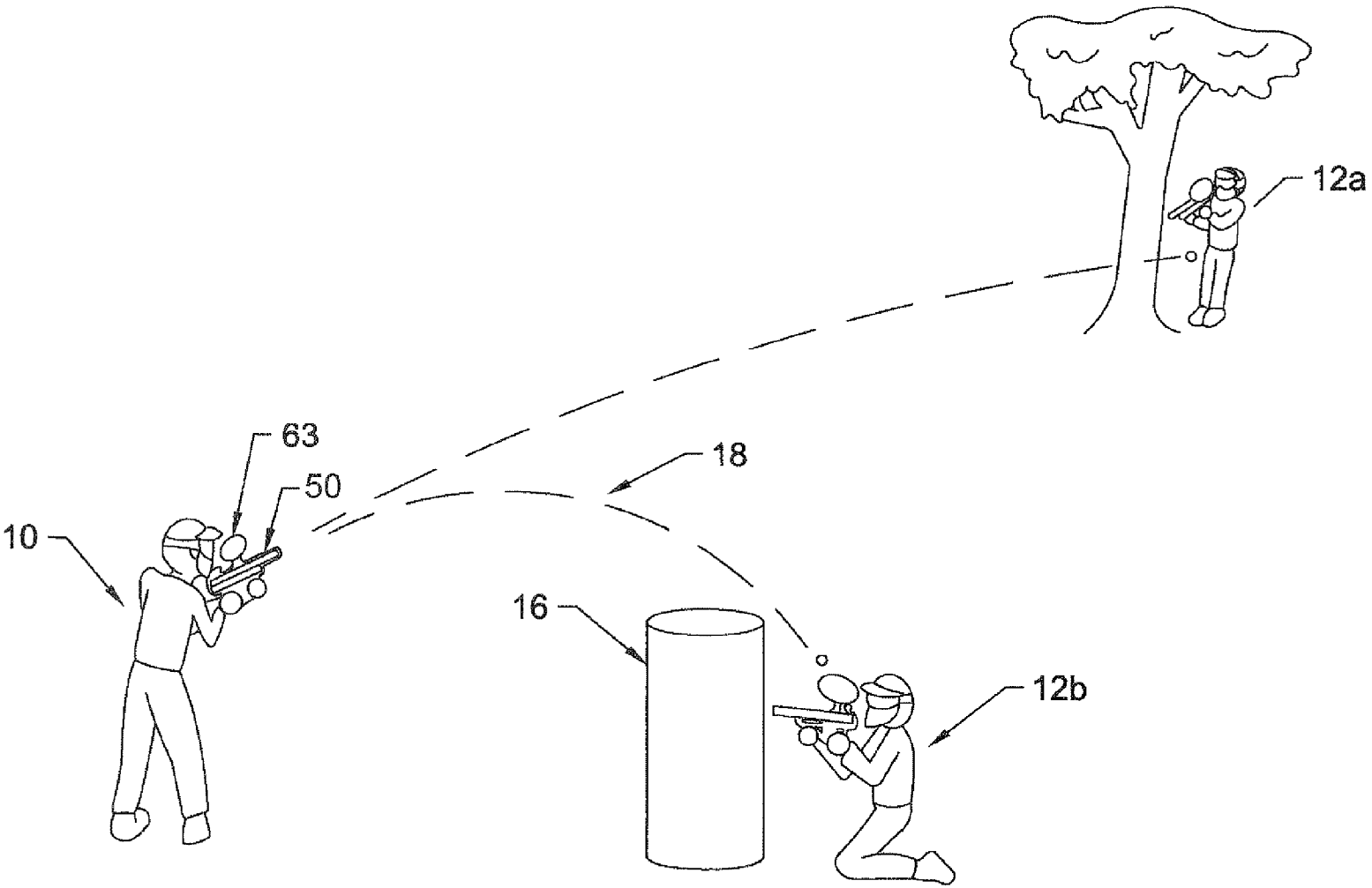
FIG. 2 illustrates a player shooting projectiles at targets on a paintball playing field using a compressed gas projectile accelerator.

Further, if user 10 was able, when engaging target 12*b*, to lower the velocity at which paintballs are expelled from barrel of marker 50, as well as adjust the angle of the barrel of marker 50 upward at a predetermined angle; the likelihood of user 10 being able to strike target 12*b* behind obstacle 16 with a paintball is greatly improved. This is because the paintball will travel along a substantially arc shaped path 18 as a function of the speed at which the paintball exits the barrel and the angle of the barrel. Therefore, as illustrated in FIG. 2, user 10 is capable of lobbing a paintball onto target 12*b* thereby eliminating the player, which is illustrated as target 12*b*.

Referring to FIG. 3, still again user 10 is illustrated firing projectiles at two respective targets 12*a*, 12*b* using a compressed gas projectile accelerator 50. User 10 is shooting at target 12*a* with a marker 50 that is set or configured to expel paintballs at target 12*a* at an upper velocity setting, as described above.

As in the above form, user 10 is lobbing paintballs on to target 12*b* with marker 50, also described above. Further, if user 10 was able to expel a multiple of paintballs at said lower velocity, and in a controlled velocity spread from the barrel of marker 50 to lets say, for example, a 5 shot volley of 160-170-180-190-200 FPS. And adjust the angle of barrel of marker 50 upward at a predetermined angle as before, the likelihood of user 10 being able to strike target 12*b* behind obstacle 16 with a paintball would greatly improve yet again. This is because the spread velocity of paintballs traveling along the enlarged arc shaped paths 18 would have greater and more uniformed area coverage, as a function of the fire mode of marker 50.

Figure 3:
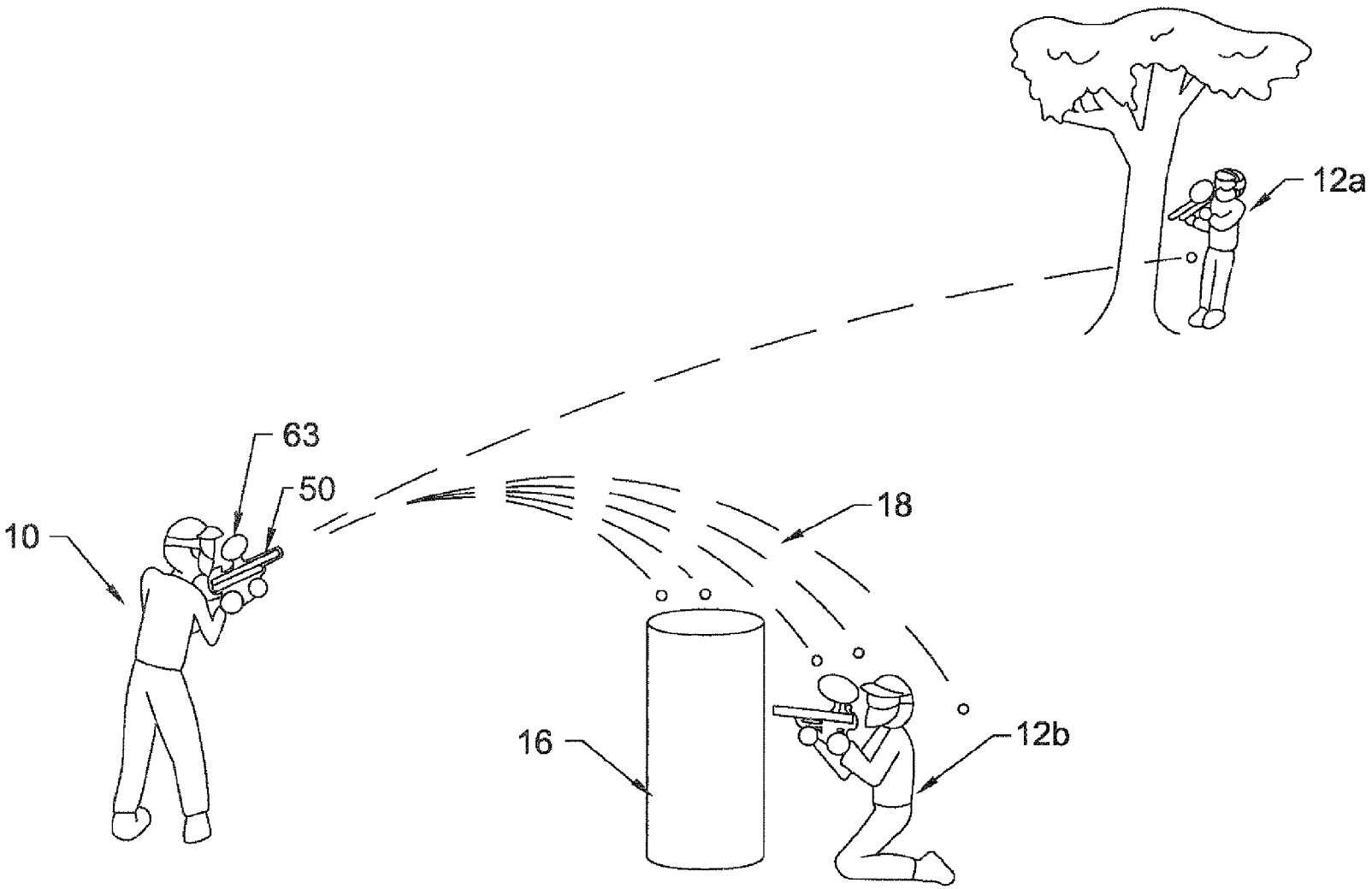
FIG. 3 illustrates a player shooting projectiles at targets on a paintball playing field using a compressed gas projectile accelerator.

As those skilled in the art would recognize, delivering a controlled spread or volley of paintballs along the enlarged or substantially arc shaped paths 18 onto target 12*b* would reduce the possible inaccuracies or miscalculations of user 10 and/or marker 50. The controlled spread or volley would also reduce the ability of target 12*b* to react to or avoid the incoming paintballs. Therefore, as illustrated in FIG. 3, user 10 is capable of lobbing a spread of paintballs onto target 12*b* thereby eliminating the player, which is illustrated as target 12*b*.

Further, those skilled in the art would also recognize that different arc angles and different lowered velocities can be used to lob paintballs onto a target like target 12*b*.

Referring to FIG. 4, yet again user 10 is illustrated firing projectiles at two respective targets 12*a*, 12*b* using a compressed gas projectile accelerator 50. User 10 is shooting at target 12*a* with a marker 50 that is set or configured to expel paintballs at target 12*a* at an upper velocity setting, as described above.

As in the above forms, user 10 is lobbing paintballs on to target 12*b* with marker 50, also described above. Further again, if user 10 was able to expel paintballs switching between the single velocity lobbing fire mode 17 (see FIG. 2) and the multiple velocity spreader lobbing fire mode 19 (see FIG. 3). And adjust the angle of barrel of marker 50 upward at a predetermined angle as before, the likelihood of user 10 being able to strike target 12*b* behind obstacle 16 with a paintball would greatly improve further still. This is because the paintballs traveling along the arc shaped path 18 of the single velocity lobbing fire mode 17 would indicate to user 10 the flight path and its impact, and act as a spotting round. Thus, allowing user 10 to adjust marker 50 and/or the barrel angle before firing in the velocity spreader fire mode 19.

Still further, in another form, if user 10 was able to combine the single velocity lobbing fire mode 17 and the multiple velocity spreader lobbing fire mode 19 into a combination or singular fire mode—a spotter round velocity spreader fire mode, the likelihood of user 10 being able to strike target 12*b* behind obstacle 16 with a paintball would greatly improve yet again.

This is because, firing a lobbing spotter round in combination with a controlled spread of paintballs of the velocity spreader mode along said arc shaped paths 18 onto target 12*b* would yet again, reduce the possible inaccuracies or miscalculations of user 10 and/or marker 50, as before; while further reducing the ability of target 12*b* to react to or avoid the incoming paintballs, due to the abbreviated time between said fire modes.

Figure 5:
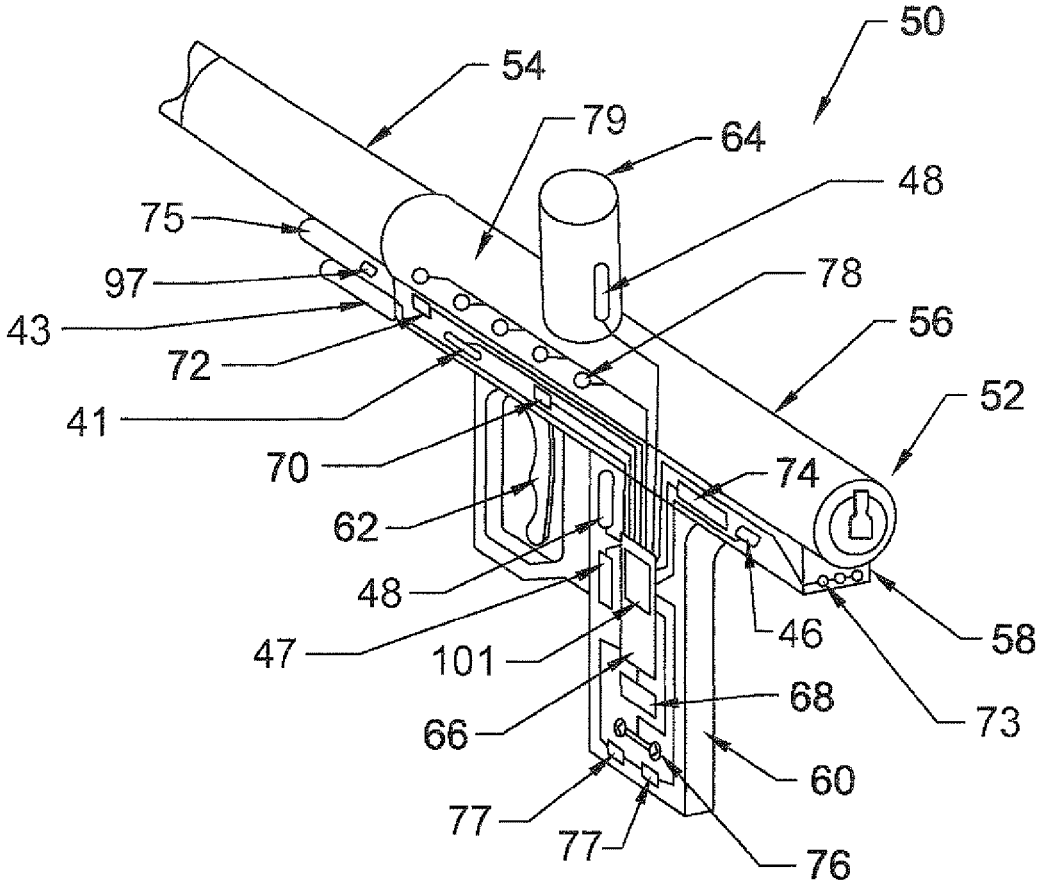
FIG. 5 is a cross-sectional view of an illustrative compressed gas projectile accelerator.

Referring to FIG. 5, in this form paintball marker 50 includes an on the fly velocity adjustment mechanism 52. Velocity adjustment mechanism 52 is operable or configured to allow user 10 to manually and/or selectively adjust the velocity setting at which paintballs are expelled from barrel 54 of marker 50. Marker 50 is operationally configured to expel projectiles from barrel 54 at a range of velocities ranging from an upper velocity setting to a lower velocity setting. In one form, the upper velocity setting corresponds to the maximum velocity at which a paintball is allowed to be expelled from barrel 54, which can be 300 FPS for example. Further, in one form, the lower velocity setting corresponds to the lowest possible or functional velocity setting at which marker 50 is capable of expelling a paintball from barrel 54. Different user preferred upper and lower velocity limit settings can be utilized in various other forms of the present invention.

Figure 4:
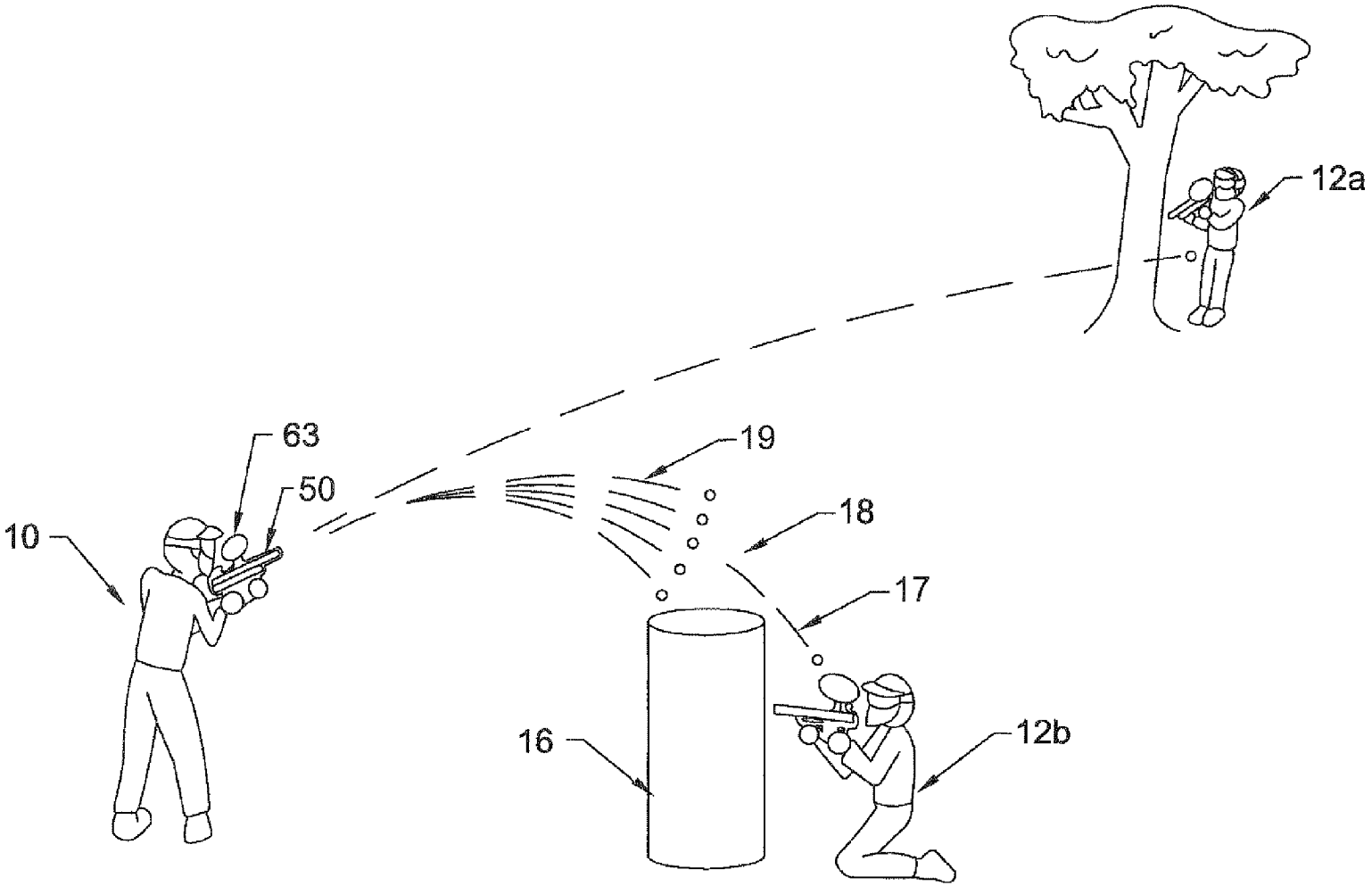
FIG. 4 illustrates a player shooting projectiles at targets on a paintball playing field using a compressed gas projectile accelerator.

In one form, marker 50 includes a housing or frame body 56, a grip frame rail 58, a grip or grip frame 60, a trigger mechanism 62, and a feed tube 64 to which is connected a paintball hopper 63 (see e.g. FIG. 4). As illustrated, body 56 is connected with grip frame rail 58. Alternatively, grip frame rail 58 can be an integral part of body 56 or grip frame 60. Barrel 54 is connected with one respective end of body 56 and, in this illustrative form, velocity adjustment mechanism 52 is connected with the opposite end of body 56. Feed tube 64, which paintball hopper 63 (see FIG. 4) is removably connected with and feeds paintballs to marker 50, is also integrated with or formed as a part of body 56. Trigger mechanism 62 is movably connected with grip frame rail 58 or grip frame 60 and is configured to, with each trigger pull, expel one or more paintballs from barrel 54.

Marker 50 includes an electronic circuit board or controller 66 connected with a power source 68. Although illustrated as being housed in grip frame 60, it should be appreciated that circuit board 66 and power source 68 can be housed in other locations of marker 50. Power source 68 is connected with circuit board 66 and provides power to circuit board 66. As such, an electro-pneumatic marker 50 is disclosed in this representative form. Marker 50 further includes a trigger sensor 70, a velocity or speed sensor 72, and a solenoid valve 74 that are connected with circuit board 66.

Trigger sensor 70 is configured or operable to generate a trigger signal to indicate when trigger mechanism 62 is pulled by user 10. Trigger sensor 70 can comprise an optical eye, a LED sensor, a magnetic sensor, a Hall effect sensor, or any other suitable type of sensor. The trigger signal is sent to circuit board 66. In response to the trigger signal, circuit board 66 generates a solenoid firing signal that is sent to solenoid valve 74, in one form. Upon receipt of the solenoid firing signal, solenoid valve 74 is operable to release a predetermined amount of compressed gas, as a function of the trigger signal, to expel a paintball from marker 50.

In one form, after a predetermined amount of time, circuit board 66 can generate a solenoid deactivate signal sent to solenoid valve 74 thereby stopping the release of compressed gas used to expel the paintball from barrel 54 of marker 50. In another form, circuit board 66 deactivates or ceases generating the trigger signal to stop solenoid valve 74 from releasing compressed gas from source 100 (see FIG. 7). As set forth in greater detail below, depending on the respective firing mode that marker 50 is currently configured to operate in, circuit board 66 is configured to generate one or more solenoid signals to cause marker 50 to expel one or more paintballs from barrel 54. In addition, circuit board 66 is configured to selectively control or adjust the velocity at which paintballs are expelled from marker 50 by controlling the amount of volume of compressed gas used to expel paintballs. In one form, this is accomplished by controlling the amount of time compressed gas is allowed to be released by solenoid valve 74 from source 100 (see FIG. 7).

Speed sensor 72 can comprise a laser, an optical eye, a LED speed sensor, a sonic sensor, a radar, or any other suitable type of speed sensor. Speed sensor 72 and solenoid valve 74 can be housed in other locations of marker 50 other than in grip frame rail 58, as illustrated. Speed sensor 72 is configured or operable to generate a speed signal indicative of the velocity at which paintballs are expelled from barrel 54 of marker 50. The speed signal is directed to or detected by circuit board 66, which is operable to adjust operation of solenoid valve 74 to adjust the velocity at which paintballs are fired according to various firing modes as a function of the speed signal.

A velocity controller 76 is connected with circuit board 66. Velocity controller 76 can comprise a plurality of push buttons, a dial, a slider, or other types of control mechanisms. In one form, velocity controller 76 is configured to allow user 10 to manually adjust the velocity at which paintballs are expelled from barrel 54 of marker 50. Circuit board 66 is configured to monitor the setting or position of velocity controller 76 and adjust the operation of marker 50 according to this setting. Velocity controller 76, in one form, is operable to adjust marker 50 to operate between a maximum or upper and minimum or lower velocity setting.

A breech sensor 78 is connected with circuit board 66 and is positioned along breech 79. Breech sensor 78 can comprise a laser, an optical eye, a LED sensor, an infrared sensor, or any other suitable type of sensor for indicating breech status or condition sensing. Breech sensor 78 can also comprise a plurality or array of suitable sensors. Breech sensor 78 is configured to monitor the status of a breech 79 of marker 50. For example, breech sensor 78 is configured to send a paintball loaded signal to circuit board 66. In yet another form, breech sensor 78 is configured to send a breech obstruction signal to circuit board 66 indicating a problem has occurred. In this example, circuit board 66 can be configured to shut marker 50 down or cease operation until the problem has been corrected.

A pressure sensor 46 is connected with circuit board 66. Pressure sensor 46 can comprise an electronic sensor, pneumatic sensor, or any other suitable type of pressure sensor. Pressure sensor 46 is configured to monitor a pressure value associated with marker 50. In particular, in one form, pressure sensor 46 is configured to monitor the pressure value at which compressed gas, supplied from compressed gas source 100 (see FIG. 7), is being supplied to solenoid valve 74. As set forth in greater detail below, a pressure signal is sent to circuit board 66 from pressure sensor 46 which is in turn, configured to control the amount of time solenoid valve 74 is opened during a firing operation at least partially as a function of the value of the pressure signal. For example, as marker 50 is operational and has fired several shots in a row, the pressure value of compressed gas available to solenoid valve 74 to fire the next shot can decrease somewhat, thereby requiring a greater volume of compressed gas to expel a paintball at a desired or controlled FPS value. Circuit board 66 is configured to increase the amount of time that solenoid valve 74 is opened as a function of the desired FPS value (which can vary in different firing modes) and the compressed gas pressure value available to solenoid valve 74.

Circuit board 66 can also be configured to control various additional operating parameters of marker 50 as a function of signals received from pressure sensor 46. In one form, circuit board 66 is configured to place marker 50 in a stand-by mode or shut marker 50 off if, for example, the signal received from pressure sensor 46 indicates compressed gas pressure levels above a predetermined safe threshold or a predetermined operational threshold. While pressure sensor 46 is illustrated in the grip frame rail 58, it should be appreciated that it can be positioned in other locations on marker 50.

In another form, a distance sensor 75 is connected with circuit board 66. Distance sensor 75 can comprise a laser distance sensor, an optical distance sensor, an ultrasonic distance sensor, a range finder, or any other suitable type of distance sensor. In this form, as user 10 aims barrel 54 at potential targets 12*a*, 12*b*, distance sensor 75 is configured to generate an electronic distance signal, which can be an analog or digital signal, that is sent to circuit board 66. The distance signal is indicative of the distance from marker 50 to one of the respective targets 12*a*, 12*b*.

Circuit board 66 is configured and operable to use the distance signal to calculate the velocity at which paintballs need to be expelled from marker 50 and the angular tilt required for barrel 54 of marker 50 to lob or launch a volley or salvo of paintballs down field to strike target 12*a*, 12*b*. In the alternative, circuit board 66 can be configured to automatically determine a proper velocity to expel paintballs as a function of a tilt sensor signal received from tilt sensors 48 and the distance signal. In yet another form, distance sensor 75 can include or be connected with a button 97 that selectively transmits a distance signal to circuit board 66 every time it is pressed by user 10.

Marker 50 can also include tilt sensors 48 connected with circuit board 66. Tilt sensors 48 are configured to sense or measure, in two axes in one form, the tilting of marker 50. In particular, tilt sensors 48 are used to monitor the angular position of barrel 54 in comparison to a reference plane, which in this case comprises the ground G. Tilt sensors 48 can comprise an electrolytic tilt sensor, an electronic clinometer or inclinometer, an accelerometer, a piezoelectric accelerometer, a gyro sensor, a full motion sensor, or any other suitable type of sensor. Although tilt sensors 48 are illustrated as being housed in grip frame 60 and feed tube 64, it should be appreciated that these elements can be located in other locations of marker 50.

In yet another form, one or more user controls 77 are connected with circuit board 66. Controls 77 can comprise push button controls, dial controls, or any other suitable type of controls. In one form, controls 77 provide manual control to user 10 for adjustment of one or more of the components or operations of marker 50. For example, controls 77 can finely adjust or fine tune the operation of tilt sensors 48, trigger sensor 70, distance sensor 75, velocity controller 76, and/or breech sensor 78. Further, controls 77 can be configured substitutable and/or alternate with the components or operations, for example, being a manual or overriding controller for tilt sensors 48.

Controls 77 can also be configured to operate as a manual distance controller, wherein controls 77 can be utilized to manually input a distance to a respective target 12*a*, 12*b* that is utilized by circuit board 66. In addition, controls 77 can also be used to select different firing modes (e.g.—semi-automatic, automatic, three shot burst, five shot burst, lobbing mode, etc.). As such, in this form, controls 77 inform circuit board 66 of the firing mode desired by user 10.

In one form, marker 50 includes an electronic velocity adjustment mechanism. A velocity controller 76, which can comprise a push button control, a dial control, a sliding control, or any other suitable type of control, is connected with circuit board 66 for allowing a user to selectively set a velocity setting at which projectiles are expelled from barrel 54. For example, if velocity controller 76 comprises two buttons (e.g.—a velocity up and a velocity down button), each press of one of the respective buttons causes a signal to be sent to circuit board 66. In response, circuit board 66 will either raise or lower the velocity setting of marker 50 in predetermined increments (e.g.—5 FPS, 10 FPS, and so forth). Controls 77 can be utilized to set the increments in which user 10 desires each button press to raise or lower the velocity setting.

Velocity controller 76 can be configured as the primary velocity adjustment feature, as a secondary velocity adjustment feature, and/or as an additional velocity adjustment feature on marker 50. In one form, circuit board 66 is configured to not allow marker 50 to expel paintballs above a predetermined maximum velocity or below a predetermined operational velocity. As such, regardless of how many times user 10 attempts to increase or decrease the velocity once one of these thresholds is reached; circuit board 66 is configured to ignore the request. Although controls 77 and velocity controller 76 are illustrated as being housed in grip frame 60, it should be appreciated that these elements can be located in other locations of marker 50.

In one form, where the velocity setting is not permitted to go above a predetermined maximum value, circuit board 66 is configured to control one or more operating parameters of solenoid 74 as a function of the velocity setting. In particular, in one form, in response to the user selected velocity setting, circuit board 66 is operable to control the timed release of compressed gas by solenoid 74 as a function of the velocity setting. The higher the velocity setting, the longer circuit board 66 will control solenoid 74 to release compressed gas to expel the paintball from marker 50. As such, circuit board 66 controls the velocity of the paintballs by controlling the volume of compressed gas that is released by solenoid 74 during a firing operation.

In one form, like the above form, the velocity setting is not permitted to go above a predetermined maximum value, and circuit board 66 is configured with rounds per second ("RPS") setting that does not permit marker 50 to go above a predetermined maximum RPS value. Circuit board 66 is configured to control one or more operating parameters of solenoid 74 as a function of the velocity setting and/or the RPS setting. Again, controls 77 can be used to adjust the RPS setting (at least to an upper threshold value) of marker 50.

As previously set forth, in some forms, marker 50 includes a velocity or speed sensor 72 which is configured to allow circuit board 66 to determine the velocity of projectiles exiting barrel 54 of marker 50. Circuit board 66 is adapted to adjust one or more operating parameters of marker 50, in one form the operating parameters of solenoid 74, as a function of the velocity determination, the velocity setting and/or the RPS. Further, signals from speed sensor 72 can be utilized by circuit board 66 to verify that a projectile was properly loaded and expelled from barrel 54, as well as, the RPS of projectiles being expelled.

Marker 50 can also include a breech sensor 78 connected with circuit board 66. Breech sensor 78 is configured to permit determination of breech status, in one form, as a function of the velocity setting. For example, in the illustrated form breech sensor 78 is an array of sensors arranged in breech 79 to determine or verify an operational members' position (e.g.—such as bolt 112 (see FIG. 11)) in respect to a paintball's position and/or any separation from the paintball. Circuit board 66 can then control one or more operating parameters as it relates to breech status and/or the velocity setting. Such as, for example; circuit board 66 can disregard an upcoming signal from speed sensor 72 when a paintball, loaded in the breech 79, is separated from the bolt 112 above a set threshold.

One or more conditional indicators 73 are also connected with circuit board 66. Indicators 73 can comprise lights, LED's, indication displays, or any other suitable indicators or display device. Although indicators 73 are illustrated as being on the rear of marker 50, it should be appreciated that they can be positioned in other locations on marker 50. Indicators 73 allow user 10 to monitor the operational status or parameters of marker 50. In addition, indicators 73 can also be used to inform the user of marker 50 of barrel 54 alignment in various firing modes. Further, indicators 73 can also be used to inform the user of a proper velocity setting for marker 50.

Indicators 73 can be combined with and/or into other components or features. For example, indicators 73 can be combined with breech sensor 78. In one form, as illustrated, breech sensor 78 being an array of sensors in breech 79 would give user 10 a representative external view of breech 79, such as a paintball's position or the severity of a fouled breech. Also, indicators 73 can be combined with velocity controller 76 or controls 77 such that user 10 adjusts marker 50 with the indicators 73 that are illuminated by circuit board 66.

As previously set forth, marker 50 includes tilt sensors 48 connected with circuit board 66. Circuit board 66 can be configured with a safety feature of one or more operating parameters of marker 50 as a function of signals received from tilt sensors 48. For example, when marker 50 is laid down, is pointed straight up or straight down, circuit board 66, which is capable of sensing this angular orientation of marker 50 as a function of a tilt sensor signal, can be configured to automatically place marker 50 in a stand-by mode thereby disabling marker 50 from expelling projectiles. The stand-by mode can also be an energy saving mode.

Circuit board 66 can also be configured to control other operational parameters of marker 50 as a function of a tilt sensor signal received from tilt sensors 48. For example, when marker 50 is positioned in or exceeds a predetermined angle in relation to ground G, circuit board 66 is configured to switch or change firing modes or change the velocity settings of marker 50. Controls 77 can also be configured to adjust or fine tune the signal (i.e.—the determined angle of marker 50) generated by tilt sensors 48. Also, controls 77 may be configured as a manual mode controller. In one form, user 10 can use controls 77 to set a predetermined angular setting indication thereby overriding the determination made by tilt sensors 48. Controls 77 when configured as a manual mode controller can be configured as a primary, secondary, or additional mode controller.

In still another form, the projectile accelerator 50 includes a motion sensor 47 connected with circuit board 66. Motion sensor 47 can be configured to comprise an operational control of one or more operating parameters. For example, when user 10 moves said marker 50 in preset and/or preprogrammed series of motions, actions, and/or gestures, marker 50 would automatically switch fire modes. Gestures such as a quick barrel flick left followed by a quick barrel flick upward would automatically switch marker 50 from semi auto fire mode into full auto fire mode. To further illustrate an example of a preprogrammed gesture; user 10 moves marker 50 in three quick horizontal motions—forward thrust/backward thrust/forward thrust, marker 50 then automatically self switches from full automatic mode to burst fire mode. While motion sensor 47 is illustrated housed in the grip frame 60, it should be appreciated that it can be positioned in other locations on marker 50; said motion sensor 47 could comprise a manual sensor, electronic sensor, pneumatic sensor, or any other suitable type of motion sensor for detecting and/or measuring the motion and/or movement of marker 50. Motion sensor 47 connected with circuit board 66 can be configured with a safety mode. For example, when motion sensor 47 senses a sudden and/or severe impact, such as a fall, circuit board 66 can place marker 50 into a stand by mode.

In yet another form, the projectile accelerator 50 includes a directional/locational sensor 43 connected with circuit board 66. Directional/locational sensor 43 can be configured to comprise an operational control of one or more operating parameters. Directional/locational sensor 43 can be configured to be pre programmable and/or reprogrammable. For example, in the sport of paintball; the playing fields, of major tournament paintball events, are laid out and/or designed prior to the event, for the teams to inspect and plan game strategy; with most major paintball events posting virtual field layouts on the internet. Further; the players of the more established teams, know well before game play begins what position on the field they will be playing and what their responsibilities are. Also established players pretty much know, before play starts, what opponents and bunkers they will be playing against. As such a player could pre register and/or pre program their marker to fit to the perceived play for the beginning of a game. For example, an established player might know their starting position is behind their own back right corner bunker; and must eliminate or pin down any opponents in the far left and right corner bunkers on the opposite end of the playing field. Said established player also understands the low lay down bunker on the 50 yard line in the center of the field is the biggest threat to their game plan, if occupied by an opponent. Thus, said established player configures his/her marker, before play starts, to automatically lob paintballs at a set selected lower velocity setting when pointed at the 50 yard line bunker. Also, said marker would shoot at the upper velocity setting when pointed at the far opposing corner bunkers. Since directional/locational sensor 43 was preregistered with the starting position of said established player; once established player leaves his starting position or bunker, marker 50 would no longer lob paintballs, at the set lower velocity setting, when pointed in a directional heading that matched the directional heading for the earlier 50 yard line lobbing shot.

In another form, directional/locational sensor 43 connected with circuit board 66 of marker 50 could be programmed to automatically switch to stand by/off mode in the staging area or parking lot. While the directional/locational sensor 43 is illustrated being located on the front of marker 50, it should be appreciated that it can be positioned in other locations on marker 50. Said directional/locational sensor 43 could comprise a GPS sensor, magnetic sensor, I.R. sensor, R.F. sensor, or any other suitable type of sensor for the measuring and/or sensing of said marker 50 positional direction or bearing; and/or its positional location.

In another form, projectile accelerator 50 includes a vibration/sound sensor 41 connected with circuit board 66. Vibration/sound sensor 41 can be configured to comprise an operational control of one or more operating parameters. Also vibration/sound sensor 41 can be configured to allow the gathering or collection of operational data for analysis or examination by said user and/or marker technician. For example, in the sport of paintball, communication between team members is a very important part of a winning strategy. While some paintball markers have gotten some what quieter in recent years, they can still be fairly loud individually; but can be very loud collectively, when all the markers on a playing field are firing during a game. Also having the player's own firing paintball marker close to the player's own head and ears, while said player is wearing protective goggles with ear protection, makes hearing other team members difficult at times. The games can be so loud that players have to yell information and/or instruction to fellow team members, causing most teams to develop and use codes knowing the opposing team might hear said information and/or instruction. Further still, established team members sometimes relay said information and/or instruction across the field from one team member to other team members. This noisy environment or situation could make for unsafe field conditions, and makes controlling the game difficult for field officials/referees.

The vibrations from the firing markers are also a concern. The vibrations from a firing marker not only produce unwanted noise, said vibrations produce unwanted wear and tear on both the player and said marker. These vibrations also influence the marker's velocity consistency and/or accuracy. While some vibrations are inherit to the design of the marker, other vibrations are from mistuned markers and/or marker operations. Still other vibrations develop during a game. Such as, different members or components of a marker can loosen during the firing of said marker causing even more vibrations. For example, it's common for experienced players to reach down and twist their marker's barrel before a game starts. These experienced players are reseating or affixing their barrel that might have unscrewed or vibrated loose during the pre game testing; some experienced players even twist their barrels during a game.

Vibration/sound sensor 41 can be configured to allow the collection of operational data for analysis off the playing field. Vibration/sound sensor 41 connected with circuit board 66, can indicate increased vibrations, audible level noises, inaudible noises and/or sub level noise levels through indicators 73; such as a barrel vibrating loose, as detailed above. Further, vibration/sound sensor 41 could be configured to adjust and/or change one or more of operating parameters through circuit board 66. In one form, the operating parameters of the solenoid valve 74 could be adjusted and/or changed by vibration/sound sensor 41 through circuit board 66. For example, vibration/sound sensor 41 connected with circuit board 66 detects exceptionally high sub level noises and/or vibrations when user 10 reaches the set RPS limit (i.e. 13 balls/rounds per second), thus the RPS limit is lowered by circuit board 66, (i.e. 11 balls/rounds per second) where said sub level noises and/or vibrations are at acceptable levels. Vibration/sound sensor 41 could comprise a sonic sensor, audio sensor, acoustic sensor, vibration sensitive sensor or any other suitable type of sensor for the measuring and/or sensing acoustical sounds and/or vibrations of said marker 50. Vibration/sound sensor 41 can be housed in other locations of marker 50 than in grip frame rail 58, as illustrated.

In yet another form, projectile accelerator 50 includes a vibration/sound sensor 41 which can be connected with circuit board 66 or can have a separate controller and/or circuit board. Also vibration/sound sensor 41 can be connected to a separate power source. Vibration/sound sensor 41 could be configured to include acoustical sending and/or output members and/or devices; as well as, vibration sending and/or output members and/or devices. Further, said acoustical and/or vibration output devices can be included into or housed in other components of marker 50, while still being connected to vibration/sound sensor 41. Further still, vibration/sound sensor 41 with said connected acoustical and/or vibration output devices could be configured to comprise the sending and/or transmitting anti sound waves and/or sound canceling signals; as well as, the sending and/or transmitting anti vibration waves and/or vibration canceling signals.

Figure 6A:
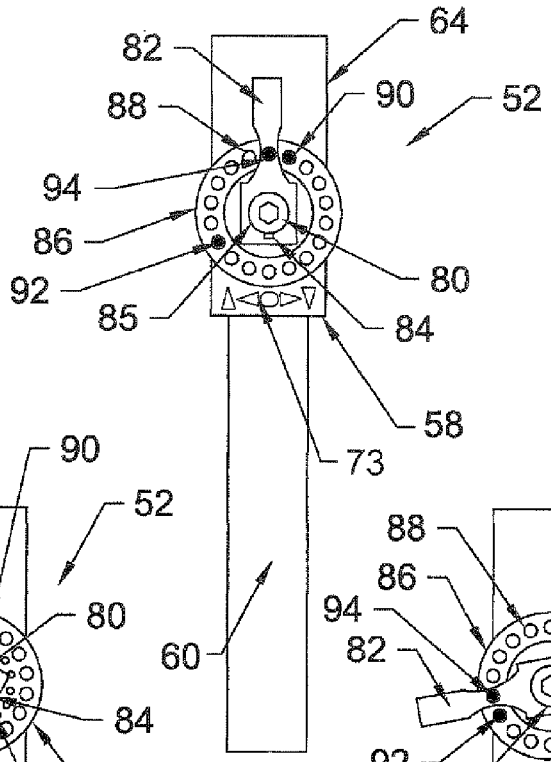
FIGS. 6*a*-6*c* set forth rear views of a compressed gas projectile accelerator including a velocity adjustment mechanism.
Figure 6B:
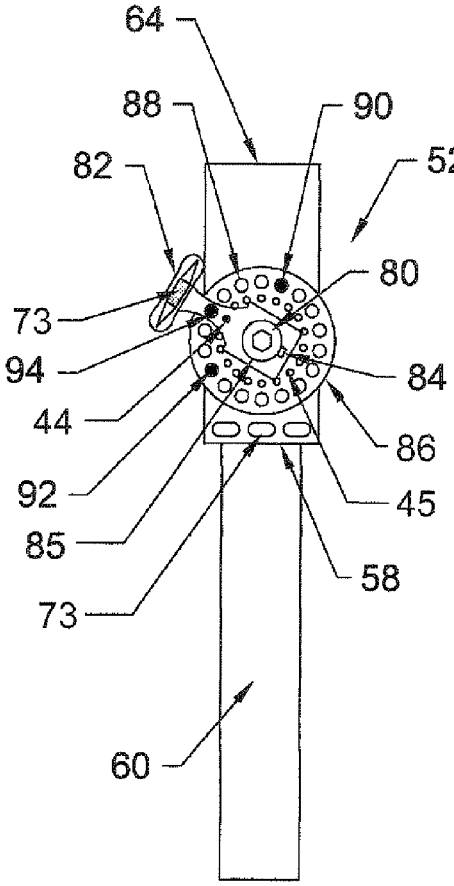
Figure 6C:
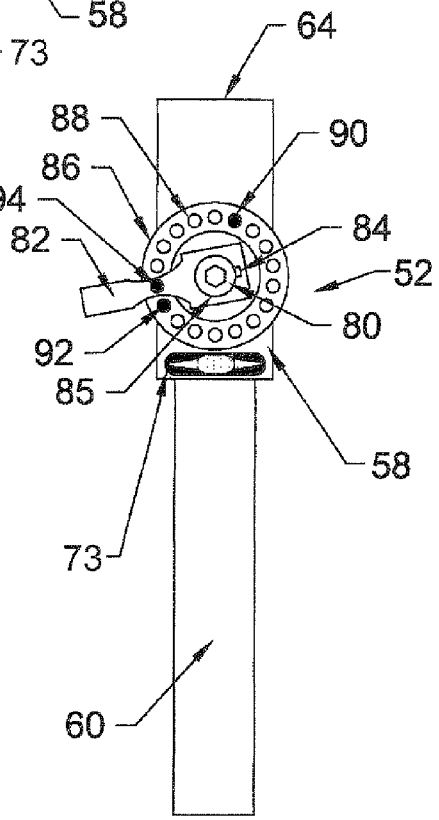

Referring collectively to FIGS. 6*a*-6*c*, a rear view of one representative form of marker 50 is depicted to better illustrate one form of velocity adjustment mechanism 52. In this form, velocity adjustment mechanism 52 includes a primary and/or main velocity adjustor 80. Main velocity adjustor 80 is configured to adjust a velocity setting of marker 50. In particular, main velocity adjustor 80 is designed to configure marker 50 so that marker 50 cannot expel paintballs above a predetermined upper or maximum velocity setting, which, for illustrative purposes only, is 300 FPS. In this illustrative example, main velocity adjustor 80 comprises an allen head screw configured to adjustably control the upper velocity setting of marker 50. For example, adjustment of main velocity adjustor 80, by tightening or loosening main velocity adjustor 80, increases or decreases the maximum velocity setting of marker 50.

Velocity adjustment mechanism 52 includes an adjustment device or member 82 that is connected with main velocity adjustor 80. In this form, adjustment device 82 comprises a lever selector that is secured to main velocity adjustor 80 with a retention member or set screw 84. Adjustment device 82 includes an aperture 85 that fits around an outside diameter of main velocity adjustor 80. Once main velocity adjustor 80 is set to cause marker 50 to function at the user preferred or authorized upper velocity setting, which is just below 300 FPS in this example, lever selector 82 is positioned about a dial 86 in a user selected position and then set screw 84 is used to tightly secure lever selector 82 to main velocity adjustor 80. In this example, as illustrated in FIG. 6*a*, user 10 has selected a twelve o-clock position for lever selector 82 as the setting for the maximum or upper velocity setting.

In order to prevent user 10 from being able to turn lever selector 82 clockwise, thereby increasing the velocity at which a projectile may be expelled, lever selector 82 must be restricted. As previously discussed, any velocity setting above the upper or maximum velocity setting, would cause marker 50 to be viewed as a "hot marker" as understood by those skilled in the art. In this example, dial 86 includes a plurality of apertures 88 that are positioned around a circumference or perimeter of dial 86. A blocking pin 90 is positioned or placed in a respective aperture 88 immediately next to lever 82 to prevent lever selector 82 from being rotated any further in the clockwise direction. As such, this prevents user 10 from being able to adjust the velocity setting of marker 50 above the upper velocity setting. This is an important feature as user 10 would not be allowed to use marker 50 on the playing field if he/she was capable of adjusting marker 50 to shoot above the maximum allowed velocity setting.

In this form, as user 10 rotates lever selector 82 counterclockwise, the velocity at which paintballs are expelled from barrel 54 of marker 50 begins to decrease. For example, at the setting illustrated in FIG. 6*b*, marker 50 is set to expel paintballs at an intermediate or transitional FPS setting. The further lever selector 82 is adjusted counterclockwise, the velocity at which paintballs are expelled from marker 50 decreases until, as illustrated in FIG. 6*c*, lever selector 82 reaches a lowest functional or lower velocity setting. In FIG. 6*c*, the lower velocity setting is controlled by placement of pin 92 in a user 10 selected aperture 88 of dial 86.

During operation, lever selector 82 will hit or bump up against pins 90 and 92, which does not allow lever selector 82 to be adjusted any further beyond the upper and lower velocity settings. Selector 82 can also include a detainment mechanism, which is a detent 94 in this example, that is located in alignment with apertures 88 on dial 86 to help temporarily secure said selector 82 in place once a velocity setting is chosen by user 10. Pins 90, 92 can comprise standard pins, set screws, or any other type of equivalent device that will restrict movement of lever selector 82 beyond the upper and lower velocity settings. Apertures 88 can be threaded and in one form, dial 86 is connected to body 56 (see FIG. 10) of marker 50 and in another form, dial 86 is formed as an integral part of body 56, pressure regulator 106 (see FIG. 8), compressed gas adapter 102 (see FIG. 9), or other components of marker 50 as disclosed herein.

In another form, a rear view of electro-pneumatic marker 50 is depicted. Velocity adjustment mechanism 52 comprises a main velocity adjustor 80, selector 82, set screw 84, aperture 85, dial 86, apertures 88, blocking pin 90, blocking pin 92, and detent 94, as disclosed in the above form(s). Velocity adjustment mechanism 52 also comprises indicators 73 connected with circuit board 66 (see FIG. 5). Indicators 73 can comprise any suitable indicators, as described above and/or as illustrated FIGS. 5, 6*a*-6*c*. Indicators 73 can be configured as part of and/or with controls 77. Furthermore, in one form, velocity adjustment mechanism 52 comprises situational connecters, connectors, or links 44 and 45, as illustrated in FIG. 6*b*, connected with circuit board 66. Situational connecters or links 44 and 45 can comprise optical eyes, electric contacts, magnetic sensors; or any other suitable type of sensors, contactor, and/or link. Connectors 44 and 45 cooperate to generate an electric output signal that informs circuit board 66 of the velocity setting of marker 50. Connector 44 and connectors 45 are illustrated on selector 82 and dial 86, but it should be appreciated that it can be positioned in other locations on marker 50.

Figure 7:
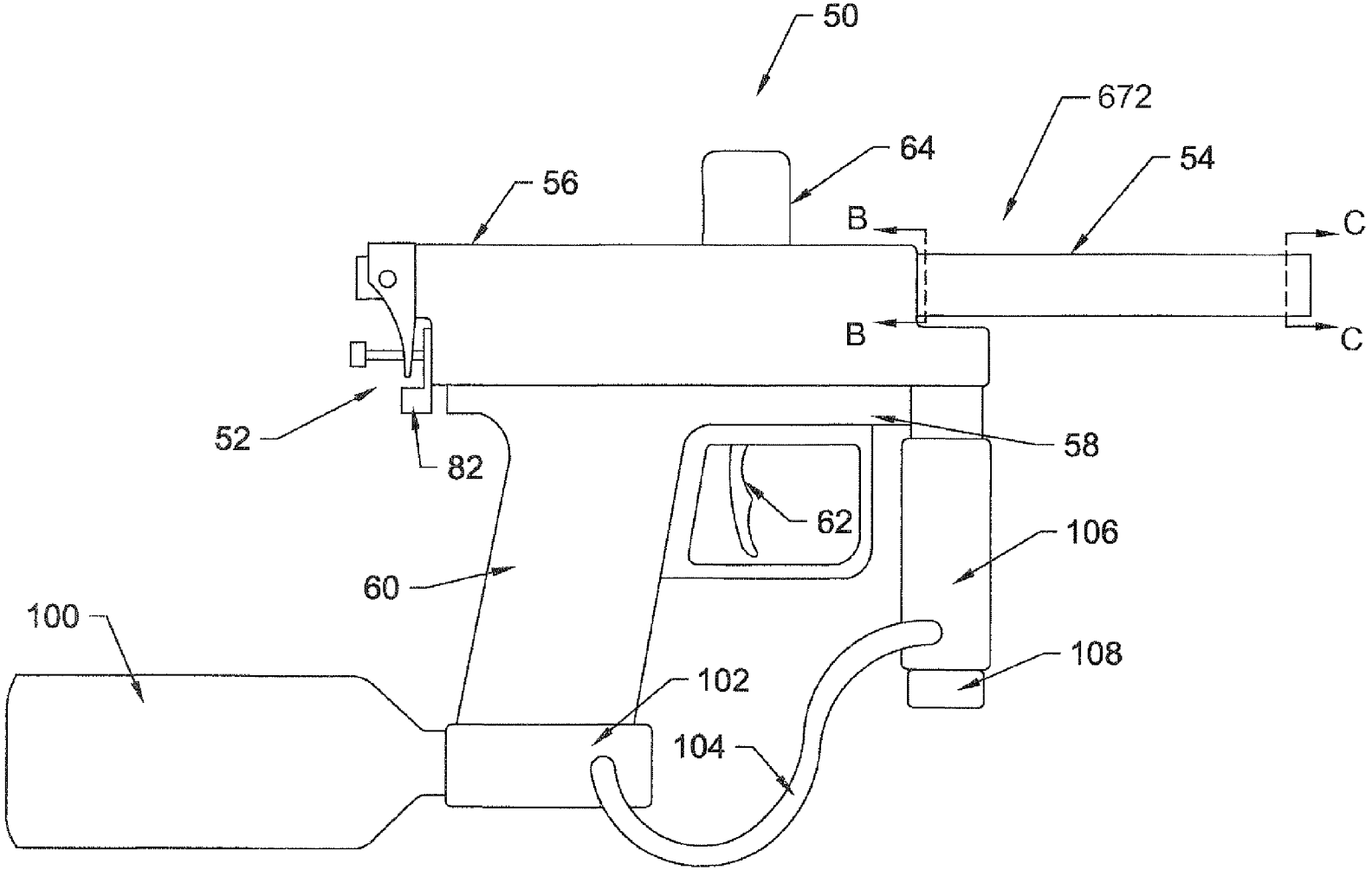
FIG. 7 illustrates a side view of a compressed gas projectile accelerator including velocity adjustment mechanism positioned in a different location.

Referring to FIG. 7, a side view of one illustrative form of marker 50 is illustrated showing velocity adjustment mechanism 52 located directly on marker 50. In this form, velocity adjustment mechanism 52 is illustrated as being located or positioned at the back or rear of body 56; however, those skilled in the art should appreciate that the velocity adjustment mechanism can be located at several other positions on marker 50. Marker 50 includes a compressed gas source 100, which can contain compressed air, $CO_2$, nitrogen, or any other type of suitable compressed gas, which is removably connected with a compressed gas adapter 102 of marker 50. The compressed gas is used to expel projectiles from barrel 54 of marker 50.

In this illustrated form, a gas line 104 connects an output of compressed gas adapter 102 to a pressure regulator 106. Compressed gas from compressed gas source 100 is in communication with pressure regulator 106. Pressure regulator 106 prevents gas pressures from rising above a predetermined threshold level before entering marker 50, to prevent damage of the internal components of marker 50. Pressure regulator 106 includes an adjustment knob 108 that provides for adjustment of one or more operating parameters of pressure regulator 106.

Figure 8:
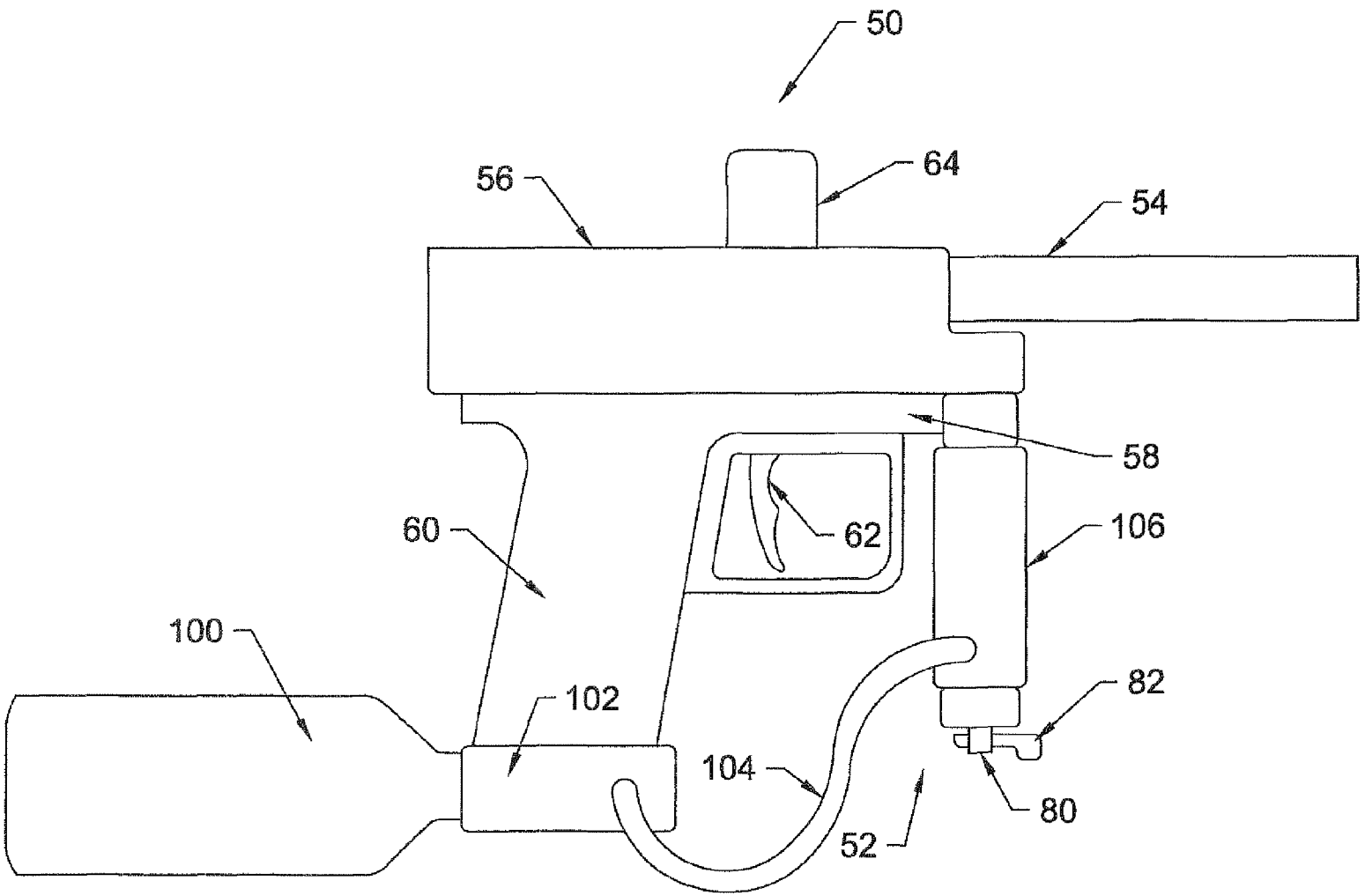
FIG. 8 illustrates a side view of a compressed gas projectile accelerator including velocity adjustment mechanism positioned in a different location.

Referring to FIG. 8, in this representative form, velocity adjustment mechanism 52 is configured as an integral part of pressure regulator 106. As such, movement of selector 82 on regulator 106 between an upper set point and a lower set point will cause marker 50 to expel projectiles from barrel 54 between a maximum or upper velocity setting and a minimum or lower velocity setting.

Figure 9:
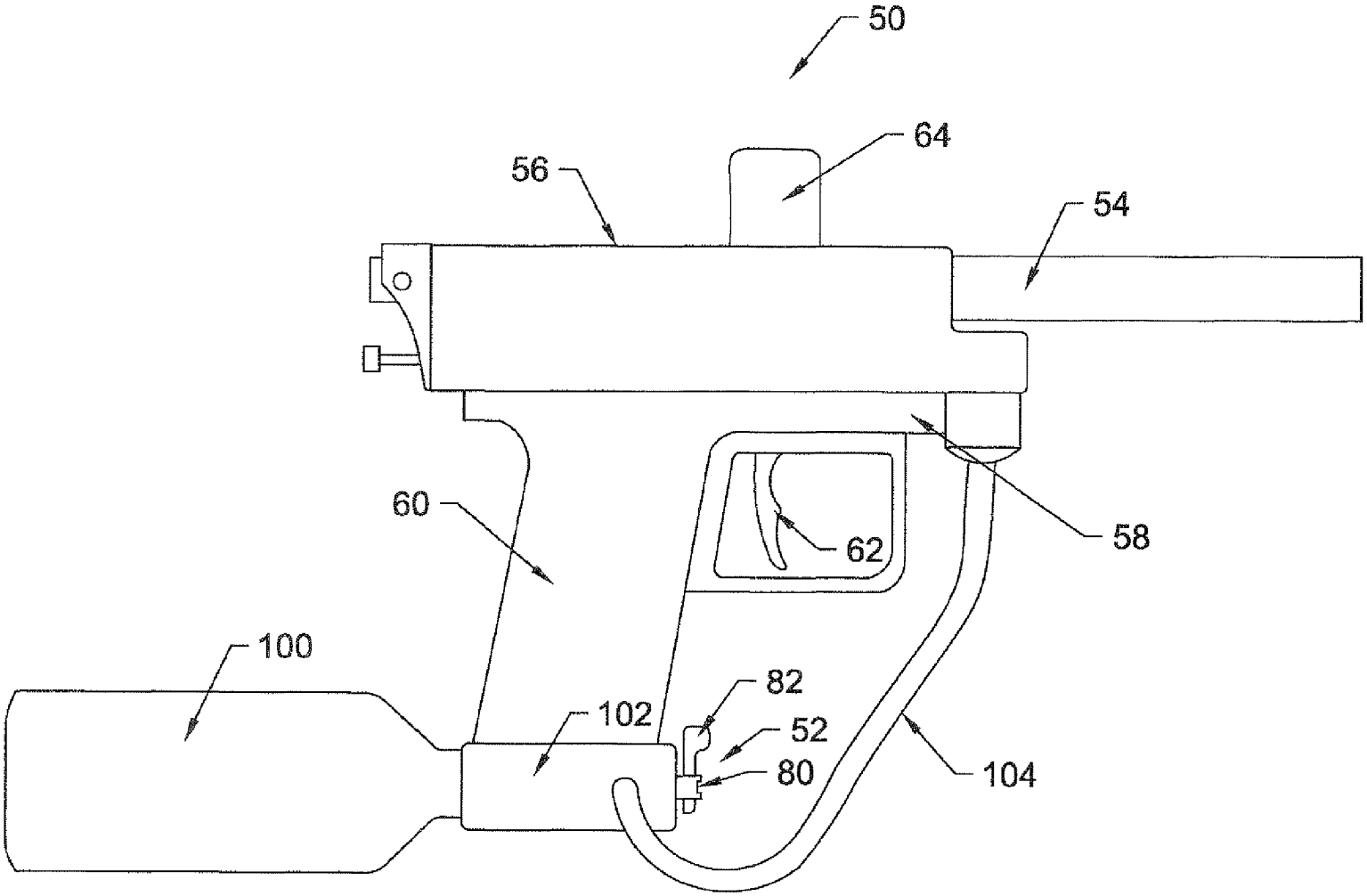
FIG. 9 illustrates a side view of a compressed gas projectile accelerator including velocity adjustment mechanism positioned in a different location.

Referring to FIG. 9, in this representative form, velocity adjustment mechanism 52 has been incorporated as a component of compressed gas adapter 102. Movement of selector 82 on compressed gas adapter 102 between an upper set point and a lower set point will cause marker 50 to expel projectiles from barrel 54 between an upper velocity setting and a lower velocity setting. All of the features discussed above with reference to FIGS. 6*a*-6*c* are hereby incorporated by reference into the representative forms set forth in FIGS. 7, 8, and 9.

Figure 10:
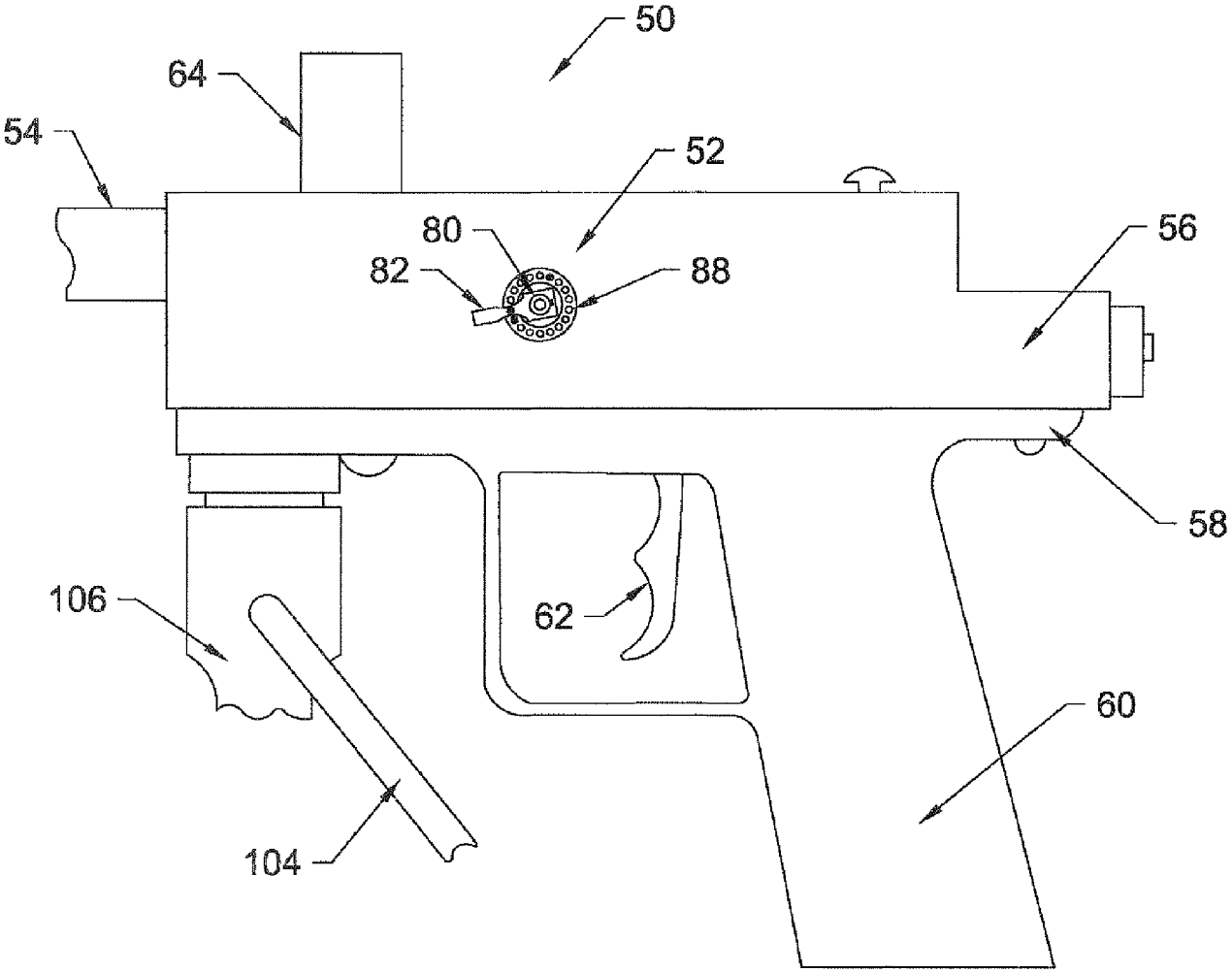
FIG. 10 illustrates a portion of a compressed gas projectile accelerator having a velocity adjustment mechanism.

Referring to FIG. 10, in this representative form, velocity adjustment mechanism 52 is mounted on a side of marker 50. Selector 82 is illustrated as being set at the maximum velocity setting. Rotation of selector 82 clockwise causes main velocity adjustor 80 to block a gas passage in marker 50 thereby allowing user 10 to incrementally reduce the velocity of paintballs that are expelled from barrel 54. For the sake of brevity, those skilled in the art should recognize that the remaining features of marker 50 and velocity adjustment mechanism 52 are the same as those set forth with respect to FIGS. 6*a*-6*c*.

Figure 11:
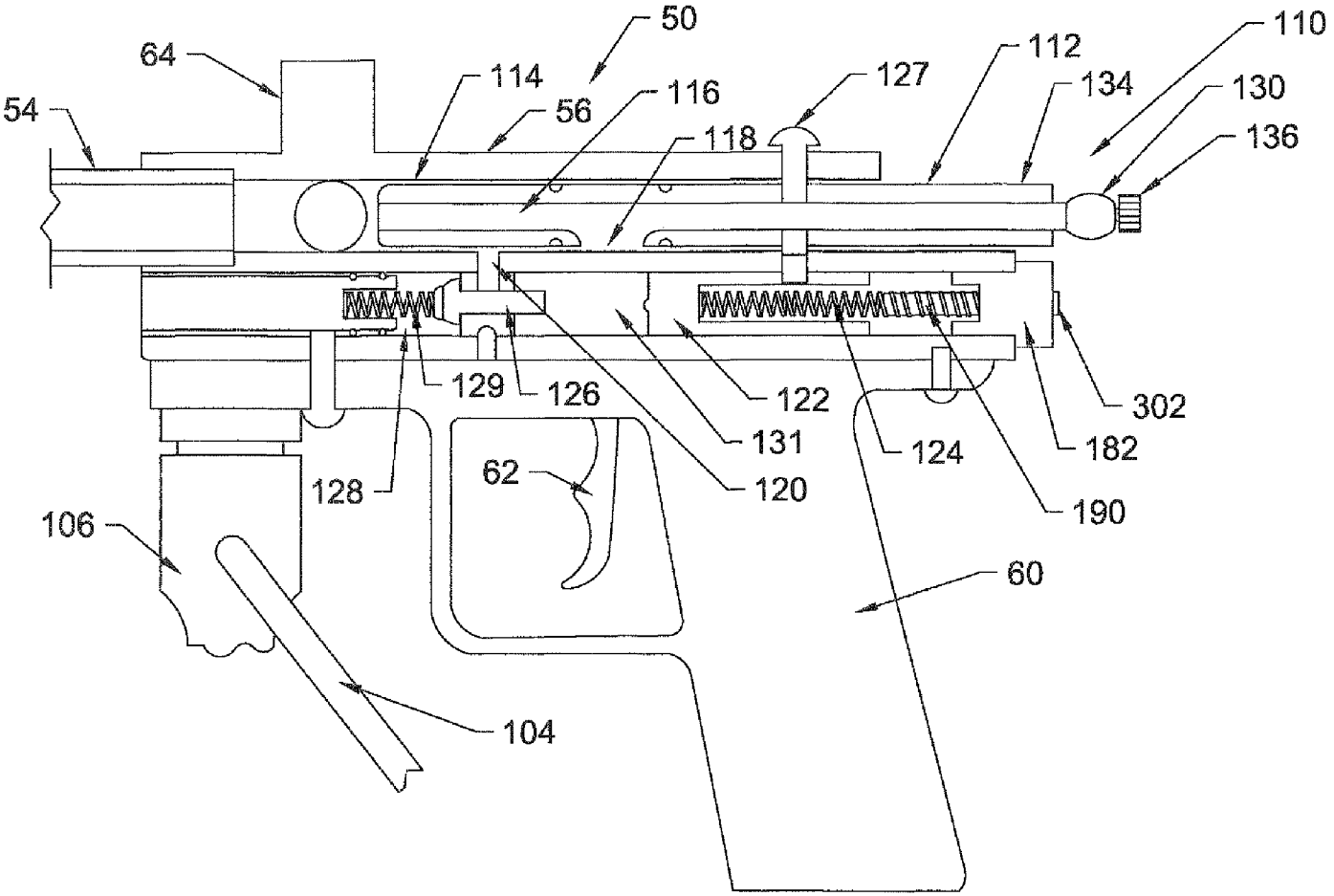
FIG. 11 illustrates a portion of a compressed gas projectile accelerator in cross-sectional form having a velocity adjustment mechanism.

Referring to FIG. 11, another representative form of marker 50 is illustrated that includes a velocity adjustment mechanism 110. In this representative example, marker 50 includes a bolt 112 that travels back and forth along a longitudinal axis in a bolt chamber or bore 114 inside body 56 of marker 50. Bolt 112 includes a gas passage 116 through which compressed gas passes in order to expel paintballs from barrel 54. As bolt 112 travels forward, a gas port 118 in bolt 112 reaches a valve passage 120. During operation, once trigger mechanism 62 is pressed, trigger mechanism 62 releases a hammer 122 that travels forward under the pressure or force provided by a hammer spring 124. Said tension force of hammer spring 124 is adjusted with main velocity adjustor 302 housed in hammer spring end cap 182. After traveling a predetermined distance, hammer 122 strikes a respective end of a valve 126, thereby actuating valve 126.

Actuation of valve 126 causes compressed gas, which is stored in a compressed gas storage chamber 128 on an opposite side of valve 126, to vent through valve passage 120 into gas passage 116 of bolt 112 through gas port 118. It should be appreciated that bolt 112 and hammer 122 move together and gas port 118 is positioned on bolt 112 such that gas port 118 is aligned with valve passage 120 when hammer 122 strikes valve 126. A bolt and hammer connecting pin 127 is used to connect bolt 112 with hammer 122. As such, compressed gas is permitted to travel from compressed gas storage chamber 128 to valve passage 120 and then into gas passage 116 of bolt 112 via gas port 118. This compressed gas is then used to expel a paintball from the barrel 54. After compressed gas is expelled from chamber 128, a spring 129 connected to an end of valve 126 forces valve 126 shut or closed, thereby stopping the flow of compressed gas through valve passage 120. At the same time compressed gas is passed through passage 120, compressed gas is also directed to a hammer chamber 131, which causes hammer 122 and bolt 112 to recoil for another shot.

As illustrated in FIG. 11, an adjustable relief valve 130 is a venting mechanism connected with an exposed end of bolt 112. Adjustable relief valve 130 is used to control or limit the pressure that is supplied from the flow of compressed gas utilized to expel paintballs from barrel 54. As such, when compressed gas is introduced to gas passage 116 of bolt 112, compressed gas travels forward to expel a paintball from barrel 54 and backwards towards venting mechanism on end 134 of bolt 112. Depending on the desired velocity setting, a predetermined amount of compressed gas will vent through velocity adjustment mechanism 110. Adjustable relief valve 130 includes an adjustment mechanism 136, a knob or wheel in this illustrative example, that allows user 10 to adjust velocity settings between the maximum or upper velocity setting and the minimum or lower velocity setting.

In another form, an electro-pneumatic marker 50 is represented. Venting mechanism of velocity adjustment mechanism 110 is electronically controlled; in one form, by circuit board 66, described above (see FIG. 5). In yet another form, velocity adjustment mechanism 110 of electro-pneumatic marker 50 is pneumatically controlled; in one form, by solenoid valve 74 connected to circuit board 66.

Figure 12:
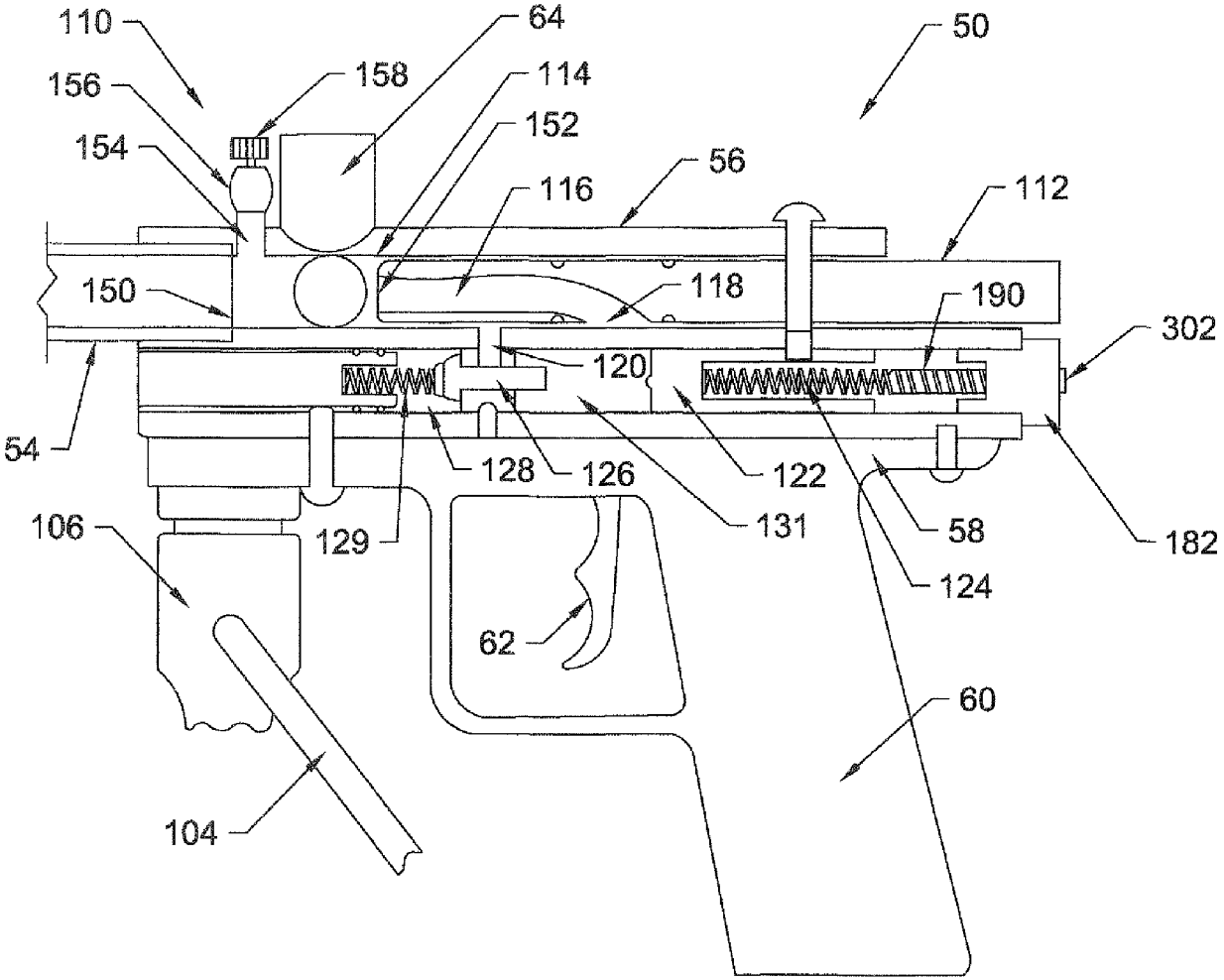
FIG. 12 illustrates a portion of a compressed gas projectile accelerator in cross-sectional form having a velocity adjustment mechanism.

Referring to FIG. 12, in yet another illustrative form, marker 50 includes a velocity adjustment mechanism 110 located on body 56. In particular, velocity adjustment mechanism 110 is a venting mechanism located at an end 150 of barrel 54. In this form, bolt 112 does not travel completely to end 150 of barrel 54. As such, a gap exists between an end 152 of bolt 112 and end 150 of barrel 54 during a firing operation such that a seal is not formed between barrel 54 and bolt 112. Body 56 includes a gas port 154 that is connected with a venting mechanism, which is an adjustable relief valve 156 in this form. As with the previous form, during a firing operation, compressed gas travels through gas passage 116. A predetermined amount of this compressed gas is redirected into gas port 154 and is vented through adjustable relief valve 156. Velocity adjustment mechanism 110 includes a knob 158 that is used by user 10 to control the amount of compressed gas that is released from adjustable relief valve 156. Adjustable relief valve 156 is thus capable of allowing marker 50 to expel projectiles between a maximum or upper velocity setting and a minimum or lower velocity setting.

In another form, an electro-pneumatic marker 50 is represented. Venting mechanism of velocity adjustment mechanism 110 is electronically controlled; in one form, by circuit board 66, described above (see FIG. 5). In yet another form, velocity adjustment mechanism 110 of electro-pneumatic marker 50 is pneumatically controlled; in one form, by solenoid valve 74 connected to circuit board 66.

Figure 13:
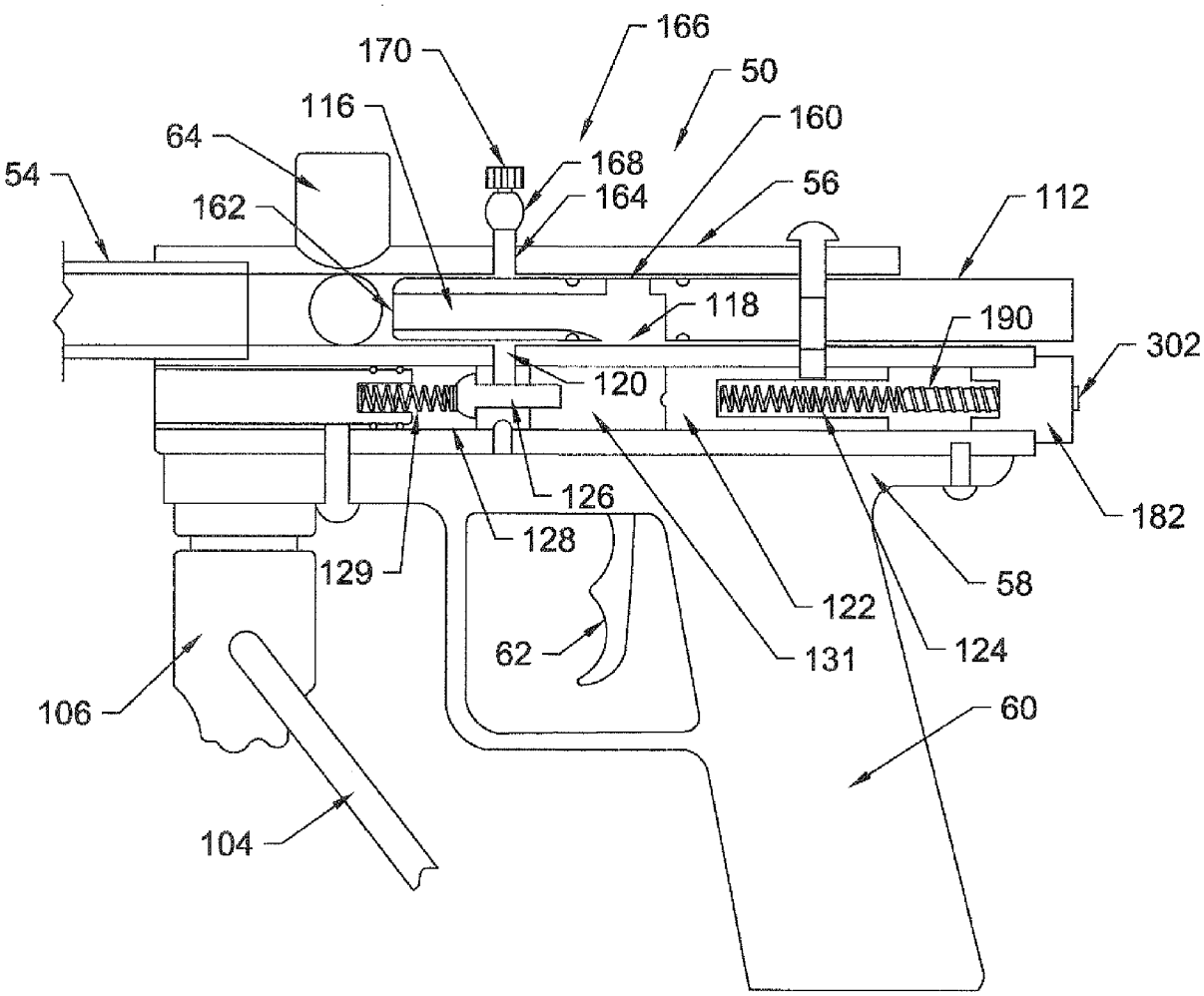
FIG. 13 illustrates a portion of a compressed gas projectile accelerator in cross-sectional form having a velocity adjustment mechanism.

Referring to FIG. 13, in yet another form, bolt 112 includes a gas passage 116 that includes input port 118 and an output port 160, in addition to a port 162 used to expel paintballs from barrel 54. Body 56 includes a gas port 164 that aligns with output port or vent 160 of bolt 112 during a firing operation and redirects a predetermined amount of compressed gas to a venting mechanism. As with the previous forms, marker 50 includes a velocity adjustment mechanism 166, which comprises an adjustable relief valve 168 that acts or functions as the venting mechanism. In this form, velocity adjustment mechanism 166 is located behind feeder 64 in body 56. Adjustable relief valve 168 includes a knob 170 that is used by user 10 to control the amount of compressed gas that is released from adjustable relief valve 168. Adjustable relief valve 168 is thus capable of allowing marker 50 to expel projectiles between a maximum velocity setting and a minimum velocity setting.

In another form, an electro-pneumatic marker 50 is represented. Venting mechanism of velocity adjustment mechanism 166 is electronically controlled; in one form, by circuit board 66, described above (see FIG. 5). In yet another form, velocity adjustment mechanism 166 of electro-pneumatic marker 50 is pneumatically controlled; in one form, by solenoid valve 74 connected to circuit board 66.

Figure 14:
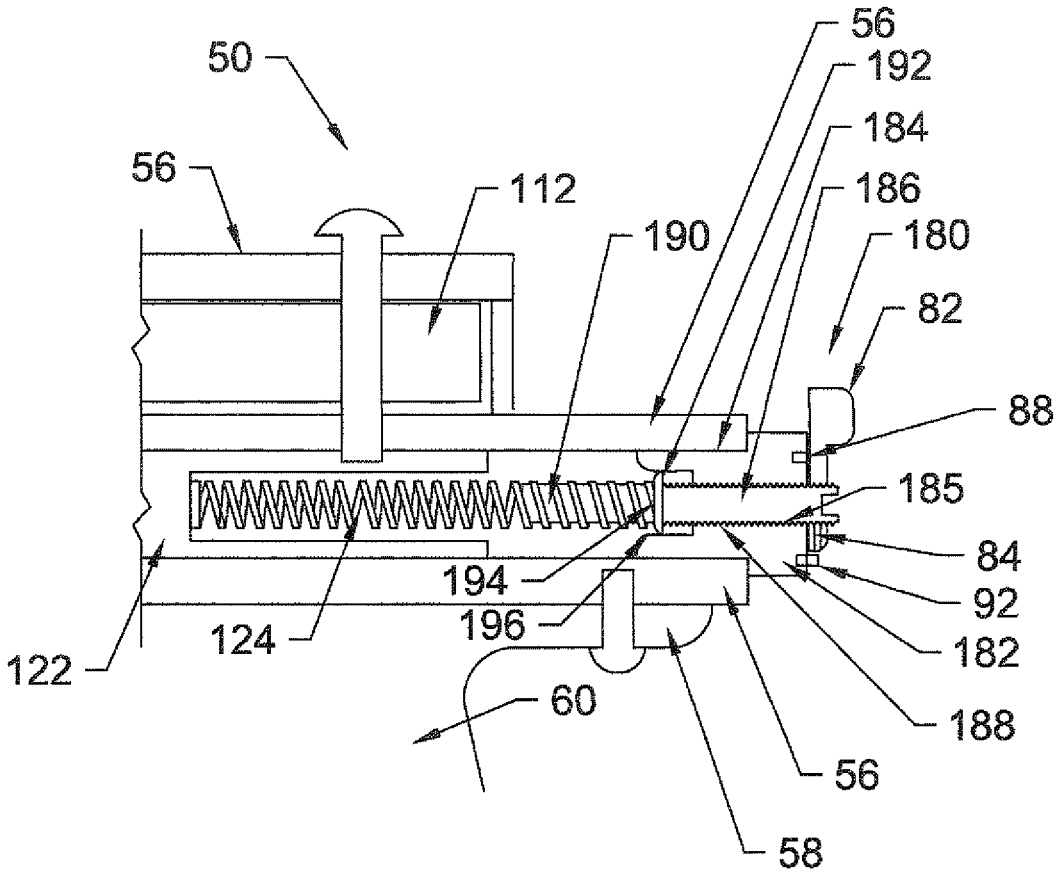
FIG. 14 illustrates a portion of a compressed gas projectile accelerator in cross-sectional form having a velocity adjustment mechanism.

Referring to FIG. 14*a*, a portion of another representative marker 50 is illustrated that includes a velocity adjustment mechanism 180. In this representative form, a hammer spring end cap 182 is connected with an end 184 of body 56. Hammer spring end cap 182 can be threadably connected with body 56 or friction fit with body 56. A threaded end 185 of a main velocity adjustor 186 is secured in a threaded aperture 188 of hammer spring end cap 182. Main velocity adjustor 186 has an unthreaded end 190 that extends from threaded end 185 into the body 56 of marker 50 and includes a spring retention collar 192. An end 194 of hammer spring 124 fits around unthreaded end 190 of main velocity adjustor 186 and rests against collar 192. A portion of main velocity adjustor 186 fits within a retention aperture 196 of end cap 182.

In this form, main velocity adjustor 186 is used to set the maximum or upper velocity setting by adjustment of main velocity adjustor 186 in end cap 182. Main velocity adjustor 186 is used to adjust the tension on hammer spring 124. The more tension that is applied to hammer spring 124 (i.e.—by screwing main velocity adjustor 186 further into end cap 182), the harder hammer 122 strikes valve 126 during a firing operation. The harder hammer 122 strikes valve 126, the longer valve 126 is activated and a greater volume of compressed gas is released from valve 126, thereby expelling paintballs from barrel 54 at a higher velocity. Likewise, loosening main velocity adjustor 186, which lessens the tension applied to hammer 122 by spring 124, causes hammer 122 to strike valve 126 with less force during a firing operation. This causes a quicker activation of valve 126 and a release of a lesser gas volume during a firing operation, thereby expelling paintballs from barrel 54 at a lower velocity.

As with the form illustrated in FIGS. 6*a*-6*c*, this form can include an adjustment device 82 (e.g.—a selector lever). Once main velocity adjustor 186 has been set to expel projectiles at an upper velocity level or setting, selector 82 can be connected with or adjusted on main velocity adjustor 186. Although dial 86 is not included in this form, it could be connected with end cap 182. In this form, end cap 182 includes apertures 88. As with the forms disclosed in FIGS. 6*a*-6*c*, pins or set screws 90 and 92 can be positioned in apertures 88 to ensure that selector 82 cannot be adjusted above the upper velocity setting or below the minimum or lower velocity setting. See FIGS. 6*a*-6*c*. Set screw 84 is used to secure selector 82 to main velocity adjustor 186.

Figure 15:
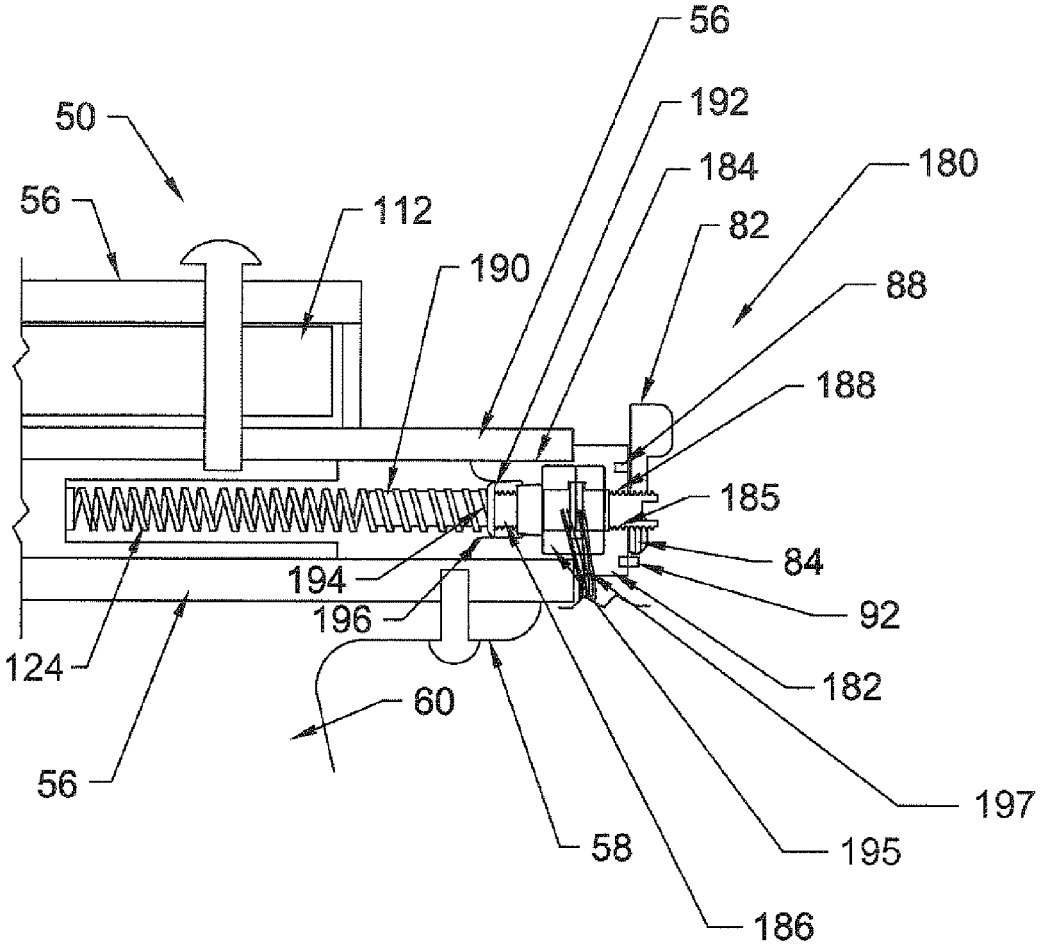
FIG. 15 illustrates a portion of a compressed gas projectile accelerator in cross-sectional form having an assisted velocity adjustment mechanism.

Referring to FIG. 15, a portion of an electro-pneumatic marker 50 is illustrated that includes a velocity adjustment mechanism 180. In this representative form, a hammer spring end cap 182 includes an electric threaded shaft motor or actuator 195. In another form, motor/actuator 195 is configured or constructed to interchange with or replace end cap 182. Threaded shaft 186 of electric actuator 195, (like main velocity adjustor 186 of FIG. 14), includes a threaded end 185 that is positioned in a threaded aperture 188 of hammer spring end cap 182. Threaded shaft adjustor 186 has an unthreaded end 190 that extends from threaded end 185 into the body 56 of marker 50 and includes a spring retention collar 192. An end 194 of hammer spring 124 fits around unthreaded end 190 of main velocity adjustor 186 and rests against collar 192. A portion of threaded shaft adjustor 186 fits within a retention aperture 196 of end cap 182, as in the above form.

In this form, like the above form (see FIG. 14), threaded shaft adjustor 186 is used to set the maximum or upper velocity setting by adjustment of threaded shaft adjustor 186 in end cap 182. Said adjustment of threaded shaft adjustor 186 in end cap 182 can be made by actuator 195 through wiring harness 197 to connected circuit board 66 with velocity controller 76 and/or controls 77, in one form (see FIG. 5). Also, said adjustment of threaded shaft adjustor 186 in end cap 182 can be made manually; in one form, through allen head screw end, as described above (see FIG. 6*a*-6*c*). Threaded shaft adjustor 186 is used to adjust the tension on hammer spring 124. The more tension that is applied to hammer spring 124 (i.e.—by screwing threaded shaft adjustor 186 further into end cap 182), the harder hammer 122 strikes valve 126 during a firing operation. The harder hammer 122 strikes valve 126, the longer valve 126 is activated and a greater volume of compressed gas is released from valve 126, thereby expelling paintballs from barrel 54 at a higher velocity. Likewise, loosening threaded shaft adjustor 186, which lessens the tension applied to hammer 122 by spring 124, causes hammer 122 to strike valve 126 with less force during a firing operation. This causes a quicker activation of valve 126 and a release of a lesser gas volume during a firing operation, thereby expelling paintballs from barrel 54 at a lower velocity.

Again, as with the forms illustrated in FIGS. 6*a*-6*c* and FIG. 14, this form can include an adjustment device 82 (e.g.—a selector lever). Once threaded shaft adjustor 186 has been set to expel projectiles at an upper velocity level or setting, selector 82 can be connected with or adjusted on threaded shaft adjustor 186. Although dial 86 is not included in this form, it could be connected with end cap 182. In this form, end cap 182 includes apertures 88. As with the forms disclosed in FIGS. 6*a*-6*c*, pins or set screws 90 and 92 can be positioned in apertures 88 to ensure that selector 82 cannot be adjusted above the upper velocity setting or below the minimum or lower velocity setting. See FIGS. 6*a*-6*c*. Set screw 84 is used to secure selector 82 to threaded shaft adjustor 186. Adjustment device 82 can be, in one form, a manual velocity adjustor or over riding velocity adjustor. Further in one form, selector 82 secured to threaded shaft adjustor 186 will hit or bump up against pins 90 and 92, as described above (see FIG. 6*a*-6*c*); and prevent the adjustment of threaded shaft adjustor 186 by motor/actuator 195 beyond the upper and lower velocity settings. Although illustrated as being housed in spring end cap 182, it should be appreciated that actuator 195 can be housed in other locations of marker 50. Also, actuator 195 can be connected to a separate controller and/or power source through wiring harness 197. Electric actuator 195 can comprise a servo, solenoid, stepper motor, indirect drive motor, direct drive motor, ball screw drive, worm gear drive or any other suitable type of motor, drive, and/or actuator.

Further, as those skilled in the art would recognize, electric actuator 195 can be alternated or substituted with pneumatic and/or hydraulic motors, drives, and/or actuators. Said pneumatic/hydraulic motors, drives, and/or actuators can comprise a servo, solenoid, fluidic muscle actuator, indirect drive actuator, direct drive actuator, ball screw drive, vane actuator, rotary vane motor, multi stage cylinder or any other suitable type of motor, drive, and/or actuator. Pneumatic actuator 195 can be activated and/or controlled by solenoid valve 74, connected with circuit board 66, in one form; and activated and/or controlled by an independent or secondary solenoid valve, in another form.

Figure 16:
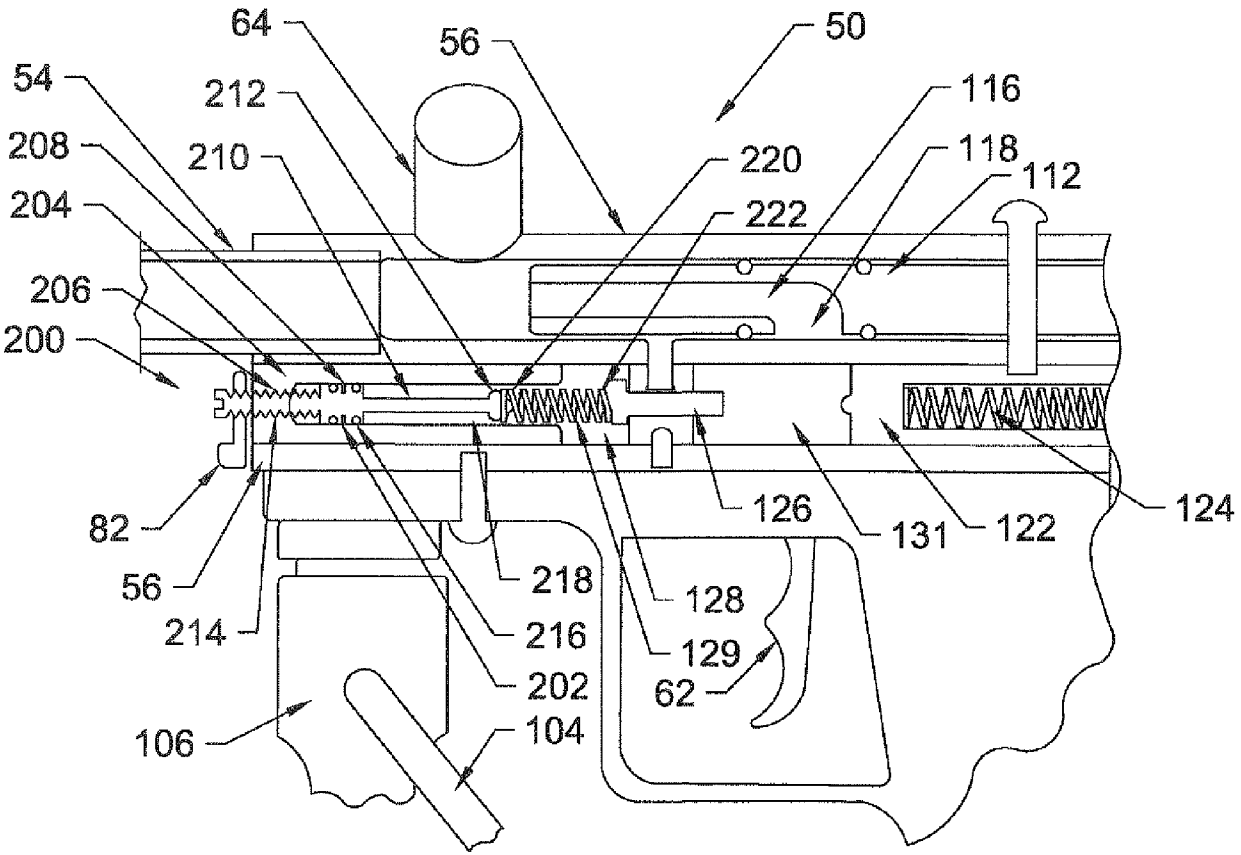
FIG. 16 illustrates a portion of a compressed gas projectile accelerator in cross-sectional form having a velocity adjustment mechanism.

Referring to FIG. 16, in this form, marker 50 includes a velocity adjustment mechanism 200 that adjusts the tension applied by spring 129 to valve 126. As those skilled in the art would recognize, the velocity adjustment mechanism 200 can be configured additionally on marker 50 with or without the above described main velocity adjustor 186 (see FIG. 14), main velocity adjustor 302 (see FIG. 11), or main velocity adjustor 80 (see FIG. 6*a*-6*c*). Velocity adjustor 202 is positioned in a valve spring retention member 204. Retention member 204 is connected with body 56 and is positioned in chamber 128. Velocity adjustor 202 includes a threaded end 206, a sealing member 208, an extension member 210, and a collar 212. Threaded end 206 is threaded into an internally threaded aperture 214 of retention member 204 and transitions into sealing member 208. Sealing member 208 includes one or more seals 216 that form a fluid tight seal between sealing member 208 and an internal bore 218 of retention member 204. Extension member 210 extends away from sealing member 208 inside internal bore 218 and transitions into collar 212. An end 220 of spring 129 is connected with collar 212 and an opposite end 222 of spring 129 is connected with an end of valve 126.

Velocity adjustment mechanism 200 works in conjunction with hammer 122 in this form. Velocity adjustment mechanism 200 is used to adjust the force applied to the end of valve 126. The more force that is applied to valve 126, the faster valve 126 shuts after being struck by hammer 122. As such, as threaded end 206 is tightened into retention member 204, more force is applied to valve 126 by spring 129. Likewise, as threaded end 206 is loosened from retention member 204, less force is applied to valve 126. The faster valve 126 closes, the less volume of compressed gas is allowed to pass through valve 126 to expel projectiles from barrel 54 of marker 50. As such, adjustment of threaded end 206 to a predetermined location or setting allows user 10 to set an upper velocity setting. As with the previous embodiments, velocity adjustment device 82 can then be used to raise and lower the velocity at which paintballs are expelled from barrel 54.

As those skilled in the art would recognize, actuator 195 (see FIG. 15) is adaptable to velocity adjustment mechanism 200. For example, if valve spring retention member 204 extended outward in length, as well as, threaded end 206 of velocity adjustor 202; actuator 195 could be housed in valve spring retention member 204 as illustrated in FIG. 15. All other features of this form remain the same as previously set forth with respect to FIGS. 6*a*-6*c*, 14, and 15.

Figure 17:
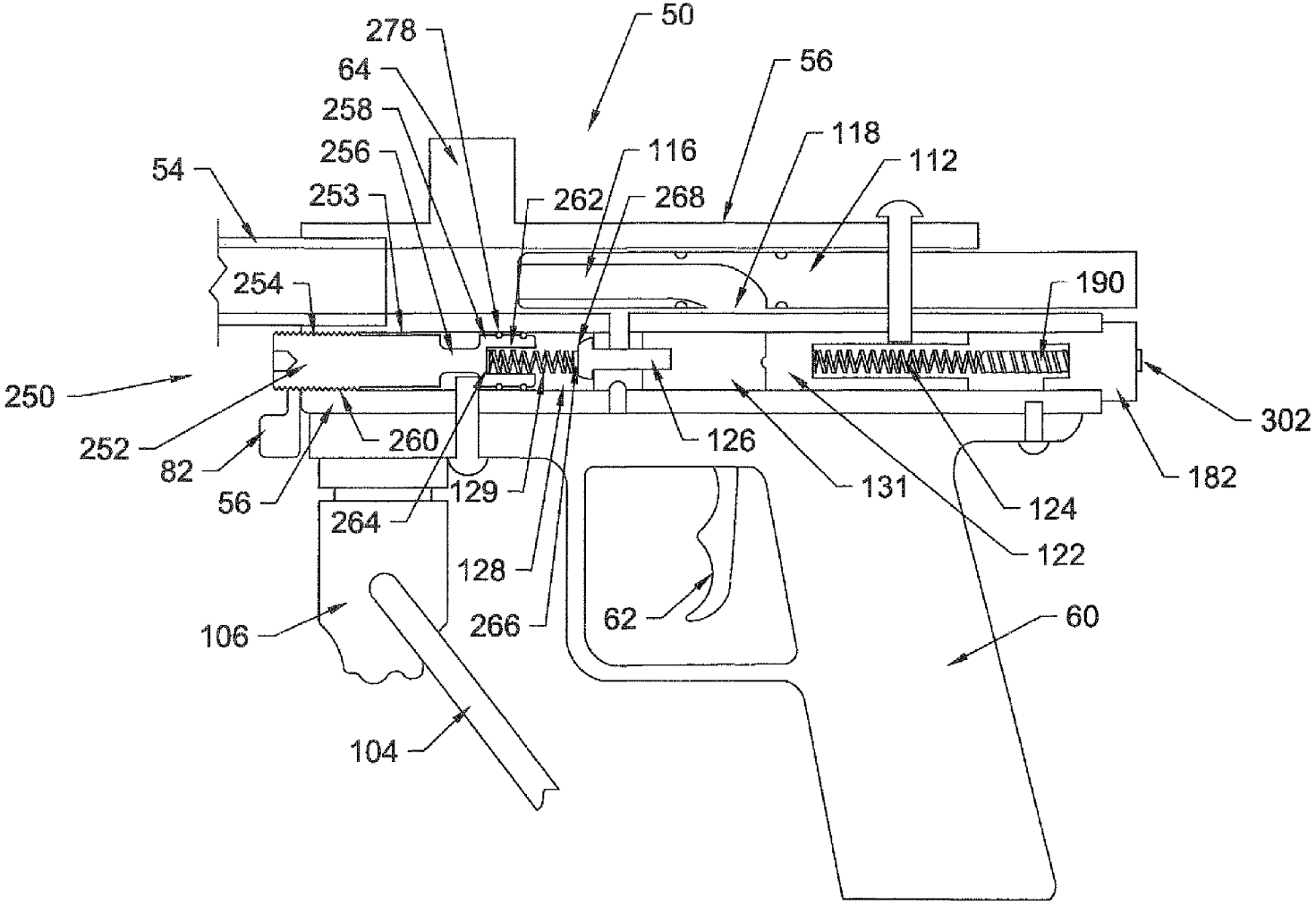
FIG. 17 illustrates a portion of a compressed gas projectile accelerator in cross-sectional form having a velocity adjustment mechanism.

Referring to FIG. 17, in this form, marker 50 includes a velocity adjustment mechanism 250 that adjusts the volume of gas and the tension on spring 129 to control the force at which a paintball is expelled from barrel 54. Velocity adjustment mechanism 250 includes a velocity adjustor 252 that is threaded into body 56 of marker 50. In particular, velocity adjustor 252 is threaded into chamber 128 of marker 50. Velocity adjustor 252 includes a threaded segment 254, an extension segment 256, and a spring receiving segment 258. Threaded segment 254 is threaded into an internally threaded segment 260 of bore 253.

Extension segment 256 extends away from threaded segment 254 a predetermined distance into bore 253. At an opposite end of extension segment 256 is a spring receiving segment 258. Spring receiving segment 258 includes an aperture 262 that receives a first end 264 of spring 129. A second end 266 of spring 129 is connected with or engages an end 268 of valve 126. At least one seal 278 is positioned between spring receiving segment 258 and bore 253 to provide a fluid tight seal for chamber 128, which is defined by bore 253, spring receiving segment 258 and valve 126.

In this form, chamber 128 comprises a compressed gas storage chamber that is refilled with compressed gas after each shot. The compressed gas has a predetermined pressure level, which is controlled by regulator 106, and a predetermined volume. While the pressure level does not change, velocity adjustment mechanism 250 is configured to change the volume or amount of compressed gas that is stored in chamber 128. In addition, the tension on spring 129 is also adjusted which, in turn, changes the amount of force applied to end 266 of spring 129.

During setup, velocity adjustor 252 is configured to allow marker 50 to expel paintballs from barrel 54 at a maximum or upper velocity setting. As with the previous forms, adjustment device or selector 82 allows user 10 to adjust operation of marker 50 between the upper velocity setting and the lower velocity setting. Tightening, or screwing in velocity adjustor 252, increases the tension on spring 129, thereby causing valve 126 to close faster when hammer 122 strikes valve 126, as well as decreases the volume of chamber 128.

Loosening velocity adjustor 252 decreases the force placed on valve 126 and increases the volume of chamber 128 (i.e.—thereby allowing more compressed gas into chamber 128), which allows paintballs to be expelled from barrel 54 at a higher or increased velocity. Movement of adjustment device 82 tightens and loosens velocity adjustor 252, thereby allowing adjustment of marker 50 between the upper velocity setting and lower velocity setting. As with the representative form set forth with respect to FIGS. 6*a*-6*c*, 14 and 15, movement of adjustment device 82 is prevented from occurring above or below the upper velocity setting and lower velocity setting.

As with FIG. 16, those skilled in the art would recognize, actuator 195 (see FIG. 15) is adaptable to velocity adjustment mechanism 250. For example, in one form, if the outer diameter of velocity adjustor 252 was reduced and threaded, on outer end of velocity adjustor 252 (end under barrel 54); and actuator 195 could be housed and/or secured in bore 253 as illustrated in FIG. 15. All other features of this form remain the same as previously set forth with respect to FIGS. 6*a*-6*c*, 14, and 15.

Figure 18:
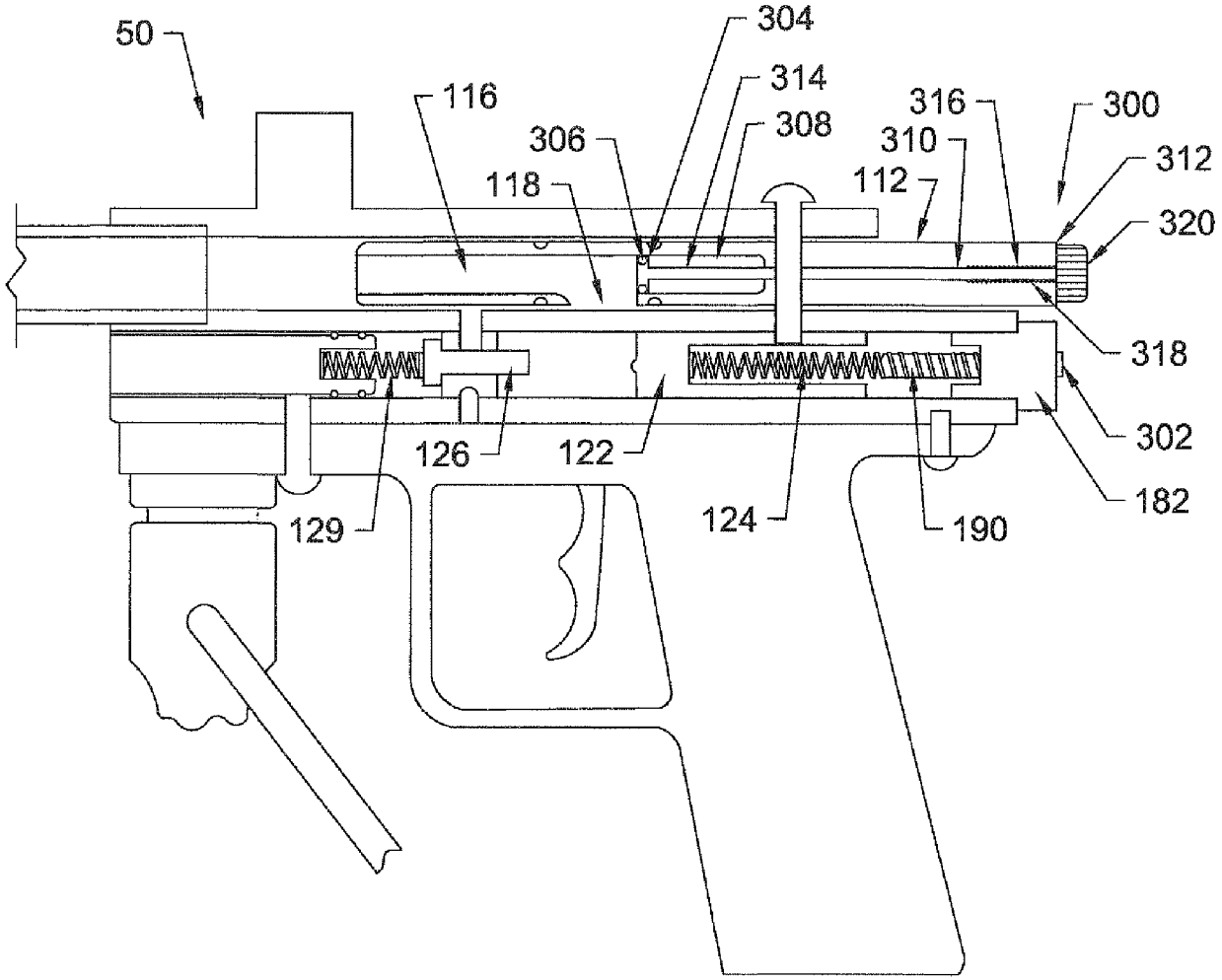
FIG. 18 illustrates a portion of a compressed gas projectile accelerator in cross-sectional form having a velocity adjustment mechanism.

Referring to FIG. 18, yet another form of marker 50 is illustrated that includes a velocity adjustment mechanism 300. In this form, a first velocity adjustor 302 is used to set marker 50 to operate at the maximum or upper velocity setting. This is accomplished by adjusting the tension or force applied to hammer 122 by spring 124 similar to the manner described above. During this adjustment, velocity adjustment mechanism 300 is positioned such that a gas chamber blocker 304 is located in a fully closed or forward position. The outer diameter of gas chamber blocker 304 includes a seal 306 that forms a fluid tight seal with a rear gas chamber 308 in bolt 112.

A rear portion of bolt 112 includes an aperture 310 running from an open end 312 of bolt 112 to rear gas chamber 308. A rod 314 is connected with gas chamber blocker 304 and runs through the rear end of bolt 112 out of open end 312. A portion 316 of the rear end of bolt 112 contains internal threads and a portion 318 of the end of rod 314 contains external threads. An adjustment knob 320 is connected with the exposed end of rod 314.

Adjustment knob 320 is used to screw rod 314 in and out of bolt 112. When adjustment knob 320 is in the fully closed position, gas chamber blocker 304 blocks or closes off chamber 308. As adjustment knob 320 is unscrewed or adjusted outwardly, more of chamber 308 becomes exposed thereby increasing the total volume of gas passage 116. In this form, during a firing operation, valve 126 is configured to release a set amount of compressed gas at a set pressure. As the bolt air chamber, or total size of gas passage 116, increases with the rearward adjustment of rod 314, moving gas chamber blocker 304 further back into gas chamber 308, the velocity of the paintball during a firing operation decreases. This allows user 10 to adjust marker 50 to expel paintballs between the upper velocity setting and a lower velocity setting through the adjustment of knob 320.

Again, those skilled in the art would recognize, actuator 195 (see FIG. 15) is adaptable to velocity adjustment mechanism 300. For example, in one form, actuator 195 could be housed and/or secured in rear end of bolt 112 near open end 312, with portion 318 of the end of rod 314 threading through actuator 195. Since the upper velocity setting, in this form, is set with main velocity adjustor 302 with gas chamber blocker 304 in the forward or closed position, as described above. Velocity of marker 50 can be adjusted between the upper velocity setting and lower velocity setting with actuator 195 of velocity adjustment mechanism 300 by, in this form, increasing or decreasing the volume of gas chamber 308 and/or gas passage 116. Actuator 195, in one form, is connected with circuit board 66, and/or as described in FIG. 15. Also, said adjustment of gas chamber blocker 304 can still be made manually; in one form, through the adjustment of knob 320.

Further, as those skilled in the art would recognize, actuator 195 can be configured pneumatically, as described above (see FIG. 15), and controlled by solenoid valve 74, connected with circuit board 66, in one form. Thus, gas chamber 308 can be increased and/or decreased pneumatically, in one form, to adjust the velocity of electro-pneumatic marker 50 between said upper velocity setting and said lower velocity setting.

Figure 19:
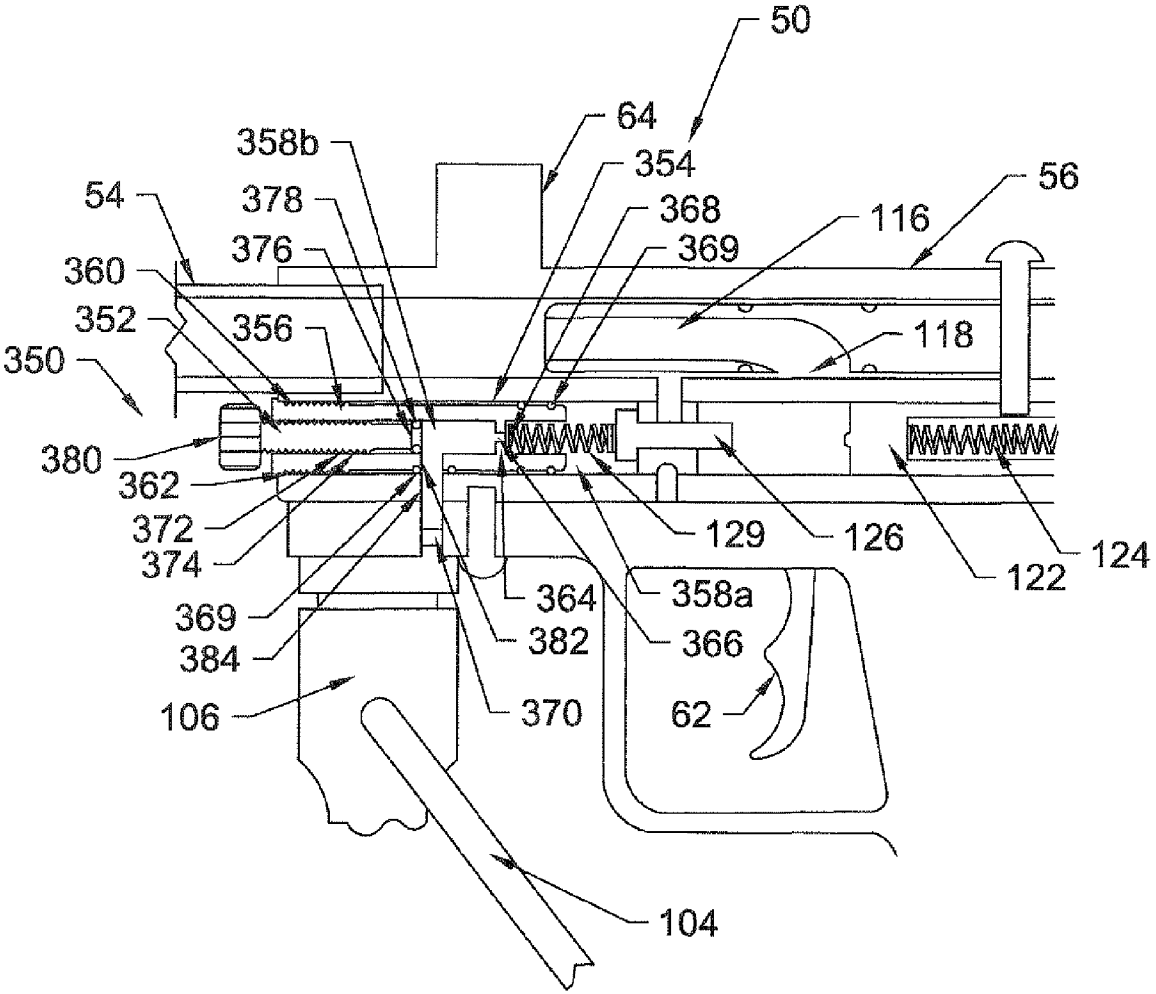
FIG. 19 illustrates a portion of a compressed gas projectile accelerator in cross-sectional form having a velocity adjustment mechanism.

Referring to FIG. 19, yet another representative marker 50 is disclosed that includes a velocity adjustment mechanism 350. This form is similar to that disclosed with respect to FIG. 18 except that instead of the volume adjustment occurring in connection with bolt 112, it takes place with respect to valve 126. Once the upper velocity setting is set using first or main velocity adjustor 302, as described above, velocity adjustment mechanism 350 can be used to adjust the velocity setting between the upper velocity setting and the lower velocity setting. In this form, a forward end of body 56 includes a longitudinal bore 354 that houses valve 126.

A valve plug 356 is secured in bore 354 that defines a rear gas chamber 358*b* and a forward gas chamber 358*a*, which together define a gas storage chamber. In this form, valve plug 356 includes an outer threaded portion 360 that is threaded into an internally threaded portion 362 of bore 354. Valve plug 356 also includes a spring retention member 364 that includes an aperture 366. An end 368 of spring 129 rests against a respective surface of spring retention member 364. At least one seal 369 is used to provide a fluid tight seal between bore 354 and valve plug 356. A valve 370, which can comprise a solenoid valve, is used to selectively supply compressed gas to the rear gas chamber 358*b* and forward gas chamber 358*a*.

Velocity adjustment mechanism 350 includes a velocity adjustor 352. Velocity adjustor 352 includes an outer threaded portion 372 that engages an inner threaded portion 374 of valve plug 356. Velocity adjustor 352 includes a gas chamber blocker 376. An outer diameter of gas chamber blocker 376 includes a seal 378 that forms a fluid tight seal between gas chamber blocker 376 and an inner wall of rear gas chamber 358*b*. Velocity adjustor 352 also includes an adjustment knob 380 that extends or is positioned outwardly from the end of valve plug 356.

When marker 50 is being adjusted for use or play, velocity adjustor 352 is secured or screwed all the way into rear gas chamber 358*b* as far as possible. Valve plug 354 includes a gas supply aperture 382 that is in alignment with a gas supply passage 384. In this example, gas chamber blocker 376 is in approximate alignment with gas supply aperture 382. Once velocity adjustor 352 is in the forward most position, first/main velocity adjustor 302 is used to set the upper velocity setting of marker 50.

During play, user 10 can lower the velocity setting of marker 50 by unscrewing or adjusting the position of velocity adjustor 352. Adjusting the position of velocity adjustor 352 outwardly by turning knob 380, increases the volume of rear gas chamber 358*b*. Since compressed gas is supplied to the gas storage chamber, which as previously set forth comprises rear gas storage chamber 358*b* and forward gas storage chamber 358*a*, at a set pressure and set volume, increasing the volume of the gas storage chamber causes a decrease in velocity of paintballs that are expelled from barrel 54.

Yet again, those skilled in the art would recognize, actuator 195 (see FIG. 15) is adaptable to velocity adjustment mechanism 350. For example, in one form, actuator 195 could be housed and/or secured in valve plug 356 and adjust velocity adjustor 352, which includes gas chamber blocker 376. As such, actuator 195 of velocity adjustment mechanism 350 can increase or decrease the volume of the gas storage chamber, thus in one form, increasing or decreasing the velocity of electro-pneumatic marker 50 between said upper velocity setting and said lower velocity setting. Those skilled in the art would again recognize, velocity adjustment mechanism 350 with actuator 195 can be configured pneumatically, as illustrated in FIGS. 15 and 18.

Figure 20:
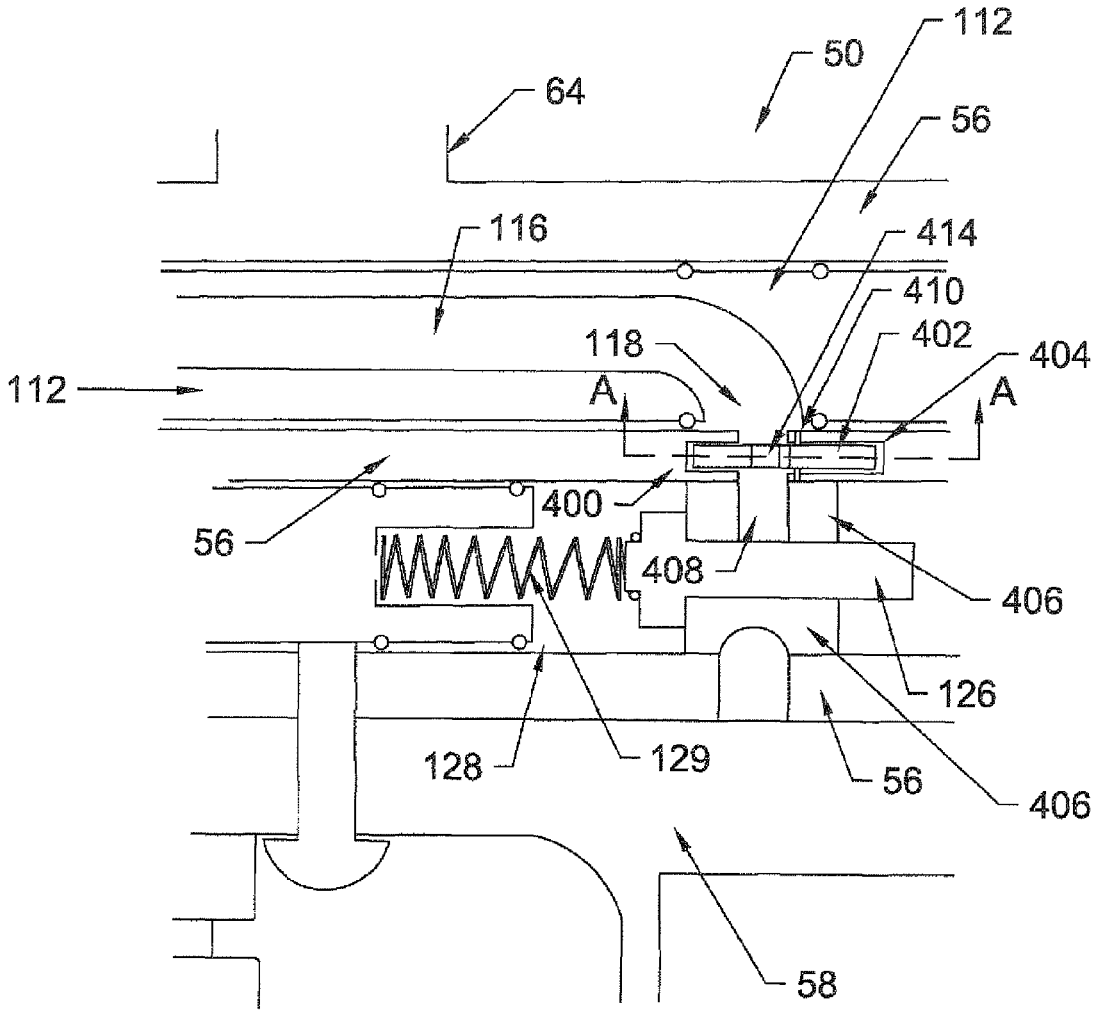
FIG. 20 illustrates a portion of a compressed gas projectile accelerator in cross-sectional form having a velocity adjustment mechanism.

Referring to FIG. 20, a portion of yet another form of marker 50 is illustrated that includes another representative form of a velocity adjustment mechanism 400. Velocity adjustment mechanism 400 includes a dial selector, which in this form comprises an adjustable gas passage blocker 402 positioned in a slot 404 of body 56. Valve 126 includes a valve body 406 that includes a gas port 408. Adjustable gas passage blocker 402 is positioned in slot 404 of body 56 on a swivel pin 410. As set forth in greater detail below, as gas passes from chamber 128 through port 408 of valve 126, the gas also passes through adjustable gas passage blocker 402 before entering input port 118 of gas passage 116 in bolt 112.

Figure 21A:
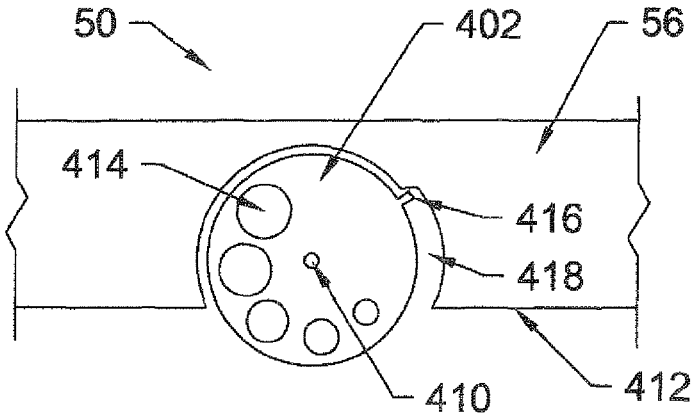
FIGS. 21*a*-21*c* illustrates cross-sectional views of an adjustment dial of a velocity adjustment mechanism.
Figure 21B:
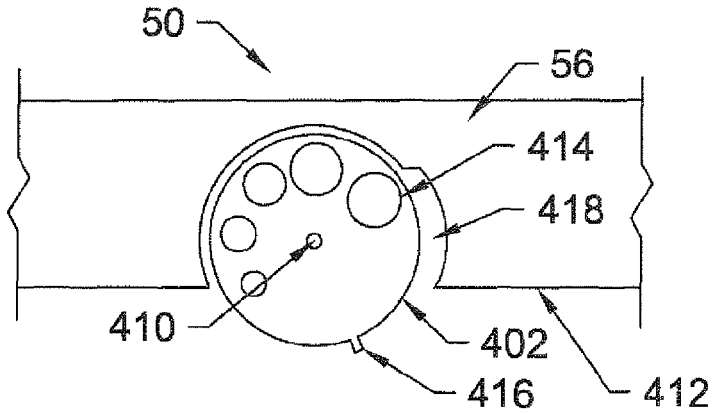
Figure 21C:
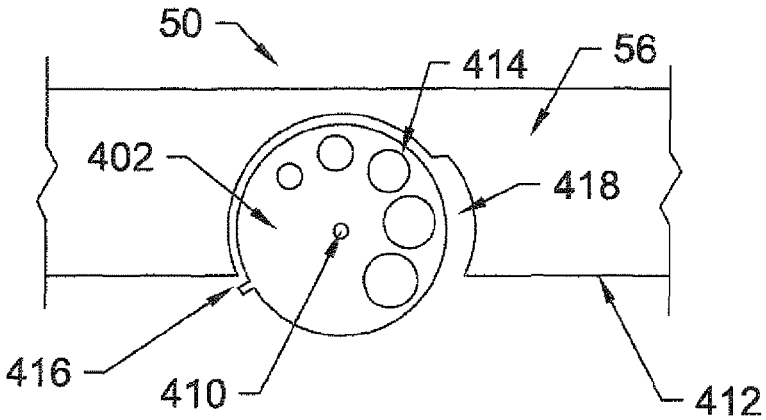

Referring to FIGS. 21*a*-21*c*, which depicts top cross sectional views of marker 50 along hash A-A in FIG. 20, a more illustrative view of adjustable gas passage blocker 402 is illustrated. A portion of gas passage blocker 402 protrudes outwardly from a side 412 of body 56. Adjustable gas passage blocker 402 includes a plurality of passages 414 positioned about a circumference or perimeter of adjustable gas passage blocker 402. Each passage 414 has a different diameter or size. Main velocity adjustor 302 (see FIG. 11) is used to set the upper velocity setting of marker 50 and adjustable gas passage blocker 402 is used to lower the velocity setting to different settings as a function of which passage 414 is selected.

As set forth above, gas passage blocker 402 includes passages 414 that are sized according to the amount of restriction that is desired. For example, in FIG. 21*a*, the largest diameter passage 414 is aligned with gas port 408 or valve 126. As such, marker 50 is set at the upper velocity setting. FIG. 21*b* represents a middle setting and FIG. 21*c* represents the lower velocity setting. An adjustment member 416 protrudes outwardly from gas passage blocker 402. A cutaway or slot 418 is located in body 56 that provides a passageway for adjustment member 416 to travel through.

Figure 22A:
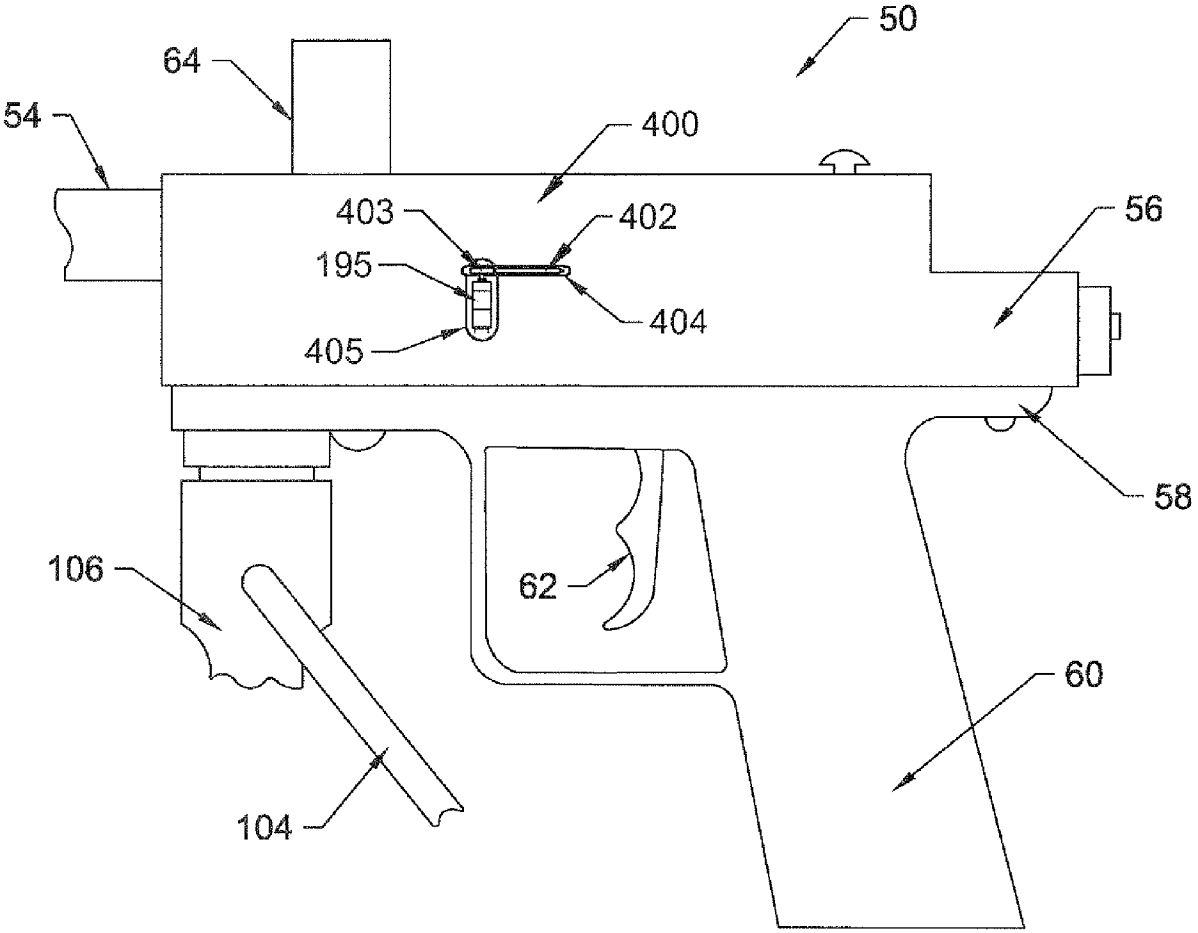
FIG. 22*a* illustrates a portion of a compressed gas projectile accelerator in cross-sectional form having an assisted velocity adjustment mechanism.
Figure 22B:
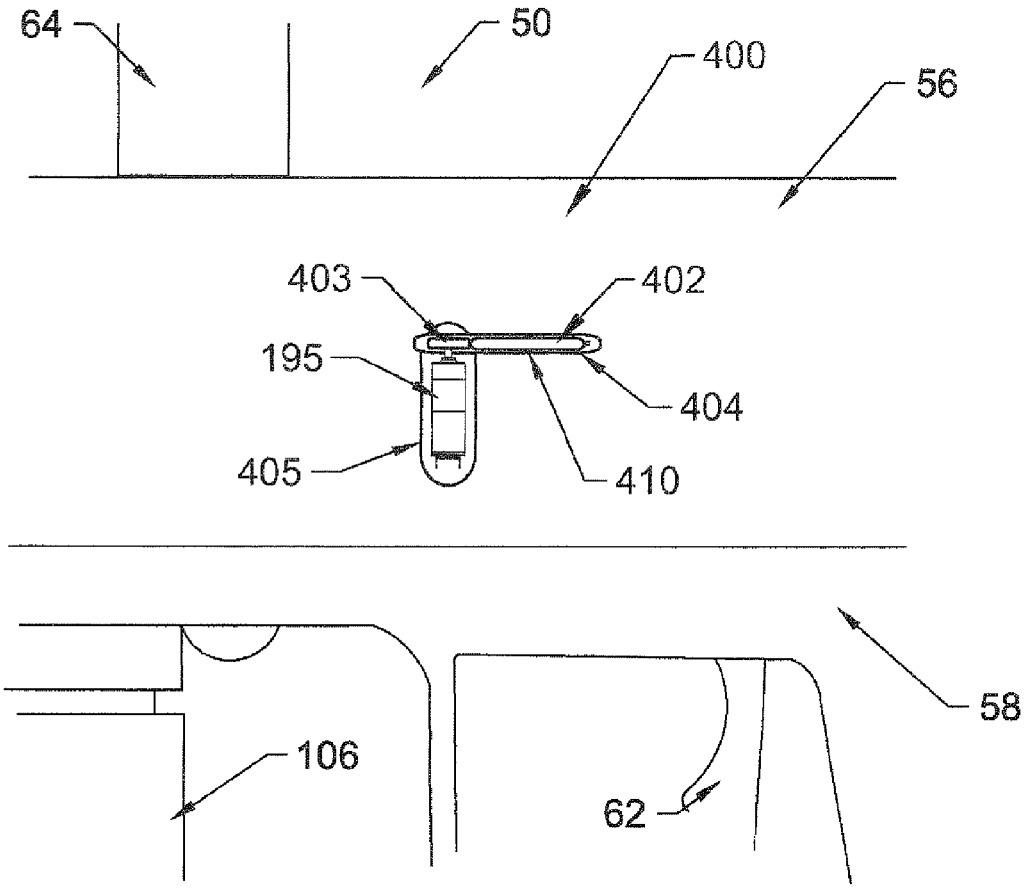
FIG. 22*b* illustrates a portion of a compressed gas projectile accelerator in cross-sectional form having an assisted velocity adjustment mechanism.
Figure 22C:
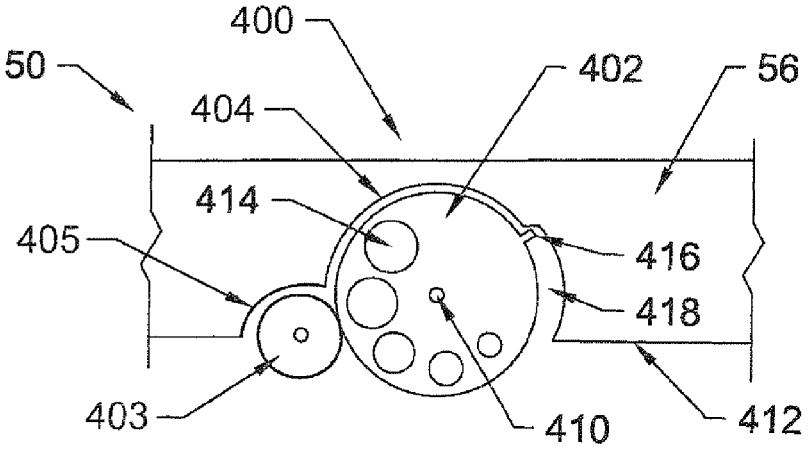
FIG. 22*c* illustrates cross-sectional views of an adjustment dial of an assisted velocity adjustment mechanism.

Referring to FIGS. 22*a*-22*c*, in another form, marker 50 includes another representative form of velocity adjustment mechanism 400; velocity adjustment mechanism 400, like in above form (see FIGS. 20 and 21), includes a dial selector, which also comprises an adjustable gas passage blocker 402 positioned in a slot 404 of body 56. As before, adjustable gas passage blocker 402 is positioned in slot 404 of body 56 on a swivel pin 410. Adjustable gas passage blocker 402 is configured to selectively restrict compressed gas flow from the valve 126 (see FIG. 20) to gas passage 116 in bolt 112, as described above. The upper velocity setting of marker 50 is set through main velocity adjustor 302, while the largest diameter passage 414 is aligned with gas port 408 or valve 126. The progressive selection of smaller and smaller diameter passages 414 further increases the restriction on the compressed gas flow, progressively. Thus, velocity adjustment mechanism 400 can be used to adjust the velocity setting between the upper velocity setting and the lower velocity setting.

In another representative form, an electro-pneumatic marker 50 is illustrated that includes actuator 195. Actuator 195 is positioned in external cavity or indentation 405. Actuator 195 includes a friction drive wheel or tension drive gear 403, in this form, that mates to and selectively rotates adjustable gas passage blocker 402, in slot 404. As such, actuator 195 connected to circuit board 66 can adjust the velocity setting between the upper velocity setting and the lower velocity setting, in one form, with velocity controller 76, controls 77, and/or with a operational fire mode (see FIG. 5), in another form.

Yet again, actuator 195 can be configured pneumatically, as described above (see FIG. 15), and controlled by solenoid valve 74, connected with circuit board 66, in one form. Thus, restriction on compressed gas flow with adjustable gas passage blocker 402 can be increased and/or decreased pneumatically, in one form, to adjust the velocity of electro-pneumatic marker 50 between said upper velocity setting and said lower velocity setting.

Figure 23:
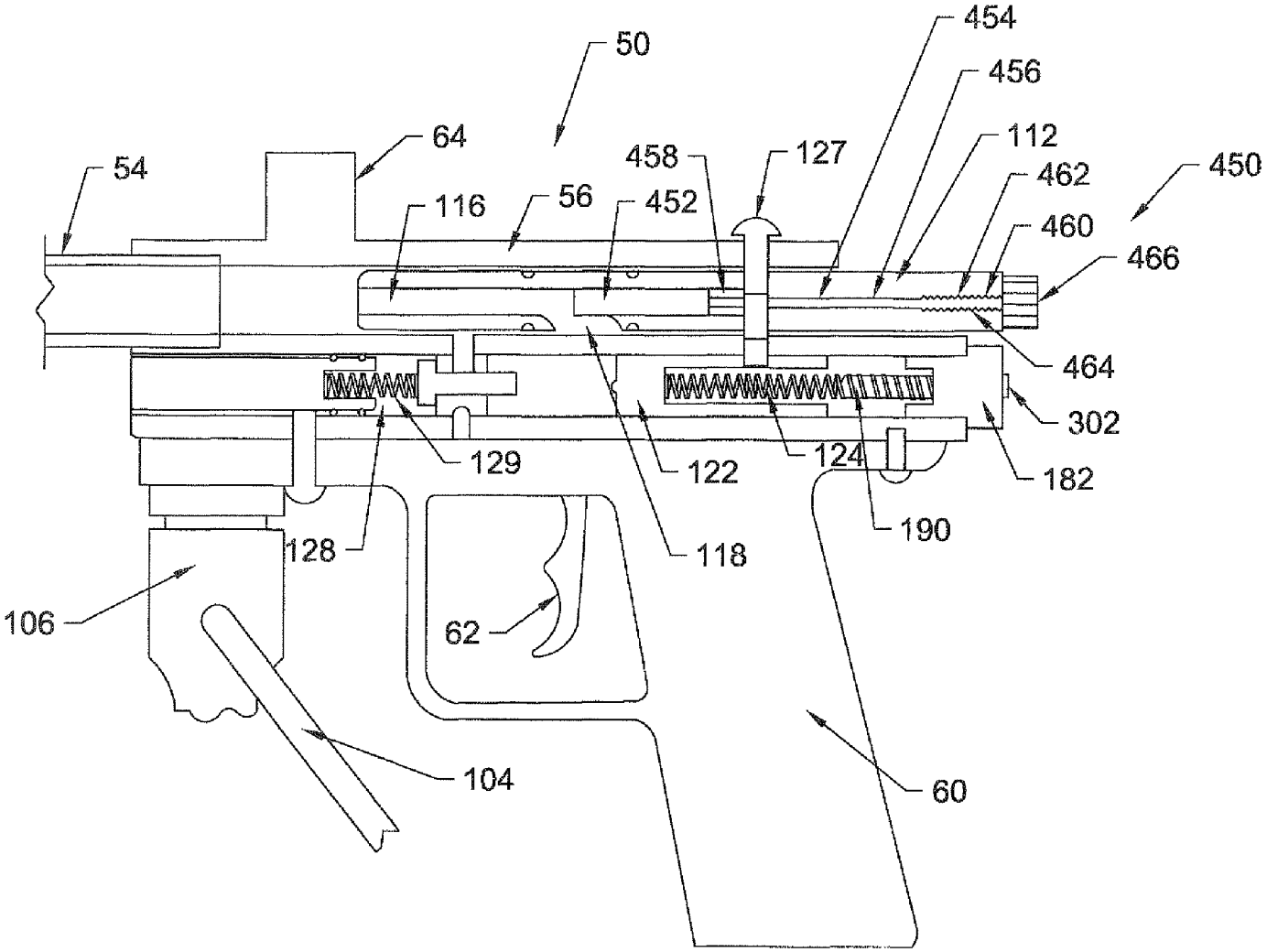
FIG. 23 illustrates a portion of a compressed gas projectile accelerator in cross-sectional form having a velocity adjustment mechanism.

Referring to FIG. 23, in yet another form, marker 50 includes a velocity adjustment mechanism 450 that comprises a bolt passage blocker 452 that is designed to partially block port 118 of bolt 112. Bolt passage blocker 452 is connected with a rod 454 that fits within an aperture 456 in bolt 112. Bolt passage blocker 452 fits within a retaining aperture 458 bored in bolt 112. An end portion 460 of rod 454 includes an externally threaded portion 462 that engages an internally threaded portion 464 of bolt 112. The end of rod 454 is connected with an adjustment knob 466.

Bolt passage blocker 452 is configured to block port 118 of bolt 112 such that gas is restricted from flowing into passage 116 of bolt 112. As knob 466 is screwed in and out, bolt passage blocker 452 adjusts to either increasingly or decreasingly block port 118. As a result, the velocity at which paintballs are expelled from barrel 54 can be adjusted between a maximum velocity setting and a minimum velocity setting. The maximum velocity setting can be configured on marker 50 by using main velocity adjustor 302, as previously set forth. When the maximum velocity is set, bolt passage blocker 452 is set in a fully retracted state or position so that user 10 cannot increase the velocity while on the field to an excessive velocity setting.

Similar to FIG. 18, actuator 195 (see FIG. 15) is adaptable to velocity adjustment mechanism 450. For example, in one form, actuator 195 could be housed and/or secured in the rear end portion of bolt 112, with the externally threaded portion 462 of rod 454 threading through actuator 195. Since the upper velocity setting, in this form, is set with main velocity adjustor 302, while passage blocker 452 is in a retracted position, as described above. The velocity of marker 50 can be adjusted between the upper velocity setting and lower velocity setting with actuator 195 of velocity adjustment mechanism 450 by, in this form, increasing or decreasing the restriction on compressed gas flow with connected passage blocker 452. Again, actuator 195, in one form, is connected with circuit board 66, and/or as described in FIG. 15. Also, said adjustment of passage blocker 452 could still be made manually; in one form, through the adjustment of knob 466.

Yet again, actuator 195 can be configured pneumatically, as described above (see FIG. 15), and controlled by solenoid valve 74, connected with circuit board 66, in one form. Thus, restriction on compressed gas flow with connected passage blocker 452 can be increased and/or decreased pneumatically, in one form, to adjust the velocity of electro-pneumatic marker 50 between said upper velocity setting and said lower velocity setting.

Figure 24:
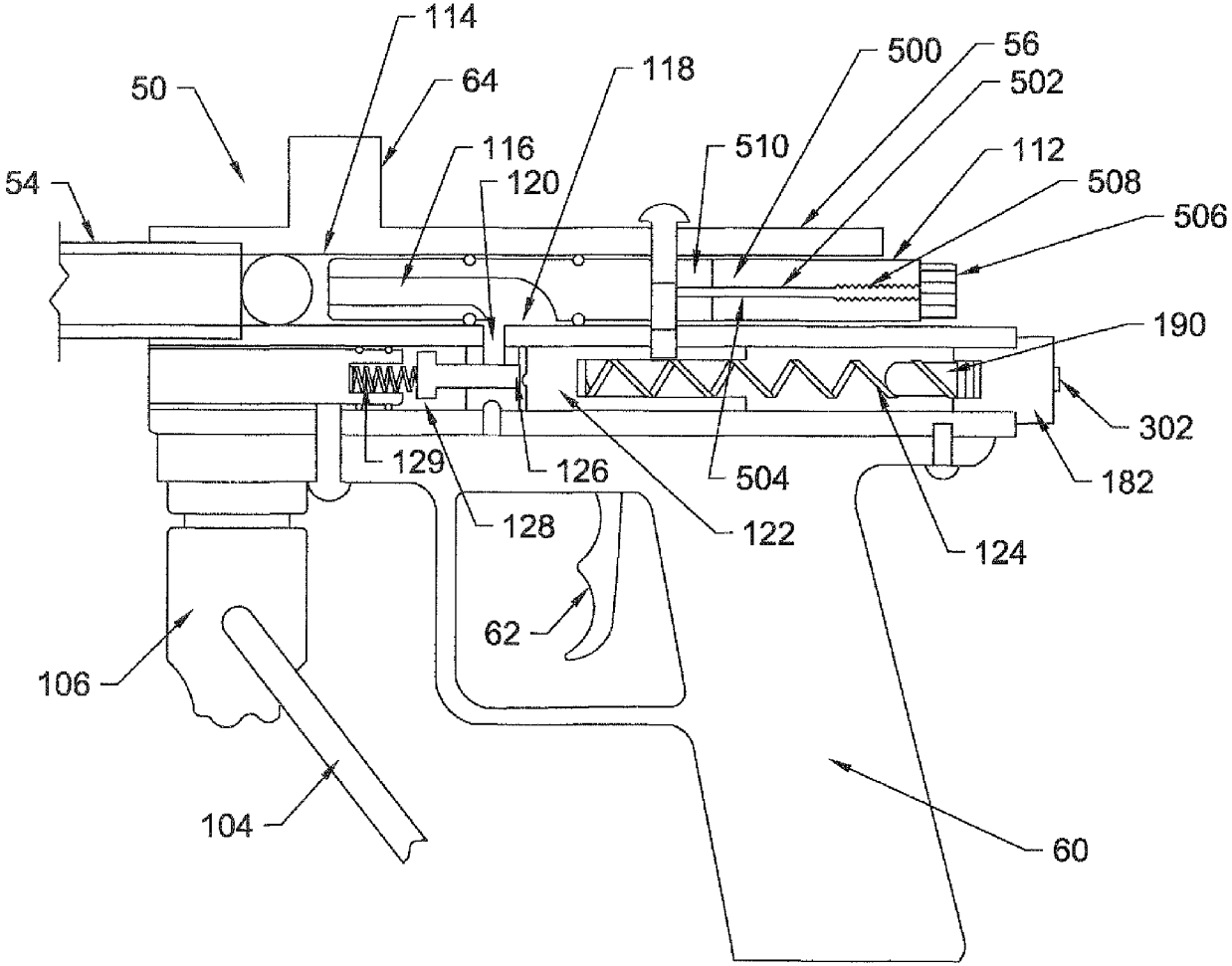
FIG. 24 illustrates a portion of a compressed gas projectile accelerator in cross-sectional form having a velocity adjustment mechanism.

Referring to FIG. 24, another representative form of marker 50 is illustrated that includes a velocity adjustment mechanism 500. In this form, the position of bolt 112 is adjusted such that, during a firing operation, port 118 of bolt 112 is misaligned with gas passage 120. As such, the misalignment of port 118 restricts the flow of compressed gas to passage 116, thereby slowing down the velocity of paintballs being expelled from barrel 54. The bolt and hammer connecting pin 127 is positioned in vertical slot or aperture 510 in bolt 112. One end of a rod 502 is connected with bolt and hammer connecting pin 127. Another end of rod 502 is connected with a knob 506. Rod 502 is positioned in an aperture 504 in bolt 112. An end portion 508 of rod 502 includes external threads that mate with internal threads in aperture 504. With bolt and hammer connecting pin 127 joined to hammer 122, rotation of rod 502 with knob 506 repositions bolt 112 back and forth along a longitudinal axis in bolt chamber or bore 114 inside body 56 of marker 50. The maximum velocity is ready to set when knob 506 is fully unscrewed and bolt 112 is in the forward most position. Then maximum velocity setting is configured on marker 50 using main velocity adjustor 302, as previously set forth.

As knob 506 is screwed in, bolt 112 moves rearward, thereby causing port 118 to become misaligned with passage 120. The more port 118 becomes misaligned with passage 120, by adjustment of bolt 112 on the bolt and hammer connecting pin 127 through knob 506, the lower the velocity of paintballs expelled from barrel 54 will be. In addition, when bolt 112 is misaligned with passage 120, some compressed gas will be vented through feed tube 64, thereby also lowering the velocity of the paintball.

Again, similar to FIG. 18, actuator 195 (see FIG. 15) is adaptable to velocity adjustment mechanism 500. For example, in one form, actuator 195 could be housed and/or secured in the rear end portion of bolt 112, with the external threads of end portion 508 threading through actuator 195. Since the upper velocity setting, in this form, is set with main velocity adjustor 302 while bolt 112 is in the forward most position, as described above. The velocity of marker 50 can be adjusted between the upper velocity setting and lower velocity setting with actuator 195 of velocity adjustment mechanism 500 by the repositioning of bolt 112; thus, increasing or decreasing the restriction on compressed gas flow between passage 120 and port 118. Also, said adjustment of bolt 112 can still be made manually; in one form, through the adjustment of knob 506.

Further, actuator 195 can be configured pneumatically, as described above (see FIG. 15), and controlled by solenoid valve 74, connected with circuit board 66, in one form. Thus, the restriction of compressed gas flow between passage 120 and port 118 can be increased and/or decreased pneumatically, in one form, to adjust the velocity of electro-pneumatic marker 50 between said upper velocity setting and said lower velocity setting.

Figure 25:
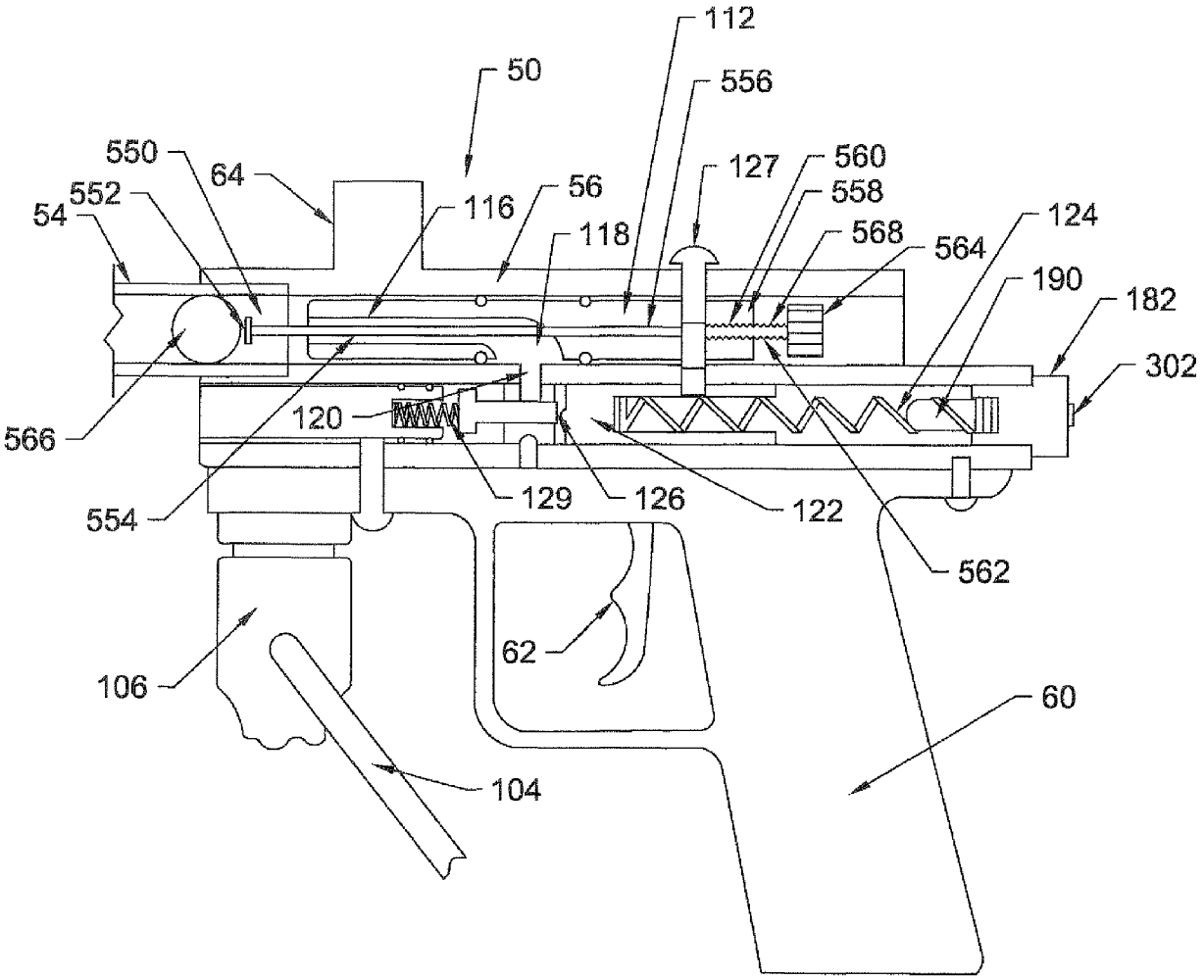
FIG. 25 illustrates a portion of a compressed gas projectile accelerator in cross-sectional form having a velocity adjustment mechanism.

Referring to FIG. 25, another representative form of marker 50 is illustrated that includes a velocity adjustment mechanism 550. In this form, velocity adjustment mechanism 550 creates controllable separation between a paintball 566 and bolt 112. Velocity adjustment mechanism 550 comprises a paintball repositioning member 552 that pushes paintballs further into barrel 54 during a firing operation. Paintball repositioning member 552 is connected with a rod 554 that passes through gas passage 116 and an aperture 556 in bolt 112. An end 558 of bolt 112 includes an internally threaded portion 560 and an end 568 of rod 554 includes an externally threaded portion 562 that threads into internally threaded portion 560. A knob 564 is connected to end 568 of rod 554 and allows adjustment of ball repositioning member 552.

Ball repositioning member 552 is configured to push a paintball 566 into barrel 54 at various depths. The further paintball 566 is pushed out of the breech into barrel 54, the greater the separation from said bolt 112, thereby the slower or less velocity paintball 566 will be expelled from barrel 54 during a firing operation. Knob 564 allows user 10 to adjust the depth at which paintball 566 is pushed into barrel 54, thereby allowing adjustment of the velocity at which paintball 566 is expelled from barrel 54 between an upper velocity setting and a lower velocity setting. As those skilled in the art would recognize, the ball repositioning member 552 is for the controllable separation of the paintball 566 from the compressed gas forces of compressed gas passage 116, of bolt 112.

Yet again, similar to FIG. 18, actuator 195 (see FIG. 15) is adaptable to velocity adjustment mechanism 550. For example, in one form, actuator 195 could be housed and/or secured in the end 558 of bolt 112, with externally threaded portion 562 of rod 554 threading through actuator 195. Since the upper velocity setting, in this form, is set with main velocity adjustor 302 while paintball repositioning member 552, of bolt 112, is in the rearward most position. The velocity of marker 50 can be adjusted between the upper velocity setting and lower velocity setting with actuator 195 of velocity adjustment mechanism 550 by the positioning of paintball 566; thus, increasing or decreasing the compressed gas forces on paintball 566.

Further, actuator 195 can be configured pneumatically, as described above (see FIG. 15), and controlled by solenoid valve 74, connected with circuit board 66, in one form. Thus, the energy to expel paintball 566 can be increased and/or decreased pneumatically, in one form, to adjust the velocity of marker 50 between said upper velocity setting and said lower velocity setting.

Referring collectively to FIGS. 24 and 25; another representative form of marker 50 is illustrated that includes a velocity adjustment mechanism, which is a combination of velocity adjustment mechanism 500 and velocity adjustment mechanism 550. Said combination velocity adjustment mechanism would position the paintball, similar to velocity adjustment mechanism 550, through longitudinal movement of the bolt 112 into barrel 54. Said representative bolt 112 would be the ball repositioning member itself; pushing paintball 566 into barrel 54 at various depths. Those skilled in the art would recognize that the represented bolt and the valve mechanism might be independent of each other; in one form, such as not including connecting pin 127. The independent movement of the bolt is more commonly associated with electro-pneumatic markers.

Figure 26:
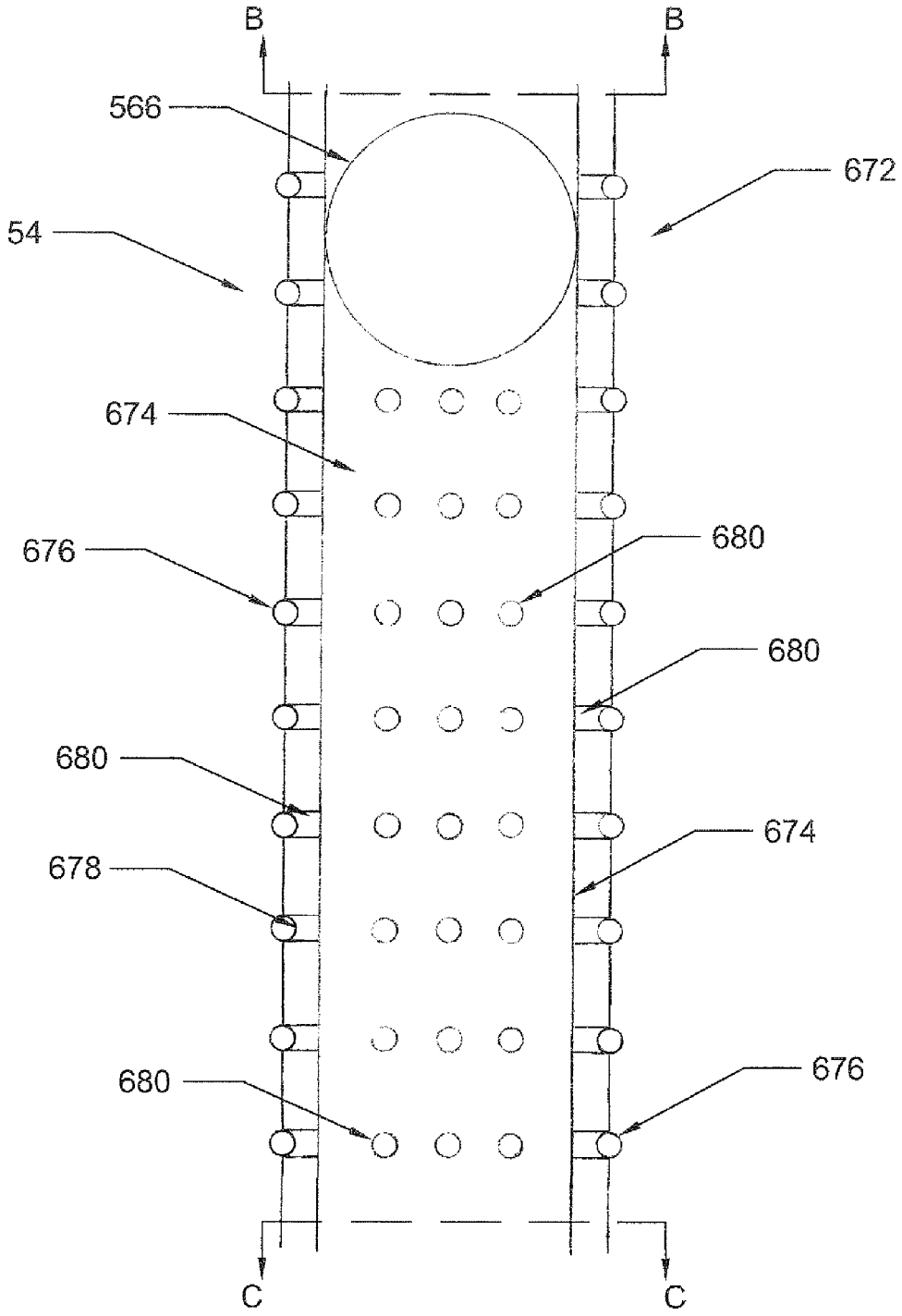
FIG. 26 illustrates a portion of a compressed gas projectile accelerator barrel in cross-sectional form having a velocity adjustment mechanism.
Figure 27:
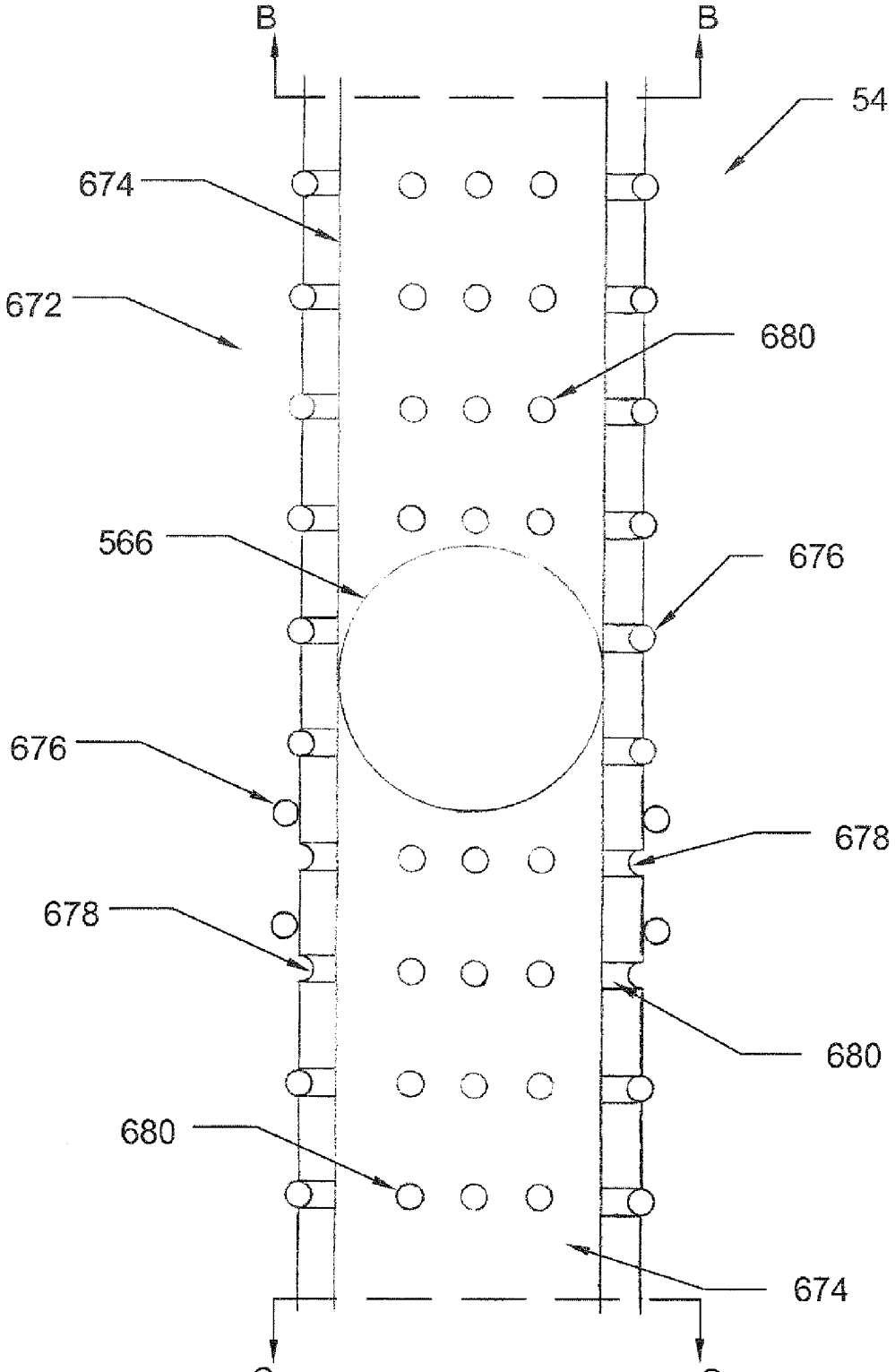
FIG. 27 illustrates a portion of a compressed gas projectile accelerator barrel in cross-sectional form having a velocity adjustment mechanism.

Referring collectively to FIGS. 7, 26, 27, and 28; yet another representative marker 50 is disclosed that includes a velocity adjustment mechanism 672. Velocity adjustment mechanism 672 includes a compressed gas venting method in barrel 54 of marker 50. FIGS. 26 and 27 depicts top cross sectional views of barrel 54 between hashes B-B to C-C in FIG. 7, for a more illustrative view of the compressed gas venting method of velocity adjustment mechanism 672. Barrel 54 includes a plurality of venting outlets or ports 680 allowing user 10 to controllably vent compressed gas behind paintball 566, as paintball 566 travels down inner bore 674 of barrel 54. Venting ports 680 are positioned, in this illustrated form, in a plurality of circular depressions or grooves 678 around the outer diameter of barrel 54. O-rings or seals 676 in barrel grooves 678 allow user 10 to controllably close and/or seal off venting ports 680. The position and the quantity of venting ports 680 that are opened allow the control of the force, of the compressed gas behind paintball 566. The ports 680 of barrel 54 that are closer to breech 79 of marker 50 or the paintball 566 starting point will permit more compressed gas venting, as would the quantity of opened venting ports 680. User 10 would start with all venting ports 680 closed and adjust marker 50 with the main velocity adjustor, as described above, to the upper velocity setting. Then user 10 can selectively adjust the velocity of paintball 566 from marker 50 between the upper velocity setting and a lower velocity setting though the selective opening of venting ports 680 in barrel 54.

Figure 28:
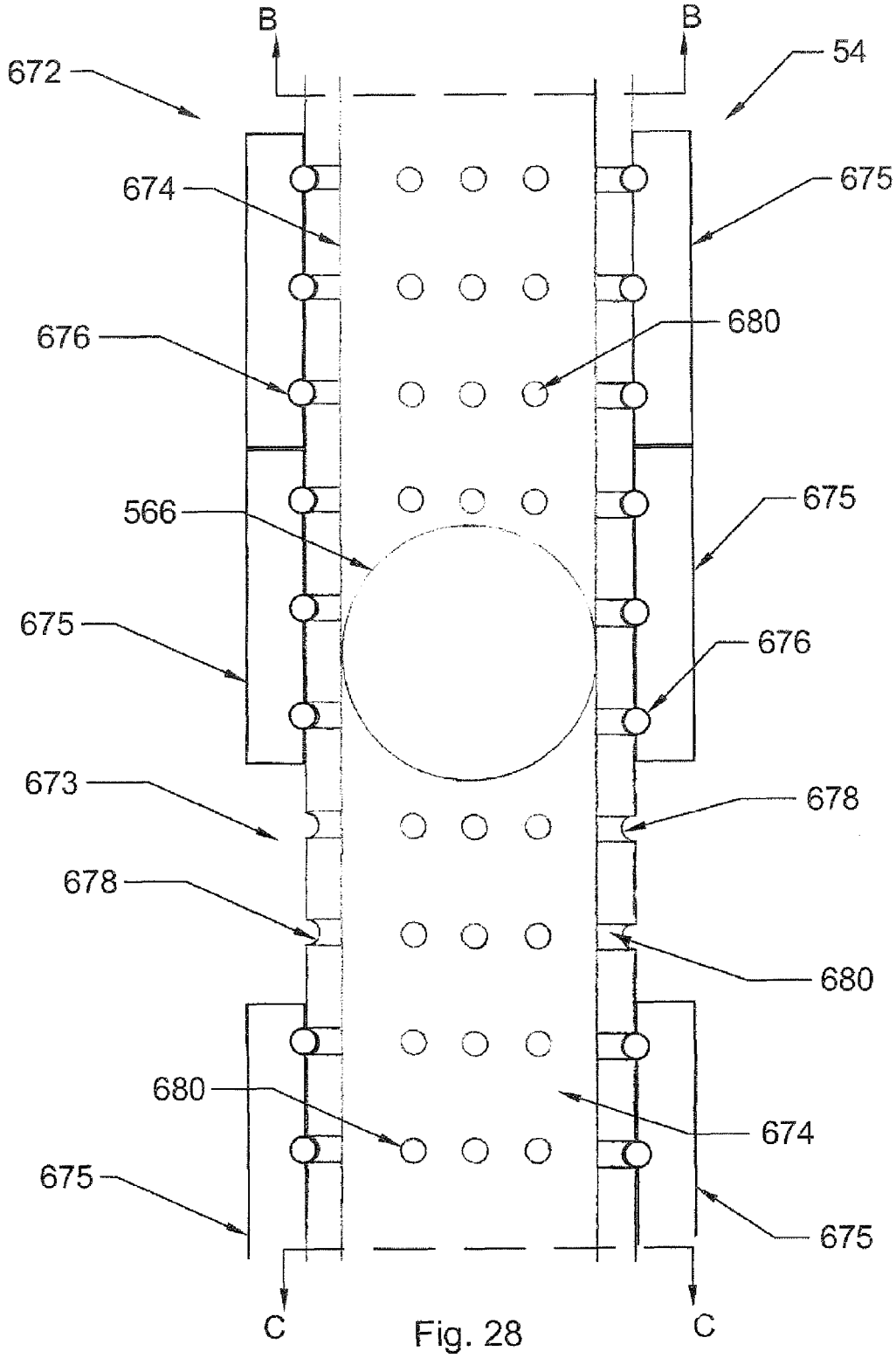
FIG. 28 illustrates a portion of a compressed gas projectile accelerator barrel in cross-sectional form having a velocity adjustment mechanism.

In another form, velocity adjustment mechanism 672 includes a compressed gas venting method in barrel 54 of marker 50, as described above. FIG. 28 also depict a top cross sectional view of barrel 54 between hashes B-B to C-C in FIG. 7. As before, barrel 54 includes a plurality of venting outlets or ports 680 allowing user 10 to controllably vent compressed gas behind paintball 566, as paintball 566 travels down inner bore 674 of barrel 54. Venting ports 680 are positioned in a plurality of circular depressions or grooves 678 around the outer diameter of barrel 54. In this form, o-rings or seals 676 are secured in slide able or positional sleeve members 675; alternatively, in another form, o-rings or seals 676 can be an integral part of sleeve members 675. Seals 676 are situated in movable sleeve members 675, to allow seals 676 to fit into barrel depressions 678, there by sealing off venting ports 680. User 10 would start with sleeve members 675 positioned so that seals 676 close all venting ports 680, then user 10 can adjust marker 50 with the main velocity adjustor 302 to the upper velocity setting, as described above. Subsequently, user 10 can selectively slide sleeve members 675 to open selected venting ports 680. In one form, user 10 can fully open selected venting ports 680 producing an opening or venting gap 673; in another form, user 10 can semi open selected venting ports by slightly moving sleeve members 675, there by creating a vent chamber between the o-rings or seals 676. Therefore, user 10 can selectively adjust the velocity of paintball 566 from marker 50 between the upper velocity setting and a lower velocity setting through the selective opening of venting ports 680 with sleeve members 675 of barrel 54.

Figure 29A:
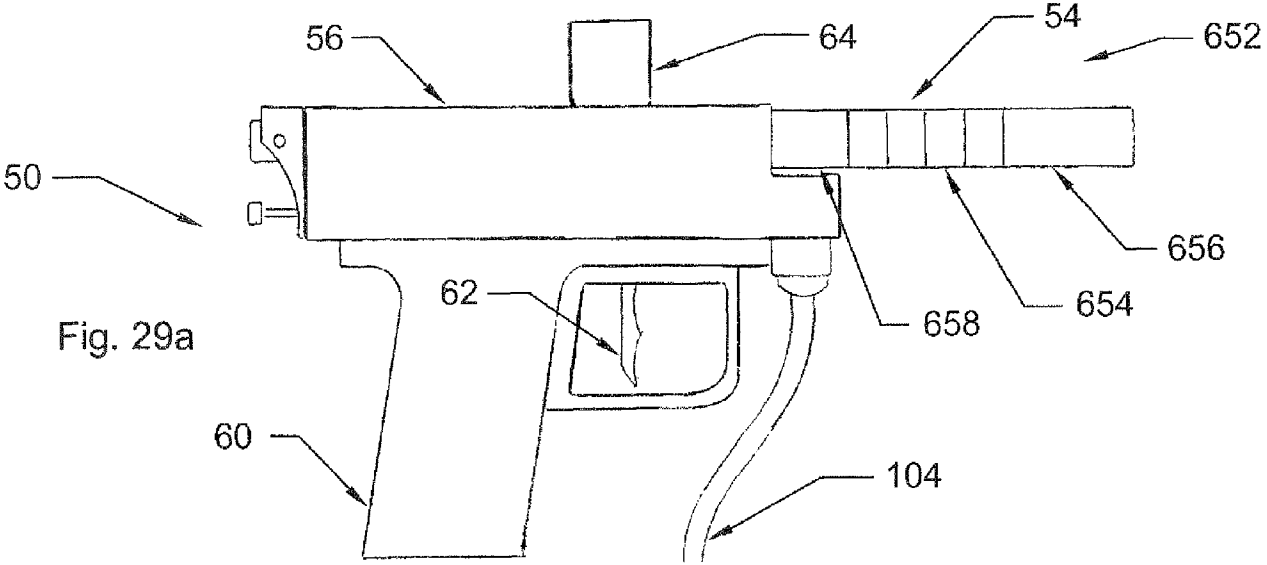
FIG. 29*a* illustrates a side view of a compressed gas projectile accelerator including a barrel having a velocity adjustment mechanism.
Figure 29B:
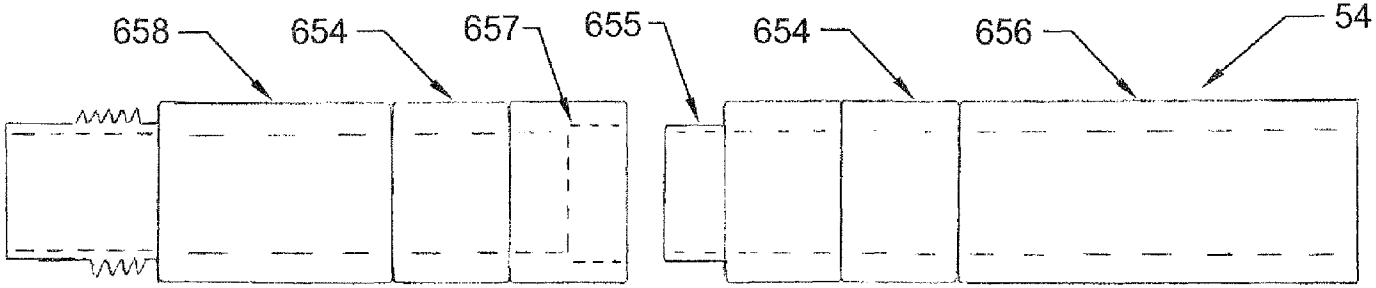
FIG. 29*b* illustrates a side view of a compressed gas projectile accelerator barrel including a velocity adjustment mechanism.

Referring collectively to FIG. 29*a*-29*b*, another representative form of marker 50 is illustrated that includes a velocity adjustment mechanism 652. In this form, portions of barrel 54 are added or removed to control the velocity of marker 50 between the upper velocity setting and the lower velocity setting. User 10 would set the upper velocity setting on marker 50 with the main velocity adjustor, as described above, and with all barrel 54 portions connected. Said portions or components of barrel 54 include starting or base component 658, a plurality of velocity adjustor or spacer components 654, and an end or tip component 656. In this illustrated form, barrel components are connected by joining the male ends 655 of said barrel components with female ends 657 of other barrel components. User 10 with upper velocity set on marker 50 and a fully assembled barrel 54, can now selectively remove adjustor components 654 from base component 658 to lower the velocity of marker 50 toward and/to the lower velocity setting. This is because the compressed gas propelling the paintball down the barrel 54 loses its effectiveness on shorter and shorter barrel lengths as more compressed gas escapes around the paintball when it exits a shortened barrel 54 before utilizing its full propelling force. Thus user 10 can adjust the velocity of marker 50 with velocity adjustment mechanism 652, by adding or removing a plurality of velocity adjustor components 654, between said upper velocity setting and said lower velocity setting.

Figure 30A:
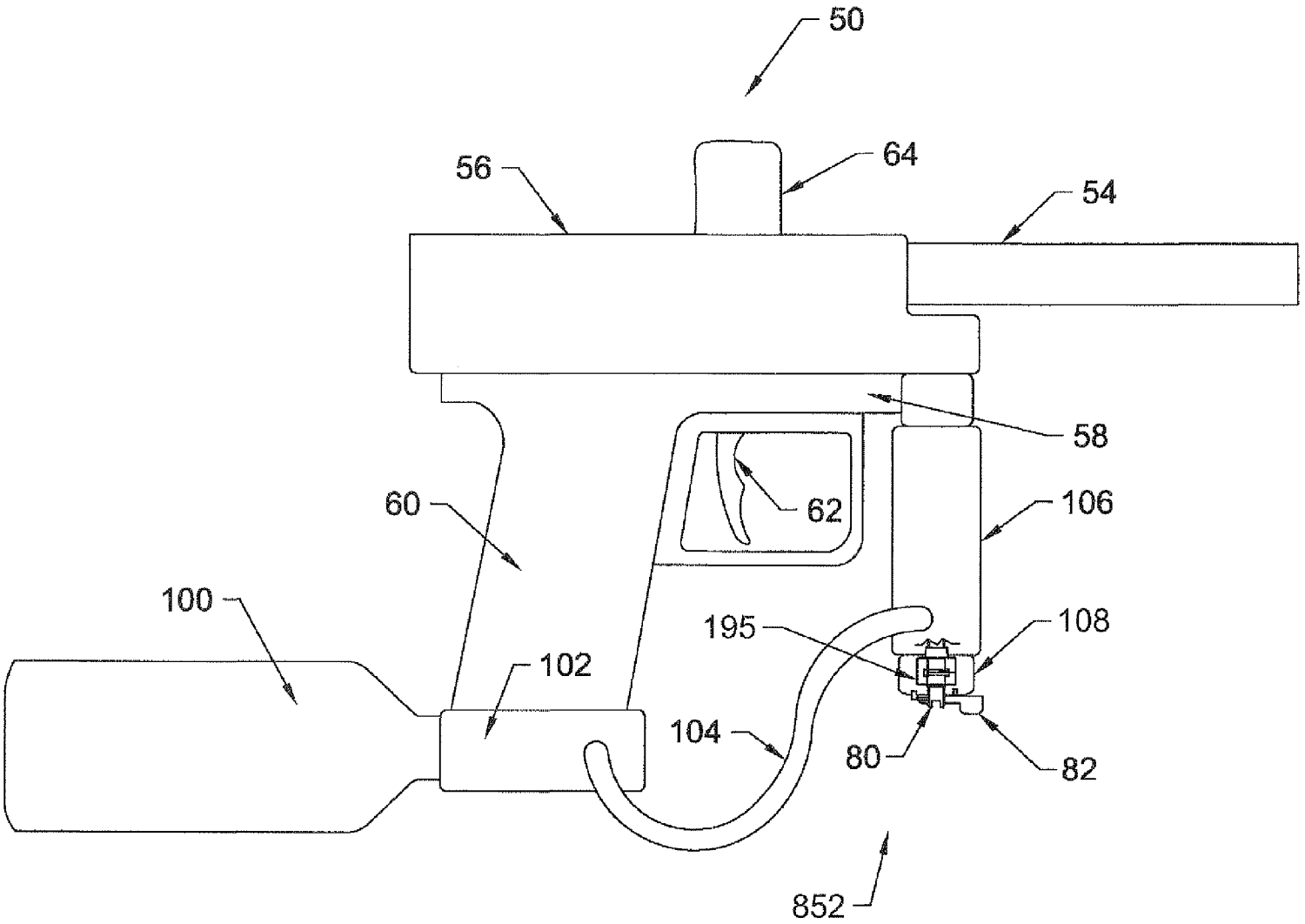
FIG. 30*a* illustrates a side view of a compressed gas projectile accelerator including an assisted velocity adjustment mechanism in cross-sectional form.
Figure 30B:
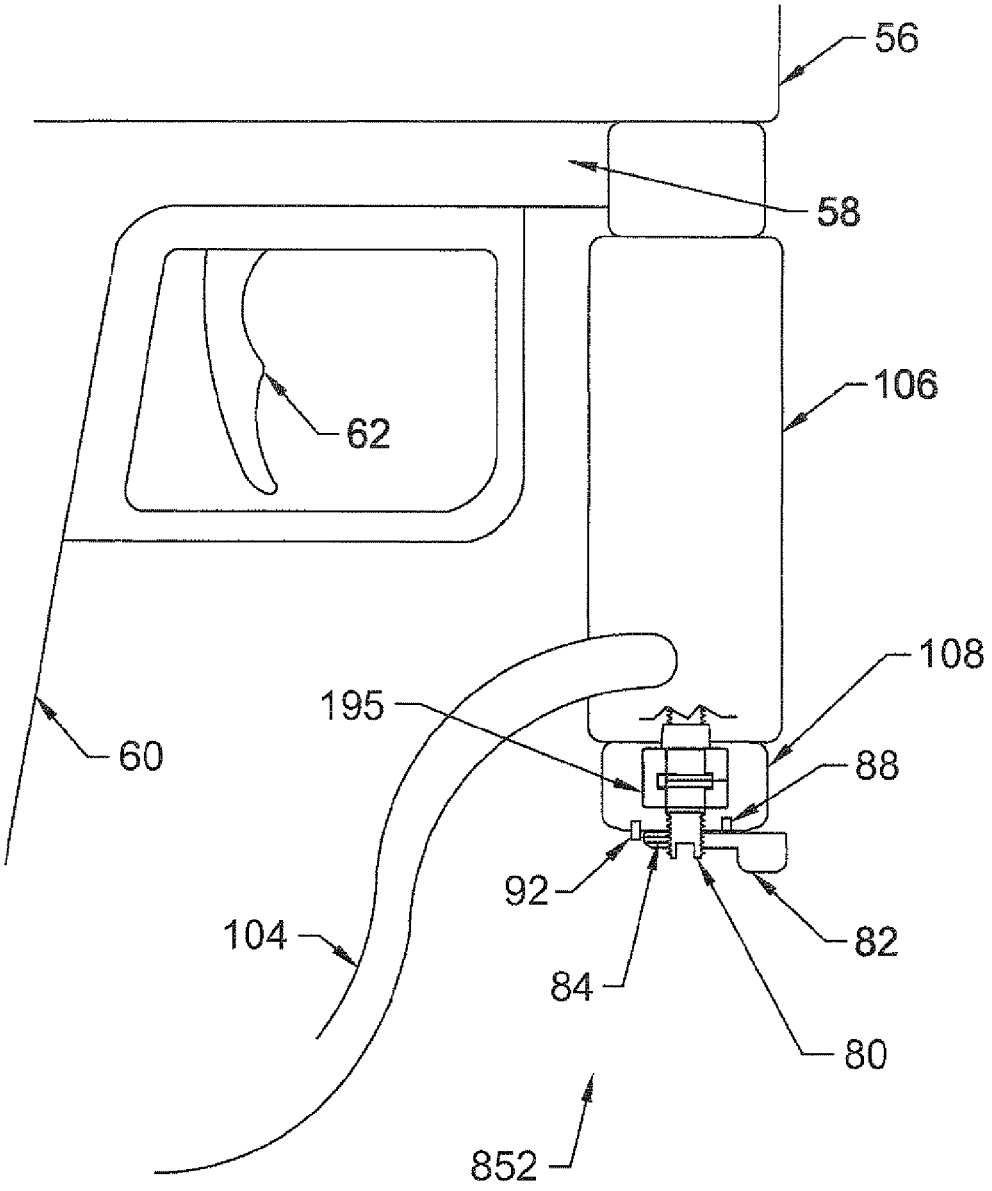
FIG. 30*b* illustrates a portion of a compressed gas projectile accelerator including an assisted velocity adjustment mechanism in cross-sectional form.

Referring collectively to FIGS. 30*a* and 30*b*, a representative form of marker 50 is illustrated that includes a pressure regulator 106. Pressure regulator 106 controls and/or regulates the compressed gas of marker 50, in one form, the compressed gas is used to expel projectiles from barrel 54 of marker 50. As illustrated, in one form, compressed gas is supplied to pressure regulator 106 through gas line 104 from connected compressed gas source 100. Yet, in another form, the compressed gas from compressed gas source 100 is supplied to pressure regulator 106 internally through grip frame 60, grip frame rail 58, and/or body 56 of marker 50. In one form, Pressure regulator 106 can adjust, control and/or regulate the compressed gas of marker 50 by controlling and/or regulating the aspects, qualities, and/or characteristics of the compressed gas used, such as, the volume, pressure, flow, flow rate, storage area, timed released, and/or temperature of the compressed gas.

In one representative form, pressure regulator 106 of marker 50 is configured to comprise velocity adjustment mechanism 852. In one form, velocity adjustment mechanism 852, being similar to velocity adjustment mechanism 52 of FIG. 8, is configured as an integral part of pressure regulator 106. In another form, velocity adjustment mechanism 852 is an additional and/or supplementary member or component to a pressure regulator 106 of marker 50. For example, end cap or housing 108 of FIG. 30*a* can be an alternate or substitution for adjustment knob 108 of FIG. 7. Although illustrated as being housed in end cap 108 it should be appreciated that velocity adjustment mechanism 852 can be housed in other locations of pressure regulator 106 or marker 50.

Velocity adjustment mechanism 852 of pressure regulator 106 includes a main velocity adjustor 80. In this form, main velocity adjustor 80 is used to set the maximum or upper velocity setting, of marker 50, through the adjustment of the compressed gas, as described above. Main velocity adjustor 80 can be adjusted by actuator 195 (see FIG. 15), in one form, or adjusted manually through allen head screw end, as described above (see FIG. 6*a*-6*c*), in another form.

Again, as illustrated in FIGS. 6*a*-6*c* and FIG. 15, this form can include an adjustment device 82 (e.g.—a selector lever). Once main velocity adjustor 80 has been set to expel projectiles at an upper velocity level or setting, selector 82 can be connected with or adjusted on main velocity adjustor 80. In one form, end cap 108 includes apertures 88. As with the forms disclosed in FIGS. 6*a*-6*c*, pins or set screws 90 and 92 can be positioned in apertures 88 to ensure that selector 82 cannot be adjusted above the upper velocity setting or below the minimum or lower velocity setting. See FIGS. 6*a*-6*c*. Set screw 84 is used to secure selector 82 to main velocity adjustor 80. Adjustment device 82 can be, in one form, a manual velocity adjustor or over riding velocity adjustor. Further in one form, selector 82 secured to main velocity adjustor 80 will hit or bump up against pins 90 and 92, as described above (see FIG. 6*a*-6*c*); and prevent the adjustment of main velocity adjustor 80 by motor/actuator 195 beyond the upper and lower velocity settings.

Still further, in another form, velocity adjustment mechanism 852 of pressure regulator 106, can be configured to include situational connectors 44 and 45 (see FIG. 6*b*) connected with circuit board 66 (see FIG. 5). In one form, circuit board 66 knowing the position of main velocity adjustor 80 and selector 82, through connectors 44 and 45, can adjust or actuate main velocity adjustor 80 and selector 82 between the upper and lower velocity settings. Therefore, user 10 can set the upper actuation limit and the lower actuation limit for actuator 195 through circuit board 66, thereby setting the upper velocity setting and the lower velocity setting.

Also, in another form, actuator 195 can be configured with a positional sensor that determines the respective positions of main velocity adjustor 80, and the degrees of actuation of actuator 195 and/or main velocity adjustor 80. Thus, actuator 195, with the incorporated positional sensor, in one form, would not adjust the velocity of marker 50 beyond the upper velocity setting and lower velocity setting, as set by user 10. In one form, user 10 can set the upper and lower velocity setting or limit, for actuator 195, through circuit board 66 with controls 77 and/or velocity controller 76 (see FIG. 5), as described above. In another form, velocity adjustment mechanism 852 of pressure regulator 106, connected with circuit board 66, can be configured with pressure sensor 46 (see FIG. 5). Circuit board 66 in communication with pressure sensor 46 can adjust or control one or more operating parameters of pressure regulator 106, of marker 50. For example, user 10 sets the upper velocity setting and lower velocity setting for marker 50 with controls 77 and/or velocity controller 76, connected with circuit board 66, which is connected with pressure sensor 46. Circuit board 66 knowing the operation pressure or its determined value, of the compressed gas of marker 50, for the upper velocity setting and the lower velocity setting, would only adjust actuator 195 between those determined pressures and/or values.

Also, circuit board 66 in communication with pressure sensor 46, can adjust actuator 195 to lower the velocity and/or operational pressure of marker 50, such as, when the gas pressure of marker 50 and/or pressure regulator 106 exceeds a preset safety limit, or the velocity of marker 50 exceeds the upper velocity setting. In one form, speed sensor 72 connected with circuit board 66 (see FIG. 5), can determine, analyze and/or verify the velocity of an expelled paintball, respective to a determined value of pressure sensor 46, a selected velocity setting, and/or the adjustment of main velocity adjustor 80 through actuator 195 of pressure regulator 106.

All of the features discussed above with reference to FIG. 5, FIGS. 6*a*-6*c*, and FIG. 15 are hereby incorporated by reference into the representative forms set forth in FIGS. 30*a* and 30*b*. Also, those skilled in the art would recognize that marker 50 can be configured with a plurality of pressure regulators with electric and/or pneumatic adjustment mechanisms, such as, velocity adjustment mechanism 852. For example, many paintball markers of today are configured with a plurality of pressure regulators; such as, a pressure regulator to control the force or velocity at which the paintball is expelled and a pressure regulator to control the pressure of compressed gas that is used to operate the marker's functions.

Figure 30C:
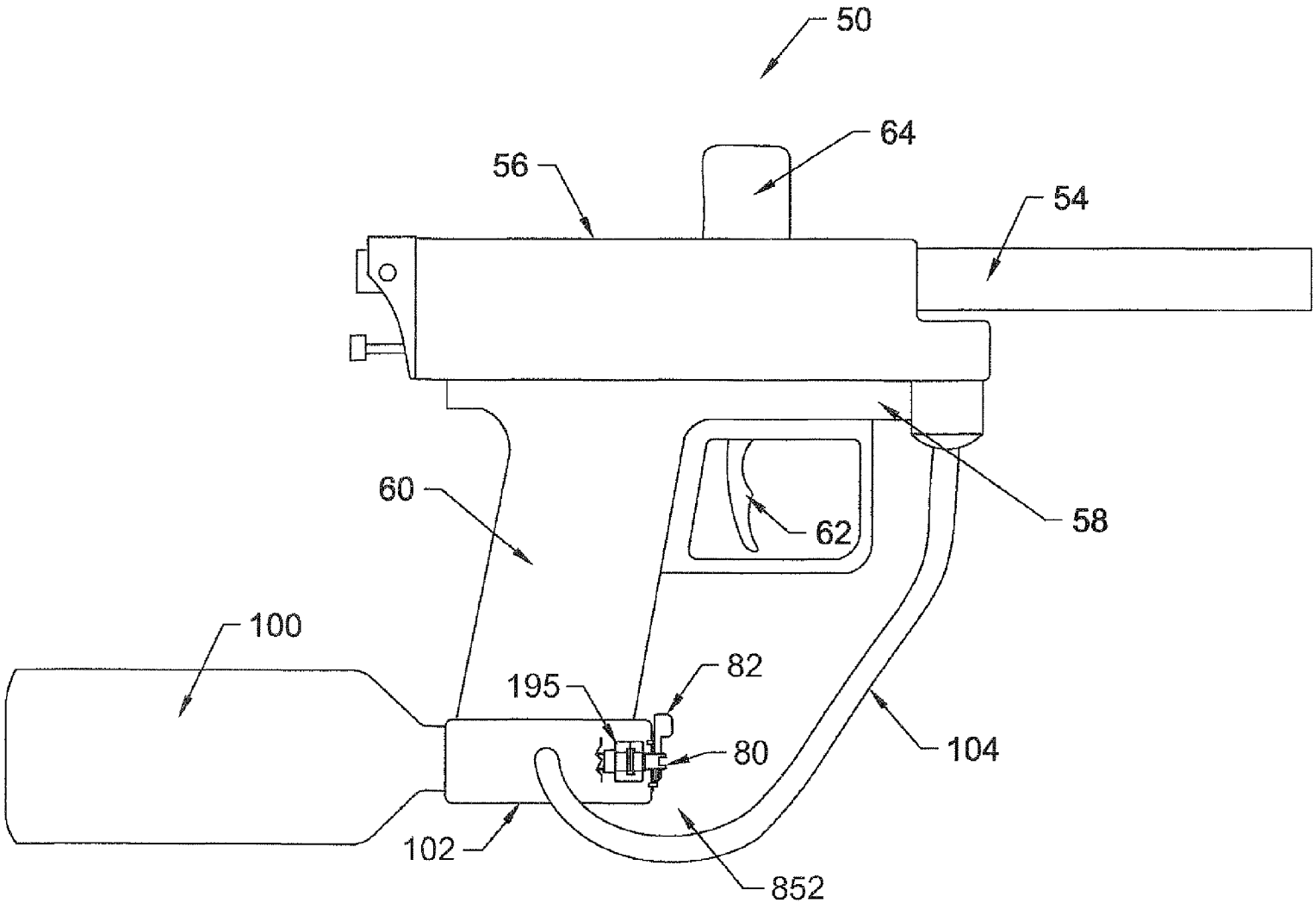
FIG. 30*c* illustrates a side view of a compressed gas projectile accelerator including an assisted velocity adjustment mechanism in cross-sectional form.
Figure 30D:
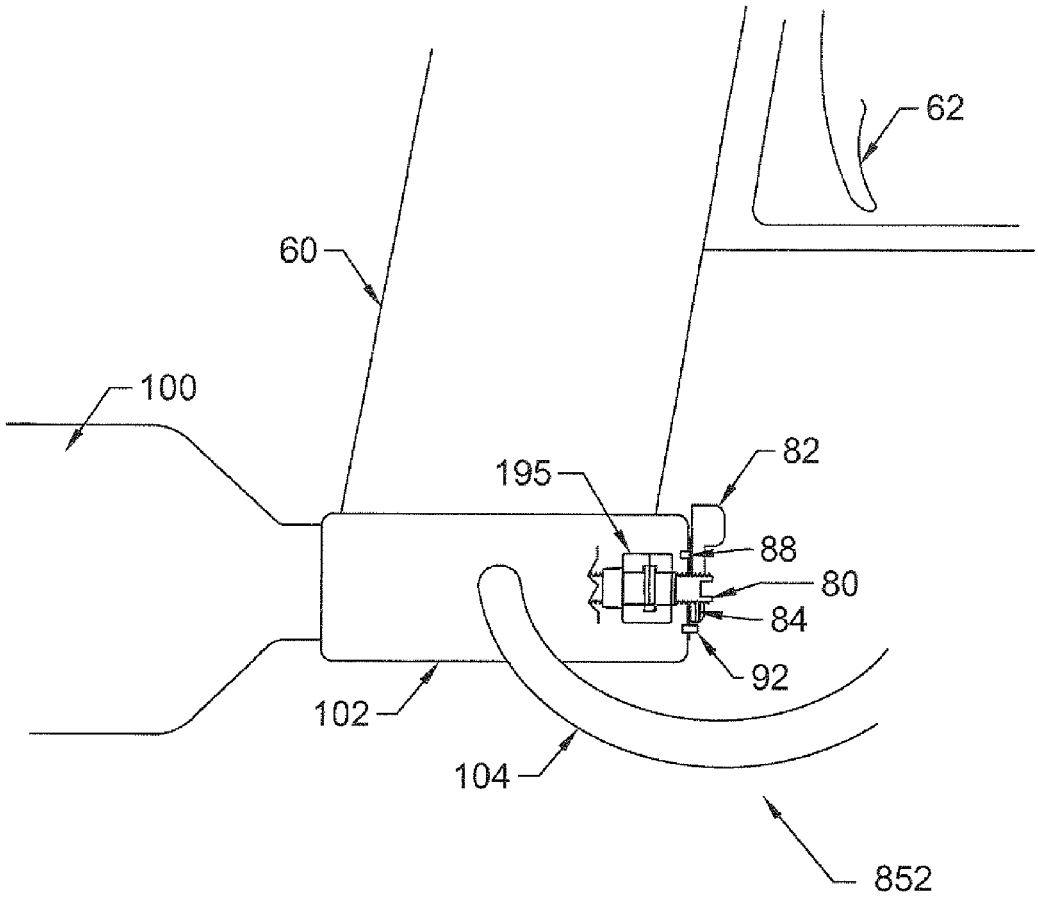
FIG. 30*d* illustrates a portion of a compressed gas projectile accelerator including an assisted velocity adjustment mechanism in cross-sectional form.
Figure 31A:
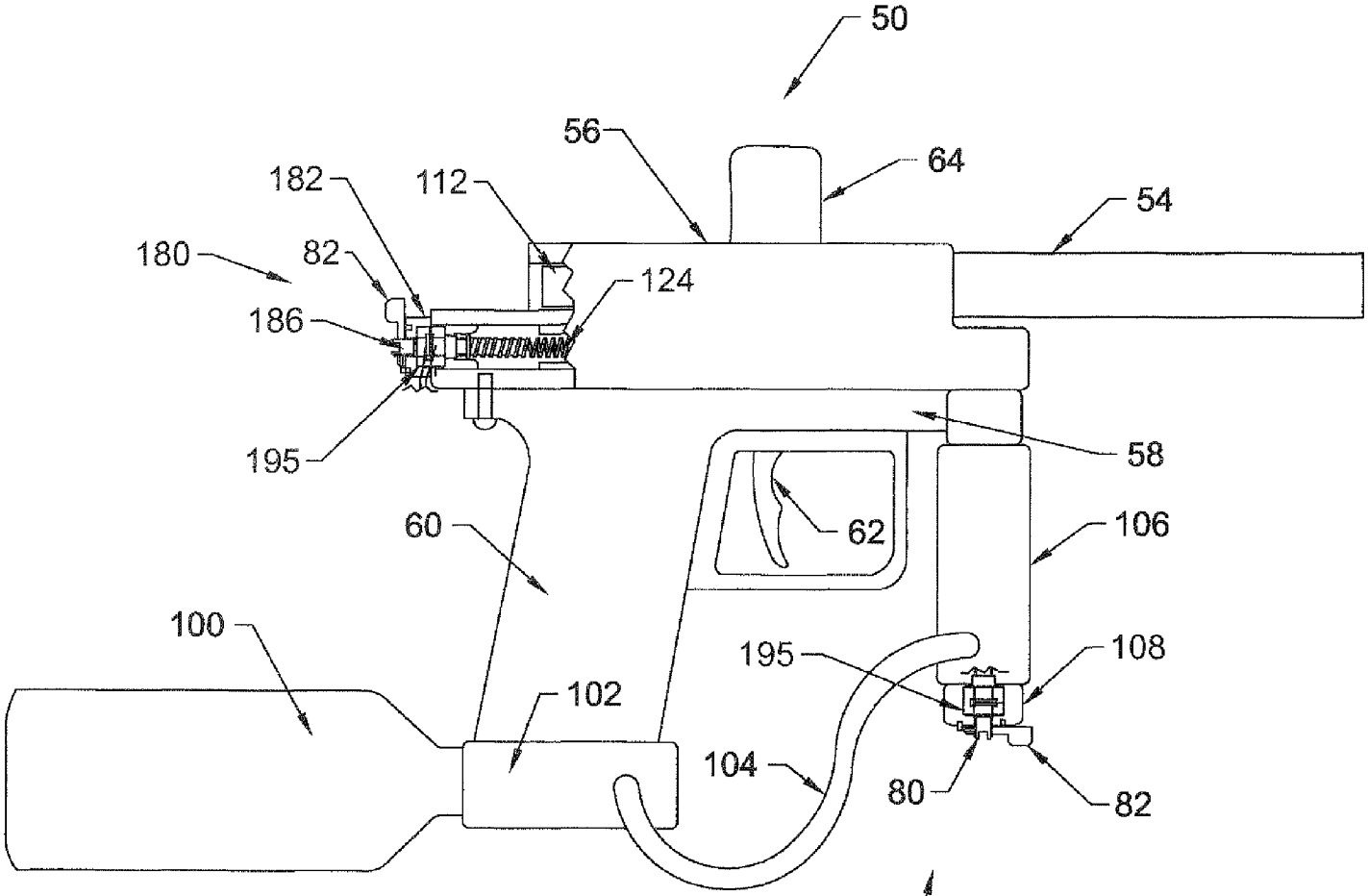
FIG. 31*a* illustrates a side view of a compressed gas projectile accelerator including assisted velocity adjustment mechanisms in cross-sectional form.
Figure 31B:
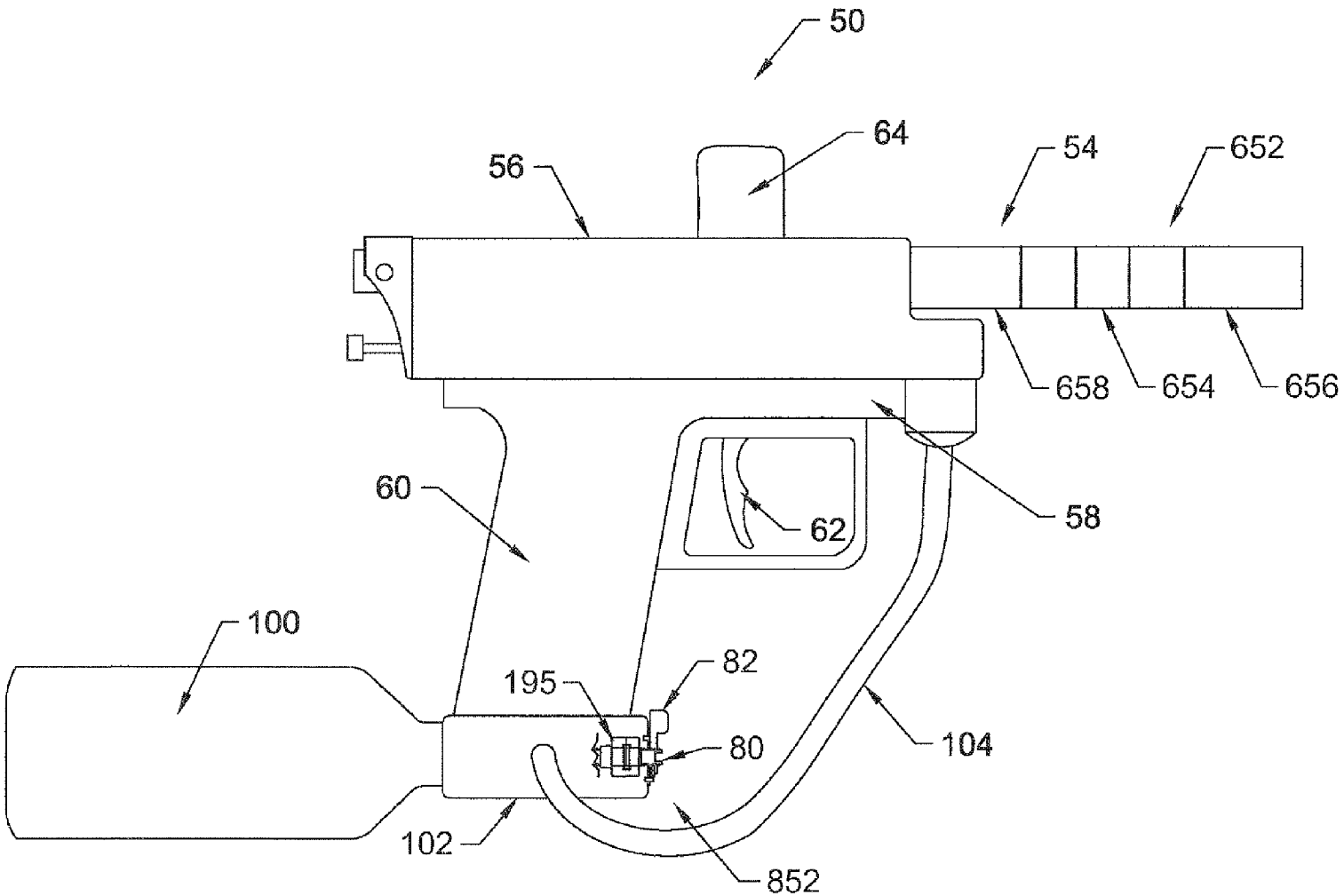
FIG. 31*b* illustrates a side view of a compressed gas projectile accelerator having a velocity adjustment mechanism barrel and an assisted velocity adjustment mechanism in cross-sectional form.
Figure 31C:
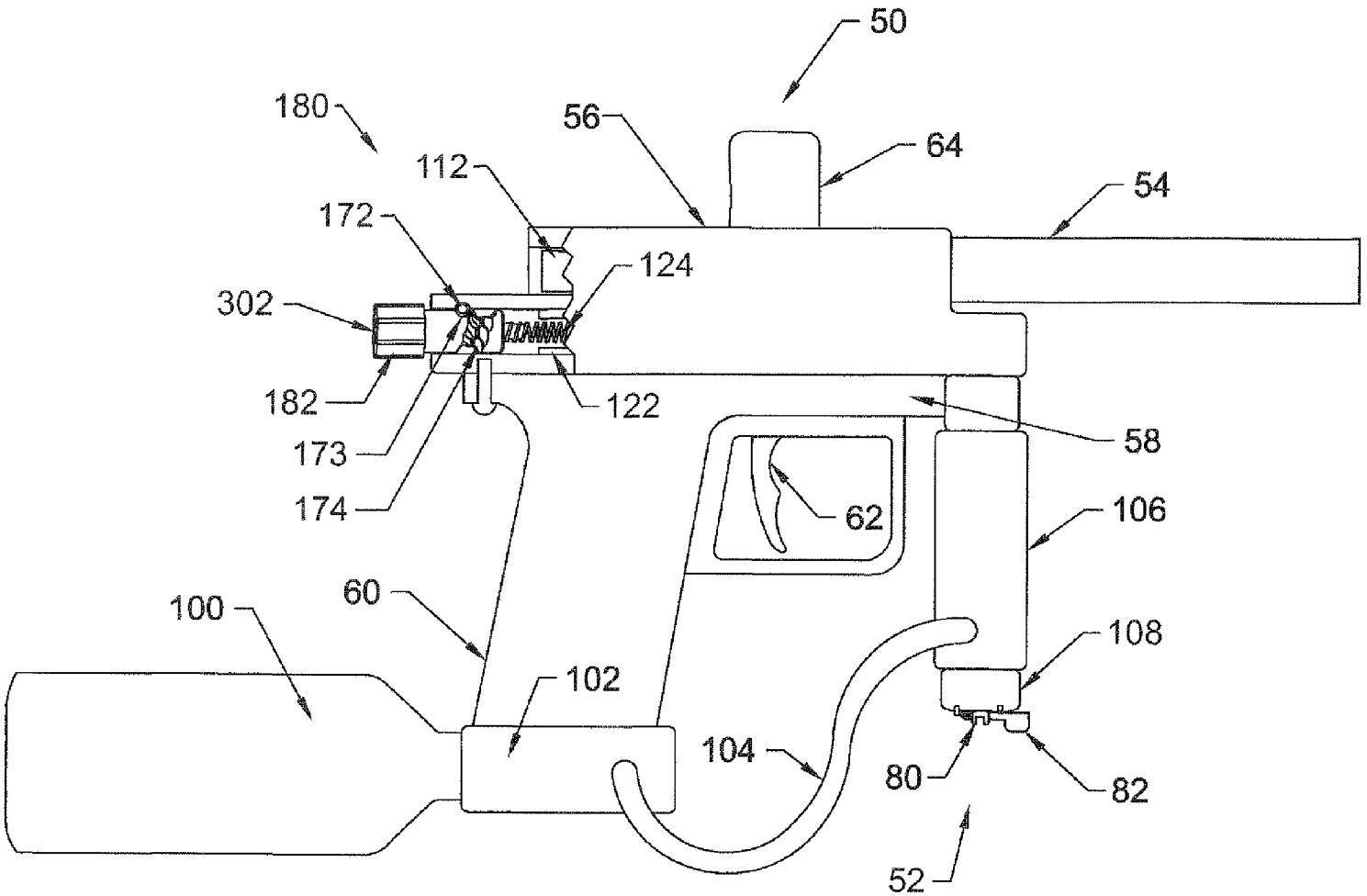
FIG. 31*c* illustrates a side view of a compressed gas projectile accelerator including velocity adjustment mechanisms, one in cross-sectional form.
Figure 31D:
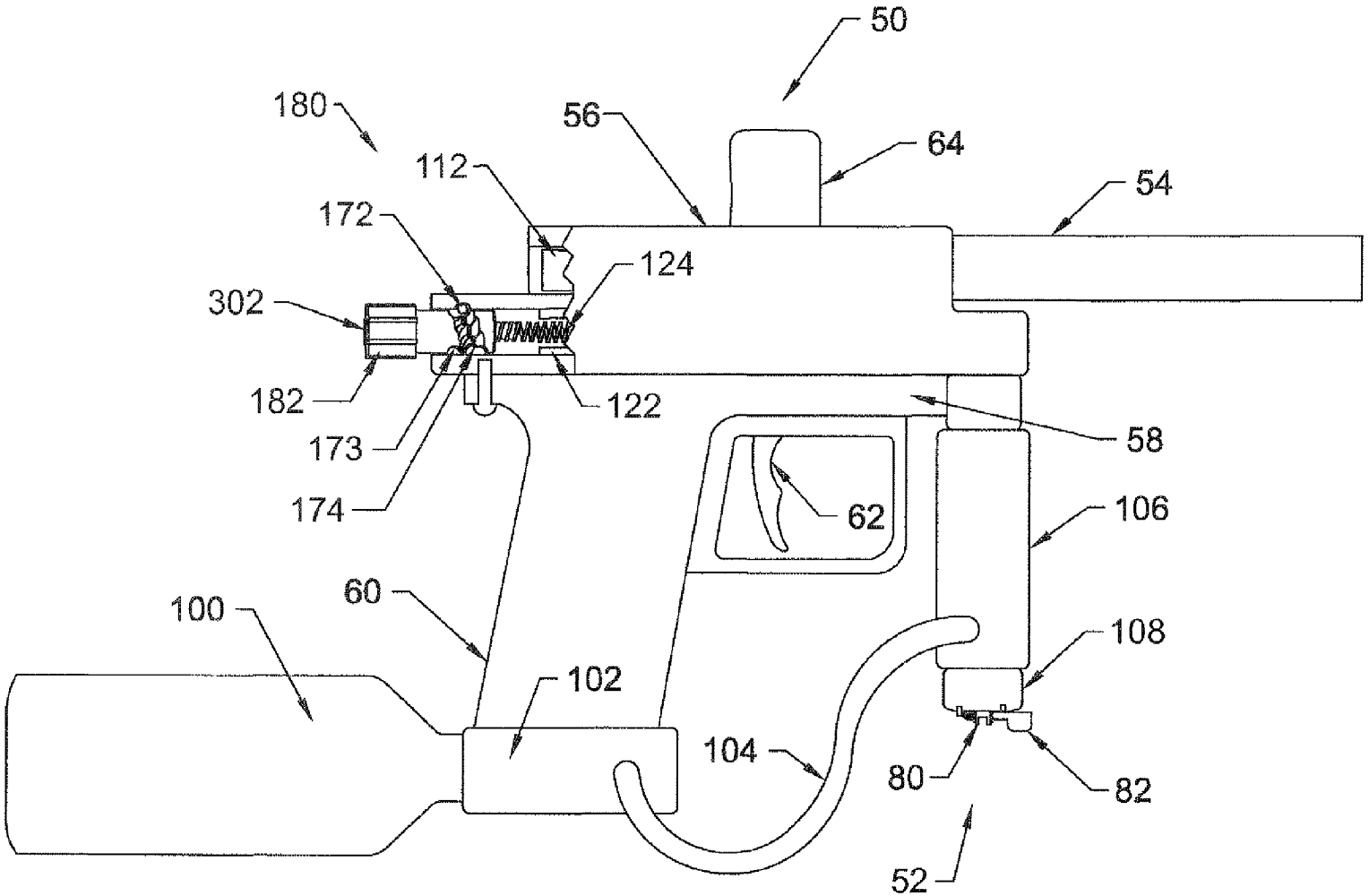
FIG. 31*d* illustrates a side view of a compressed gas projectile accelerator including velocity adjustment mechanisms, one in cross-sectional form.
Figure 31E:
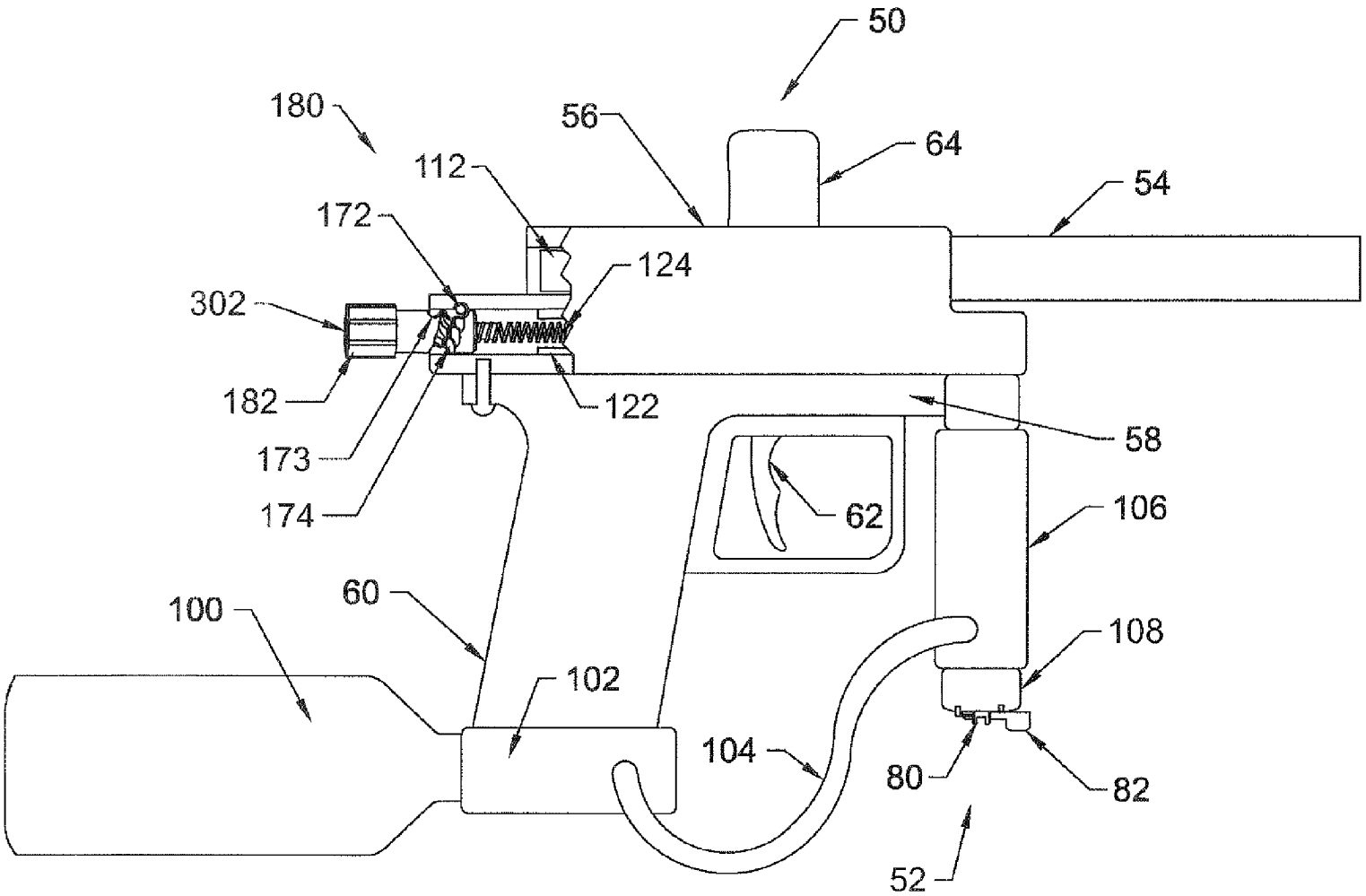
FIG. 31*e* illustrates a side view of a compressed gas projectile accelerator including velocity adjustment mechanisms, one in cross-sectional form.

Referring collectively to FIGS. 30*c* and 30*d*, another representative form of marker 50 is illustrated that includes a velocity adjustment mechanism 852, that is, in connection or relationship with, the compressed gas source 100, through compressed gas adapter 102, in one form. In another form, velocity adjustment mechanism 852 can be configured into or part of compressed gas source 100 itself, such as, many of the compressed gas sources or tanks sold today. Some of these tanks or sources are controlled or regulated with an attached external regulator, while others are configured with an internal regulator. Still other tanks or sources, attach to an adapter, such as illustrated compressed gas adapter 102. Thus, an electric and/or a pneumatic controlled velocity adjustment mechanism, such as velocity adjustment mechanism 852, can be configured internally into, externally onto, and/or in connection with a compressed gas source or tank 100. Again, for the sake of brevity, all of the features discussed above with reference to FIG. 5, FIGS. 6*a*-6*c*, FIG. 15, and FIGS. 30*a*-*b* are hereby incorporated by reference into the representative forms set forth in FIGS. 30*c* and 30*d*.

Further, those skilled in the art would also recognize that pressure regulators with electric and/or pneumatic adjustment mechanisms, such as, those representatively illustrated in FIGS. 30*a* to 30*d*, would allow a user to retrofit many paintball markers sold to date with a velocity adjustment that allowed the user to expel paintballs between an upper velocity setting and a lower velocity setting, as set forth in greater detail below.

Referring collectively to FIGS. 31*a* to 31*e*, in this form, representative marker 50 can include a plurality of velocity adjustment mechanisms. As described above, marker 50 can include a primary or main velocity adjustor (i.e.—main velocity adjustor 302, main velocity adjustor 80, main velocity adjustor 186, etc.) and a secondary velocity adjustor (i.e.—selector lever 82, adjustment mechanism 110, adjustment mechanism 180, adjustment mechanism 200, adjustment mechanism 250, etc). Further, as described above, marker 50 can include an additional adjustment mechanism, such as actuator 195, to the primary velocity adjustor or to a secondary velocity adjustor. Even though, also described above, markers of today can be configured with a plurality of different adjustment means or mechanisms, such as, a regulator to control tank pressure (i.e.—compressed gas adapter 102), vertical regulator to control expelling pressure (i.e.—pressure regulator 106), main velocity adjustor 302, etc.; still markers of today are configured to be used or played with at one velocity setting, an upper velocity setting.

As representatively illustrated in FIG. 31*a*-*e*, marker 50 can be configured with a plurality of velocity adjustment mechanisms or means that allow a user 10 to further adjust or finely adjust the velocity setting(s) of marker 50, between an upper velocity setting and a lower velocity setting. For example, see FIG. 31*a*, marker 50 can be configured with velocity adjustment mechanism 852 (see FIG. 30*a*-*b*) and velocity adjustment mechanism 180 (see FIG. 15). In a further example, see FIG. 31*b*, marker 50 can be configured with velocity adjustment mechanism 652 (see FIG. 29*a*-*b*) and velocity adjustment mechanism 852 (see FIG. 30*c*-*d*).

Further still, user 10 can configure one velocity adjustment mechanism for one purpose and/or function, while configuring an additional velocity adjustment mechanism for another purpose and/or function. For example, see FIG. 31 *c*-*e*, marker 50 can be configured with velocity adjustment mechanism 52, that adjusts the pressure and/or volume of compressed gas used by marker 50, and with velocity adjustment mechanism 180, that adjusts the force or tension of hammer spring 124, there by adjusting the timing of valve 126 (see FIGS. 14 and 16). In the above illustrative form, velocity adjustment mechanism 180 adjusts the force, speed, and/or time hammer 122 activates or interacts with valve 126, through the tension and/or force of hammer spring 124. In the above representative form, spring end cap 182 is held or retained in body 56 with body/cap pin 172. End cap 182 includes cam or progressive thread and/or surfaces 174 that allow the adjustment of end cap 182 and spring 124, while still being held or retained in body 56 with body/cap pin 172, such as, an intermediate velocity position and/or setting illustrated in FIG. 31*d* or a lower velocity position and/or setting illustrated in FIG. 31*e*. Also, in one form, adjusting end cap 182, of velocity adjustment mechanism 180, can include non-adjusting positions or surfaces 173, that do not allow the adjustment of end cap 182, as in restrictive tournaments (see FIG. 31*c*).

Also, in another representative form, user 10 can configure one velocity adjustment mechanism for a segment or portion of a purpose and/or function, while configuring an additional velocity adjustment mechanism for another segment or portion of a purpose and/or function. For example, one velocity adjustment mechanism can be configured to adjust marker 50 quickly in 20 FPS increments, while another velocity adjustment mechanism can be configured to finely adjust marker 50 in 5 FPS increments. Also, one velocity adjustment mechanism can be configured to adjust marker 50 through the upper half of the velocity settings, while another velocity adjustment mechanism can be configured to adjust marker 50 through the lower half of the velocity settings, of the velocity settings falling between the upper velocity setting and the lower velocity setting (i.e.—300 FPS to 220 FPS for one velocity adjustment mechanism and 219 FPS to 140 FPS for another velocity adjustment mechanism). Further, for example, one velocity adjustment mechanism can be configured to adjust the velocity settings of marker 50 in a lobbing mode, while another velocity adjustment mechanism can be configured to adjust the velocity settings of marker 50 in an energy saving mode, as set forth in greater detail below.

Also, a plurality of velocity adjustment mechanisms or means can be combined into a single velocity adjustment mechanism or means that is multi functional. For example, see FIG. 14, hammer spring end cap 182 can be threadably connected with body 56, thus hammer spring end cap 182 can be configured as a velocity adjustment mechanism to lessen the spring force of hammer spring 124, similar to velocity adjustor 252 in FIG. 17 or velocity adjustor 180 in FIG. 31*d-e*; while still being configured with lever 82 of velocity adjustment mechanism 180 (see FIG. 14). There by allowing one velocity adjustment mechanism or means to adjust the velocity setting of marker 50 for one purpose while allowing the other velocity adjustment mechanism or means to adjust the velocity setting of marker 50 for another purpose, as described above, although being configured and/or housed in a single unit or member.

Figure 32:
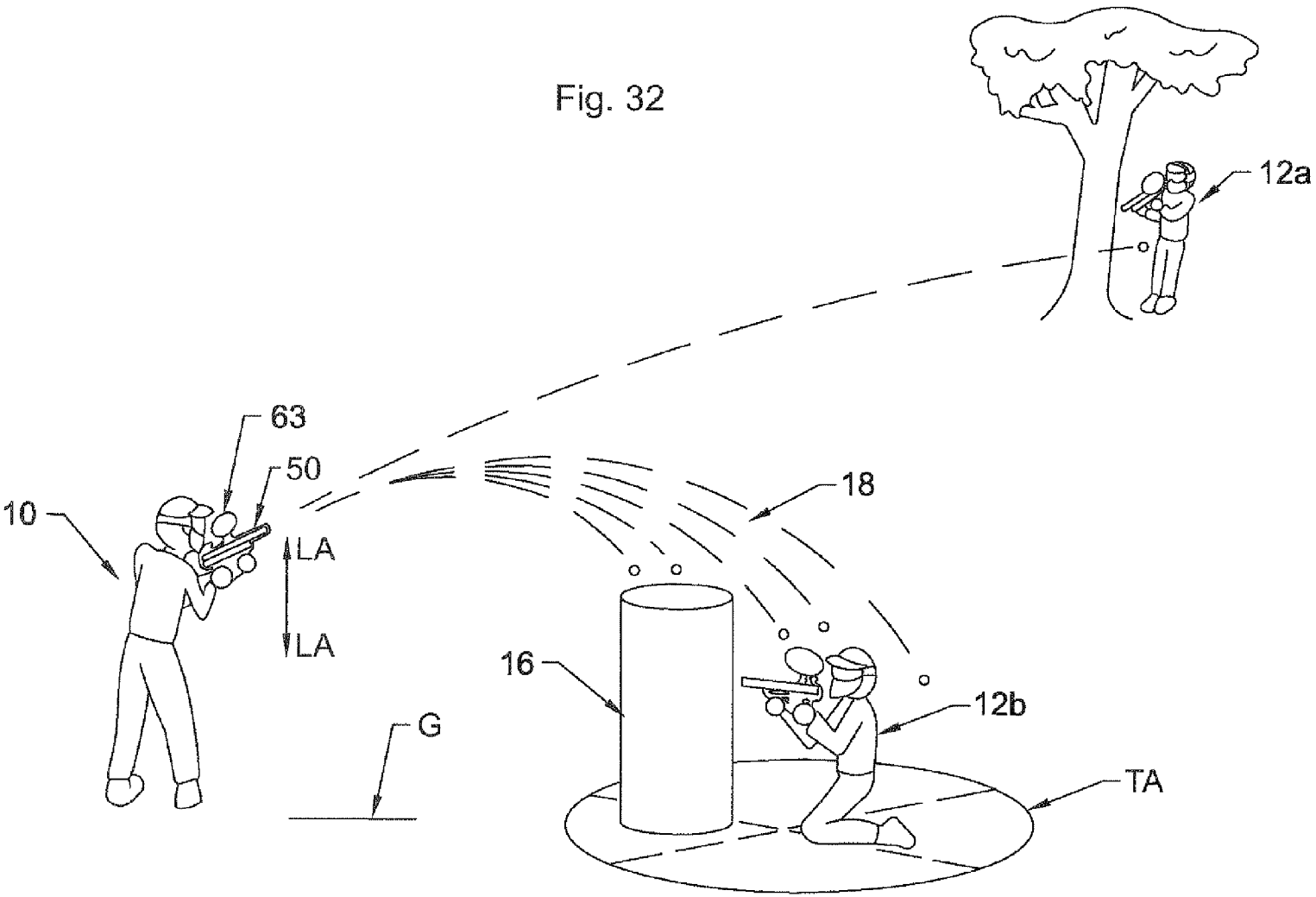
FIG. 32 illustrates a player shooting projectiles at targets on a paintball playing field using a compressed gas projectile accelerator.
Figure 33:
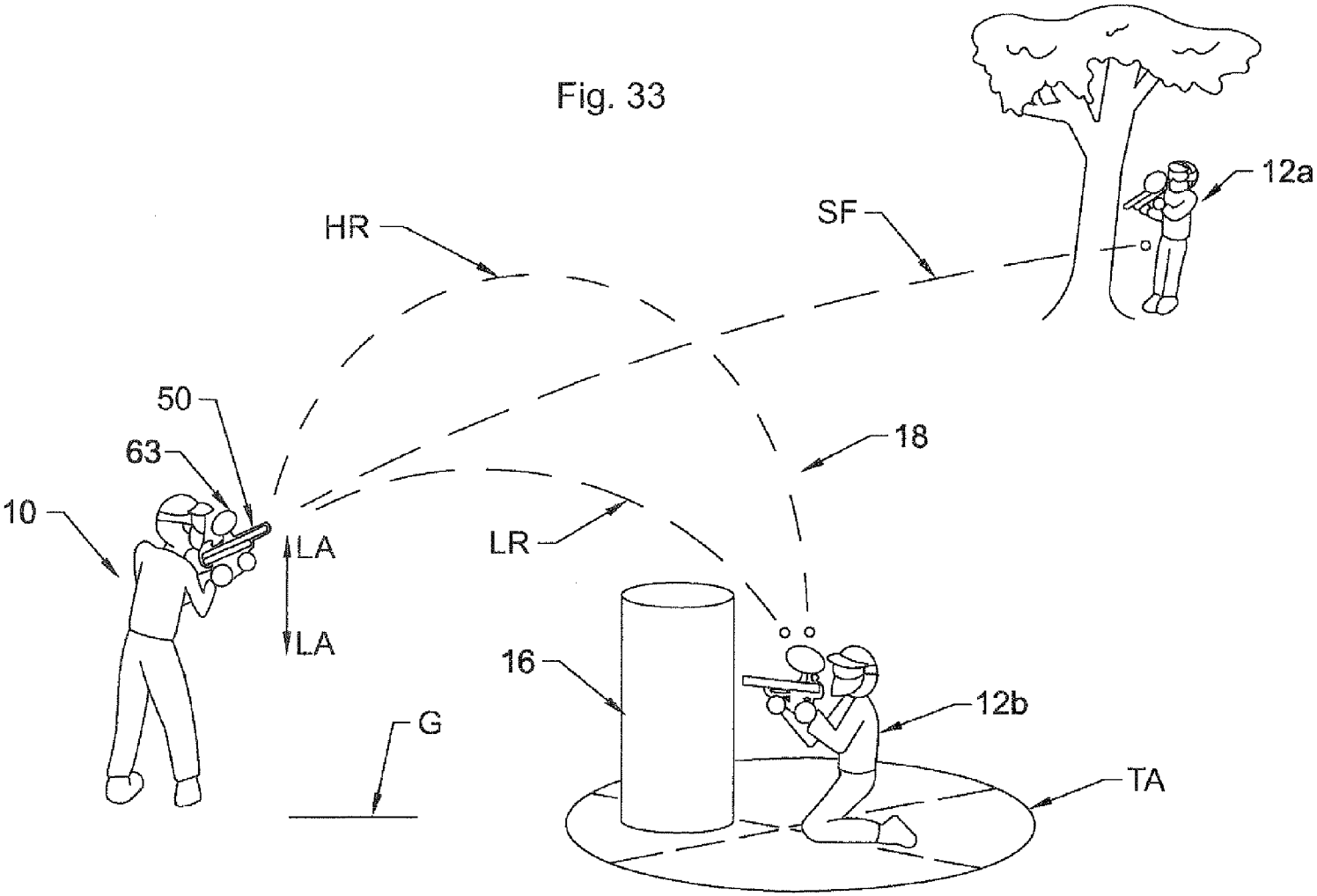
FIG. 33 illustrates a player shooting projectiles at targets on a paintball playing field using a compressed gas projectile accelerator.

Referring collectively to FIGS. 32 and 33, a user 10 is illustrated firing projectiles or paintballs at two respective targets 12*a*, 12*b* using a compressed gas projectile accelerator or paintball marker 50. User 10 is shooting at target 12*a* with a marker 50 that is configured to expel paintballs at target 12*a* at an upper velocity setting, which in this form, comprises the maximum allowable velocity setting of 300 FPS, as described above. Again, since user 10 is a substantial distance from target 12*a*, thus requiring the paintball to travel a greater distance, the paintball tends to travel along somewhat of an arced path after traveling a predetermined distance due to the force of gravity on the paintball.

User 10 is also lobbing paintballs on to target 12*b* with marker 50 set at the lower velocities of the lobbing mode, also described above (see FIG. 32). As user 10 adjusts or positions barrel 54 of marker 50 along latitudinal axis LA-LA, relative to the ground G, the impact of the paintballs of the lobbing mode changes, outwardly then inwardly; if said lower velocities remain unchanged. For example, user 10 is lobbing paintballs at target 12*b*, in target area TA, with marker 50 configured to one set of lower velocities and starting with low barrel 54 angle while impacting target area TA. As user 10 increased the angle of barrel 54 along latitudinal axis LA-LA the impact of the paintballs would extend increasing past target area TA, until the paintballs reached their distance limit for that set of said lower velocity settings. Then, their impact would increasingly return to target area TA, as user 10 continued to increase the angle or position of barrel 54 towards a greater predetermined angle.

Further, as illustrated in FIG. 33, a lobbed paintball, of said lower velocity settings, can have more than one predetermined expelling angle for any particular velocity setting. For example, user 10 is lobbing paintballs at target 12*b* with marker 50 configured to one velocity setting of the said lower velocity settings. User 10 is lobbing paintballs at target 12*b* in two different arc shaped paths, a high radius HR shaped arced path and a low radius LR shaped arced path. The high radius HR shaped arced path and the low radius LR shaped arced path are comparatively representative of the substantially arc shaped paths 18 that can be used or selected by user 10, to lob paintballs onto target 12*b* in target area TA.

Figure 34:
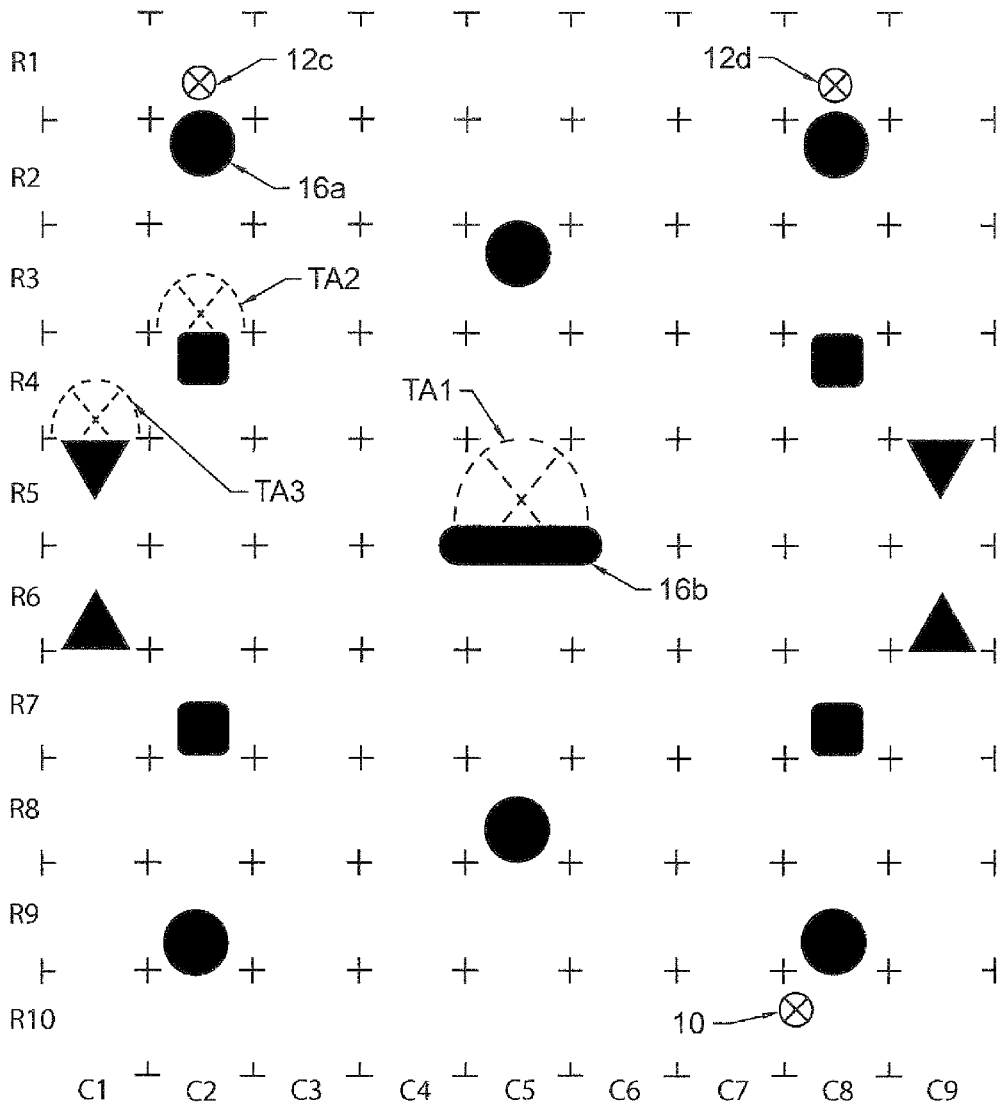
FIG. 34 illustrates a gridded overhead view of a tournament paintball field with players, target areas, and obstacles.

Referring to FIG. 34, an overhead representative example of a paintball playing field is illustrated; in particular, a tournament playing field. Tournament paintball playing fields are typically designed or arranged to be tactically balanced for two opposing teams, with equal and mirror like qualities. Tournament fields are normally laid out on fairly level ground with various shaped bunkers or obstacles that provide cover to the players. The dimensional size of the field, the placement of obstacles and the quantity of obstacles on the field routinely depends on the number of allowed players per playing team, such as 3 man teams, 5 man teams, 10 man teams, etc. The playing fields for most major tournament paintball events are generally pre designed for the teams to inspect and plan game strategy; with many major paintball events posting virtual version of the field layouts on the internet, as described above (see FIG. 5).

As illustrated, user 10 is playing or opposing at least two opponents, represented as target 12*c* and target 12*d*. Target 12*c* is playing behind obstacle 16*a* that is located in grid R2/C2 and target 12*d* is playing in grid R1/C8 behind an obstacle located in grid R2/C8. User 10 is playing behind or off the back right bunker or obstacle; which is, the representative upright cylindrically shape in grid R9/C8. User 10 is expelling paintballs at target 12*c* and target 12*d* with marker 50, set at the upper velocity setting, as described above. User 10, in this illustrative example, recognizes the low tubular obstacle 16*b*, on the 50 yard line in the center of the field as the biggest threat to team's game plan, if occupied by an opponent. Thus, user 10 preregistered grid R5/C5, illustrated as target area TA1; as well as, other target areas in other grids behind other opposing obstacles, illustrated as target area TA2 and target area TA3. The preregistering of grids and/or target areas into marker 50 by user 10, allows user 10 to expel paintballs at or onto targets in said target areas quicker and more precisely. In one form, marker 50 includes directional/locational sensor 43, as described above (see FIG. 5); directional/locational sensor 43 allows user 10 to position marker 50 in the preregistered directional heading of a pre selected target area and marker 50 will self select or auto select the preregistered preferences and/or factors (i.e. selected velocity settings, firing mode, etc.) that were selected and input by user 10 before the game began. Said preregistering of a target area can be done for the straight fire mode and the lobbing fire mode. For example, user 10 could preregister grid R1/C2 behind obstacle 16*a* for the upper velocity setting of the straight fire mode or grid R5/C5, target area TA1, for a lower velocity setting of the a lobbing fire mode. Further, besides presetting the velocity setting or settings for a particular target area, as well as, the firing mode (i.e.—straight fire mode, lobbing mode, velocity spreader lobbing, lobbing burst mode, etc.); user 10 can preregister a delivery arc or angular path, such as a high radius HR shaped path and/or a low radius LR shaped path, as described above (see FIG. 33). The preregistering of the delivery path allows user 10 to consider and/or compensate for, the shape and/or size of an obstacle in front of an opponent or a target area. For example, user 10 can register a high radius HR shaped path for a taller obstacle and register a low radius LR shaped path for a shorter obstacle. In one form, marker 50 includes indicators 73, as described above (see FIG. 5); said indicators 73 can guide user 10 to the proper and/or selected angle for barrel 54 for the selected preregistered delivery path, such as the high radius HR or the low radius LR shaped path, during play of the game.

The preregistering of marker 50 can be done before play begins on the paintball field. This preregistering of marker 50 can be accomplished through trial and error, with positive results being acknowledged and input into marker 50, during a pre game test firing. Also, the preregistering of marker 50 can be accomplished through above described configured marker (see FIG. 5). For example, said configured marker 50 includes directional/locational sensor 43; allowing user 10 to input the starting location for marker 50. The distance and direction to a selected target or target area can be determined by marker 50 through directional/locational sensor 43; such as, during the pre game field walk user 10 inputs said starting location into marker 50, then user 10 walks over to the selected target area and inputs its location, thus marker 50 knows the distance between the two entered locations and the directional heading. Additionally, the distance to a selected target or target area can be input by user 10 through included distance sensor 75 or controls 77 configured as a manual distance control, as described above. This, input of the distance to a selected target or target area, by controls 77, is aided by the announcement of the dimensional fields lay outs or designs, by event promoters. In one form, directional/locational sensor 43, distance sensor 75, and/or manual distance control 77 can be used to verify and/or cross reference, the others, distance to target determination. Other aspects and/or factors can be input or preregistered by user 10 before the game, such as, preferred velocity settings, preferred delivery paths, firing modes, RPS, activating barrel angles of the auto select mode, the directional heading of a selected target relative to the starting position, etc. The registering of marker 50, similar to the pregame preregistering, can be done during play of the game while on the playing field, as described above (see FIG. 5). Also, the pregame preregistered factors, aspects, determinations, and/or preferences can be adjusted or changed during play of the game, such as; with controls 77, also described above (see FIG. 5).

Further, the preregistering of an angular path limit or angle limit for barrel 54 can also be set for any velocity setting, at or above a specified velocity setting, as a safety mode. For example, a tournament promoter or official of a representative paintball event comprehends that a lob paintball from a barrel of a marker with an angle of more than 70 degrees, at a velocity of more than 240 FPS could drift over the safety netting, which is in front the viewing area. Thus, a preregistered limit might be imposed or set to, 65 degrees or less for any velocity setting above 235 FPS. In this example, any barrel 54 angle above 65 degrees would be limited to an upper velocity setting of 235 FPS by the configured marker.

Figure 35A:
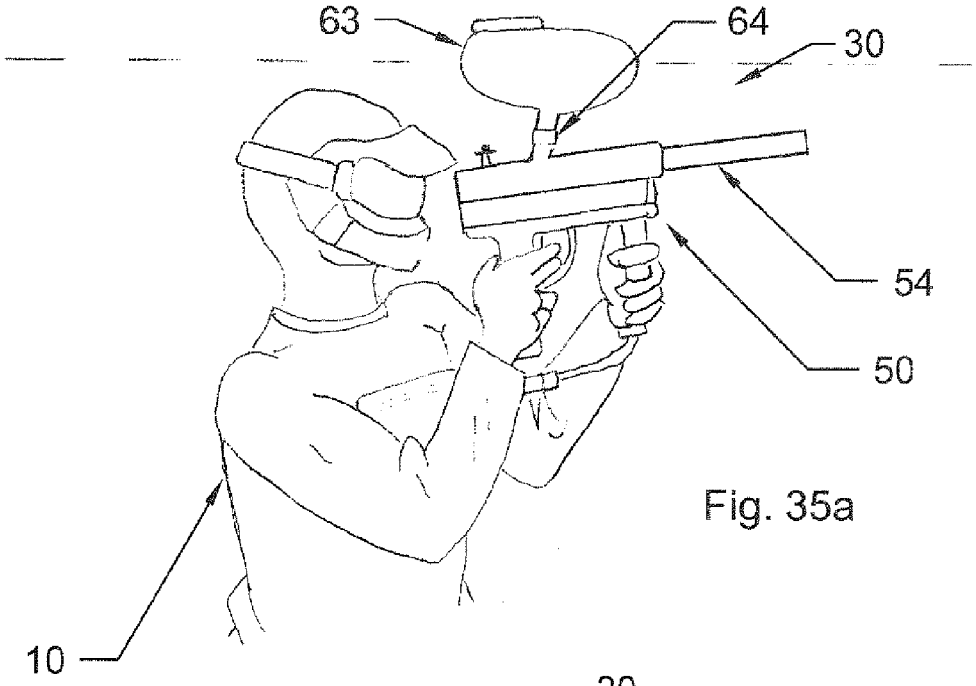
FIG. 35*a*-35*b* illustrates views of a portion of a player with a compressed gas projectile accelerator including an assisted loading mechanism.
Figure 35B:
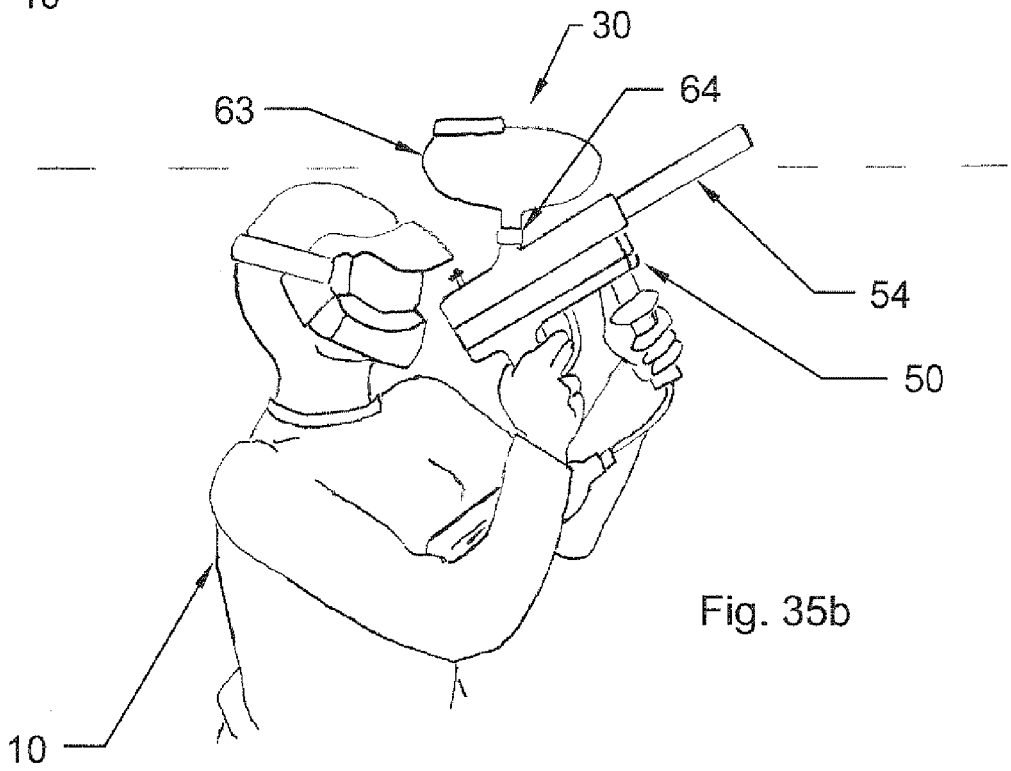

Referring collectively to FIG. 35 *a-b*, a representative form of a paintball feeding system is illustrated. In particular, a paintball feed system and/or method 30 that considers, counteracts, and/or compensates for the angle or positional position of marker 50 and/or paintball hopper 63. For example, when a marker of today, with fixed vertical feed tube, is placed in a predetermined angle in order to lob paintballs onto a target such as target 12*b*, the feed tube 64 of marker 50 would be 90 degrees to that predetermined angle. That is, if the barrel 54 of marker 50 is at a predetermined lobbing angle of 60 degrees, the feed tube 64 is at 90 degree angle to that 60 degree angle of the barrel 54, and not at 90 degrees to the ground. Further for example, if the barrel 54 of marker 50 is pointing at 1 o'clock (from a side view), then the feed tube 64 would be pointing at 10 o'clock. Thus the paintball hopper 63 could have feeding problems and/or miss feeds. However, if marker 50 included a pivoting, rotating, and/or hinged member or component, such as feed tube 64, that considered, counteracted, and/or compensated for the angle or positional position of barrel 54 and marker 50; paintball hopper 63 would feed paintballs as it's designed. Also, paintball hopper 63 can be configured to consider, counteract, and/or compensate for its angular or positional position, as set forth in greater detail below. Those skilled in the art would recognize that most paintball hoppers in use today are designed and perform best in a level or more level position; and that most paintball markers in use are designed with fixed vertical feed tubes for this reason.

Figure 36:
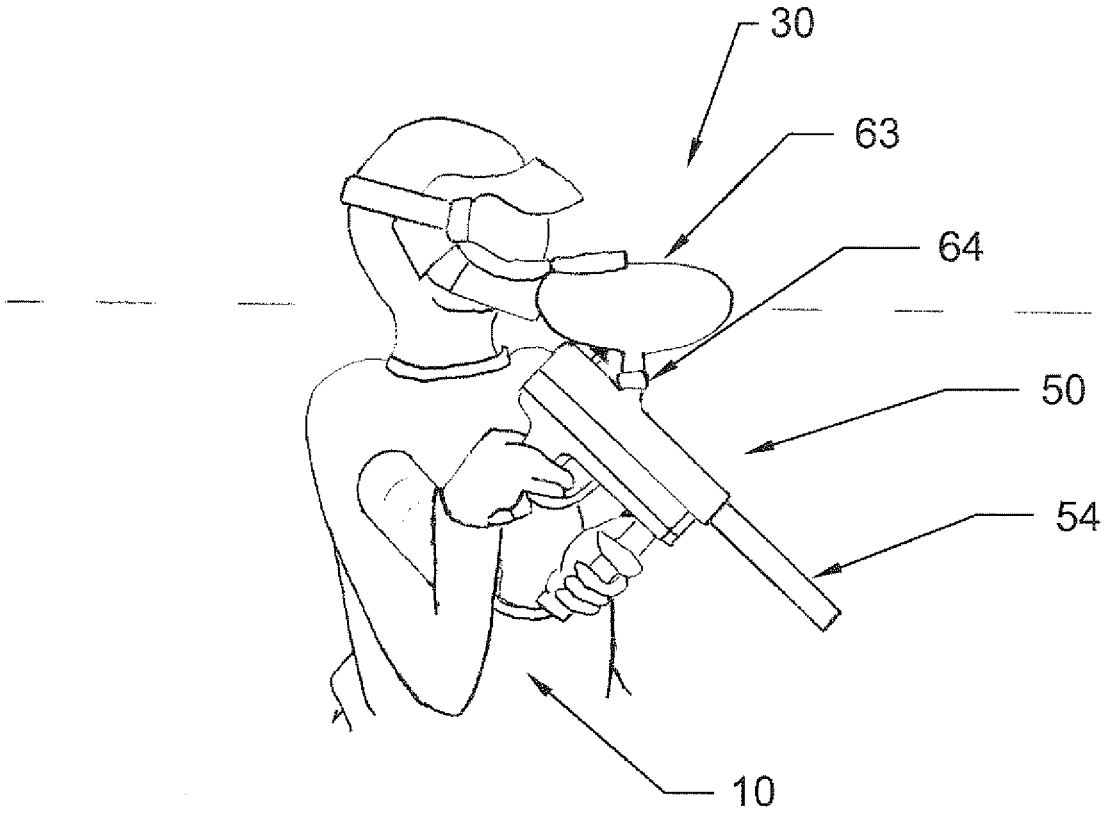
FIG. 36 illustrates a portion of a player with a compressed gas projectile accelerator including an assisted loading mechanism.

Referring to FIG. 36, another representative form of paintball feed system and/or method 30 is illustrated. Similar to the above form, in this illustrated form; paintball feed system 30 includes a method that considers, counteracts, and/or compensates for the angular or positional position of marker 50 and/or paintball hopper 63, where the angle is a downward angle. For example, when user 10 is not engaging an opponent, marker 50 might be placed in a resting or downward angle, as illustrated. Thus, paintball hopper 63 would not be fully ready to feed paintballs through feed tube 64 to marker 50 as designed; if marker 50 has a fixed vertical feed tube, as described above. In this representative form, marker 50 includes a pivoting, rotating, and/or hinged feed tube 64 that considered, counteracted, and/or compensated for the angle or positional position of barrel 54 and marker 50; there by allowing paintball hopper 63 to be fully ready and able to feed paintballs once user 10 engaged a target. Again, paintball feed system 30 can include a paintball hopper 63 configured to consider, counteract, and/or compensate for its angular or positional position.

Further, in the sport of paintball; tournament paintball allows the "bunkering" of an opponent, that is where a player or user runs up to an opponent's bunker or obstacle, and shoots said opponent. Many times said opponent is kneeling or laying prone behind the bunker causing the "bunkering" player or user to shoot downward to eliminate said opponent. This downward shooting causes the paintball hopper 63 to be out of its preferred level position. But, as illustrated in this form; marker 50 and/or paintball hopper 63 can comprise a pivoting, rotating, and/or hinged feed method that considers, counteracts, and/or compensates for the angular or positional position marker 50 and/or paintball hopper 63, there by allowing the proper feeding of paintballs to marker 50.

Referring collectively to FIG. 37*a-f*, in this representative form, paintball marker 50 includes paintball feed system 30. In this form, paintball feed system 30 of marker 50 can be configured to includes a pivoting, rotating, and/or hinged member or component, which is feed tube 64 in this representation, that considers, counteracts, and/or compensates for the angle or positional position of paintball hopper 63 and/or marker 50 (see FIG. 37*d-e*), as described above. In a representative form of the above form, feed tube 64 can be configured as a vertical feed tube, but with a side entry or feed, that is, a side mounted feed tube. The upper portion of side feed tube 64 turns into marker 50 through transitional sections 37 allowing paintballs to be fed to marker 50 from the side. The side mounting of feed tube 64 can be configured into the right side of marker body 56 (see FIG. 37*a*) and/or the left side of marker body 56 (see FIG. 37*c*). In one form, user 10 can switch feed tube 64 from one side of marker 50 to the other side of marker 50. Feed system 30 can include a seal or plug 38 (see FIG. 37*b*) to allow the closing or sealing off of bore 114 (see FIG. 11 and FIG. 37*f*) on one side of body 56 when feed tube 64 is configured on the other side of marker 50.

In one representative form, feed tube 64 of feed system 30 can pivot or rotate 360 degrees around its mounted position on body 56 of marker 50. Further, feed system 30 can include a positional system and/or method, such as actuator 195 (see FIG. 15 and FIG. 37*f*), to allow the assisted movement or placement of feed tube 64. In one form, actuator 195 of feed system 30 can be connected to circuit board 66 (see FIG. 5) of marker 50. In another form, actuator 195 of feed system 30 can be connected to a separate controller or circuit board 66 and/or a separate power supply 68 (see FIG. 5). Further, feed system 30 can include sensors, such as tilt sensors 48 (see FIG. 5), configured to allow user 10 and/or circuit board 66 of marker 50 to position feed tube 64 and/or paintball hopper 63 in a better or premium position and/or situation. For example, user 10 can position barrel 54 of marker 50 in a predetermined angle to lob paintballs onto a target area TA. Feed system 30, with circuit board 66 and connected tilt sensor 48, then moves or repositions feed tube 64 and/or paintball hopper 63 to an improved feeding position through the activation of actuator 195. In one illustrated form (see FIG. 37*a* and FIG. 37*f*), actuator 195 is secured or connected to feed tube 64 through bands or brackets 191. Actuator 195 includes a shaft driven drive wheel or gear 193 which companions or mates to a suitable surface, such as gear teeth impressions 194 (see FIG. 37*a* and FIG. 37*f*), on the body 56 of marker 50. Thus, movement or rotation of drive gear 193 by actuator 195 causes the connected feed tube 64 to pivot or rotate around its connection to body 56 of marker 50, there by allowing circuit board 66 and connected tilt sensor 48 to position feed system 30 into a more preferred feeding position and/or situation.

Actuator 195 of the above form, similar to a form of FIG. 15, can comprise an electric means or manner, such as, a servo, solenoid, stepper motor, indirect drive motor, direct drive motor, ball screw drive, worm gear drive or any other suitable type of motor, drive, and/or actuator. Also, actuator 195 can comprise a pneumatic and/or hydraulic means or manner, such as with, pneumatic and/or hydraulic motors, drives, and/or actuators. Said pneumatic/hydraulic motors, drives, and/or actuators can further comprise a servo, solenoid, fluidic muscle actuator, indirect drive actuator, direct drive actuator, ball screw drive, vane actuator, rotary vane motor, multi stage cylinder or any other suitable type of motor, drive, and/or actuator. Pneumatic actuator 195 can be activated and/or controlled by solenoid valve 74 (see FIG. 5), connected with circuit board 66, in one form; and activated and/or controlled by an independent or secondary solenoid valve, in another form. Although illustrated in connection feed tube 64, it should be appreciated that actuator 195 can be configured in other locations of marker 50 and/or feed system 30.

Figure 37A:
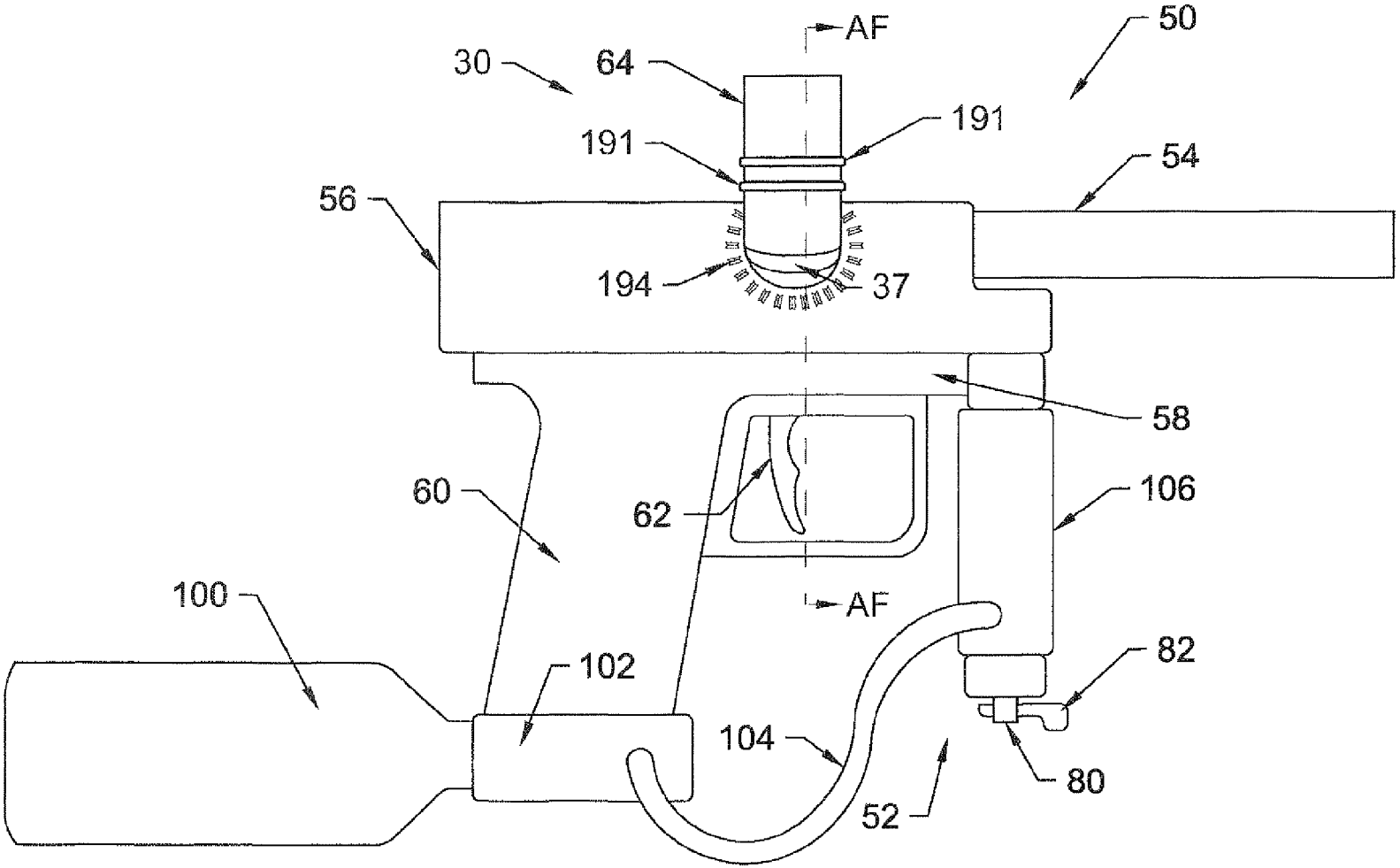
FIG. 37*a*-37*e* illustrates side views of compressed gas projectile accelerators including assisted loading mechanisms.
Figure 37B:
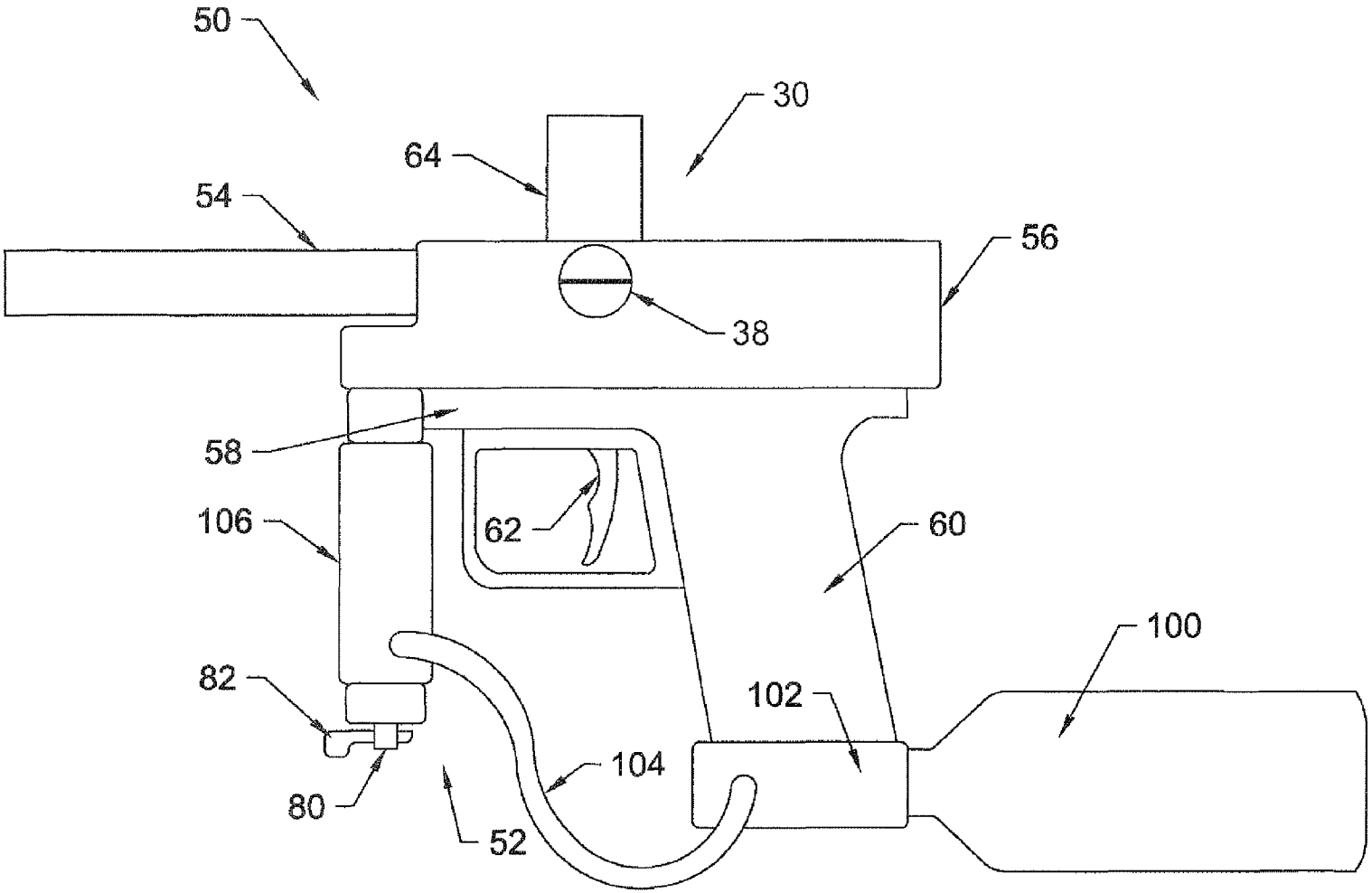
Figure 37C:
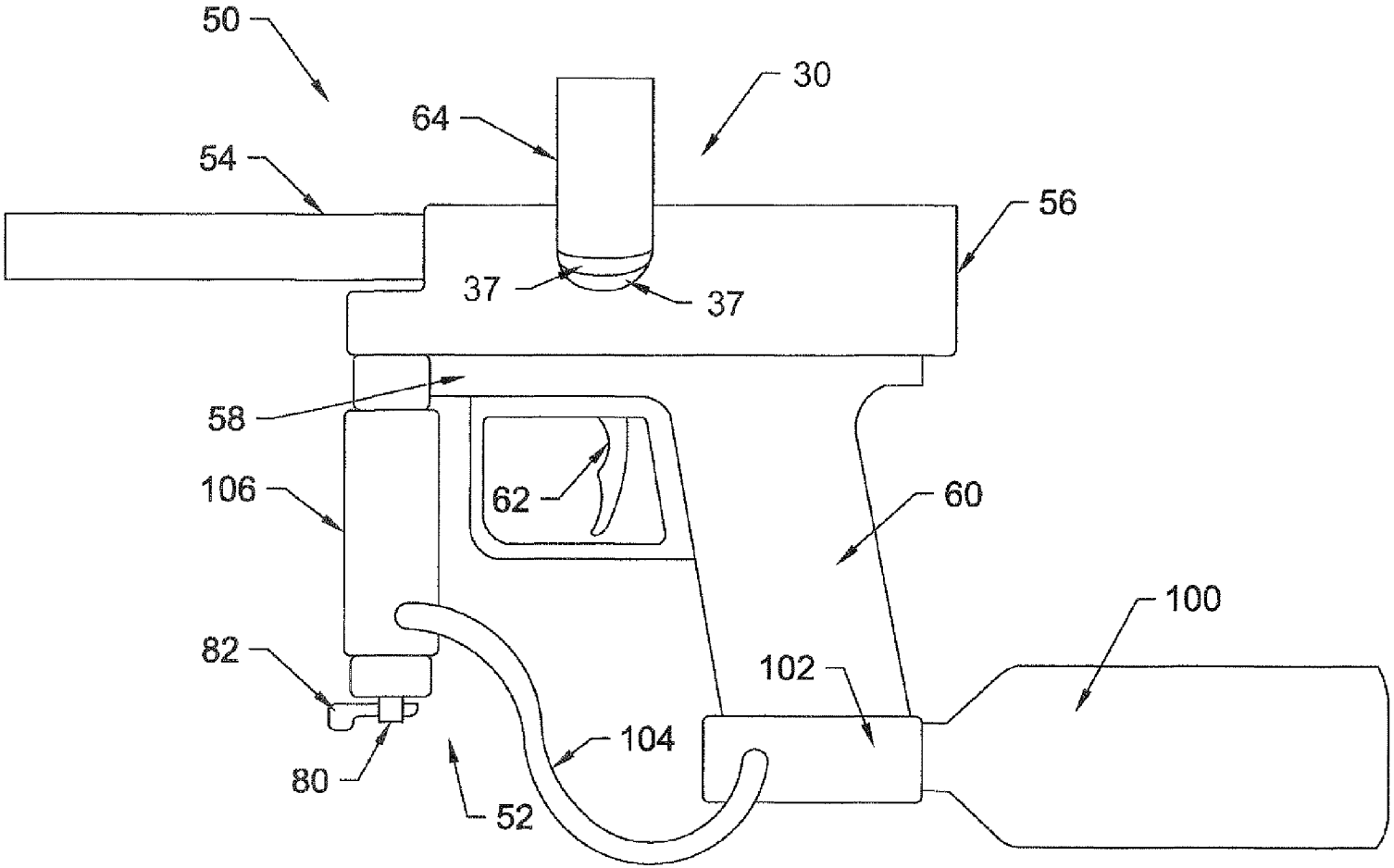
Figure 37D:
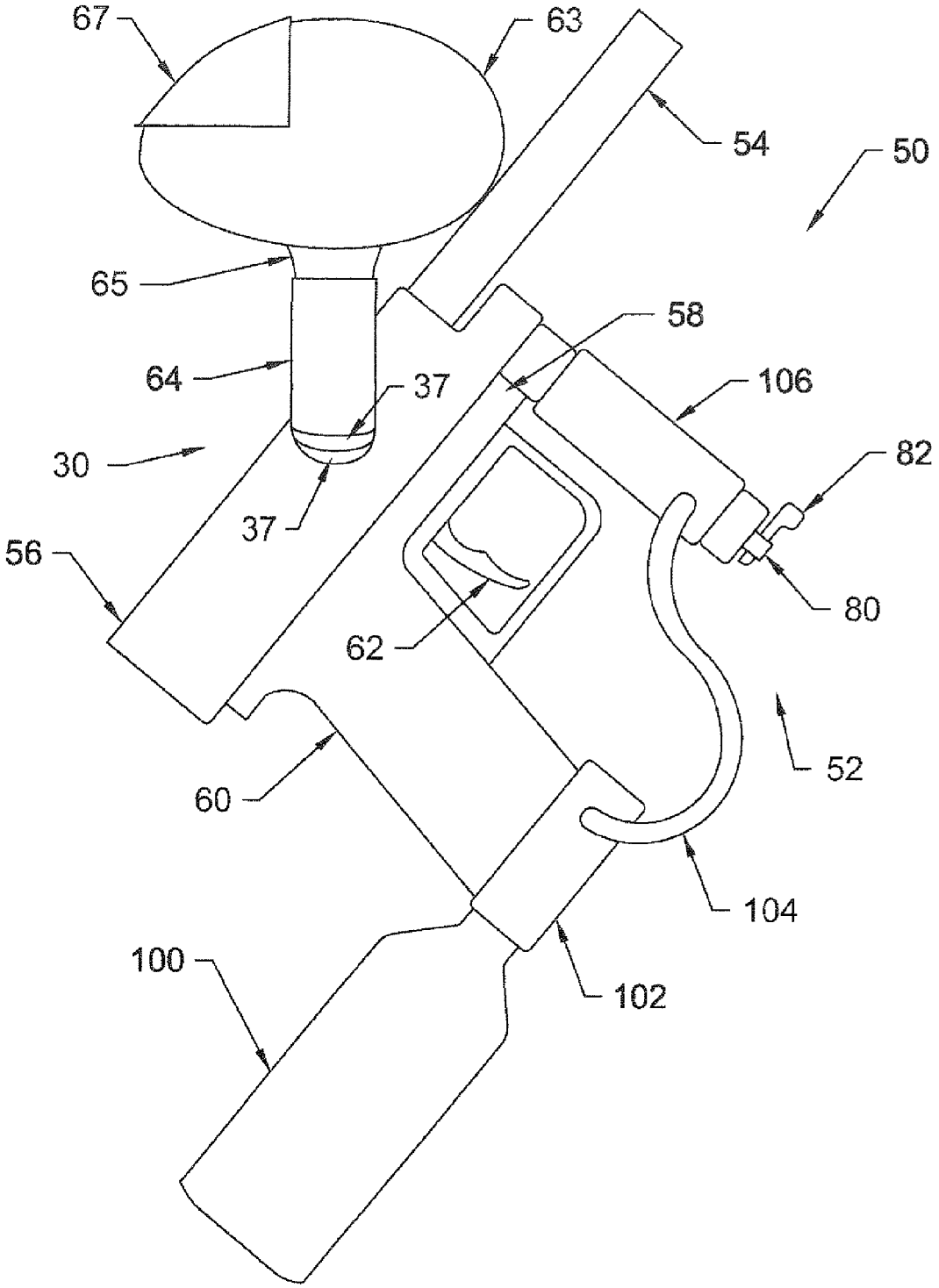
Figure 37E:
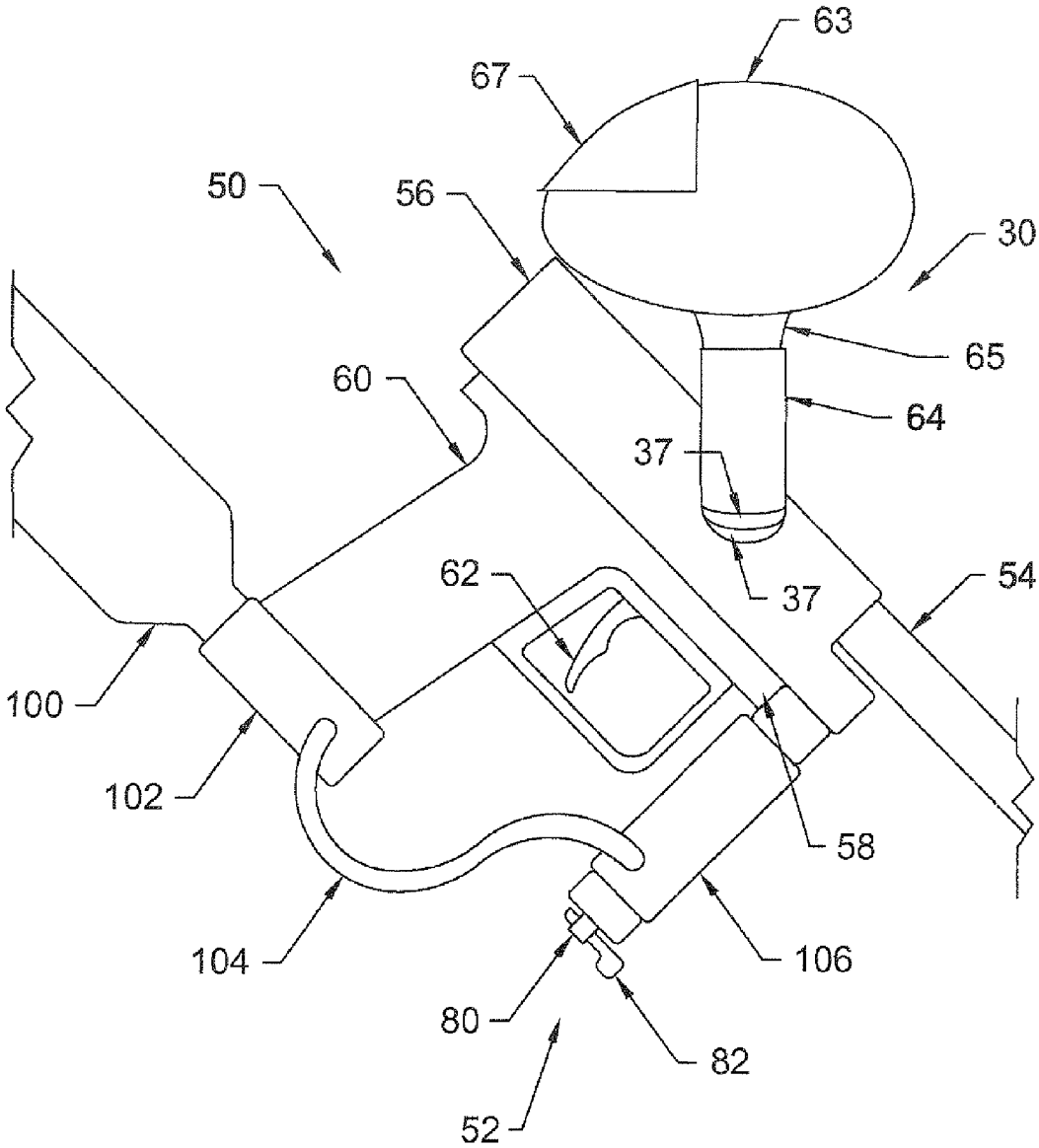
Figure 37F:
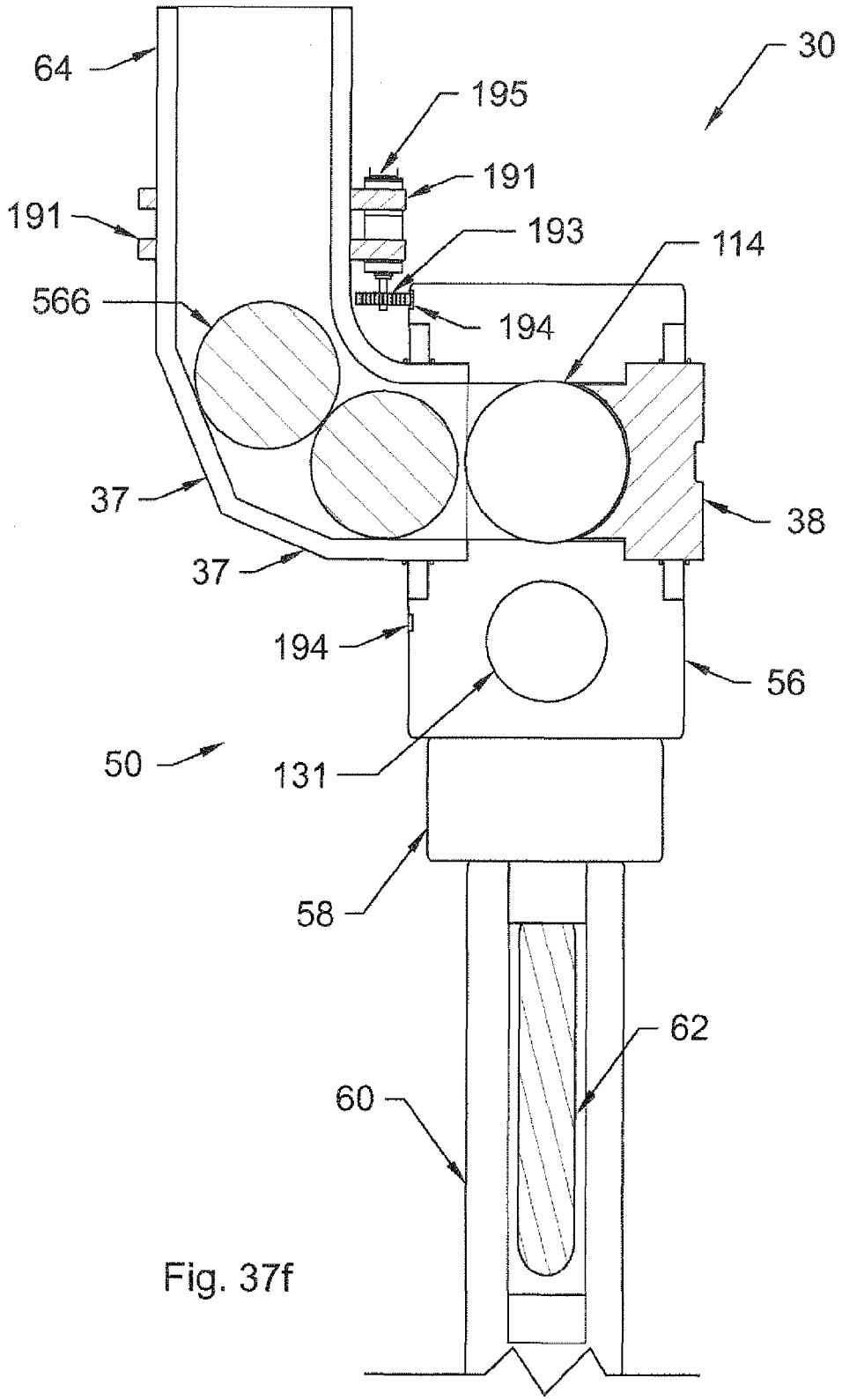
FIG. 37*f* illustrates a portion of a compressed gas projectile accelerator in front cross-sectional form having an assisted loading mechanism.
Figure 38A:
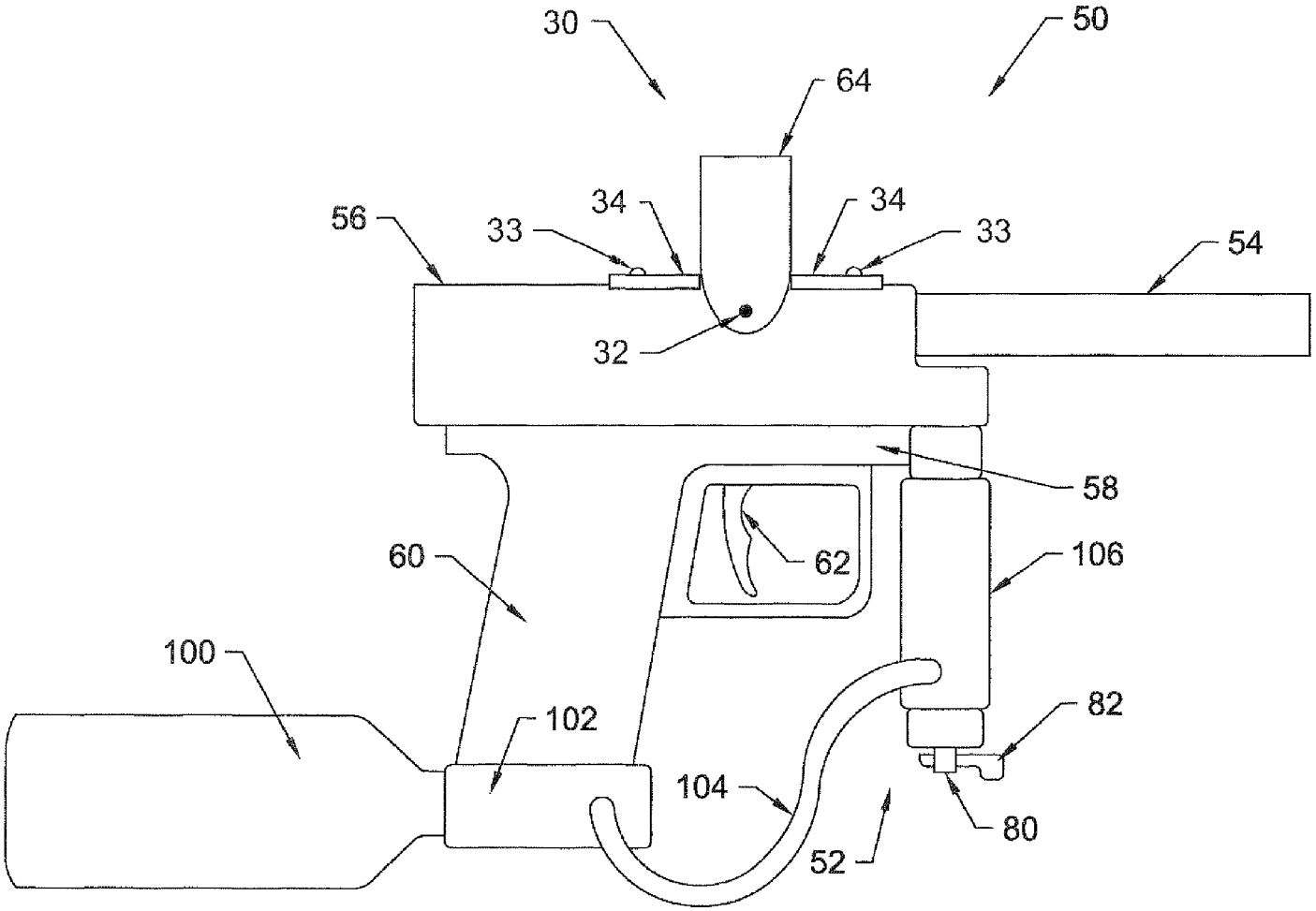
FIG. 38*a*-38*c* illustrates side views of compressed gas projectile accelerators including assisted loading mechanisms.
Figure 38B:
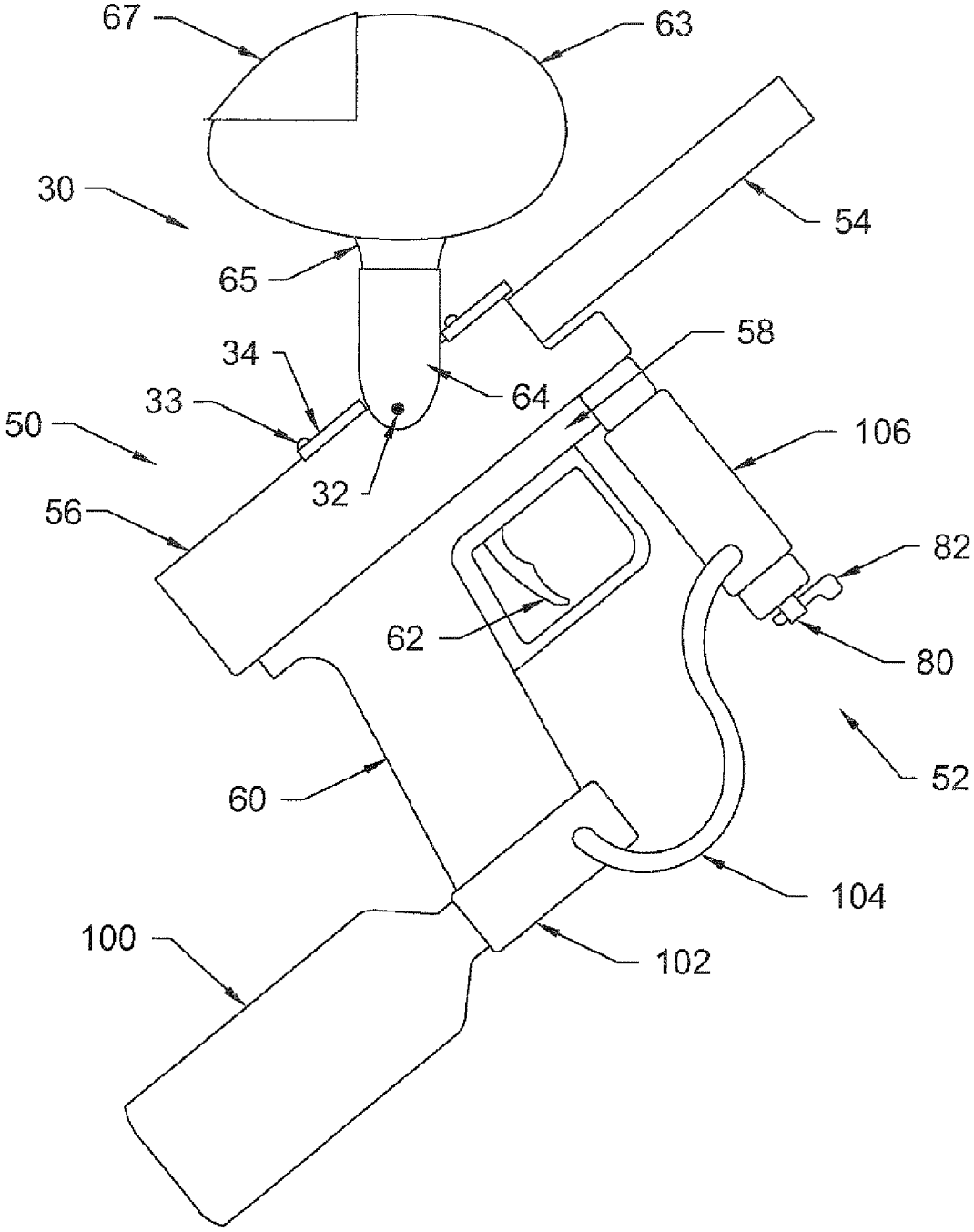
Figure 38C:
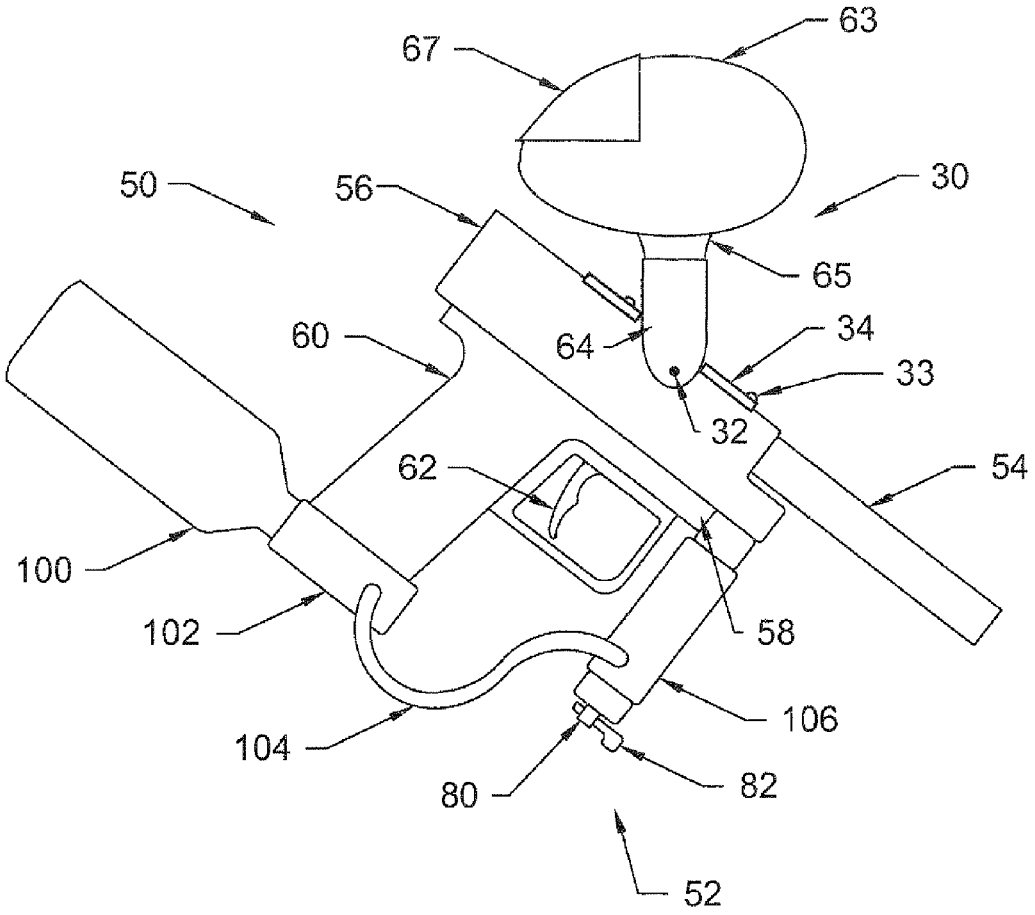
Figure 39A:
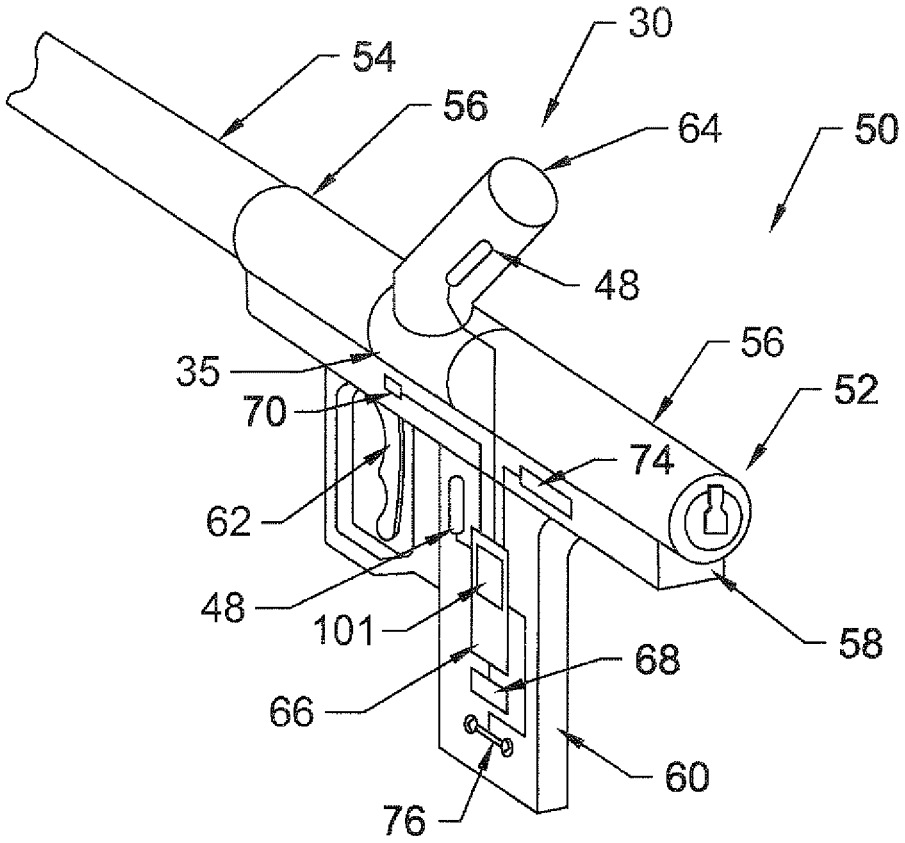
FIG. 39*a*-39*d* is cross-sectional views of illustrative compressed gas projectile accelerators including assisted loading mechanisms.
Figure 39B:
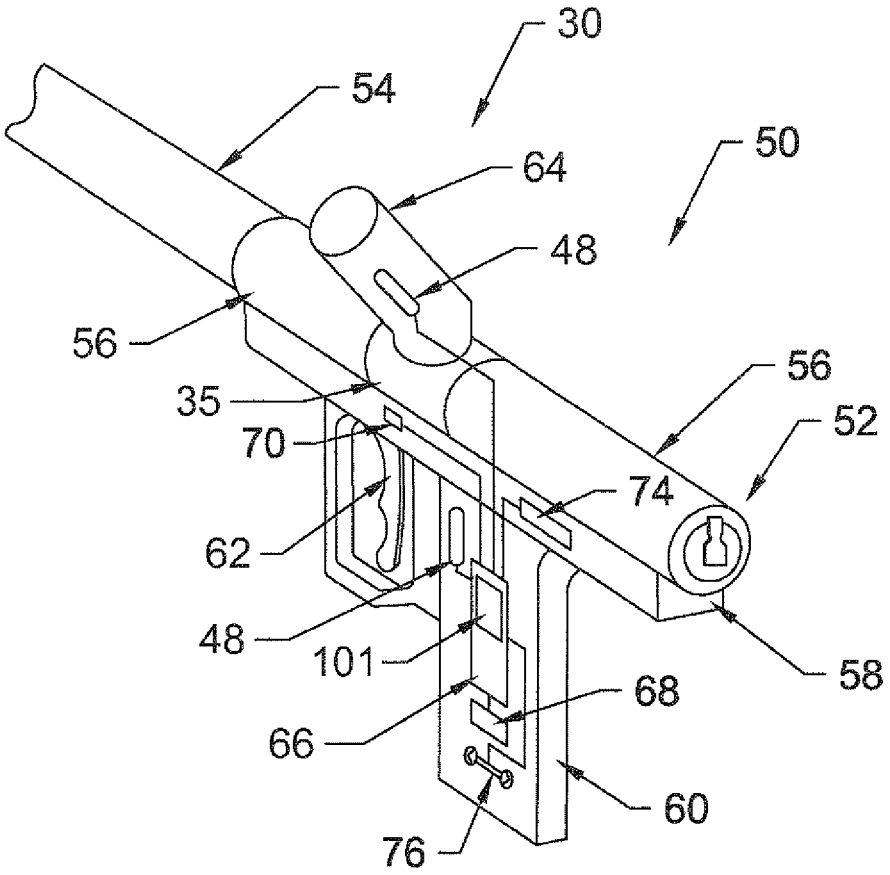
Figure 39C:
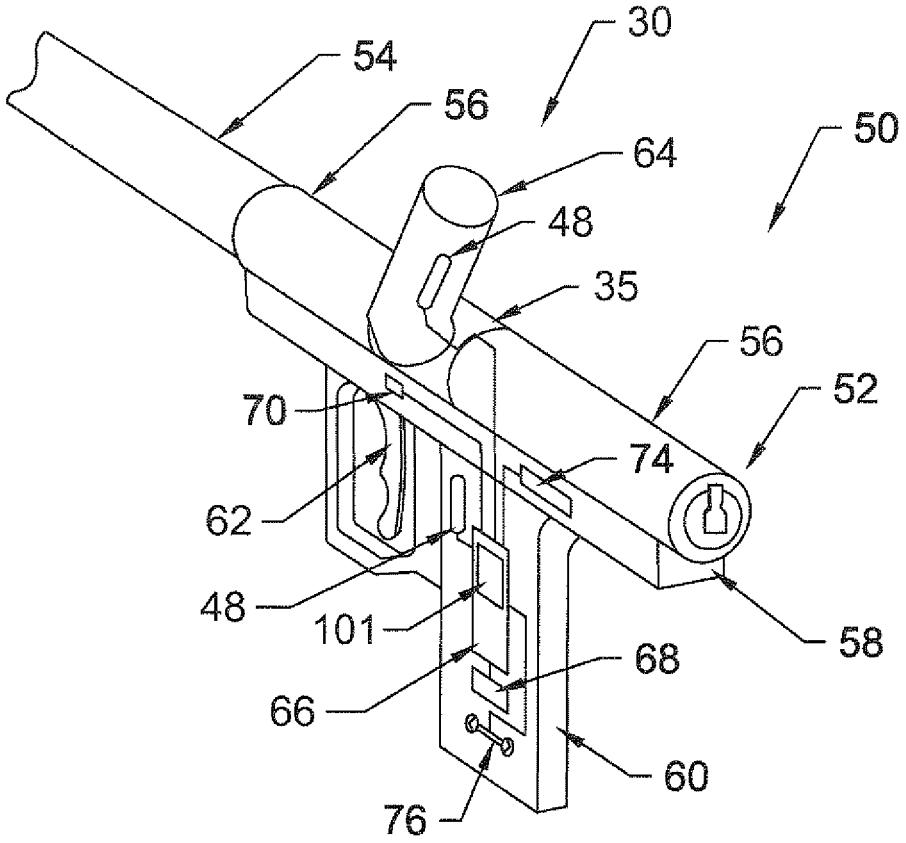
Figure 39D:
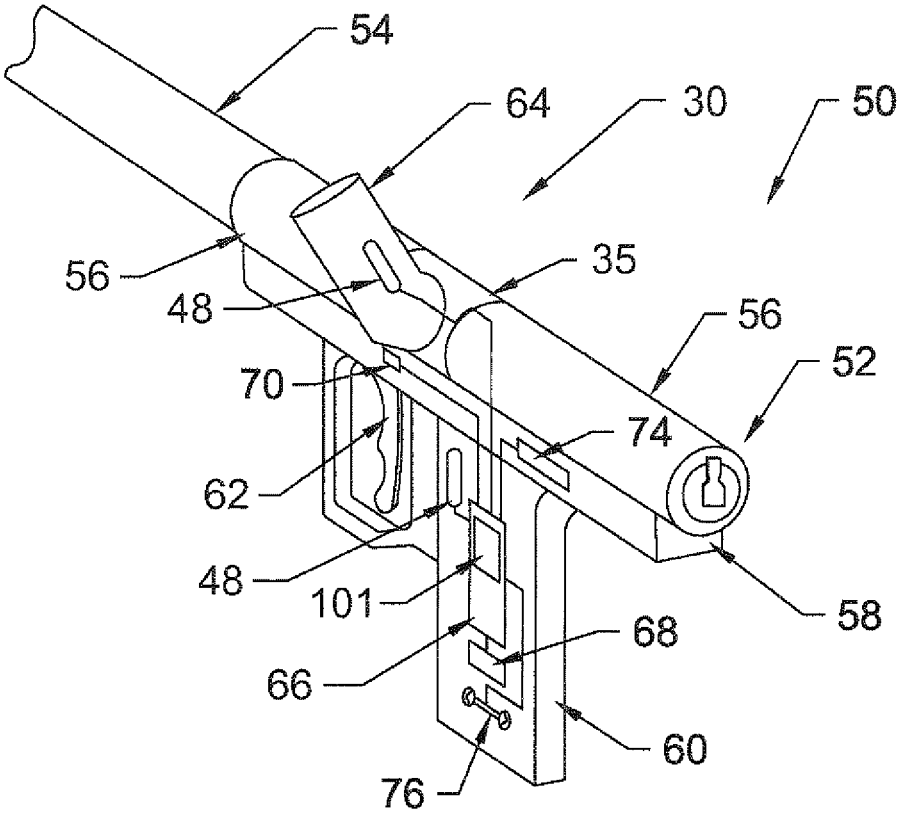

Referring collectively to FIG. 38*a-c*, another representative form of paintball marker 50 is illustrated, that includes paintball feed system 30. In this form, paintball feed system 30 of marker 50 can be configured to include a pivoting, rotating, and/or hinged member or component, such as feed tube 64, that considers, counteracts, and/or compensates for the angle or positional position of barrel 54 and marker 50, as described above (see FIG. 35*a-b*, FIG. 36). In this form, paintball feed system 30 of marker 50 can include a vertical feed tube 64, that is similar to fixed vertical feed tubes of most paintball markers of today. While feed tube 64 of paintball feed system 30 feed paintballs to marker 50 from the top, feed tube 64 of paintball feed system 30 is not fixed or held in place or one position. In one form, feed tube 64 of paintball feed system 30 can be configured to saddle or outwardly conform to the upper sides of body 56 of marker 50. Also, feed tube 64 includes a hinged and/or pivot point, such as pivot screw 32, that allows feed tube 64 to rotate forward and/or backward, while still feeding paintballs to marker 50. Paintball feed system 30 of marker 50 can be configured with slide plates or covers 34 that expose and/or cover the elongated feed port or passage for paintball expelling bore 114 (see FIG. 11 and FIG. 37*f*). In this representative form, slide covers 34 can be spring loaded or assisted and are moveably secured with retaining screws 33.

In another representative form, paintball feed system 30 can be configured to include assisted movement and/or positioning. In one form, feed system 30 includes actuator 195 (see FIG. 15 and FIG. 37*f*) to allow user 10 and/or circuit board 66 to position feed system 30 into a preferential feeding position and/or situation, as described herein.

Referring collectively to FIG. 39*a-d*, a further representative form of paintball marker 50 is illustrated, that includes paintball feed system 30. In one form, paintball feed system 30 of marker 50 can be configured to include a pivoting, rotating, and/or hinged feed tube 64 that considers, counteracts, and/or compensates for the angle or positional position of marker 50 and/or paintball hopper 63, as described above. In one representative form, feed tube 64 can be configured as an angled, curved, or slanted feed tube that can be rotationally positional to allow feed system 30 to be placed into a preferred or more preferred feeding position and/or situation (see FIG. 39*a-b*). In another form, feed system 30 includes a pivoting or rotating body segment or section 35 of body 56 that can be rotationally positional to allow feed system 30 to be placed into a preferred or more preferred feeding position and/or situation. In one representative form, feed tube 64 of feed system 30, being rotationally connected with positional body segment 35, can be positioned spherically or around body 56 of marker 50 (see FIG. 39*c-d*).

In another form, feed tube 64 and/or positional body segment 35, of feed system 30, can be configured with or be connected to actuator 195 (see FIG. 37*f*). In one form, feed system 30 includes circuit board 66 connected with actuator 195. In another representative form, feed system 30 includes tilt sensors 48 connected with circuit board 66. There by, allowing user 10 and/or circuit board 66 with connected tilt sensors 48, through the pivoting, rotating, and/or hinged movement of angled feed tube 64 and/or movable body segment 35, to position and/or reposition feed system 30 into an improved feeding arrangement and/or configuration. The repositioning of feed system 30, during play of a game, can be automatic or self selected through circuit board 66 and tilt sensors 48 connected with actuator 195. Also, the repositioning of feed system 30, during play of a game, can be manually performed or completed through controls 77 (see FIG. 5) or by hand, by user 10.

Figure 40A:
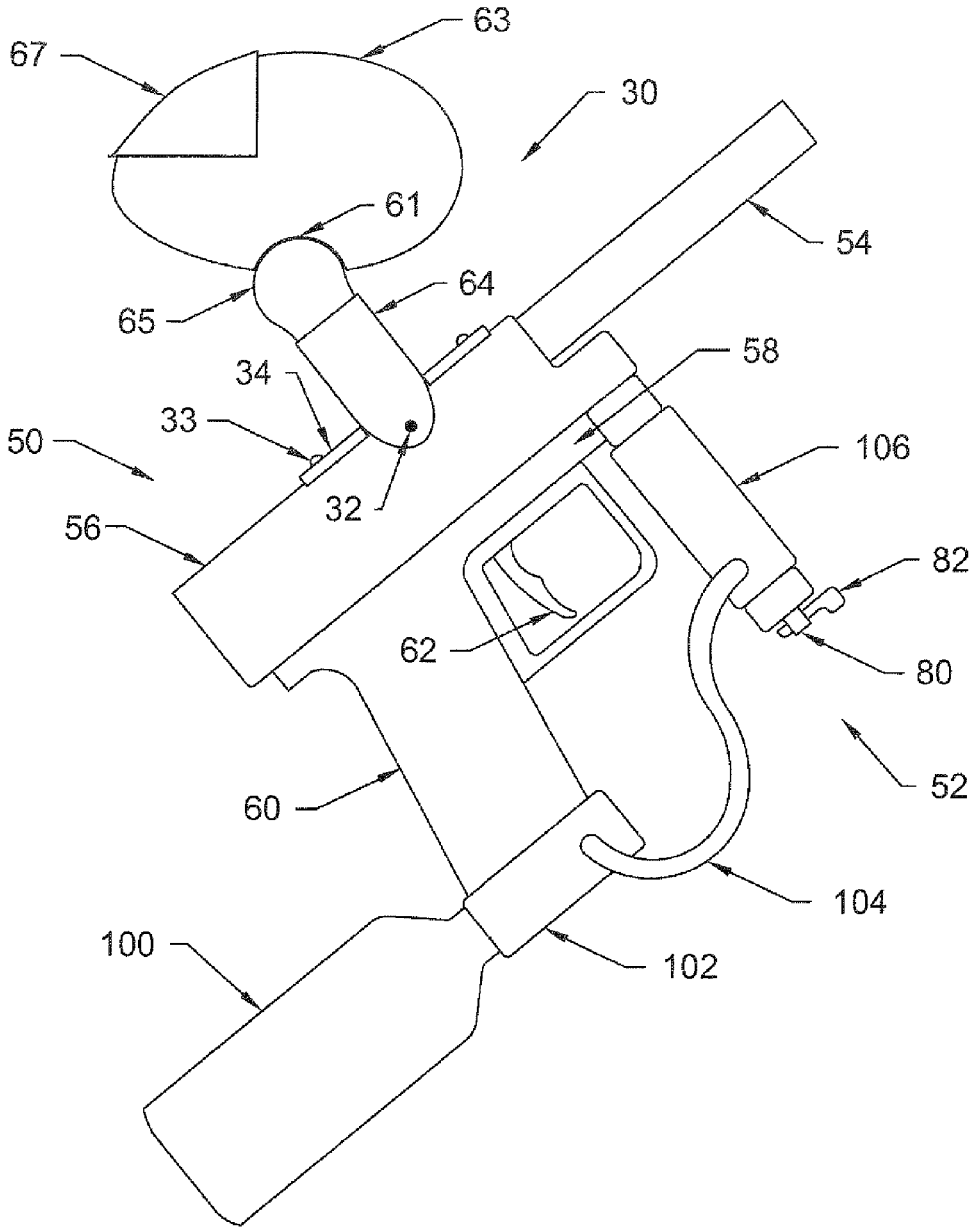
FIG. 40*a*-40*c* illustrates side views of compressed gas projectile accelerators including assisted loading mechanisms.
Figure 40B:
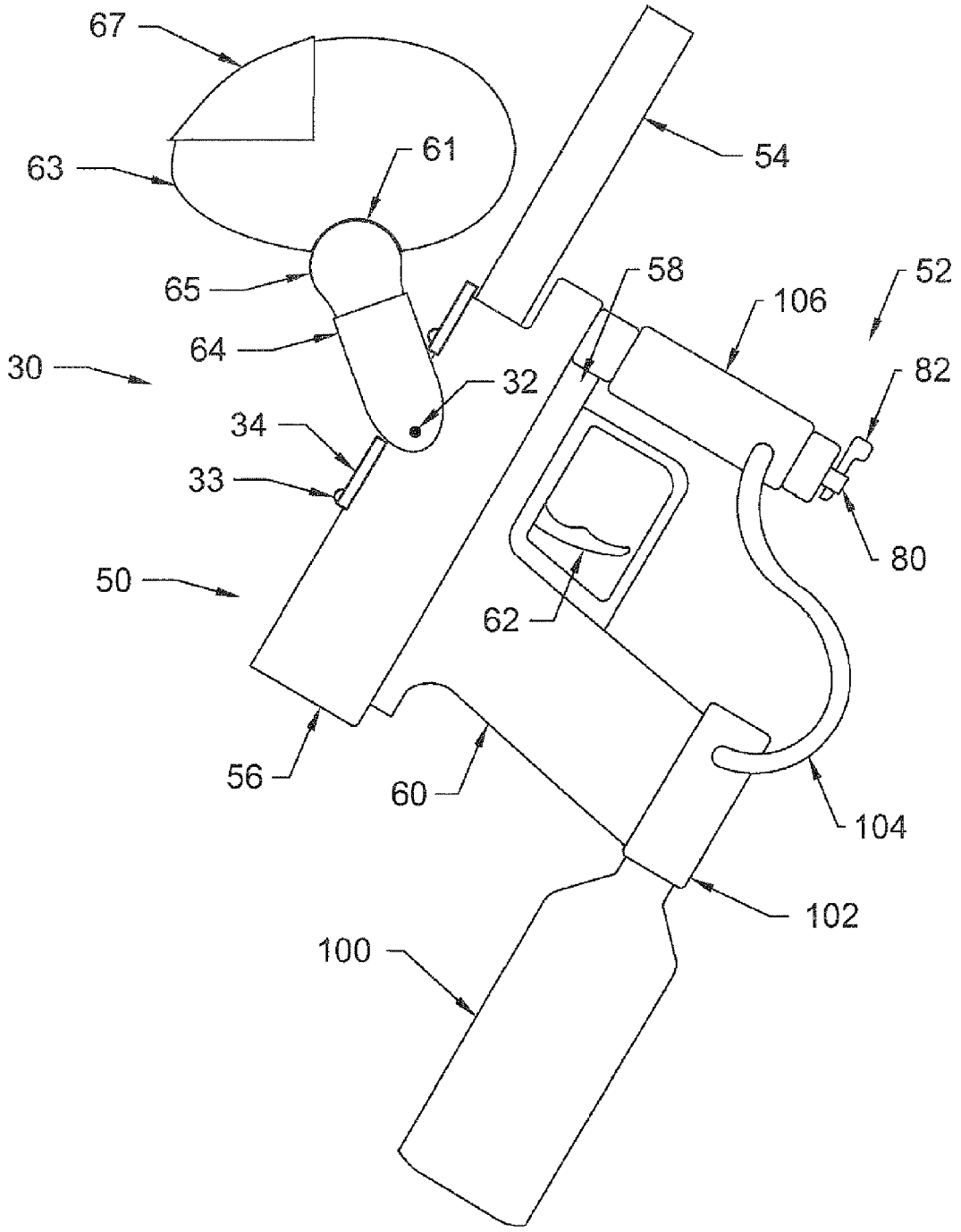
Figure 40C:
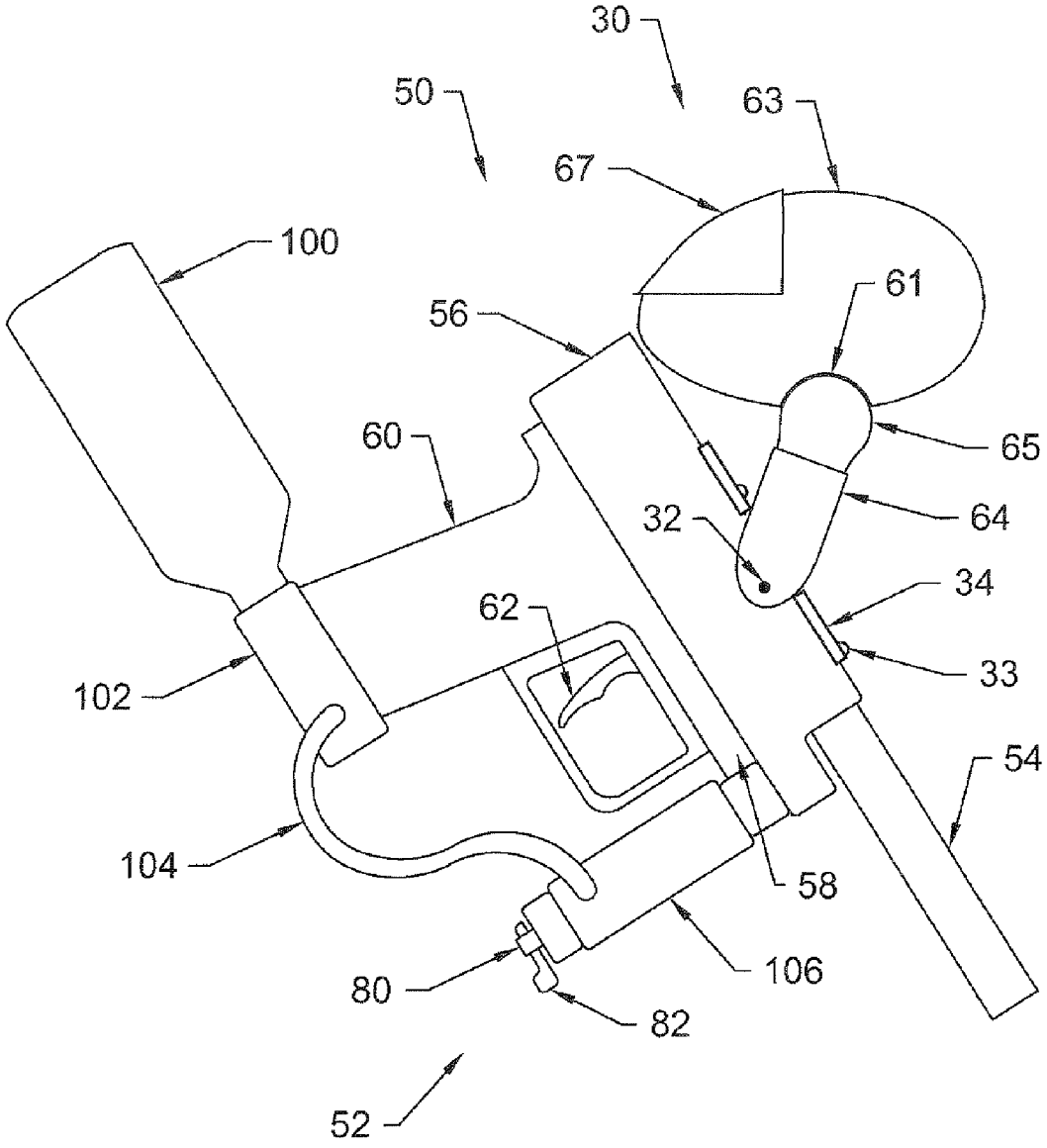

Referring collectively to FIG. 40*a-c*, a representative form of a paintball feeding system 30 is illustrated. In this form, paintball feeding method 30 considers, counteracts, and/or compensates for the angle or positional position of marker 50 and/or paintball hopper 63, as described above (see FIG. 35*a-b* and FIG. 36), through the configuration and/or cooperation of paintball hopper 63. In one representative form, paintball hopper 63 of paintball feeding system 30 includes a moveable and/or positional member, such as feed neck 65, that pivots, rotates, and/or is hinged to allow paintball feeding system 30 to feed paintballs to marker 50 in an improved or preferred position and/or situation. In one representative form, feed neck 65 can be configured with a moveable and/or positional connection 61 to paintball hopper 63. In another form, paintball hopper 63 can be configured with a moveable and/or positional connection 61 to feed neck 65 and/or feed tube 64.

In one form, the configuration of the improved or preferred feeding position of paintball feeding system 30 can be through the configuring of paintball hopper 63, as described above (see FIG. 40*a*). In another form, the configuration of the improved or preferred feeding position of paintball feeding system 30 can be through the configuring of marker 50, as described above (see FIGS. 37*a* to 39*d*). In yet another form, the configuration of the improved or preferred feeding position of paintball feeding system 30 can be through the configuring of marker 50 and paintball hopper 63, as illustrated in FIGS. 40*b* and 40*c*. For example, marker 50 of paintball feeding system 30 can be configured with a moveable and/or positional feed tube 64 (see FIG. 38*a-c*), while paintball hopper 63 of paintball feeding system 30 can be configured with a moveable and/or positional feed neck 65 (see FIG. 40*a-c*).

Further, in another form, paintball hopper 63 of feed system 30 can be configured with or be connected to actuator 195 to allow the assisted positioning of paintball hopper 63, as described above. Again, in one form, feed system 30 can include circuit board 66 connected with actuator 195. There by, allowing user 10, through controls 77 (see FIG. 5) connected with circuit board 66, to position and/or reposition feed system 30 into an improved feeding arrangement and/or configuration. Also, in another representative form, feed system 30 can also include sensors, such as tilt sensors 48, connected with circuit board 66. There by, allowing circuit board 66 to automatically configure paintball hopper 63 and/or marker 50 of paintball feed system 30 into an improved feeding arrangement and/or configuration.

Figure 41A:
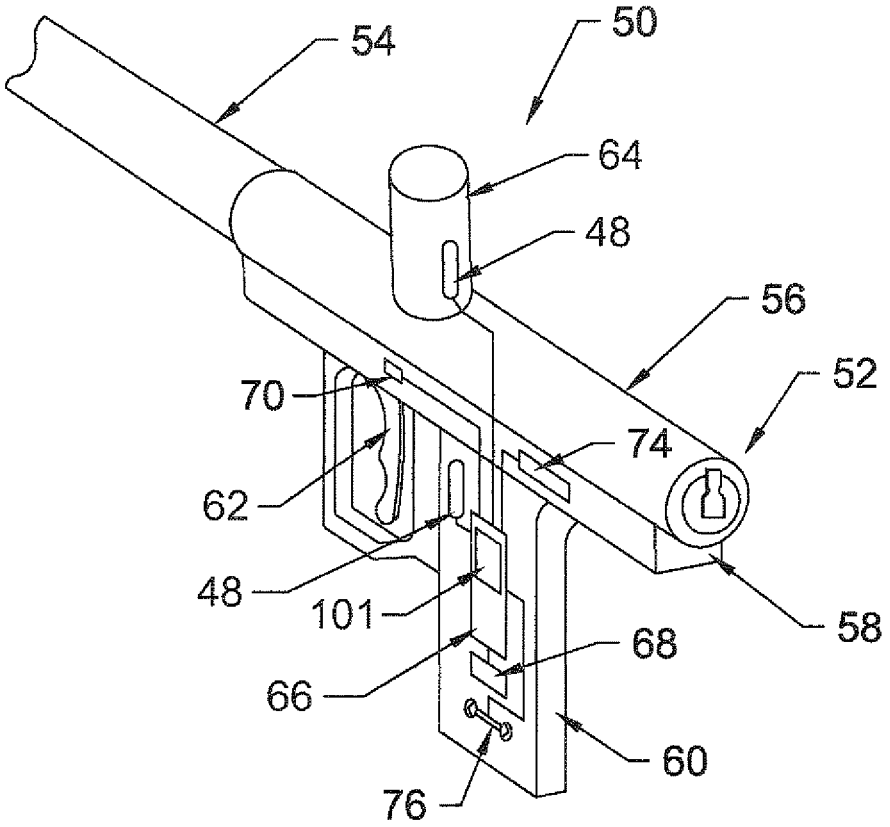
FIG. 41*a* is a cross-sectional view of an illustrative compressed gas projectile accelerator.
Figure 41B:
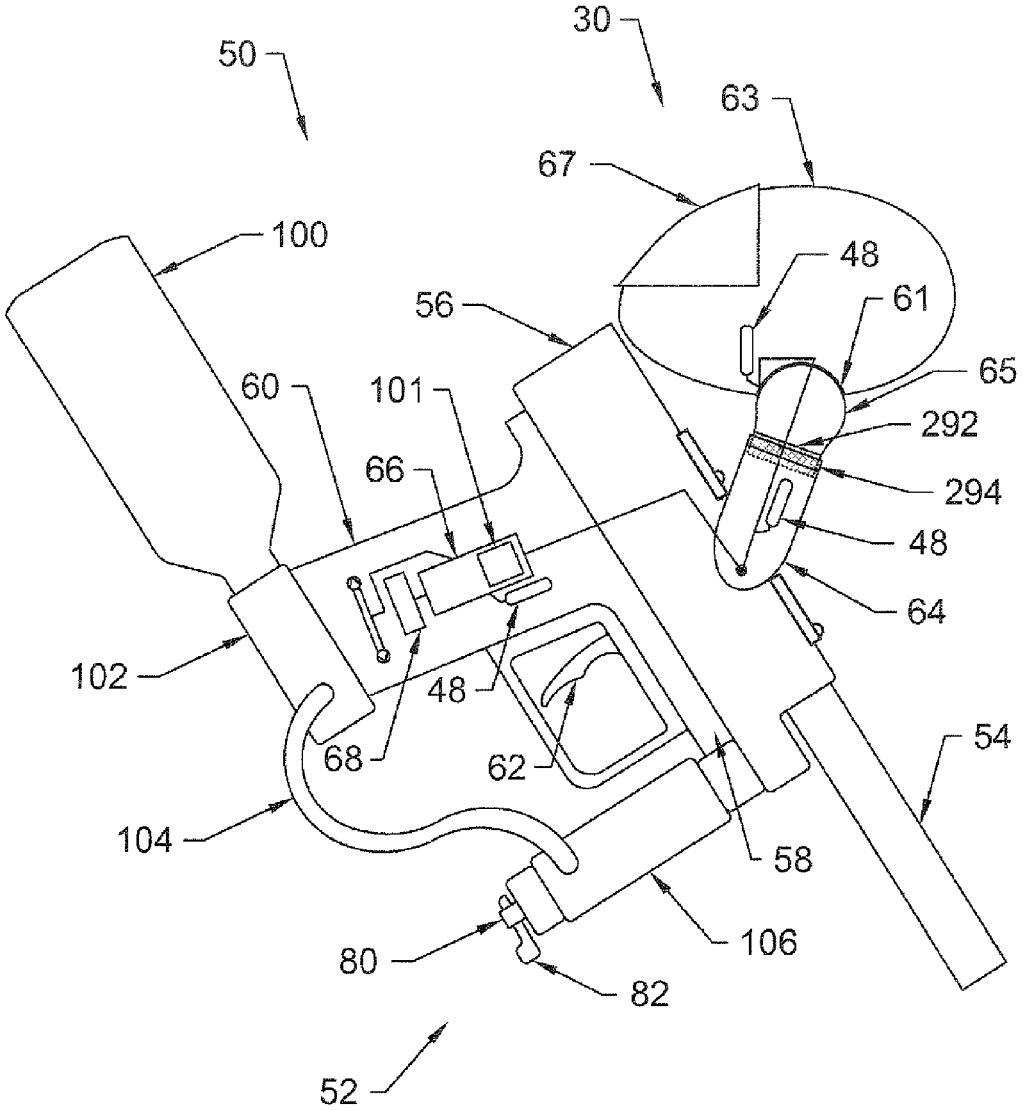
FIG. 41*b* illustrates a side view of compressed gas projectile accelerator including an assisted loading mechanism.

Referring collectively to FIG. 41*a-b*, in this representative form, paintball marker 50 includes a plurality of tilt sensors 48 connected with circuit board 66. In this form, tilt sensors 48 connected with circuit board 66 can be configured to sense and/or measure the tilt position, angular position, and/or axial position of components or members of marker 50. In one form, tilt sensors 48 can be configured to sense and/or measure the position of components or members in comparison or reference to other components or members of marker 50. In another form, tilt sensors 48 can be configured to sense and/or measure the position of components or members in comparison or reference to the ground G. For example, tilt sensor 48 illustrated in grip frame 60 can be configured to sense the tilt or angular position of marker 50 or its members in reference to the ground G, while tilt sensor 48 illustrated as part of the feed tube 64 and/or hopper 63 can be configured to sense the tilt or angular position of the paintball feed system 30, in reference to other members of marker 50.

In one representative form, elements or members of marker 50 can be connected, such as tilt sensors 48, and/or connected to circuit board 66 through a detachable or separable connection. For example, as illustrated in FIG. 41*b*, tilt sensor 48 of paintball hopper 63 can be connected to circuit board 66 in grip frame 60 through connector or link 292 and connector or link 294. In one form, connector 292 of feed neck 65 can be configured to mate and/or connect to connector 294 of feed tube 64 when paintball hopper 63 is connected to or companioned with marker 50. In another representative form, elements or members of marker 50 can be connected, such as tilt sensors 48, and/or connected to circuit board 66 through included data links or transfer elements, as set forth in greater detail below.

Similar to an above form (see FIG. 5), tilt sensors 48 can comprise an electrolytic tilt sensor, an electronic clinometer or inclinometer, an accelerometer, a piezoelectric accelerometer, a gyro sensor, a full motion sensor, or any other suitable type of sensor. Although tilt sensors 48 are illustrated as being housed in grip frame 60, feed tube 64, and paintball hopper 63 it should be appreciated that these elements can be located in other locations of marker 50. Also tilt sensors 48 can be combined into a single member or element.

Figure 42:
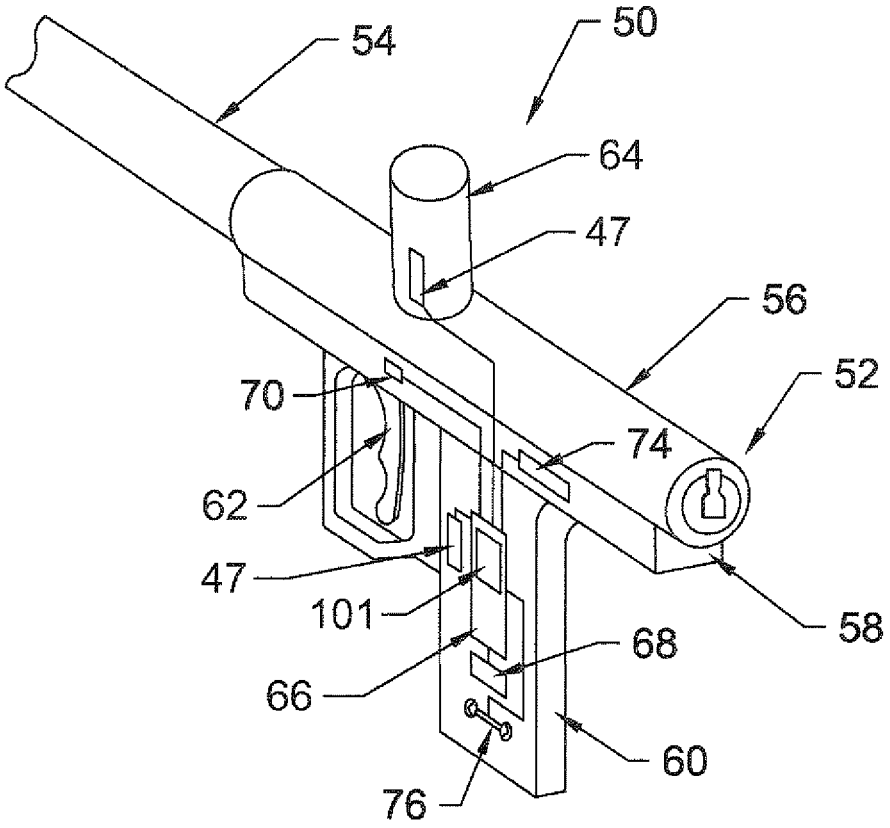
FIG. 42 is a cross-sectional view of an illustrative compressed gas projectile accelerator.

Referring to FIG. 42, in another representative form, paintball marker 50 includes a plurality of motion sensors 47 connected with circuit board 66. In this form, motion sensors 47 can be configured to sense, detect and/or measure the motion and/or movement of marker 50 or its members. For example, in one form, motion sensors 47 connected with circuit board 66 can be configured to sense, detect and/or measure the motion and/or movement of marker 50, as described above (see FIG. 5); and in another form, motion sensors 47 can be configured to sense, detect and/or measure the motion and/or movement of a member or component, such as a paintball feed system (see FIGS. 35 and 36).

Similar to an above form (see FIG. 5), while motion sensors 47 is illustrated housed in the grip frame 60 and feed tube 64, it should be appreciated that these elements can be positioned in other locations on marker 50. Also, motion sensors 47 can comprise a manual sensor, electronic sensor, pneumatic sensor, or any other suitable type of motion sensor for detecting and/or measuring the motion and/or movement of marker 50. Further, motion sensors 47 can be combined into a single member or element. Again, in one representative form, elements or members of marker 50 can be connected, such as motion sensors 47, and/or connected to circuit board 66 through a detachable or separable connection, as described above. Also, in another representative form, elements or members of marker 50 can be connected, such as motion sensors 47, and/or connected to circuit board 66 through included data links or transfer elements, again as set forth in greater detail below.

Figure 43:
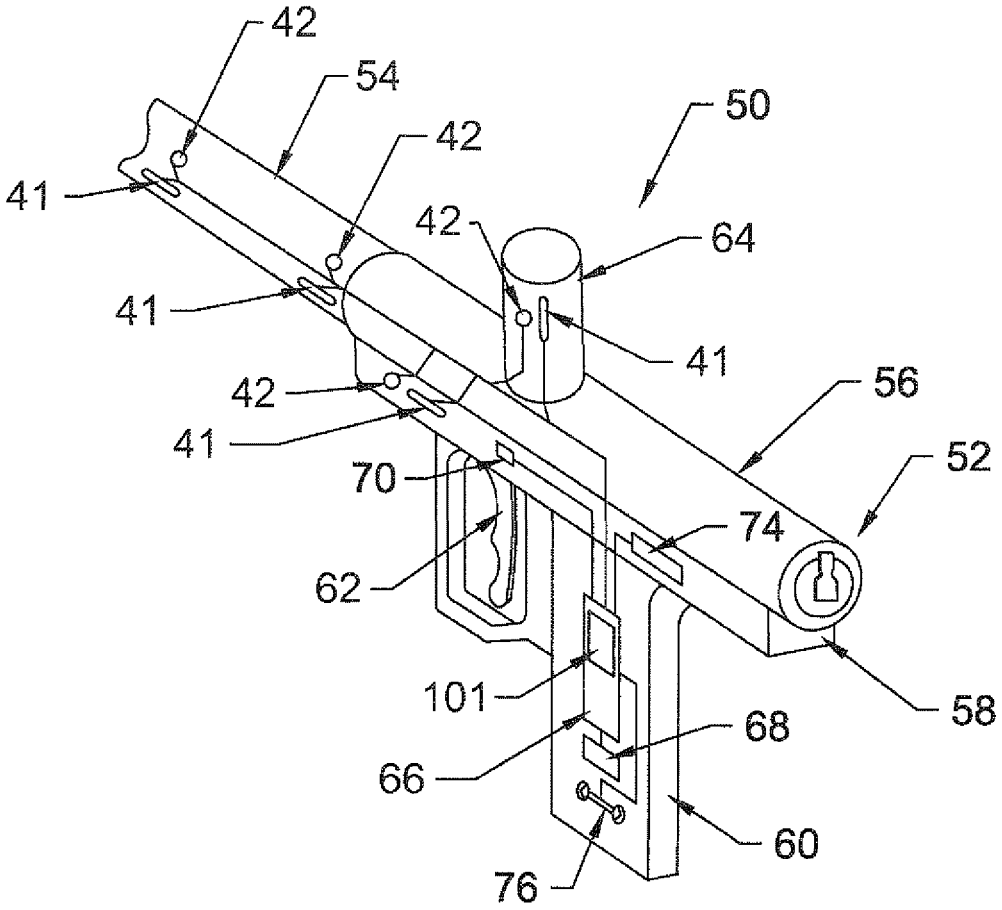
FIG. 43 is a cross-sectional view of an illustrative compressed gas projectile accelerator.
Figure 44:
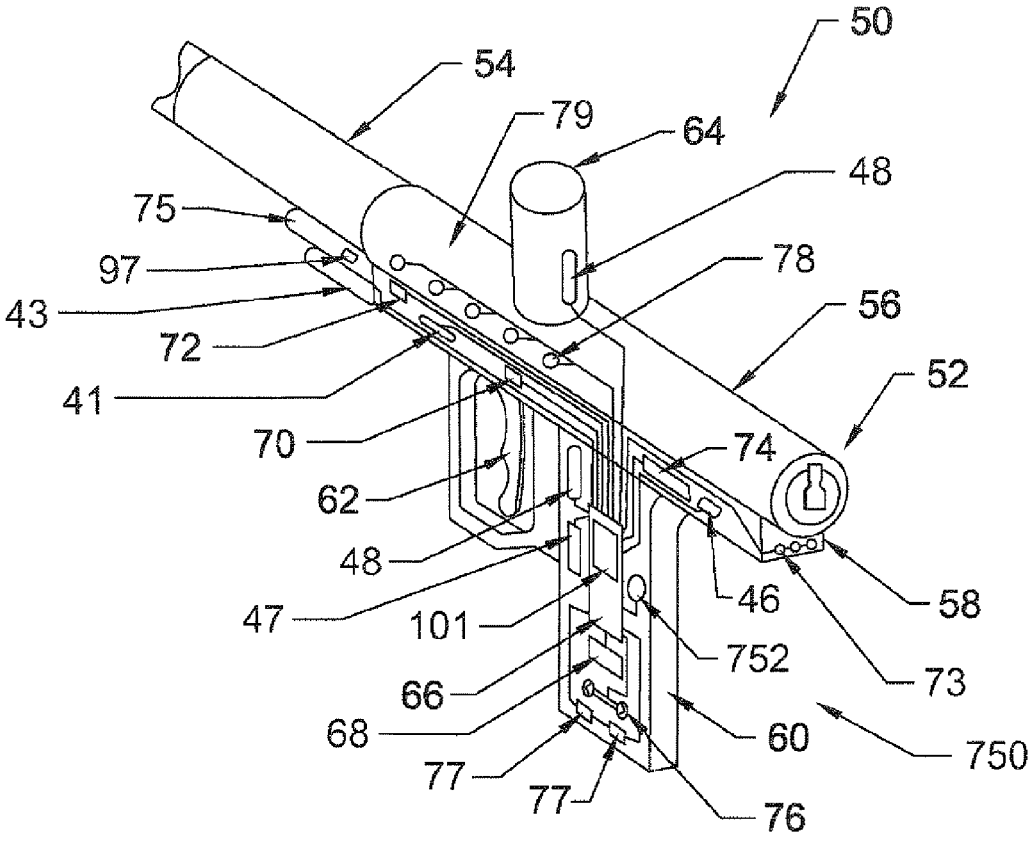
FIG. 44 is a cross-sectional view of an illustrative compressed gas projectile accelerator.
Figure 45:
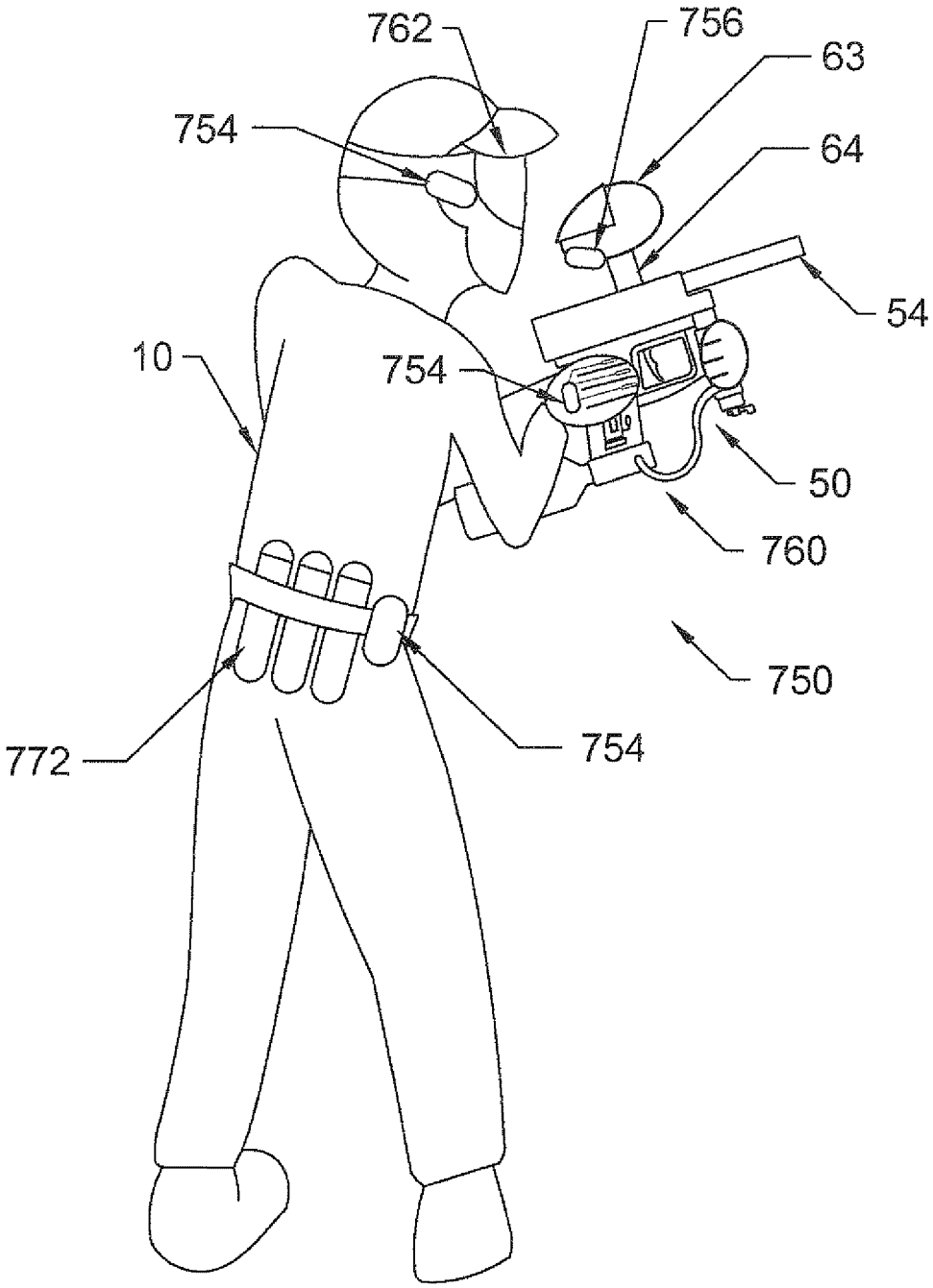
FIG. 45 illustrates a player with a compressed gas projectile accelerator and associated projectile equipment including a linked informational system.

Referring to FIG. 43, in another representative form, paintball marker 50 includes a plurality of vibration/sound sensors 41 connected with circuit board 66. In one form, paintball marker 50 includes a plurality of acoustical and/or vibration output devices and/or members 42. As described above (see FIG. 5), vibration/sound sensors 41 can be configured to allow the collection, reading, and/or analysis of vibrations, audible level noises, inaudible noises and/or sub level noises produced by marker 50 or its members. Also, in another form, in cooperation with vibration/sound sensors 41, acoustical/vibration output devices 42 can be configured to send, produce, and/or transmit anti sound waves and/or sound canceling signals; as well as, anti vibration waves and/or vibration canceling signals.

Again, similar to an above form, while vibration/sound sensors 41 are illustrated housed in the barrel 54, grip frame rail 58, and feed tube 64, it should be appreciated that these elements can be positioned in other locations on marker 50. Also, it should be appreciated that acoustical/vibration output devices 42 can be positioned in other locations on marker 50 as well. Vibration/sound sensors 41 and/or acoustical/vibration output devices 42 can be combined into a single member or members, and/or configured into or with other members or components of marker 50. Vibration/sound sensors 41 could comprise a sonic sensor, audio sensor, acoustic sensor, vibration sensitive sensor or any other suitable type of sensor for the measuring and/or sensing acoustical sounds and/or vibrations of marker 50 or its members.

Again, in one representative form, elements or members of marker 50 can be connected, such as vibration/sound sensors 41, and/or connected to circuit board 66 through a detachable or separable connection, as described above. Also, in another representative form, elements or members of marker 50 can be connected, such as vibration/sound sensors 41, and/or connected to circuit board 66 through included data links or transfer elements, again as set forth in greater detail below.

Referring collectively to FIG. 44, FIG. 45, and FIG. 46*a-b*, a representative form of a linked or networked paintball system 750 is illustrated. In one form of the above form, linked paintball system 750 can be configured that allows most, if not all, of paintball equipment used by user 10 to be linked and/or sharing data. In one form, linked system 750 can be configured with marker 50 that includes a data or information system 760 that informs or transmits the operational status, condition, or parameters of marker 50 and/or other paintball equipment, to user 10 and/or other paintball equipment. Information system 750 can be further configured to inform, guide, warn, and/or instruct user 10 of other operational information, as well as, overall game information. In another form, information system 750 can be configured to share, inform, instruct, and/or transmit the operational status, condition, instructions, or parameters of paintball equipment or equipment members with other paintball equipment or equipment members. In one form, information system 750 includes transfer elements or data links 752 connected with a circuit board 66, such as circuit board 66 of marker 50, as described above (see FIG. 5). The transfer elements or data links 752 can comprise a laser, an optical eye, a LED sensor, an infrared sensor, an infrared transmitter, R.F. sensor, R.F. transmitter, sonic sensor, sonic transmitter, or any other suitable type of transmitter, receiver, and/or sensor.

In one representative form, selected operational information is sent or transferred to a player unit or element 754 that is worn, affixed, and/or attached to user 10 and/or to equipment that is worn, affixed, and/or attached to user 10, such as, the paintball pod harness 772 or goggle system 762. For example, player unit 754 can be configured with a signaling or informing unit, which is a vibrating unit or device 757 in this form. Player unit 754 can be attached to user 10, such as, on the belt of user 10, to inform user 10 of significant information (i.e.—a low compressed gas pressure signal from pressure sensor 46 or a fouled breech signal from breech sensor 78 (see FIG. 5)), through detectable vibrating signals. Further, information indicated and/or displayed through indicators 73 of marker 50, as described above (see FIG. 5), can be additionally indicated and/or displayed through indicators 73 configured into the goggle system 762 of user 10 (see FIG. 46*a-b*). Also, the player unit 754 can be configured into or connected with said goggle system 762 of user 10. In one form, indicators 73 connected with player unit 754, of said goggle system 762 are configured to allow user 10 to receive information without looking away from a target.

In one form, player unit 754 can be configured with an acoustical device or element 755 affixed or attached to the goggle system 762 of user 10, such as, on the protective face/ear covering. In another form, the acoustical element 755 of player unit 754 can be incorporated into and/or housed into the goggle system 762 of user 10. Further, in one representative form, the acoustical element 755 of player unit 754 can be configured to allow user 10 to again receive information without looking away from a target. For example, acoustical element 755 of player unit 754 could inform user 10 of the proper angle(s) of barrel 54 for lobbing paintballs onto target 12*b* (see FIG. 4). Thus, user 10 could position barrel 54 in a lobbing angle without looking at indicators 73 on marker 50.

While some paintball markers of today send or transmit a signal to the paintball hopper 63 that the marker has fired a paintball and another paintball needs to be loaded; none transmit operational information directly to the user 10. Also, some paintball markers and paintball hoppers of today are configured with game play information, such as a game timer, none transmit this game play information to the user in an effective and/or efficient manner. Further, while some goggle systems can include acoustical game timers, none of the goggle systems of today include operational information of the marker and/or the paintball hopper. Those skilled in the art would recognize that most, if not all, the paintball equipment, such as, the marker 50, the paintball hopper 63, the goggle system 762, the paintball pod harness 772, etc. can be linked together. Also, said paintball equipment can be linked with a user 10. Further, a user 10 can be linked to said paintball equipment. For example, the goggle system 762 can be configured with a data link 752 that allows user 10 to control one or more operating parameters of marker 50. In one form of the above form, data link 752 can be configured with an audio pick up or microphone 764 (see FIG. 46*a-b*), there by allowing user 10 to acoustically control marker 50, such as, "marker semi auto mode" to change marker 50 to semi automatic fire mode, "marker energy saving mode" to change marker 50 to a set energy saving fire mode (as set forth in greater detail below), "marker 10 RPS" to change the RPS of marker 50 to 10 rounds per second, etc.

Further, player unit 754 can be configured with a controller, such as, circuit board 66 connected with a power source 68. In one form, circuit board 66 can be connected and/or configured with sensors, as described herein. For example, player unit 754 with a data link 752 can be configured with motion sensor 47 (see FIG. 5) attached to goggle system 762, thus user 10 can control one or more operating parameters of marker 50 through programmed head gestures.

In another form, information system 750 includes a paintball hopper unit or element 756. Hopper unit 756 can be configured with a data link 752, there by allowing the operational status, condition, or parameter information of hopper 63 to be transferred, transmitted, or shared with marker 50 and/or user 10 through player unit 754. In one form, hopper unit 756 can be configured with a controller, such as, circuit board 66 connected with a power source 68. In another form, hopper unit 756 can be configured with an existing controller and/or power source of hopper 63. In one form, circuit board 66 can be connected and/or configured with sensors, as described herein. For example, hopper unit 756 with a data link 752 can be configured with sensors or a sensor array, similar to breech sensor 78 (see FIG. 5), to monitor or determine the status and/or condition of paintball hopper 63, such as whether or not paintball hopper 63 has a low level of paintballs or paintball hopper 63 is fouled with broken paintballs.

In another form, hopper unit 756 with a data link 752, in communication with circuit board 66 of marker 50, can be configured to control or influence one or more operating parameters of marker 50. For example, part of information system 750 can include circuit board 66 of marker 50 configured with data link 752 and hopper unit 756 configured with data link 752. Another part of information system 750 can include player unit 754 configured with data link 752 incorporated into and/or housed into or on the goggle system 762; player unit 754 in this illustrative example includes acoustical element 755 and indicators 73. Hopper unit 756 senses a low level or quantity of paintballs in the reservoir or cavity of paintball hopper 63 through a connected conditional sensor array, as described above. Hopper unit 756 shares this determined value with circuit board 66 of marker 50 and player unit 754 through transmitted signals from and to respectively connected data links 752. Thus, circuit board 66 of marker 50 reduces the RPS limit from 13 RPS to 10 RPS, as pre configured and/or programmed by user 10. Also, user 10 being aware of or alerted to the status of paintball hopper 63 through the acoustical element 755, as well as the visual indication or alert from indicators 73 of player unit 754 of goggle system 762, is able to refill paintball hopper 63 before running out of paintballs.

Figure 46A:
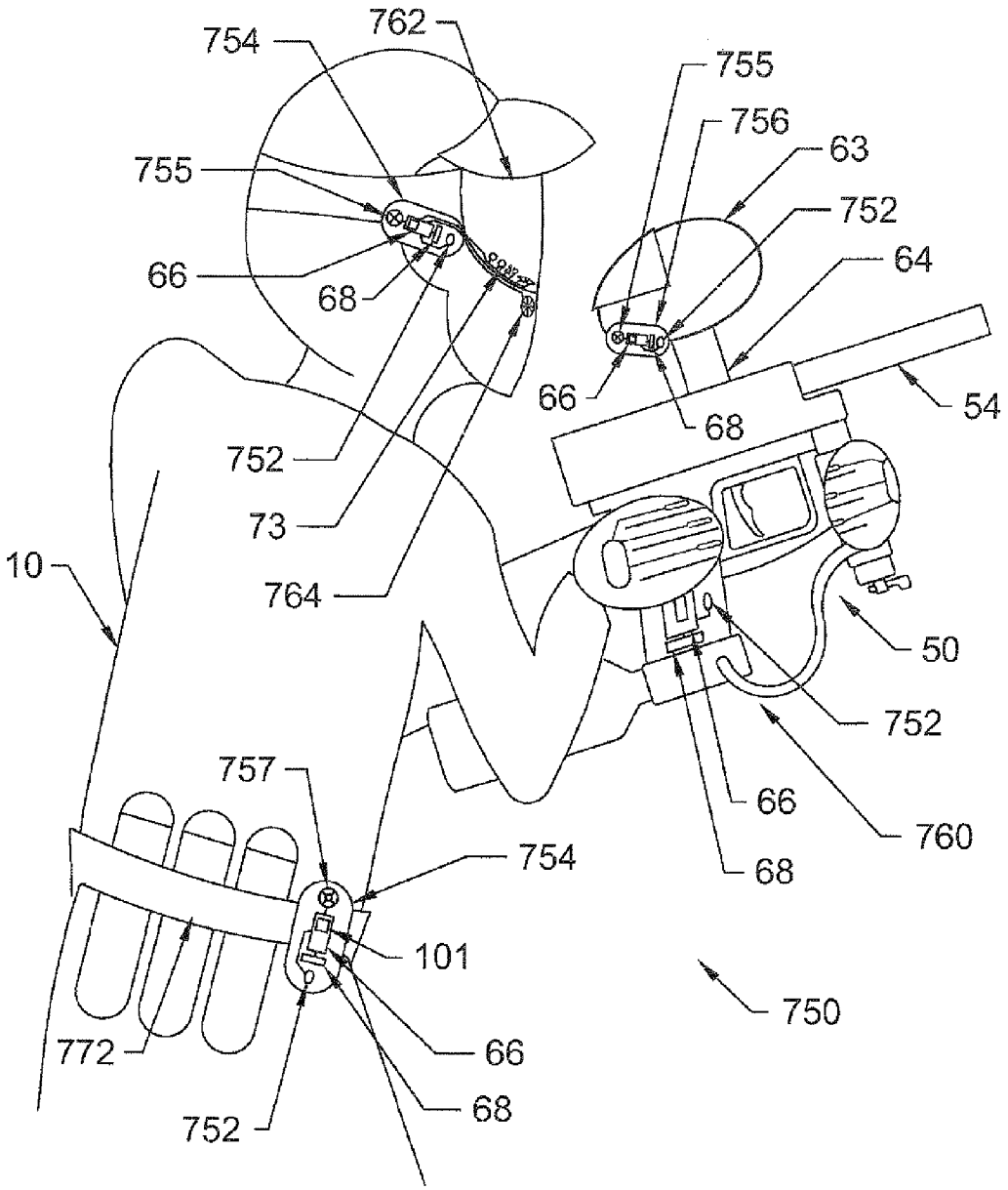
FIG. 46*a* illustrates a portion of a player with a compressed gas projectile accelerator and associated projectile equipment including a linked informational system.
Figure 46B:
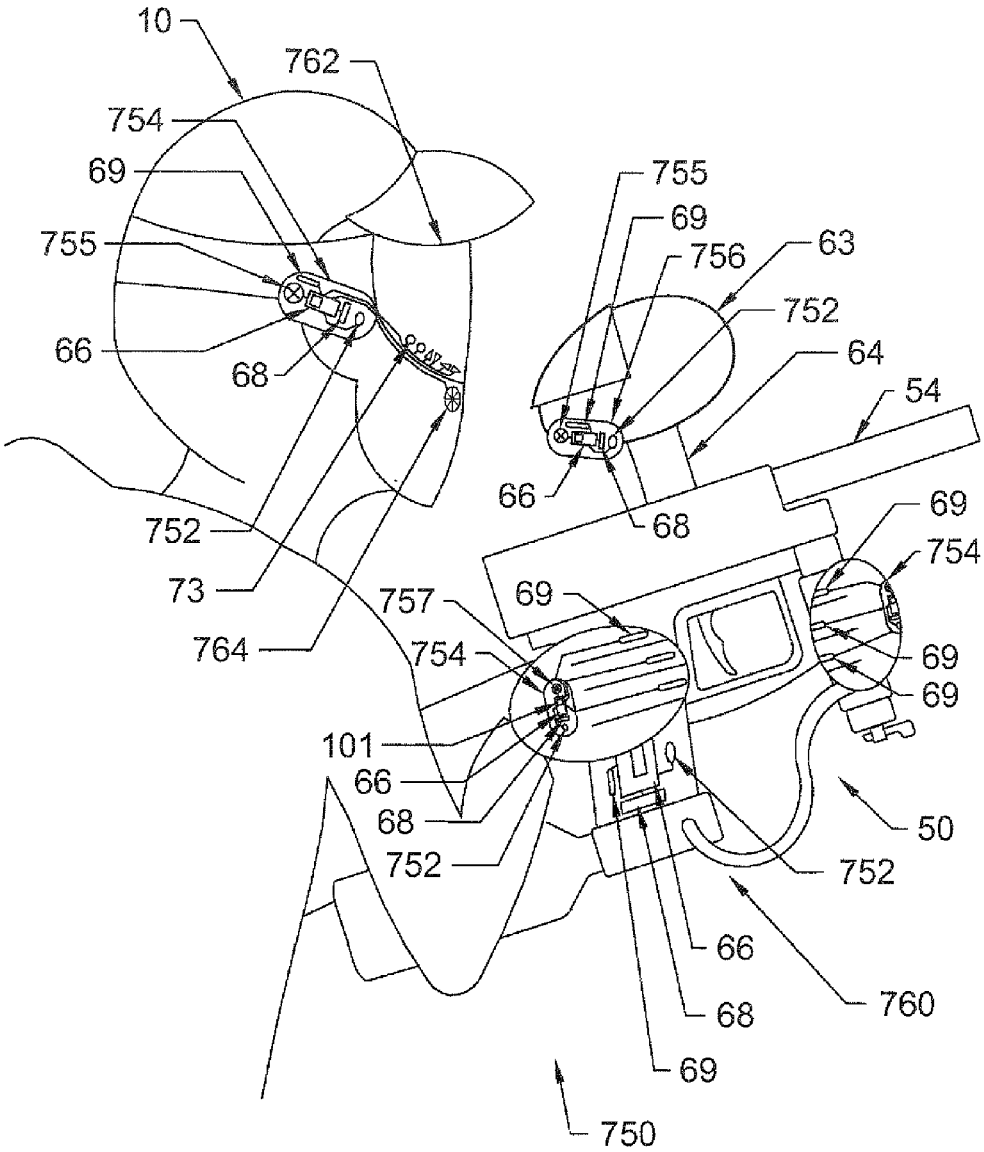
FIG. 46*b* illustrates a portion of a player with a compressed gas projectile accelerator and associated projectile equipment including a linked informational system.

In another representative form, units or elements of linked system 750, as well as, other paintball equipment of user 10, can be configured to include proximity and/or relationship components 69 (see FIG. 46*b*). In one form, proximity components 69 can react to, confirm, consider, measure, and/or analyze their relationship to other proximity sensors 69. In another form, proximity components 69 can react to, confirm, consider, measure, and/or analyze their lack of relationship to other proximity components 69. In one form, proximity components 69 can be configured to be a transmittal and/or contributive component in nature or design. In another form, proximity components 69 can be configured to be a receptive and/or receiver able component in nature or design. Further, in one form, proximity components 69 can be configured to be a transmittal and/or contributive component in nature or design, while also being, a receptive and/or receiver able component in nature or design. In one representative form, proximity components 69 and/or members of proximity components 69 can be configured to be passive and/or reactive in nature or design. While in another representative form, proximity components 69 and/or members of proximity components 69 can be configured to be responsive and/or active in nature or design. Proximity and/or relationship component 69 of linked system 750 can comprise an optical eye or component, a LED sensor or component, a magnetic sensor or component, a sonic sensor or component, a radar, an infrared sensor or component, a laser sensor or component, R.F. sensor or component, or any other suitable type of proximity and/or relationship sensor or component.

In one representative form, information system 750 can be configured with a plurality of relationship components 69 in or on the paintball equipment and/or elements of user 10. While, in another form, information system 750 can be configured with a plurality of relationship components 69 in or on the paintball playing field or area, such as, in the obstacles or bunkers. In yet another form, linked system 750 with proximity components 69 can be configured to measure, confirm, consider, and/or analyze their relationship to other proximity components 69 of other players and/or their lack of relationship to other proximity components 69 of said other players.

In one form, linked information system 750 can include a plurality of circuit boards 66 configured with a plurality of relationship components 69. In one form of the above form, the circuit boards 66 with connected relationship components 69 can be configured to control, adjust and/or change one or more of operating parameters of a user's elements and/or equipment, such as marker 50. For example, when user 10 is in close proximity to an opponent, marker 50 would automatically switch to an energy saving mode and/or a safety mode, as described above. In another illustrated example, user 10 trips and drops marker 50. Circuit board 66 of marker 50 would go into stand by mode from determined value of the separation of the proximity components 69 in user's 10 gloves and the proximity components 69 in marker 50.

Further, in another illustrated example, user 10 has configured goggle system 762 of information system 750 to primarily display the determined tilt angle for barrel 54 of marker 50, through indicators 73 when lobbing paintballs at an opponent, such as target 12*b*, as described above. User 10 has also configured player unit 754 attached to goggle system 762, with proximity component 69 connected to circuit board 66, to switch display or indication modes of indicators 73 when a respective proximity component 69 of user's 10 glove is in relationship to a proximity component 69 of player unit 754 of goggle system 762. There by, allowing user 10 to switch between information displayed with indicators 73 by positioning a non trigger finger near player unit 754 of goggle system 762. Such as, no finger proximity component 69=determined lobbing angle display, first finger proximity component 69=operational status of marker 50 display, second finger proximity component 69=operational status of paintball hopper 63 display, third finger proximity component 69=overall game information display, first and second finger proximity components 69=mute of acoustical element 755 of player unit 754 of goggle system 762, etc.

In another representative example, user 10 can configure paintball pod harness 772 to release and/or open a paintball pod when a proximity component 69, of user's 10 glove, is in relationship with a proximity sensor 69 of paintball pod harness 772. Also, paintball hopper 63 can be configured to self open with an actuator, such as actuator 195 (see FIG. 15 and FIG. 22*a-c*), when a proximity component 69 in user's 10 glove or in a paintball pod, is in relationship with a proximity component 69 of paintball hopper unit 756. Further, hopper 63 can be configured to automatically reposition, to ease the loading of paintballs, through paintball feed system 30 (see FIG. 37*a-f*), when a proximity component 69 in user's 10 glove, is in relationship with a proximity component 69 of paintball hopper unit 756.

Those skilled in the art would recognize that some of the sharing, linking, and/or communicating between paintball equipment and/or elements of information system 750 can be configured physically or mechanically. For example, circuit board 66 of marker system 760 can be connected, linked, and/or in association with paintball hopper 63 and hopper unit 756 through physical connections, such as, connector or link 292 and connector or link 294 (see FIG. 41*b*). Also, it would be recognized that particular, specific, and/or individual information systems 750 can be configured and/or linked into a group information system, such as, a team informational sharing system. For example, user 10 could be aware that a fellow team member is running low on compressed gas and has switched to an energy saving mode, through the grouping of the team's systems 750. Thus, user 10 could take over the fellow team member's pregame assigned longer shots and said fellow team member could be assigned a new duty or position on the play field. Also, the viewing audience or spectators can be informed of the situation and alerted to watch for said fellow team member to make a move up the field.

Further, it would be recognized by those skilled in the art, that the units, components, and/or members of the information system 750 can be configured to include a plurality of electronic circuit boards 66 that are configured to monitor and/or control various functional aspects of the paintball equipment of user 10, such as marker 50, paintball hopper 63, goggle system 762, paintball pod harness 772, etc. Also, said plurality of electronic circuit boards 66 of system 750 can be connected with controls and/or sensors, as described herein. In one representative form, the units, components, and/or members of the information system 750 that include a circuit board 66, can be configured to include a processor 101 that is programmable to execute one or more software routines, as illustrated in player unit 754 of the paintball pod harness 772 (see FIG. 46*a*) and/or player unit 754 of the player hand wear or gloves (see FIG. 46*b*). Processor 101 can comprise a microprocessor or microprocessors that include on-board memory for storing executable program code and/or memory may be connected with processor 101.

Still further, it would be recognized by those skilled in the art, that the components and/or members of the information system 750 can be configured, housed, or laid out in a different manner or method. Also, the linking, sharing, communicating, and/or exchange of instructions, information, determined values, and/or status conditions can be configured or laid out in a different manner or method.

Referring collectively to FIGS. 1 to 46; in one representative form, projectile accelerator 50 comprises an on the fly velocity adjustment feature or method, which is operable to allow user 10 to manually and/or selectively adjust the velocity at which paintballs are expelled from barrel 54 of marker 50 at a range of velocities ranging from an upper velocity setting to a lower velocity setting. In another form, marker 50 includes a velocity adjustment feature or method that is automatically configured to adjust the velocity at which paintballs are expelled from barrel 54 of marker 50 at a range of velocities ranging from an upper velocity setting to a lower velocity setting; as well as a RPS setting and/or a firing mode. In yet another form; marker 50 includes a velocity adjustment method that suggests or advises user 10 of possible velocity settings and/or their value, ranging from an upper velocity setting to a lower velocity setting, as well as possible angles of barrel 54, RPS setting, and/or fire mode for the elimination of a selected target.

In another form, user 10 is illustrated firing projectiles or paintballs at target 12*a*, using a marker 50 set or configured to expel paintballs at an upper velocity setting (see FIG. 3). User 10 is firing said projectiles at target 12*a* in a semi automatic firing mode. User 10 then engages target 12*b*, which is behind obstacle 16, with marker 50 which includes distance sensor 75, indicators 73, and tilt sensors 48 connected with circuit board 66 (see FIG. 5). Circuit board 66 of marker 50 being aware of the distance to target 12*b* through distance sensor 75 can calculate or determine one or more angles for barrel 54 and then indicate the proper angle(s) of barrel 54 to user 10 through tilt sensors 48 and indicators 73.

As an example, as illustrated in FIG. 6*a*, circuit board 66 is configured to illuminate either the up or down arrows of indicators 73 to inform user 10 which way to move barrel 54 of marker 50 to place marker 50 at the one or more calculated angles. The circular shaped light of indicators 73 is used to inform user 10 that marker 50 has been positioned at a proper angle. Once user 10 positions marker 50 in a respective calculated angle, circuit board 66 can calculate or determine the proper projectile velocity settings required to lob projectiles or paintballs on to target 12*b*. In one form of the above form, circuit board 66 automatically controls one or more operating parameters of marker 50 to achieve said calculated velocity settings for user 10. User 10 then presses trigger 62 thereby causing marker 50 to expel projectiles from marker 50 at the plurality of calculated velocities. For example, in 5-shot burst mode, marker 50 automatically expels five paintballs at five different velocities at target 12*b*. In the alternative, marker 50 could be set to expel projectiles in a lobbing manner at the same velocity.

In another form, user 10 again engages target 12*b* which is behind obstacle 16 with marker 50 which comprises distance sensor 75, indicators 73, and tilt sensors 48 connected with circuit board 66 (see FIG. 5). Circuit board 66 of marker 50 knowing the distance to target 12*b* through distance sensor 75 indicates to user 10 one or more calculated barrel 54 angle(s) and velocity setting(s) (see FIG. 6*a*-6*c*) through indicators 73, in order to lob projectiles on to target 12*b*. In this form, although circuit board 66 has calculated the velocity and preferred angle, user 10 may have set a preference, via controls 77, for manual adjustment of the velocity using either velocity controller 76 or velocity adjustment mechanism 52. Once user 10 has adjusted the velocity setting to the calculated setting, circuit board 66 is configured to illuminate an indicator 73 thereby informing user 10 that the calculated velocity setting has been reached. As with the previous form, circuit board 66 can also be configured to illuminate indicators 73 informing user 10 that the velocity setting needs to be increased or decreased in order to reach the calculated velocity setting. For example, the up and down or right and left indicators 73 illustrated in FIG. 6*a* could be used.

In one form, user 10 can configure marker 50 to recognize and/or add value to a preference for a velocity setting or velocity settings between an upper velocity setting and a lower velocity setting. Also, user 10 can configure marker 50 to recognize and/or add value to a preference for an angle or angles of barrel 54. For example, user 10 is firing projectiles or paintballs at target 12*a*, using a marker 50 set or configured to expel paintballs at an upper velocity setting (see FIG. 3). User 10 then engages target 12*b* with marker 50 which includes distance sensor 75, indicators 73, and tilt sensors 48 connected with circuit board 66 (see FIG. 5). Circuit board 66 knowing the distance to target 12*b* through distance sensor 75 can calculate one or more angles for barrel 54 and one or more velocity settings between an upper velocity setting and a lower velocity setting. User 10 having preset a preference for a preferred angle of barrel 54, circuit board 66 can determine if one or more of calculated velocity settings are appropriate, that is, for the user preferred angle at that determined distance. If so, circuit board 66 can configure marker 50 to expel projectiles at the proper velocity setting, in one form, or guide user 10 to the proper velocity setting through indicators 73, in another form. User 10 then positions barrel 54 in the user pre selected angle through indicators 73.

If the pre selected preferred angle for barrel 54 does not have a matching calculated velocity setting for target 12*b*, circuit board 66 can inform user 10 of closest calculated angle for barrel 54 through indicators 73, circuit board 66 can then calculate a velocity setting for marker 50 when user 10 positions barrel 54 in said closest calculated angle. Thus, circuit board 66 can calculate one or more velocity settings for an angle of barrel 54 and/or circuit board 66 can calculate one or more angles of barrel 54 for a velocity setting.

In another form, user 10 is firing projectiles at target 12*a*, using marker 50 set or configured to expel paintballs at an upper velocity setting (see FIG. 3). User 10 again is firing projectiles at target 12*a* in semi automatic mode. User 10 then engages target 12*b* which is behind obstacle 16 with marker 50. In this form, circuit board 66 of marker 50 is configured for burst mode (i.e. 5 shot burst per trigger pull) when marker 50 is lobbing projectiles between an upper velocity setting and a lower velocity setting. Tilt sensors 48 of marker 50 can be configured to selectively select between fire modes of circuit board 66.

In another form, circuit board 66 is configured to automatically selectively select between different firing modes of marker 50 as a function of signals received from tilt sensors 48. For example user 10 is firing at target 12*a* in semi automatic mode, and then fires at target 12*b* in 5 shot lobbing burst mode by positioning marker 50 in a calculated or predetermined angle as before. This pre programmed self selection of the firing mode is determined by the angle of the marker 50 through tilt sensors 48 and circuit board 66. Marker 50 is configured to selectively select or self select the semi automatic mode when user 10 returns to firing at target 12*a* as a function of tilt sensors 48 and circuit board 66.

The automatic or self selection of the upper velocity setting in the semi automatic mode from the lobbing burst mode, would also occur when target 12*b* came around obstacle 16 and was exposed to user 10, thereby giving user 10 a more direct shot at target 12*b*. This automatic selection of the upper velocity setting in the semi-automatic mode can be a function of the sensor reading received by circuit board 66 from tilt sensor 48. As marker 50 is tilted or positioned along latitudinal axis LA-LA (see FIG. 32), such that barrel 54 is positioned at a predetermined angle relative to the ground G, circuit board 66 is programmed or configured to automatically switch firing modes. For example, in this mode of operation, if tilt sensor 48 senses that marker 50 is positioned at an angle anything less than 35° relative to ground G, circuit board 66 is configured to set marker 50 in semi-automatic straight fire mode such that marker 50 shoots directly at target 12*b*. If tilt sensor 48 senses that marker 50 is positioned at an angle greater than 35° relative to ground G, circuit board 66 is configured to automatically set marker 50 in 5 shot lobbing burst mode. Marker 50 can be configured to fire in any one of a number of straight shot firing modes, such as semi-automatic mode, burst mode, ramp mode or fully automatic mode.

Further, in another form, user 10 is firing projectiles at target 12*a*, using marker 50 set or configured to expel paintballs at an upper velocity setting (see FIG. 3). User 10 is firing projectiles at target 12*a* in semi automatic straight shot mode. User 10 then engages target 12*b* which is behind obstacle 16 with marker 50. In this form, marker 50 comprises the self selecting lobbing burst mode as a function of tilt sensors 48 and circuit board 66 as described above. Further, marker 50 is configured to include a velocity spreader mode, which can be used in conjunction with different fire modes (i.e. semi auto, burst, ramp, full auto, etc.). The velocity spreader mode separates projectiles fired into selected or programmed groups or volleys, and then separates the velocity of the projectiles within these volleys such that each projectile is assigned a distinct velocity. For example in this form, user 10 is engaging targets 12*a*, 12*b* as described before (target 12*a*—upper velocity setting/self selecting semi automatic mode, 12*b*—reduced velocity setting/self selecting lobbing burst mode). In the velocity spreader mode, in this form, the velocity of the projectiles within the lobbing burst mode's volley are separated or spread out (i.e. 5 shots—160-170-180-190-200 FPS). The spread in velocity of the paintballs in substantially arc shaped paths 18, of the self selecting lobbing burst-velocity spreader mode, allows user 10 more coverage and/or control of a larger target area TA and provides for quicker target acquisition. Thus the above configured marker 50 with self selecting lobbing burst mode and velocity spreader mode, allows user 10, on the fly, to engage and eliminate target 12*b* behind obstacle 16 efficiently, while still engaging target 12*a* at will, such as in the semi automatic straight shot mode.

Those skilled in the art would recognize that the above configured marker 50 with lobbing mode and/or velocity spreader mode is programmable for the "semi automatic only" rules used by some paintball venues or fields. For example, in this form, user 10 is engaging targets 12*a*, 12*b* as described above (see FIG. 3), but in semi automatic mode only. As before user 10 switches engagement from target 12*a* to target 12*b* such that the lobbing mode is self selected through the cooperation of tilt sensors 48 and circuit board 66. Then configured marker 50 with the velocity spreader mode cycles though the programmed number of shots as in the burst mode, but one trigger pull at a time (i.e.—5 trigger pulls=160-170-180-190-200 FPS, starting over every 5 trigger pulls). Those skilled in the art would also recognize that the above configured marker 50 with velocity spreader mode is programmable for the full auto or ramp modes (i.e. 160-170-180-190-200 FPS, starting over every 5 shots until trigger activation stops) or (i.e. 160-170-180-190-200 FPS for the first 5 shots, then 200-190-180-170-160 FPS for the next 5 shots; replicating until trigger activation stops).

The number of shots in a spread of the velocity spreader mode is programmable (i.e. 2 shot—burst or spread, 3 shot—volley or spread, 4 shot—group or spread, etc.), and that groups or volleys of the velocity spreader mode can be assembled in clusters and/or collections (i.e. 3 shot group followed by 5 shot group, replicating). Further, it would be recognized that the velocity spread or velocity difference in a group or volley is also programmable (i.e. 5 FPS spread between projectiles, 10 FPS spread between projectiles, etc.). Still further, the position of the calculated velocity is programmable, as well. For example, as in an illustrative form above, 180 FPS is the calculated or determined velocity needed for user 10 to lob projectiles on to target 12*b* which is behind obstacle 16. Also in above illustrated examples; 180 FPS is in the center position of 5 shot group or volley, 2 positions before 180 FPS and 2 positions after, as in 160-170-180-190-200 FPS. This calculated velocity (i.e. 180 FPS) can be programmable set and/or positioned in a group and/or cluster (i.e. {5 shot volley} from: 160-170-180-190-200 FPS, to: 170-180-190-200-210 FPS); or (i.e. {3 shot-5 shot cluster} from: 170-180-190 FPS/160-170-180-190-200 FPS, to: 170-180-190 FPS/170-180-180-180-190 FPS). Further still, it would be recognized that the RPS in a group is programmable and the RPS in a collection of groups is programmable (i.e. {3 shot-5 shot cluster or collection} 13 RPS—rounds per second pace for the 3 shot group and 10 RPS—rounds per second pace for the 5 shot group).

In another form, marker 50 can be configured to include a saturation mode. For example, user 10 engages target 12*b* behind obstacle 16 with marker 50. User 10 is lobbing paintballs onto target 12*b* using the velocity spreader mode arranged into a collection or cluster of 3 groups with 3 shots each. In this example, the middle group in the cluster is part of a programmable saturation mode, while the first and last groups are velocity spreader mode groups, as described above, (i.e.—{first group} 170-180-190 FPS, {second group} 180-180-180 FPS, {third group} 170-180-190 FPS). The saturation mode allows user 10 to program a distinct velocity setting into a group or in a collection of groups. Further, the saturation mode allows user 10 to program a distinct value to a calculated velocity or a velocity setting. For example, marker 50 includes distance sensor 75; circuit board 66 of marker 50, in cooperation with distance sensor 75, determines the calculated velocity setting is 180 FPS for the angle of barrel 54 and for the distance to target 12*b*. User 10 programs marker 50 for the velocity spreader mode in 3 shot groups clustered into 3 groups, as described above. The center group, in this form, is a saturation group that has a distinct value, such as plus 5 FPS (i.e.—{first group} 170-180-190 FPS, {second group} 185-185-185 FPS, {third group} 170-180-190 FPS) or such as minus 5 FPS, as in (i.e.—{first group} 170-180-190 FPS, {second group} 175-175-175 FPS, {third group} 170-180-190 FPS).

The velocity spreader mode configured with the saturation mode, in a collection of groups, allows the velocity spreader groups to act as spotters for the saturation groups. For example, user 10 is lobbing projectiles at target 12*b* behind obstacle 16. Obstacle 16, in this example, is too tall or large for user 10 to conclude whether the projectiles of a single velocity lobbing mode are over shooting target 12*b*. Thus, user 10 configures marker 50 for 3 shot-3 group velocity spreader mode with saturation mode, as described above and as in (i.e.—{first group} 170-180-190 FPS, {second group} 185-185-185 FPS, {third group} 170-180-190 FPS). The first and third groups give user 10 some area coverage of the target area TA and the center group saturates the target area TA. Also, in this illustrated example, the 170 FPS projectiles of first and third groups impact the ground G in front of obstacle 16, while the 180 FPS projectiles of first and third groups impact on said enlarged obstacle 16, thus both can be used by user 10 as trajectory guides, for the other unseen projectiles of the collection. The distinct value of plus 5 FPS added to calculated velocity of 180 FPS allows user 10 to clear the enlarged obstacle 16.

In yet another form, a lobbing fire mode can include or be combined with a spotter round, as illustrated in FIG. 4. For example, a spotter round can be included in or combined with the lobbing burst mode, the lobbing full automatic mode, the lobbing semi automatic mode, the lobbing ramp mode, the velocity spreader mode, etc. Further, a spotter round can be independently programmed to a distinct velocity setting and/or a distinct value. For example, user 10 engages target 12*b*, hiding behind obstacle 16, with marker 50 configured to the spotter round velocity spreader fire mode (see FIG. 4). User 10, in this illustrated form, does not want to possibly pre warn target 12*b* to the forth coming projectiles of the velocity spreader mode, and thus user 10 sets the spotter round to a distinct value of minus 20 FPS. The spotter round falls predicatively short and unseen by target 12*b*, while still allowing user 10 to make any necessary adjustments for the upcoming velocity spreader mode.

In still another form, the velocity spreader mode can be configured as a probing fire mode. In one form, the probing fire mode can allow user 10 to determine a velocity setting, for a barrel angle, to lob paintballs onto a target area TA. For example, user 10, not knowing the distance to target area TA, in this example, position marker 50 in a lobbing angle and set marker 50 to full automatic velocity spreader mode, in a 15 paintball grouping, with a starting velocity setting of 130 FPS. User 10 aims marker 50 towards the target area TA and activates trigger sensor 70, while maintaining the angle of barrel 54. Marker 50 would then expel projectiles in a forward progressive walking manner toward the target area TA. The projectiles would continue progressing or walking toward and overcome the target area TA unless they reached their grouping limit of 15 paintballs. In one form, user 10 can stop the progression of paintballs walking toward target area TA, once the target area is reached, through controls 77. In one form, circuit board 66 of marker 50 can save this stopping point as a determined velocity setting. Thus, user 10 can then use this determined velocity setting to reengage the target area TA, if necessary, without the probing fire mode.

Those skilled in the art, in particularly, those skilled in tournament paintball would recognize that probing fire mode would allow established players to zero in the upper edge of an opponent's bunker or obstacle. Thus, lipping or slightly over shooting the obstacle to eliminate and/or pin down the opponent. For example, in one form, the lipping of an obstacle can allow the user 10 to lob projectiles at an opponent, such as target 12*b*, while maintaining a low angle of barrel 54. While, the lobbing of projectiles, having a reduced velocity setting(s) of a lobbing mode, with a low angle of barrel 54, might allow said opponent to avoid being eliminated; the lipping of paintballs, with a lower velocity setting, over obstacle 16, still allows user 10 to pin down target 12*b* while his/her team mates maneuver. Further still, the low angle of barrel 54 allows user 10 a quicker shot at a possible maneuvering opponent or other targets, such as target 12*a*. Thus, user 10 can select a low arced path, intermediate arced path, and/or a high arced path to lob projectiles at a target, such as target 12*b*, as desired by user 10.

In another form, user 10 is firing projectiles at target 12*a*, using marker 50 set or configured to expel paintballs at an upper velocity setting (see FIG. 3). User 10 then engages target 12*b* which is behind obstacle 16 with marker 50. In this form, marker 50 includes the self selecting lobbing mode as a function of the tilt sensors 48 and circuit board 66; and programmable velocity spreader mode, as described above. Also in this form, marker 50 comprises controls 77. While circuit board 66 is the principal controller, controls 77 are an additional or secondary controller. Controls 77 are a programmable controller for the tuning or adjustment of one or more operating parameters of marker 50. For example, as described, user 10 engages target 12*b* behind obstacle 16 with marker 50, but is shooting into a strong head wind. Controls 77 can be configured to allow user 10 to adjust or tune the reading from distance sensor 75 and/or tilt sensors 48, or their values. Thus, allowing user 10 to properly engage target 12*b* despite the strong head wind.

Further, in another example, user 10 is currently firing projectiles at target 12*b* with marker 50 in the lobbing burst-velocity spreader mode, but is unable to eliminate target 12*b* because of uncontrollable circumstances. However, user 10 is keeping target 12*b* pinned down and effectively out of play of the game. Controls 77 of marker 50 are configured to allow user 10 to adjust the rate of fire or rounds per second (RPS) of the lobbing burst-velocity spreader mode, so that user 10 can pin down target 12*b* more effectively and/or longer before reloading. In another form of the above form, where controls 77 are programmed to adjust the RPS within the lobbing burst-velocity spreader mode of marker 50, controls 77 can be further programmed to switch marker 50 to "semi automatic only" at one end the controller, and to full auto at the other end of the controller; while controlling the RPS of the lobbing burst-velocity spreader mode with the in-between settings of controls 77.

Yet further, in still another example, user 10 is currently firing projectiles at target 12*b* with above configured marker 50 in the lobbing burst-velocity spreader mode, but is unable to currently eliminate target 12*b* because of uncontrollable circumstances, as in the above example. In this example however, user 10 needs to eliminate target 12*b*. If controls 77 of marker 50 were programmed to adjust the spread of the velocity within the lobbing burst-velocity spreader mode (i.e. from 10 FPS programmed velocity spread like 160-170-180-190-200 FPS to a 5 FPS programmed velocity spread like 170-175-180-185-190 FPS). The more concentrated fire of the now adjusted velocity spreader mode will allow user 10 to better eliminate target 12*b* behind obstacle 16, while still having some of the area coverage of the velocity spreader mode. Thus, user 10 can pre program and/or re program the self selecting lobbing fire mode and/or velocity spreader fire mode.

In another form, user 10 is illustrated firing projectiles or paintballs at target 12*a*, using a compressed gas projectile accelerator 50 set or configured to expel paintballs at an upper velocity setting (see FIG. 3). User 10 then engages target 12*b* which is behind obstacle 16 with said marker 50 which includes indicators 73 and tilt sensors 48 connected with circuit board 66 (see FIG. 5). In this form, distance sensor 75 is not connected to circuit board 66 or is not allowed. However controls 77 can be programmed to set the known or estimated distance to target 12*b*. Circuit board 66 of marker 50 knowing the distance to target 12*b* through controls 77 can calculate or determine possible angle or angles for barrel 54 and then indicate said angle(s) of barrel 54 to user 10 through tilt sensors 48 and indicators 73. Once user 10 positions marker 50 in one or more calculated angles, circuit board 66 can automatically calculate or determine the projectile velocity settings required to lob projectiles or paintballs on to target 12*b*.

In another form, user 10 is firing projectiles at target 12*a* and target 12*b* with marker 50. Marker 50 includes distance sensor 75, indicators 73, and tilt sensors 48 connected with circuit board 66 (see FIG. 5). And in this form, marker 50 includes the self selecting lobbing burst mode as a function of the tilt sensors 48 and circuit board 66; and programmable velocity spreader mode, as described above. Also in this form, distance sensor 75 and/or its determined value are programmable and/or re programmable to adjust one or more operating parameters of said marker 50. For example, user 10 is firing projectiles at target 12*a* with marker 50 configured to expel projectiles at an upper velocity setting (see FIG. 3). User 10 then tries to eliminate target 12*a* using the self selecting lobbing burst mode by positioning marker 50 in a predetermined lobbing angle, as described above. Marker 50 being aware of the distance to target 12*a* through distance sensor 75, recognizes target 12*a* is beyond the set or programmed distance limit of the self selecting lobbing burst mode and thus remains in semi automatic mode.

Further, in another example, user 10 is currently firing projectiles at target 12*b* behind obstacle 16, with above configured marker 50 in the self selecting lobbing burst-velocity spreader mode (see FIG. 3), but is unable to eliminate target 12*b* because of uncontrollable circumstances. Target 12*b* moves to get an advantage and runs by user 10. If user 10 engaged now adjacent target 12*b*, marker 50 would self select the semi automatic mode, at the upper velocity setting; as a function of the more level angular position of marker 50 as sensed by tilt sensors 48. Marker 50 knowing the distance to target 12*b* through distance sensor 75 automatically adjusts the velocity setting of marker 50 to a safer and/or lower velocity setting. Many, if not most, paintball fields or venues have a surrender rule for recreational paintball players (i.e. a player is not allowed to shoot another player at 10 feet or closer, one of the players must surrender). This is for the players' safety, because the markers are set at one velocity setting; which comprises the upper velocity setting.

The described safer and/or lower velocity setting for an adjacent opponent or target can be configured as an operational fire mode. This surrender mode, for the sake of brevity, can be configured to be pre programmable and/or re programmable. Such as, the distance to a target or the determined value from distance sensor 75 could be set, reset, and/or adjusted. Also the selected velocity setting for the safer lower velocity setting could be set, reset, and/or adjusted. Also the surrender mode can be configured as the default setting for the lobbing mode, such as a low power source situation. Further, the surrender mode can be user 10 selected through controls 77.

In another form, user 10 is illustrated firing projectiles or paintballs at target 12*a*, using a compressed gas projectile accelerator 50 set or configured to expel paintballs at an upper velocity setting (see FIG. 3). User 10 is also engaging target 12*b* which is behind obstacle 16 with marker 50 in the self adjusting and/or selecting lobbing burst-velocity spreader mode. In this form, marker 50 includes distance sensor 75, indicators 73, and tilt sensors 48 connected with circuit board 66 (see FIG. 5); described above. Additionally, marker 50 includes speed sensor 72 connected with circuit board 66. Speed sensor 72 is configured to permit determination of a velocity of a projectile exiting marker 50. Circuit board 66 is adapted to adjust one or more operating parameters of marker 50 as a function of the velocity determination from speed sensor 72 and the desired velocity setting. Thus, circuit board 66 in cooperation with speed sensor 72 is configured to adjust the velocity of marker 50 to the calculated or desired velocity setting to allow user 10 to engage target 12*b* with the lobbing burst-velocity spreader mode more effectively. For example, user 10 tunes in or verifies marker 50 is performing properly before play starts, such as being under the upper velocity limit and is on target while in the lobbing burst-velocity spreader mode. Then as the ambient temperature and/or the temperature of marker 50 changes the operating gas pressure of marker 50 during play, user 10 can then stay on target in the lobbing burst-velocity spreader mode through speed sensor 72. Also user 10 will not exceed the upper velocity setting when not in lobbing mode when engaging target 12*a*. Further, user 10 will not exceed the RPS setting, as speed sensor 72 can be configured to verify and adjust marker 50 to a RPS setting.

In yet another form, user 10 is firing projectiles or paintballs at target 12*a*, using a marker 50 set or configured to expel paintballs at an upper velocity setting (see FIG. 3). User 10 is also engaging target 12*b* which is behind obstacle 16 in the lobbing burst-velocity spreader mode with marker 50; which includes distance sensor 75, indicators 73, controls 77, tilt sensors 48 and speed sensor 72 connected with circuit board 66 (see FIG. 5). Marker 50 also includes pressure sensor 46 connected with circuit board 66. Pressure sensor 46 is configured to permit determination of the operational pressure of compressed gas and/or its value. Circuit board 66 is configured to adjust one or more operating parameters of marker 50, as a function of the sensed pressure value by pressure sensor 46, and the desired velocity setting, and/or the fire mode. For example, as in previous illustrated form, user 10 is engaging target 12*a* and target 12*b* with marker 50 configured, as described above. As the ambient temperature and/or the temperature of marker 50 changes the operating gas pressure of marker 50 during play, user 10 can then stay on target in the lobbing burst-velocity spreader mode through speed sensor 72 and/or pressure sensor 46. Also during play marker 50 determines that the desired pressure determination and/or its value for engaging target 12*b* cannot be maintained in the lobbing burst-velocity spreader mode at its current RPS setting. Pressure sensor 46 adjusts or reduces the RPS setting to allow user 10 to stay properly engaged with target 12*b*.

In still another form, user 10 is illustrated firing projectiles or paintballs at target 12*a*, using a compressed gas projectile accelerator 50 set or configured to expel paintballs at an upper velocity setting (see FIG. 3). User 10 is also engaging target 12*b* which is behind obstacle 16 in the lobbing burst-velocity spreader mode with marker 50, which includes distance sensor 75, indicators 73, controls 77, tilt sensors 48 and speed sensor 72 connected with circuit board 66 (see FIG. 5). Marker 50 also includes breech sensor 78 connected with circuit board 66. Breech sensor 78 is configured to permit determination of the status of breech 79. For example, since the breech sensor 78 is an array of sensors, breech sensor 78 can determine or verify an operational members' position (i.e. such as the bolt) in respect to a paintball's position and/or their separation, as a function of the velocity setting and firing modes and/or their values.

Additionally in the above form, breech sensor 78 can be configured to determine the breech's status and/or condition, such as whether or not breech 79 is fouled with broken paintballs. A fouled breech can affect the velocity of fired paintballs and/or affect the readings from speed sensor 72. For example, user 10 is engaging target 12*a* with above configured marker 50 at the upper velocity setting. User 10 is also engaging target 12*b* behind obstacle 16 with marker 50 in the lobbing burst-velocity spreader mode. Breech 79 of marker 50 becomes fouled in the engagement, breech sensor 78 then indicates the fouled breech to user 10 through indicators 73. Also, the fouled breech status from breech sensor 78 in marker 50 allows circuit board 66 to compensate for and/or change the lobbing burst-velocity spreader mode; or allows user 10 to compensate for the broken paintballs in breech 79 of marker 50 with controls 77.

In still another form, projectile accelerator 50 is configured with manually selected velocity adjustment mechanism 52, which includes a main velocity adjustor 80, selector 82, set screw 84, aperture 85, dial 86, apertures 88, blocking pin 90, blocking pin 92, and detent 94, disclosed above (see FIG. 6*a*-6*c*). Also velocity adjustment mechanism 52 comprises distance sensor 75, indicators 73, and tilt sensors 48 connected with circuit board 66 (see FIG. 5). In this illustrated form, user 10 sets the upper velocity setting through main velocity adjustor 80 of velocity adjustment mechanism 52, prior to the start of play. User 10 is then able to lob projectiles at a range of velocities ranging from an upper velocity setting to a lower velocity setting; once play begins. In one form of the above form, user 10 is able to lob projectiles at a range of velocities ranging from an upper velocity setting to a lower velocity setting, as calculated and/or indicated by circuit board 66 of marker 50 through indicators 73. For example, user 10 is firing projectiles at target 12*a* in semi automatic mode, with configured and set marker 50. User 10 then engages target 12*b* which is behind obstacle 16 with marker 50. Circuit board 66 of marker 50 being aware of the distance to target 12*b* through distance sensor 75 can calculate or determine one or more angles for barrel 54 and then indicate the angle(s) of barrel 54 to user 10 through tilt sensors 48 and indicators 73. Once user 10 positions marker 50 in a calculated angle, circuit board 66 can automatically calculate or determine the projectile velocity setting needed to lob projectiles or paintballs on to target 12*b*. Circuit board 66 can then indicate the calculated velocity setting for velocity adjustment mechanism 52 of marker 50 to user 10 through indicators 73.

In another form, marker 50 is configured with velocity adjustment mechanism 52 (see FIG. 6*a*-6*c*). Marker 50 includes distance sensor 75, indicators 73, and tilt sensors 48 connected with circuit board 66 (see FIG. 5); as detailed in the above form. In this form though, velocity adjustment mechanism 52 includes speed sensor 72, breech sensor 78, controls 77, and situational connectors or links 44 and 45 connected with circuit board 66. Situational connectors or links 45 are a plurality of connectors positioned on dial 86 to match up with connector 44 of selector 82 of velocity adjustment mechanism 52 (see FIG. 6*b*). Circuit board 66 being status aware and/or situational alert to marker 50 can further advise user 10 through indicators 73. For example, circuit board 66 of marker 50 can indicate corrections, recalculations, determination changes and/or status changes, and/or their value to user 10 through indicators 73.

As an example, user 10 is illustrated firing projectiles at target 12*a*, using above configured marker 50 set to expel paintballs at an upper velocity setting (see FIG. 3). User 10 is also lobbing projectiles, along one or more arc shaped paths 18, onto target 12*b* behind obstacle 16. As user 10 switches between target 12*a* and target 12*b*, circuit board 66 can indicate the appropriate barrel 54 angle(s) of marker 50 as related to the user 10 selected position of selector 82, or circuit board 66 can indicate a new calculated setting for selector 82 of velocity adjustment mechanism 52 for a current angle of barrel 54. In another example, circuit board 66 of marker 50 can also indicate, through indicators 73, changes in barrel 54 angle(s) or position of selector 82 of velocity adjustment mechanism 52, as it relates to a determined value of speed sensor 72 and/or breech sensor 78. Also, the determined value of speed sensor 72 and/or breech sensor 78 can be adjusted by controls 77, as described above.

In another form, marker 50 is configured with velocity adjustment mechanism 52 (see FIG. 6*a*-6*c*). Again marker 50 also includes distance sensor 75, indicators 73, speed sensor 72, breech sensor 78, a trigger sensor 70, controls 77, connectors 45, connector 44, and tilt sensors 48 connected with circuit board 66 (see FIG. 5, 6*b*). While those skilled in the art would recognize that above configured marker 50 could lob projectiles onto a target, such as target 12*b* (see FIG. 3), in a lobbing burst mode (as disclosed above) as a function of velocity adjustment mechanism 52 and tilt sensors 48 connected with circuit board 66. Those skilled in the art would also recognize that configured marker 50 could also lob projectiles onto a target, such as target 12*b* (see FIG. 3), in a velocity spreader mode (also disclosed above) as a manual function of selector 82 of velocity adjustment mechanism 52 connected with circuit board 66 through connectors 45 and connector 44; and indicators 73 and tilt sensors 48 also connected with circuit board 66.

In yet another form, marker 50 is configured with velocity adjustment mechanism 52 (see FIG. 6*a*-6*c*). Marker 50 also comprises distance sensor 75, indicators 73, speed sensor 72, breech sensor 78, trigger sensor 70, controls 77, connecters 45, connecter 44, solenoid valve 74, and tilt sensors 48 connected with circuit board 66 (see FIG. 5). Since circuit board 66 of marker 50 can comprise the self selecting lobbing burst mode and/or the velocity spreader mode, with manual assistance. Circuit board 66 of marker 50 can be configured for the combination fire mode, the self selecting lobbing burst-velocity spreader mode (as described above), but with manual assistance. For brevity, the self selecting lobbing burst-assisted velocity spreader mode. For example, user 10 is firing projectiles at target 12*a*, at an upper velocity setting with marker 50 (see FIG. 3). User 10 is also engaging target 12*b* in the self selecting lobbing burst-assisted velocity spreader mode with said marker 50.

Marker 50 includes velocity adjustment mechanism 52 (see FIGS. 6*a*-6*c*) connected with circuit board 66, through connecter 44 and connecters 45. Circuit board 66 being aware of the distance to target 12*b* through distance sensor 75, and status aware through speed sensor 72 and breech sensor 78. User 10 simply positions marker 50 in the predetermined angle for barrel 54, with the assistance of indicators 73; and moves selector 82 of velocity adjustment mechanism 52 from the upper velocity setting (i.e. FIG. 6*a*) to the lower velocity setting (i.e. FIG. 6*c*), while activating trigger sensor 70. Thus, circuit board 66 would release a fire sequence to solenoid valve 74 every time connecter 44 of selector 82 linked with and/or connected with a connecter 45 that had value, that is, value to the programmed and/or calculated fire commands to lob projectiles in one or more substantially arc shaped paths 18 of a self selecting lobbing burst-assisted velocity spreader mode.

The release of fire commands and/or sequences from circuit board 66 to solenoid valve 74, as related to moving selector 82 of velocity adjustment mechanism 52 and velocity spreader mode, could be increasing and/or decreasing in nature (i.e. upper velocity setting to lower velocity setting or lower velocity setting to upper velocity setting). Thus, user 10 could lob projectiles onto target 12*b*, back to front then front to back as a function of the movement of selector 82 from the upper velocity setting to the lower velocity setting, and then from the lower velocity setting to the upper velocity setting, while activating trigger sensor 70. Additionally, the release of fire commands and/or operational commands from circuit board 66 to solenoid valve 74, as related to moving or rotating selector 82 of velocity adjustment mechanism 52 and velocity spreader mode while activating trigger sensor 70, can be further controlled through circuit board 66 and/or controls 77.

For example, in the above form, user 10 is engaging target 12*b*, which is behind obstacle 16, with the above described configured marker 50. User 10 is moving or rotating selector 82 of velocity adjustment mechanism 52 as a function of the assisted velocity spreader mode, while activating trigger sensor 70. User 10 moves selector 82 to fast and marker 50 is in jeopardy of exceeding the programmed RPS limit, as such one or more values of the fire commands are ignored by circuit board 66. Thus, the release of fire commands and/or operational commands from circuit board 66, of the assisted velocity spreader mode are programmable and/or re programmable.

In another form, marker 50 includes an energy saving mode. In particular, marker 50 includes a compressed gas saving mode. The compressed gas saving mode allows a user 10 to expel more paintballs, more efficiently during a game. For example, in the sport of paintball, players are limited by the number of shots they can get from the compressed gas source 100 (see FIG. 7) connected to their marker. Some efforts have been made in recent years to improve the gas usage or efficiency of today's paintball markers. And players sometimes have a choice of the compressed gas used in their marker to expel paintballs. Also, players sometimes have a choice of the size of tank or gas source 100 used on their marker. Paintball markers still have a common efficiency limitation; they shoot at one upper velocity setting, using the same amount of compressed gas to shoot a target, whether the target is 25' away or 250' away. For an illustrated example, one could estimate that user 10 can engage a target 100' away, with a starting marker velocity of 300 FPS, and impact said target at 155 FPS, in about a ½ second. One could also estimate, in this illustrated example, that user 10 can engage a target 55' away, with a starting marker velocity of 270 FPS, and impact said target at 185 FPS, in about a ¼ second. While the above illustrated example can only estimated because paintballs are not perfect spheres, as such, throwing off the drag forces, lift effect, wake effect, etc. Those skilled in the art would recognize, that a paintball expelled at a target 100 feet away, with a starting velocity set at an upper velocity setting (i.e. 300 FPS) and a paintball expelled at a target 50 feet away, with a starting velocity set at a lower velocity setting (i.e. 270 FPS) will similarly mark and eliminate said target. Thus, user 10 can also use marker 50 configured with the velocity adjustment mechanisms and/or methods illustrated and/or described herein, to expel projectiles at user selected targets in a straight fire mode; while saving or conserving compressed gas.

Those skilled in the art would also recognize, that marker 50 configured with a lobbing mode, an energy saving mode, and/or a surrender mode will potentially gain in impact accuracy and/or uniformity. Marker 50 configured with a lobbing mode, an energy saving mode, and/or a surrender mode will also potentially gain in velocity consistency and/or uniformity. For example, the possibility of the expelled paintball spinning and/or having a variable spin is reduced as the velocity is lowered.

Figure 47:
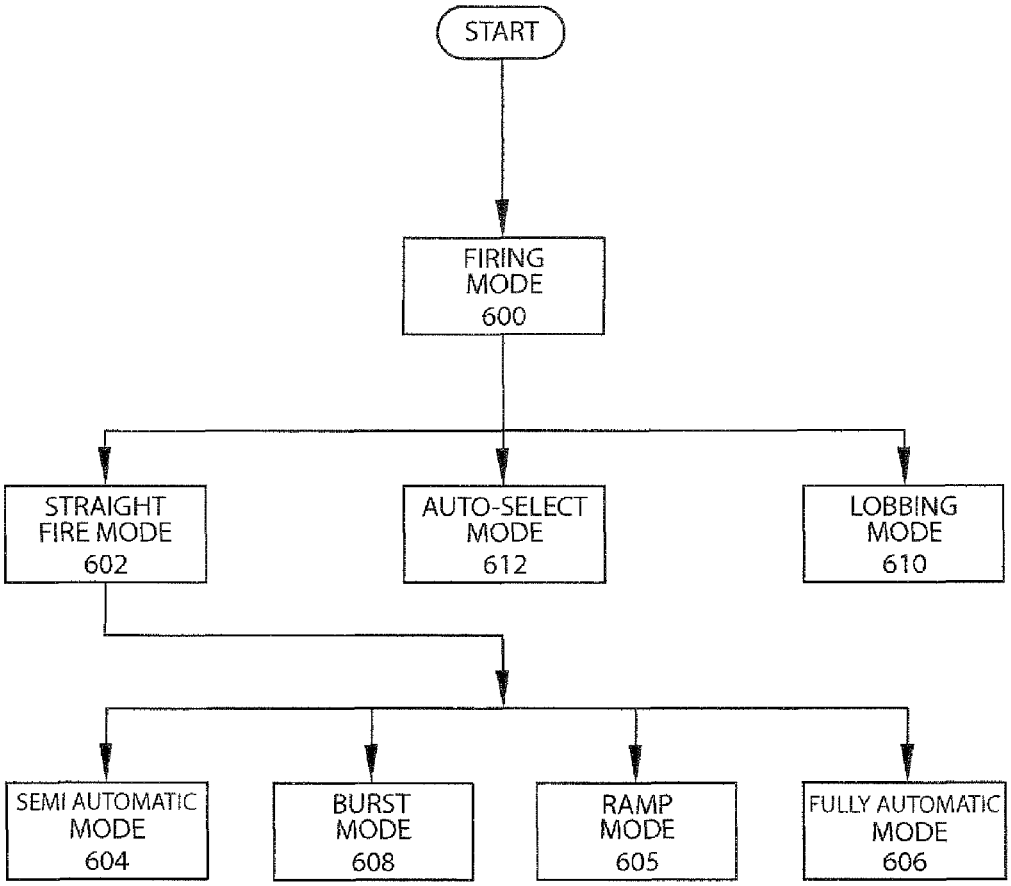
FIG. 47 illustrates representative executable modules of an electronic circuit board.

Referring to FIG. 47, as previously set forth, marker 50 includes electronic circuit board 66 that is configured to monitor and/or control various functional aspects of marker 50. In one representative form, circuit board 66 includes a processor 101 that is programmable to execute one or more software routines. Processor 101 can comprise a microprocessor including on-board memory for storing executable program code and/or memory may be connected with processor 101. In some prior art electronic markers, it is envisioned that the markers can be retrofit with a new circuit board, as well as other components, to incorporate one or more features of the present invention.

In one form, circuit board 66 includes a firing mode module or routine 600 that allows user 10 to select a desired firing mode for marker 50. User 10 can configure marker 50 to fire in a straight fire mode, a lobbing mode, or an auto-select mode. In one form, controls 77 are used by user 10 to select a respective firing mode within the firing mode module 600. Selection of the straight fire mode causes marker 50 to execute a straight fire mode module 602. In straight fire mode, marker 50 is configured to fire projectiles as a conventional marker 50. For the sake of brevity, most conventional markers of today are configured to fire projectiles in a conventional fire mode, such as, semi-automatic mode, fully automatic mode, burst mode, and/or ramp mode. In other words, marker 50 can be configured to fire projectiles at the upper velocity setting and can fire projectiles in either semi-automatic mode (e.g.—1 projectile per trigger pull), fully automatic mode (e.g.—continuous projectile fire as long as trigger is depressed), burst mode (e.g.—5 projectiles per trigger pull) or ramp mode (e.g.—12 projectiles per 6 trigger pulls). As such, in one form, straight fire mode module 602 can be configured to selectively execute a semi-automatic mode module 604, a fully automatic mode module 606, a burst mode module 608, and/or a ramp module 605. Each of the above-referenced modules 604-608 configures marker 50 to operate according to each respective firing mode.

Firing mode module 600 also allows user 10 to configure marker 50 to fire in a lobbing mode by execution of a lobbing mode module 610. As previously set forth, the lobbing mode allows user 10 to lower the velocity at which projectiles are expelled from barrel 54 of marker 50 such that the projectiles travel along arc shaped paths. Together with angling barrel 54 at predetermined angles, the lobbing mode allows user 10 to strike targets 12*b* behind obstacles 16 that would otherwise be able to avoid being struck if marker 50 was firing in straight fire mode. This is because at lower velocity settings, projectiles leaving barrel 54 of marker 50 travel along various arc shaped paths as a function of the velocity setting of marker 50. As previously set forth, in one form, circuit board 66 is configured to control operation of solenoid valve 74 to allow marker 50 to expel projectiles at varying velocity settings.

Firing mode module 600 also allows user 10 to select an auto-select mode module 612 that configures marker 50 to operate in an auto-select fire mode. As used herein, the phrase auto-select fire mode should be construed to mean that marker 50 is configured to automatically select either a straight fire mode or lobbing mode as a function of a sensor signal, such as, from tilt sensor 48. For example, as previously set forth, if tilt sensor 48 indicates that barrel 54 of marker 50 is angled above a predetermined threshold value (e.g.—any angle above 35° relative to ground G), which would indicate that marker 50 is positioned to lob projectiles on target 12*b*, auto-select mode module 612 is configured to switch marker 50 to lobbing mode. If marker 50 is positioned below the predetermined threshold value, which would indicate that marker 50 is positioned to fire substantially directly at a target 12*a*, auto-select mode module 612 is configured to switch marker 50 to straight fire mode. Also, as previously set forth, the automatic selection of a straight fire mode or lobbing mode can be a function of other signals, such as, a signal from motion sensor 47 or directional/locational sensor 43.

Figure 48:
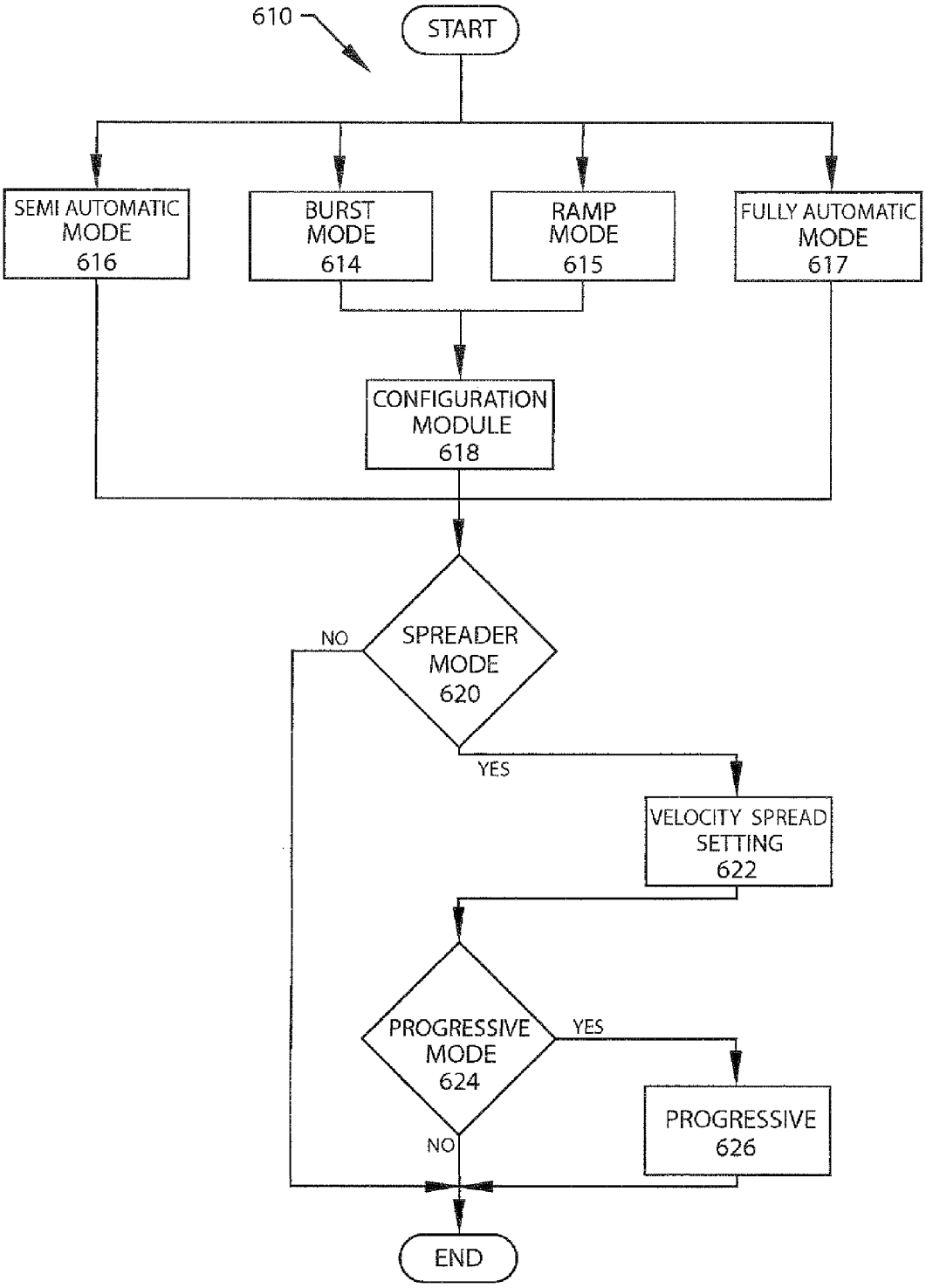
FIG. 48 illustrates representative executable modules of a lobbing mode module.

Referring to FIG. 48, lobbing mode module 610 is configured to allow user 10 to set marker 50 to fire in a semi-automatic firing mode 616, a full-automatic firing mode 617, a burst firing mode 614, or a ramp firing mode 615. If burst firing mode 614 or ramp firing mode 615 is selected by user 10, a configuration module 618 allows user 10 to configure a projectile per trigger pull (e.g. burst firing mode—3 projectiles per trigger pull, 5 projectiles per trigger pull, and so forth) or (e.g. ramp firing mode—12 projectiles per second for 6 trigger pulls per seconds). A spreader mode module 620 allows user 10 to determine whether or not marker 50 is configured to expel projectiles in a spread of velocity settings in which each projectile is assigned a distinct velocity within a range of velocities. If user 10 selects velocity spreader mode, a velocity spread setting module 622 allows user 10 to set the FPS difference between respective rounds. For example, user 10 can configure marker 50 to expel projectiles in increments of 5 FPS, 10 FPS, and so forth. Also, velocity spread setting module 622 allows user 10 to set the RPS setting, assign placement in the volley to the determined velocity, and combine volleys or groups into collections, as previously set forth.

Once user 10 configures marker 50 to function in lobbing mode and selects the velocity spreader mode, a progressive mode module 624 provides user 10 with the option to select a progressive mode. Progressive mode module 624 allows marker 50 to expel projectiles in a progressive up, a progressive down, or a progressive up and down manner. For example, marker 50 is configured to expel projectiles in a progressive mode such that the velocity settings progresses up and down in the spreader mode (e.g.—first 5 shot burst at velocities of 160 FPS, 170 FPS, 180 FPS, 190 FPS, and 200 FPS; second 5 shot burst at velocities of 200 FPS, 190 FPS, 180 FPS, 170 FPS, 160 FPS). As such, progressive mode module 624 configures marker 50 to function in a velocity progressive mode as represented at 626. As previously set forth, user 10 can use controls 77 to configure the operation of marker 50 amongst the various operating modes.

Figure 49:
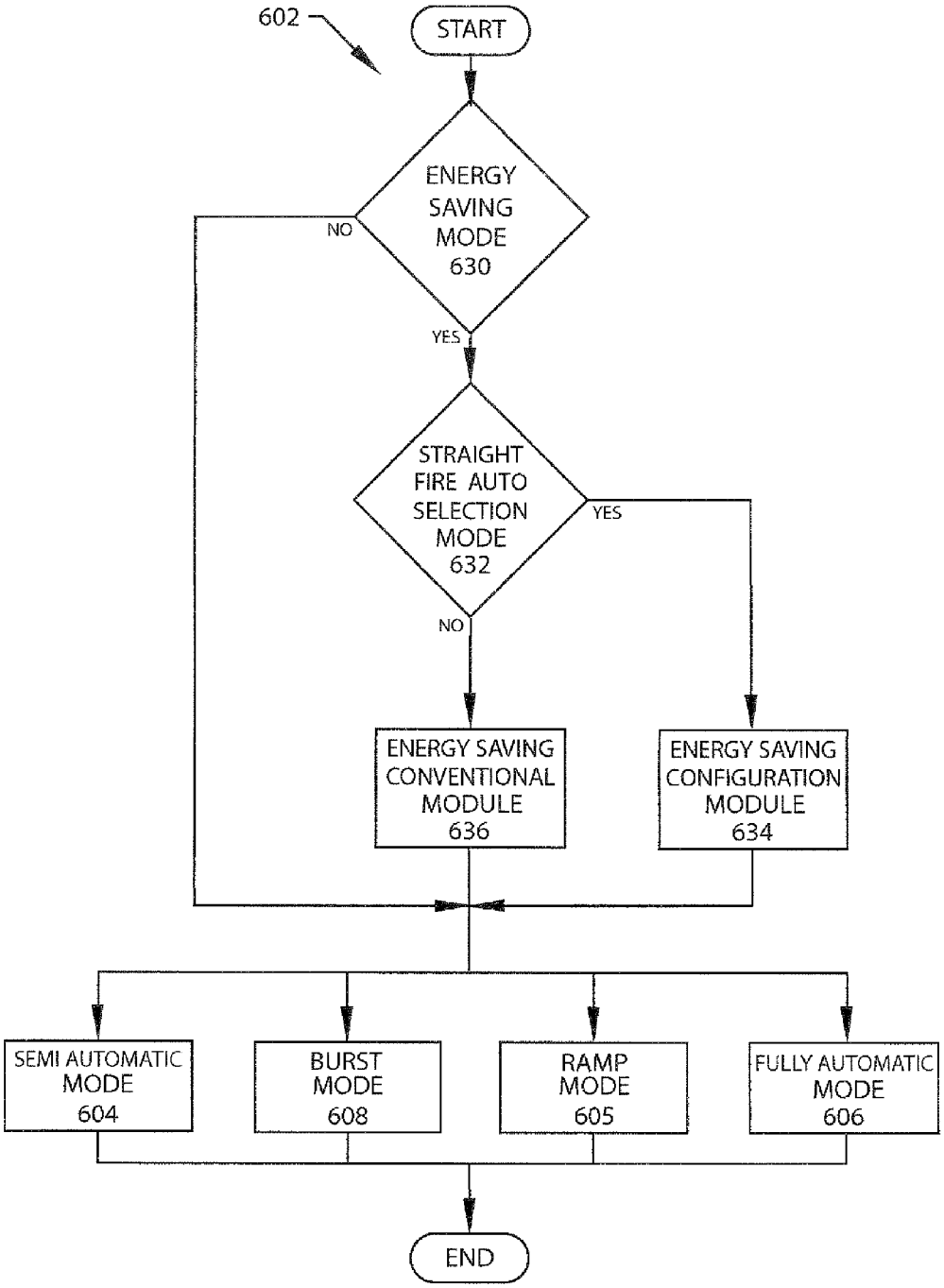
FIG. 49 illustrates representative executable modules of a straight fire module.

Referring to FIG. 49, another representative form of straight fire mode module 602 is illustrated; in this form, straight fire mode module 602 is configured to allow user 10 to set marker 50 to fire in an energy saving mode. Selection of the energy saving mode causes marker 50 to execute an energy saving mode module 630. In one form, as previously set forth, the energy saving mode is configured to save compressed gas used to expel paintballs from marker 50. The energy saving mode module 630 allows user 10 to determine whether or not marker 50 is configured with a straight fire auto selection mode, thereby executing straight fire auto selection mode module 632. Selection of the straight fire auto selection mode allows user 10, in the straight fire auto selection mode module 632, to configure marker 50 to the self selection or automatic selection of an energy saving mode as a function of a sensor signal, such as, from directional/locational sensor 43. For example, as previously set forth, if directional/locational sensor 43 indicates that barrel 54 of marker 50 is positioned in the directional heading of a preregistered target area TA and/or opponent obstacle 16, while being located in a preregistered location, straight fire auto selection mode module 632 is configured to switch marker 50 to an energy saving mode, with a selected lower velocity setting. In one form, the selected lower velocity setting is set with the energy saving configuration mode module 634; energy saving configuration mode module 634 also allows user 10 to further configure marker 50. For example, user 10 can set distinct velocity settings to different target areas, which have distinct directional headings. Also, user 10 can set different distinct velocity settings to different target areas, which have distinct directional headings, when user 10 is located in different locations on the playing field. Further, user 10 can set different energy saving lower velocity settings as a function of different sensor signals. For example, user 10 can set a distinct energy saving velocity setting for a directional heading, when located in a preregistered location and still set a different distinct energy saving velocity setting for a distinct gesture in cooperation with motion sensor 47.

The non selection of the straight fire auto selection mode, which is described above, still allows user 10 to select an energy saving lower velocity setting, through energy saving conventional mode module 636. Energy saving conventional mode module 636 allows user 10 to preset a lower velocity setting, in one form, and choose a selectable or adjustable lower velocity setting, in another form. The selectable or adjustable lower velocity setting can be controlled or managed by controls 77 or velocity controller 76, as described above (see FIG. 5).

Further, as in an above form (see FIG. 47), straight fire mode module 602 can be configured to selectively execute a semi-automatic mode module 604, a fully automatic mode module 606, a burst mode module 608, and/or a ramp module 605. Again, each of the above-referenced modules 604, 605, 606, and 608 configures marker 50 to operate according to each respective firing mode. Thus, each of the above-referenced modules 604, 605, 606, and 608 can be configured with an upper velocity setting and/or energy saving lower velocity settings.

Figure 50:
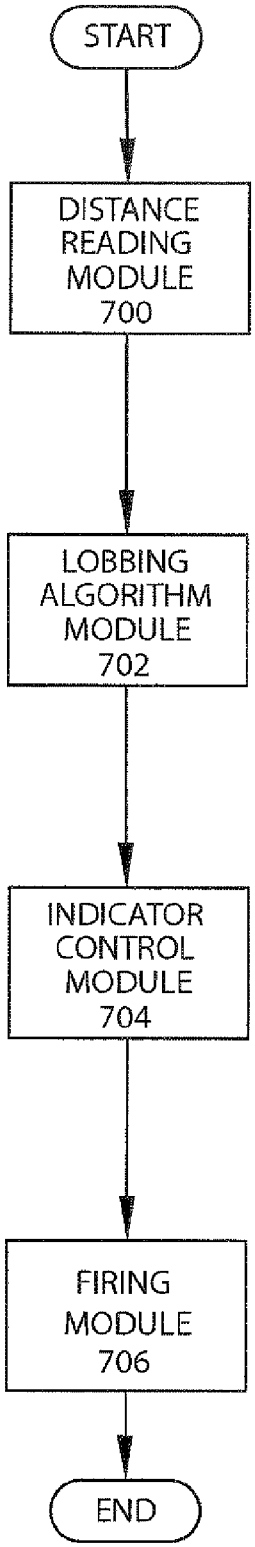
FIG. 50 illustrates representative executable modules of one form of the compressed gas projectile accelerator.

Referring to FIGS. 5 and 50, in one form marker 50 is configured in the lobbing mode to automatically calculate velocity settings and angles of barrel 54 as a function of readings obtained from distance sensor 75 and tilt sensors 48. For the sake of brevity, marker 50 has already been configured by user 10 to either operate in the lobbing mode or the auto-select mode. During play, user 10 encounters target 12*b*, which is hidden behind a respective obstacle 16. Using distance sensor 75, a distance reading module 700 allows user 10 to obtain a distance reading to target 12*b*. In the alternative, user 10 can manually enter a distance to target 12*b* using controls 77.

Marker 50 includes a lobbing algorithm module 702 that is configured to calculate a plurality of angles for barrel 54 to be positioned at and a plurality of velocity settings needed for marker 50 to be able to lob projectiles onto target 12*b*. In one form, the velocity settings are calculated as a function of the calculated angles. As such, one respective calculated angle setting will have a first set of velocity settings used to lob projectiles onto target 12*b* and another calculated angle setting will have a second set of velocity settings, and so forth. Multiple angles and sets of velocity settings may be required to lob projectiles onto target 12*b* depending on various factors, such as the height of the obstacle, the distance to target 12*b*, and so forth. As such, lobbing algorithm module 702 is configured to calculate a plurality of angles and sets of velocity settings corresponding to each respective calculated angle in order to lob projectiles onto target 12*b*.

In another form, marker 50 also includes an indicator control module 704 configured to control operation of indicators 73 to guide user 10 to position barrel 54 of marker 50 at the one or more calculated angles. Indicator control module 704 uses signals from tilt sensor 48 to determine when barrel 54 of marker 50 is positioned in at one or more of the calculated angles. As previously set forth, up and down arrows (see FIG. 6*a*) of indicators 73 can be used to guide user 10 to place marker 50 in the proper angular position. Once marker 50 is placed at one or more of the calculated angles, a respective indicator 73 is illuminated to indicate marker 50 is positioned at a one or more of the calculated angles.

A firing module 706 monitors the status of trigger 62 and in response to a pull of trigger 62, marker 50 expels a plurality of projectiles in a spreader mode at target 12*b*. In this form, marker 50 expels the projectiles at the set of velocity settings corresponding to the calculated angle. As should be appreciated, varying the angle of barrel 54 will vary the arc shaped path that projectiles that are expelled from marker 50 travel to reach target 12*b*. As the angle of barrel 54 is changed, the set of calculated velocities that projectiles need to be expelled to reach target 12*b* adjusts as a function of the distance to target 12*b* and the angular position of barrel 54 of marker 50.

Figure 51A:
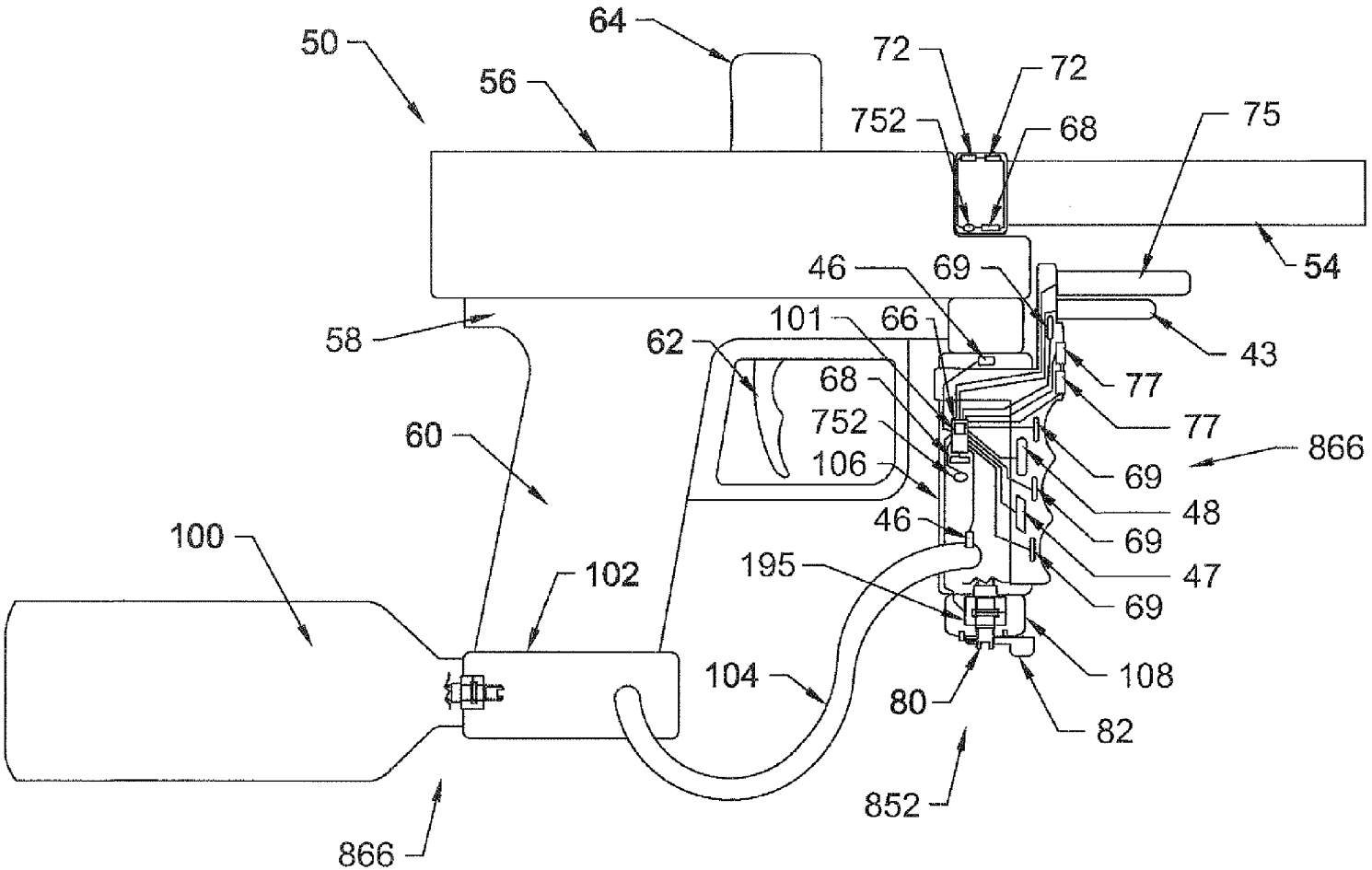
FIG. 51*a* illustrates a side view of a compressed gas projectile accelerator including linked assisted velocity adjustment mechanisms in cross-sectional form.

Referring collectively to FIGS. 30 *a-d* and FIG. 51 *a-b*, a representative form of a mechanized, computerized, and/or automated paintball regulator 866 is illustrated. In one representative form, said paintball regulator 866 includes an electronically and/or pneumatically controlled adjustment mechanism, such as, adjustment mechanism 852 (see FIG. 30 *a-b*). In one form, paintball regulator 866 can be configured with an adjustment device and/or method, such as, motor or actuator 195, as described above (see FIG. 15). In another form, paintball regulator 866 can include and/or be in communication with a control(s), such as control 77, as described above (see FIG. 5). Further, in another form, said mechanized or automated paintball regulator 866 can include and/or be in communication with a controller, such as circuit board 66, also described above. In one form, said mechanized or automated paintball regulator 866 includes controls 77 and/or a controller, such as circuit board 66, that is independent or separate from marker 50 and/or circuit board 66 of marker 50. There by, allowing a user 10 to configure said pressure regulator 866 onto different markers. Paintball players often own or have access to more than one paintball marker, and often own or have access to more than one style of marker. Some markers are mechanically operated, while other markers are electronically operated or electro-pneumatically operated, still other markers are electronically assisted mechanical markers, such as mechanically operated markers with an electronic trigger. While normally only found on lower end or level markers, some markers and/or styles of markers of today are still unregulated from the source or tank to the marker, although, this is normally only markers that use CO2 solely as the compressed gas. Further still, other markers and/or styles of markers of today, regulate the compressed gas at or near the compressed gas source or tank 100, as described above and as illustrated in FIGS. 30 *c-d*.

Those skilled in the art would recognize the benefits of a regulator or an additional regulator, even on the lower end or level markers. They would also recognize the benefits of a regulator and/or an additional regulator configured with an independent or separate controller, such as a circuit board 66, there again, allowing the pressure regulator to be switched or configured to different markers and/or styles of markers. In one form, said mechanized or automated pressure regulator 866, with a separate or individual controller, such as a circuit board 66, can be configured with transfer elements or data links 752, as described above (see FIGS. 45 to 46*b*). For example, user 10 can configured a manually operated marker 50 with automated pressure regulator 866, in the vertical pressure regulator 106 form (see FIG. 51*a*) or the source pressure regulator in adapter 102 form (see FIG. 51*b*), that includes circuit board 66 and controls 77; also electric and/or pneumatic adjustment mechanism 852 can be included, as described above (see FIGS. 15 and 30 *a-d*). Further, circuit board 66 of said pressure regulator 866 can be configured with data link(s) 752, electric power source 68, and pressure sensor(s) 46 (see FIG. 5). User 10 having set the upper velocity limit for manually operated marker 50 through a manual velocity adjustor, such as velocity adjustor 302 (see FIG. 11), user 10 can set the matching upper pressure and/or velocity limit for said pressure regulator 866, through circuit board 66 with connected controls 77. There by, allowing user 10 to adjust manually operated marker 50 between an upper velocity setting and a lower velocity setting through adjustment mechanism 852, controlled by controls 77 connected to circuit board 66. Further, circuit board 66 of said pressure regulator 866, through connected data link 752, can indicate a determined and/or set pressure/velocity setting to user 10 through indicators 73 and/or acoustical element 755, of networked paintball system 750, as described above (see FIGS. 45 to 46*b*).

In a further example, as in the above example, user 10 is using a manually operated marker 50 lacking a circuit board 66 of its own. User 10 can configure circuit board 66 of regulator 866, in the vertical pressure regulator 106 form (see FIG. 51*a*) and/or the source pressure regulator in adapter 102 form (see FIG. 51*b*), to instruct paintball hopper 63 to load another paintball, through data link 752 of hopper unit 756 and data link 752 connected to circuit board 66 of said regulator 866, as described above. The determined value that the manually operated marker 50 has fired and needs another paintball loaded can come from the swift variation or momentary change in compressed gas pressure, as determined by pressure sensor(s) 46 connected to circuit board 66 of said regulator 866.

As those skilled in the art would recognize that a mechanized, computerized, and/or automated pressure regulator 866 could be configured to include the other aspects, features, sensors, and/or methods described and/or disclosed herein. There by, allowing a user 10 to configure and/or retrofit many, if not most, paintball markers with most of the aspects, features, and/or abilities described and/or disclosed herein. For example, said pressure regulator 866 configured with a circuit board 66 and power source 68, can as include proximity sensors 69 (see FIG. 46*b*), allowing said pressure regulator 866 to automatically be placed into a safety mode or stand by mode, where by the flow of compressed gas is restricted or cut off when separated from the user 10. Also, in one illustrative form, circuit board 66 of said pressure regulator 866 can be configured with other disclosed sensors, such as tilt sensor(s) 48, distance sensor 75, directional/locational sensor 43, vibration/sound sensor(s) 41, and/or motion sensor(s) 47, as described above (see FIG. 5). Further, in another illustrative form, circuit board 66 of said pressure regulator 866 can be configured to link to separate, unattached, and/or independent sensors and/or members, such as speed sensor 72, breech sensor 78, situational connecters 44-45, and/or indicators 73, as described above (see FIGS. 5, 6, and 46*b*). Still, in another illustrative form, circuit board 66 of said pressure regulator 866 can be configured to connect with separate, unattached, and/or independent sensors and/or members, such as with connector or link 292 and 294, as described above (see FIG. 41*b*). In one form, as described above, circuit board 66 of said pressure regulator 866 can be configured to be connected to and/or in communication with a plurality of sensors, of one or more types or forms.

Figure 51B:
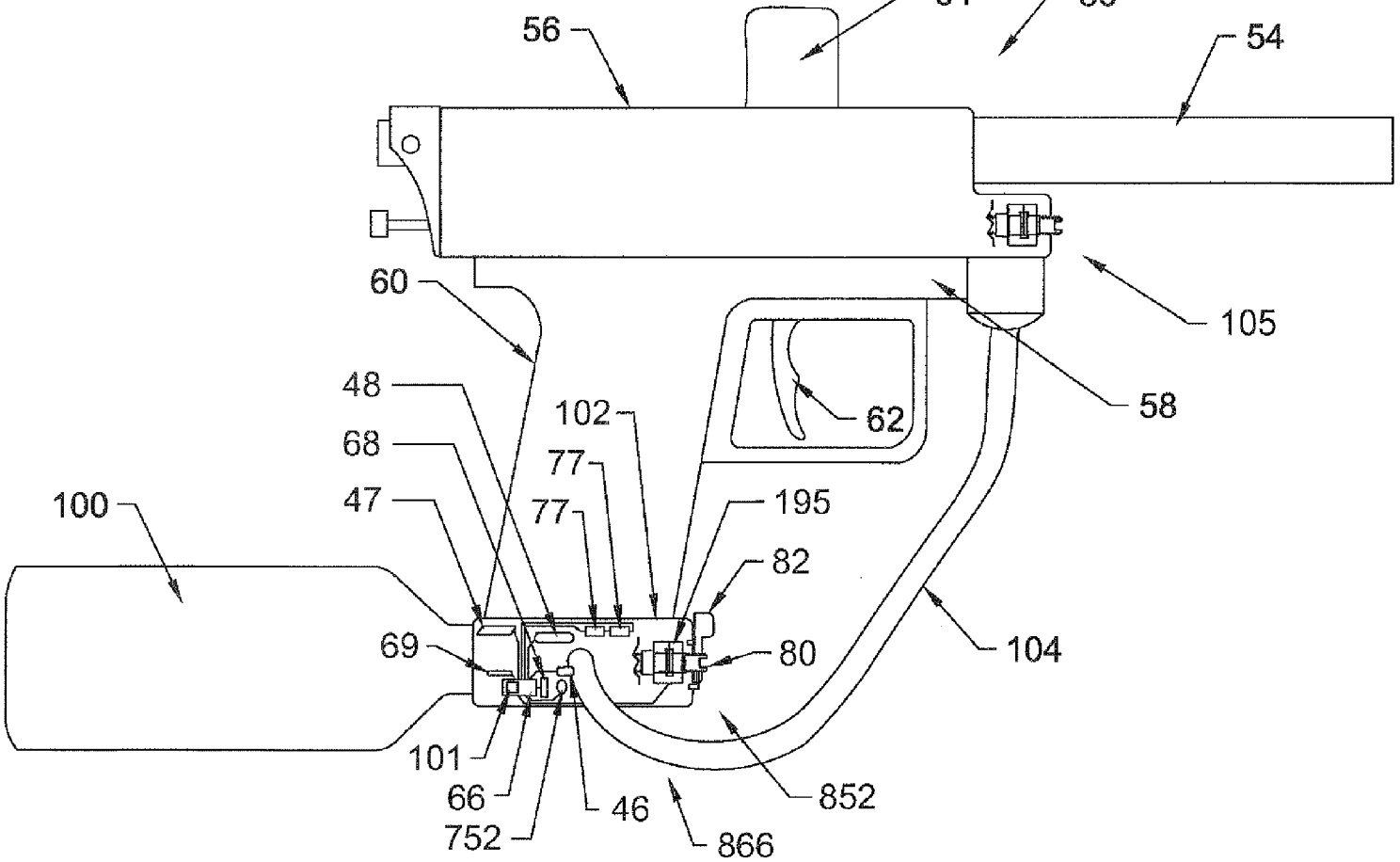
FIG. 51*b* illustrates a side view of a compressed gas projectile accelerator including linked assisted velocity adjustment mechanisms in cross-sectional form.

Further, it should be appreciated by those skilled in the art, that circuit board 66 and/or controls 77 can be configured internally or externally with a vertical pressure regulator 106 (see FIGS. 30 *a-b* and 51*a*), a source pressure regulator, such as in adapter 102 (see FIGS. 30 *c-d* and 51*b*), and/or any other pressure regulator, such as the low pressure regulators 105 used for internally operating some markers (see FIG. 51*b*). Also, circuit board 66 and/or controls 77 can be configured and/or housed with any other paintball equipment of user 10, such as into or onto marker 50 and/or hopper 63, while still being in control of, in connection with and/or in communication with said pressure regulator 866. In one form, circuit board 66 and/or controls 77 of said pressure regulator 866 or their aspects, features, processes and/or operations can be configured and/or combined with other circuit boards 66 and/or controls 77 used by user 10 in other paintball equipment, such as marker 50, hopper 63, player unit 754, hopper unit 756, etc.

In one representative form, said mechanized, computerized, and/or automated paintball regulator 866 can be configured as a member or part of a paintball system, such as, linked system 750, as described above (see FIG. 46*b*). In another form, automated regulator 866 can be configured as a member or part of a paintball marker 50, as described above (see FIGS. 5 and 6). The higher end or upper level markers of today are commonly electronically assisted markers and/or electro-pneumatic markers that include an electronic controller and/or circuit board. Thus, a user 10 can configure and/or retrofit these upper level markers to be in connection or communication with said pressure regulator 866, by replacing, enhancing and/or upgrading the existing controller and/or circuit board. There by, allowing a user 10 to configure and/or retrofit the upper level paintball markers with many, if not most, of the aspects, features, and/or abilities described and/or disclosed herein, while not reconfiguring or replacing entire marker. For example, user 10 can replace or retrofit an existing circuit board so that the new configured circuit board includes disclosed aspects, abilities, features, sensors, and/or methods, while still retaining its normal operational controls, such as in respect to the trigger sensor 70 or solenoid valve 74. The replaced or retrofitted circuit board 66 of marker 50 can include some of aspects, features, and/or sensors, such as, tilt sensors 48, motion sensors 47, vibration/sound sensors 41, proximity sensors 69, and/or transfer elements 752; while other aspects, features, sensors, and/or methods can be include with the linked or connected automated regulator 866 to eases and/or simplify the configuration of marker 50, such as, pressure sensor 46, directional/locational sensor 43, distance sensor 75, and/or transfer elements 752. Further still, other aspects, features, sensors, and/or methods, such as, speed sensor 72 and/or breech sensor 78, can be linked or connected to circuit board 66 of said pressure regulator 866 and/or circuit board 66 of marker 50, through data links 752. Therefore, user 10 can configure, reconfigure, and/or retrofit the majority, if not most, paintball markers of today to include most, if not all, the aspects, features, and/or abilities described and/or disclosed in FIG. 1 to FIG. 52*b*, depending on the original design and/or configuration of marker 50.

In another representative form, circuit board 66 in connection with said automated regulator 866 can be configured to include a processor 101 that is programmable to execute one or more software routines. In one form, processor 101 can comprise a microprocessor or microprocessors that include on-board memory for storing executable program code and/or memory may be connected with processor 101.

Figure 52A:
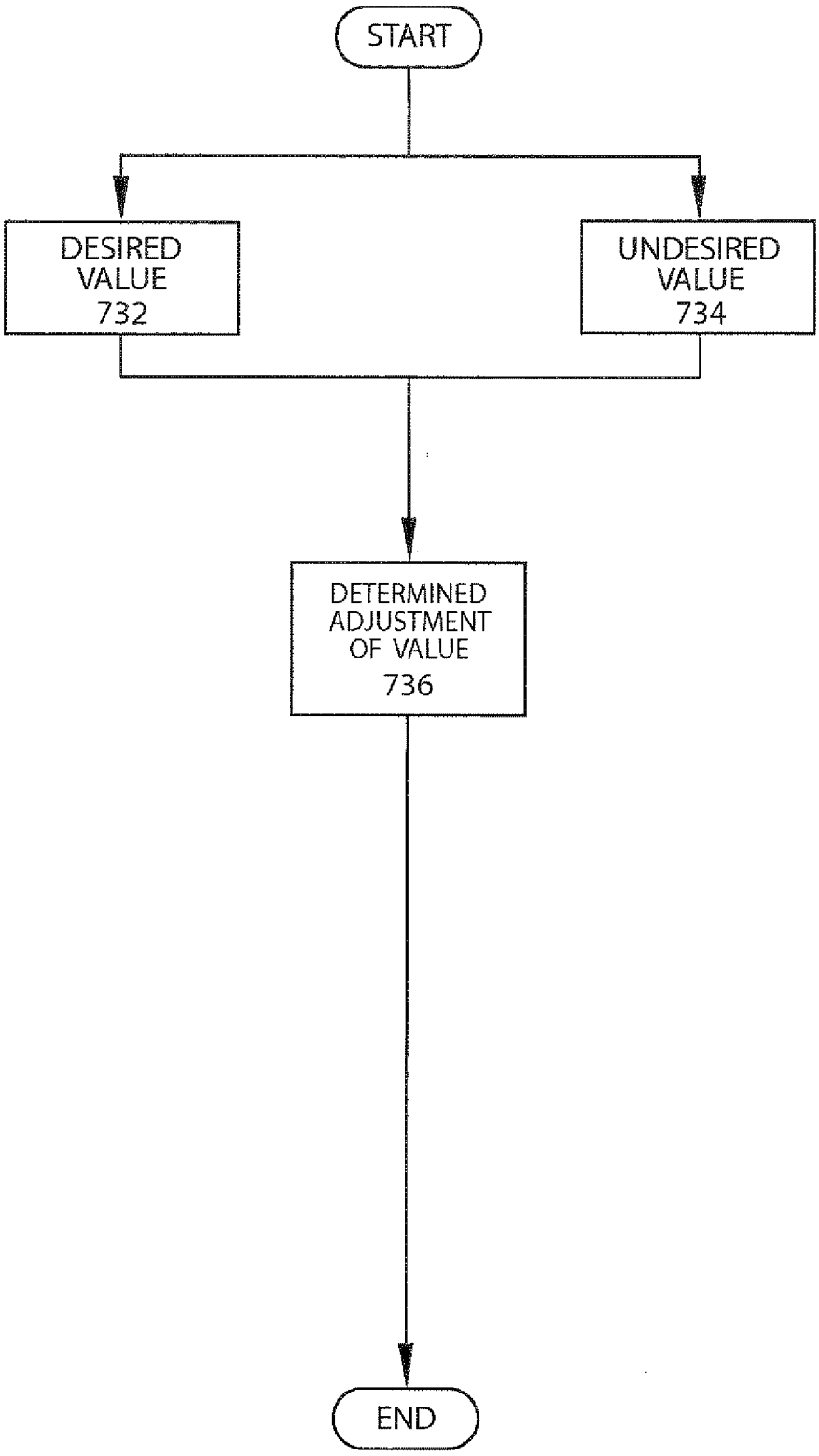
FIG. 52*a* illustrates representative executable modules of one form of the compressed gas projectile accelerator.
Figure 52B:
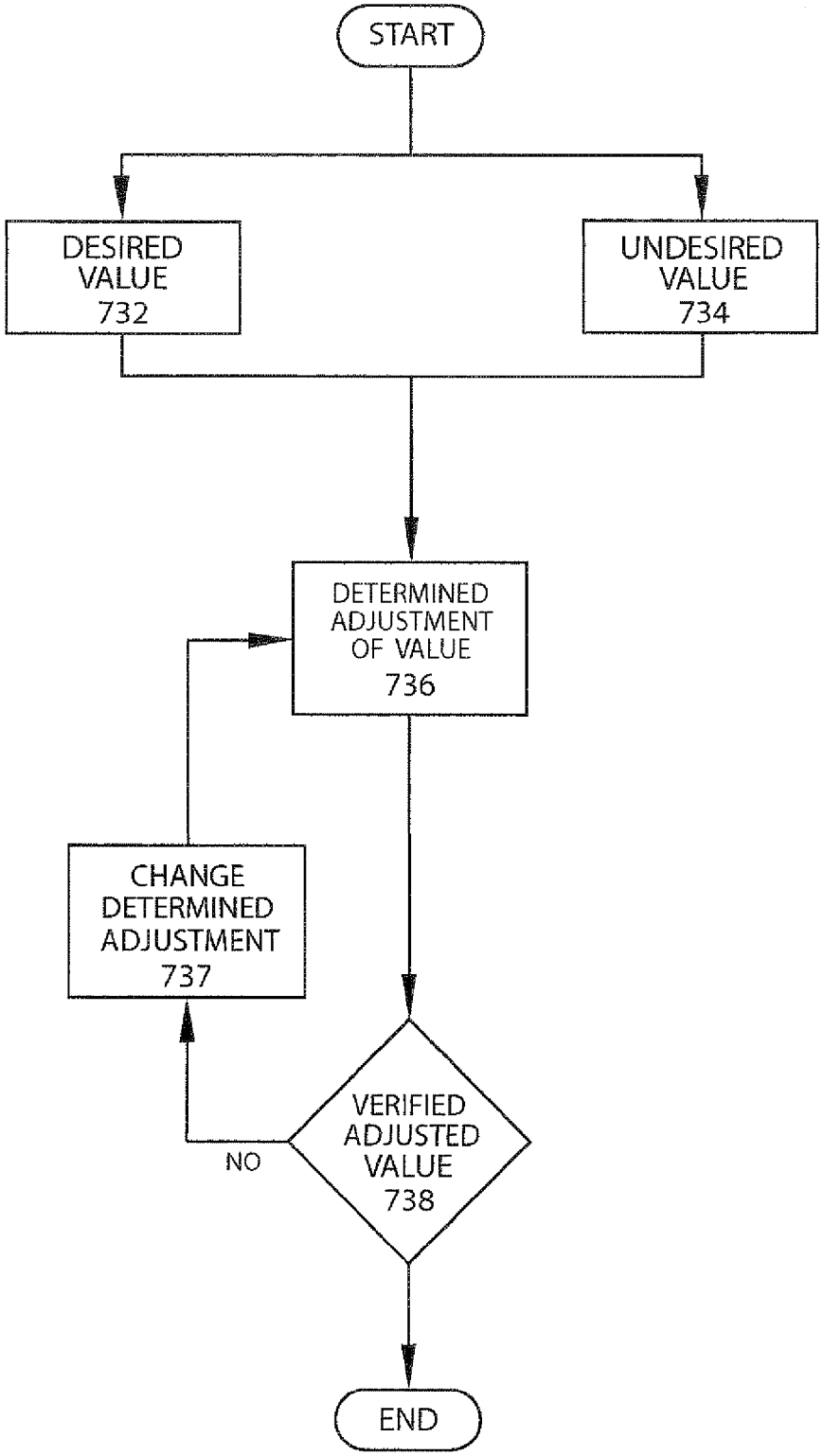
FIG. 52*b* illustrates representative executable modules of one form of the compressed gas projectile accelerator.

Referring collectively to FIG. 52*a-b*, as previously set forth, electronic circuit board(s) 66 can be configured to monitor, apply, and/or control various functional aspects, features, abilities, and/or methods that are described and/or disclosed herein. In one form, electronic circuit board(s) 66 include executable software routines that allow user 10 to set and/or program desired settings and/or values. For example, in one form of the above form, the desired value can be a determined value, such as, the determined value to allow user 10 to lob paintballs onto target 12*b*, as described above. In another form of the above form, a determined value can decide and/or influence a desired value, such as, the determined tilt angle or its value, of marker 50, influences the positioning of hopper 63 to maintain a level position or value. In another representative form, the desired value can be a settable constant value, such as, 300 FPS upper velocity limit, 13 BPS upper limit, etc.

In one form, the executable software routine determines the difference or discrepancy between a desired value 732 and an undesired value 734. In one form of the above form, the software routine determines the needed change or adjustment to the undesired value 734 for the achievement of the desired value 732. For example, user 10 has reset marker 50 to a desired velocity setting of 180 FPS and its corresponding value, the software routine of electronic circuit board 66 knowing the previous, now undesired, velocity setting and value can determine the adjustment 736 needed to the previous value to achieve the desired 180 FPS or its value. In one form, the software routine changes the value for user 10 through circuit board 66, as described above. In another form, the software routine guides or instructs user 10 through the determined adjustment of the value 736, from the undesired value 734 to the desired value 732, also described above.

In another form, as representatively illustrated in FIG. 52*b*, the software routine of electronic circuit board 66 can be configured to check or verify the determined adjustment of the value 736. In one form of the above form, the determined adjustment of the value 736 is verified, that is, the value is changed and/or adjusted. In another form, the determined adjustment of the value 736 is verified to the adjusted value 738. The verified adjusted value 738 can be compared to the desired value 732, the software routine can then correct and/or change the determined adjustment 737 of the determined adjustment of the value 736.

Another aspect of the present invention discloses a method, comprising the steps of a) configuring a compressed gas projectile accelerator to expel multiple projectiles from multiple selected velocity settings falling between a first velocity setting and a second velocity setting; and b) providing a controller configured to allow a user to selectively choose, program, and/or re program a plurality of velocity settings falling between the first and second velocity settings.

Yet another aspect of the present invention discloses a method, comprising the steps of a) configuring a compressed gas projectile accelerator to expel multiple projectiles from multiple selected velocity settings falling between a first velocity setting and a second velocity setting; and b) providing a programmable controller configured for selectively choosing a plurality of velocity settings falling between the first and second velocity settings.

A further aspect of the present invention discloses a method, comprising the steps of a) configuring a compressed gas projectile accelerator to expel multiple projectiles from multiple selected velocity settings falling between a first velocity setting and a second velocity setting; and b) providing a programmable controller configured for selectively choosing an operational mode from a plurality of operational modes with velocity settings falling between the first and second velocity settings.

A further aspect of the present invention discloses a projectile accelerator. The projectile accelerator includes a compressed gas source; a gas releasing mechanism in communication with the compressed gas source; a trigger mechanism for selectively controlling the gas releasing mechanism; and a controller associated with said gas releasing mechanism for allowing said projectile accelerator to be selectively controlled in a manner in which projectiles are expelled from said projectile accelerator between an upper velocity setting and a lower velocity setting, where said projectiles are expelled from said projectile accelerator in a lobbed manner with differing lower velocities and in a non-lobbed manner with an upper velocity setting.

Another aspect of the present invention discloses a compressed gas projectile accelerator, comprising a compressed gas source; a compressed gas control mechanism in communication with said compressed gas source for selectively controlling compressed gas to expel a multiple of projectiles; and a projectile velocity controller configured to selectively expel projectiles at a multitude of selected velocity settings falling within a range of velocity settings.

Yet another aspect of the present invention discloses an electronic projectile accelerator, comprising: an electronic circuit board; a velocity control in communication with the electronic circuit board for allowing the velocity selection from a variety of velocity settings at which projectiles are expelled from a barrel, where a velocity selection is not permitted to go above a predetermined maximum value; and a fire mode within the electronic circuit board, where the fire mode is configured to control one or more operating parameters of the electronic circuit board as a function of the velocity selection.

Another aspect of the present invention discloses an electronic projectile accelerator, comprising: an electronic circuit board; a controller connected with said electronic circuit board to allow the selection of velocity settings from a range of velocity settings at which projectiles are expelled from a barrel, while not permitting said velocity setting to go above a predetermined maximum value; and an operational mode in association with said electronic circuit board, where said electronic circuit board is configured to control one or more operating parameters of said electronic projectile accelerator as a function of said velocity settings, while not permitting a determined value to go above a predetermined maximum value in said operational mode.

A further aspect of the present invention discloses a circuit board for a compressed gas projectile accelerator. The circuit board includes software routines or modules that include a firing module configured to operate the compressed gas projectile accelerator in a straight fire mode and a lobbing mode. The straight fire mode is operable to configure the marker to operate in a semi-automatic mode, a fully-automatic mode, and a burst mode. The lobbing mode is configured to expel a group of projectiles at varying velocities within a range of velocities falling between an upper velocity limit and a lower velocity limit. Each projectile in the group of projectiles is assigned a distinct velocity setting.

Another aspect of the present invention discloses a kit for retrofitting a compressed gas projectile accelerator 50. The kit includes a velocity control method, as disclosed and described above with respect to FIGS. 1-52*b*, that is configured to allow marker 50 to expel a plurality of projectiles between a defined range of velocity settings, within a range of operational modes. A component controller or circuit board can be included in the kit for allowing a user to selectively configure, program, and/or re-program the velocity control method or operational modes. The exact components included in the kit will vary depending on the design of marker 50, paintball hopper 63, paintball pod harness 772, goggle system 762 and/or other paintball equipment, but will include one or more of the methods described and set forth with respect to FIGS. 1-52*b*.

Another aspect of the present invention discloses a kit for retrofitting a compressed gas projectile accelerator 50 and/or projectile feeding system 63. The kit includes a feeding method, as disclosed and described above with respect to FIGS. 1-52*b*, that is configured to allow marker 50 to expel projectiles while positioned in a plurality of positions and/or angles. The exact components included in the kit will vary depending on the design of marker 50, paintball hopper 63, paintball pod harness 772, goggle system 762 and/or other paintball equipment, but will include one or more of the methods described and set forth with respect to FIGS. 1-52*b*.

Another aspect of the present invention discloses a kit for retrofitting the paintball equipment of a user 10. The kit includes a data or information transfer method, as disclosed and described above with respect to FIGS. 1-52*b*, that is configured to allow the paintball equipment and/or user 10 to share data or information. The exact components included in the kit will vary depending on the design of marker 50, paintball hopper 63, paintball pod harness 772, goggle system 762 and/or other paintball equipment, but will include one or more of the methods described and set forth with respect to FIGS. 1-52*b*.

Another aspect of the present invention discloses a kit for retrofitting the paintball equipment of a user 10. The kit includes a relationship or proximity sensing method, as disclosed and described above with respect to FIGS. 1-52*b*, that is configured to allow the paintball equipment and/or user 10 to sense and/or gauge the relational position of differing equipment elements or members. The exact components included in the kit will vary depending on the design of marker 50, paintball hopper 63, paintball pod harness 772, goggle system 762 and/or other paintball equipment, but will include one or more of the methods described and set forth with respect to FIGS. 1-52*b*.

Another aspect of the present invention discloses a kit for retrofitting the paintball equipment of a user 10. The kit includes a vibration and/or acoustic sensing method, as disclosed and described above with respect to FIGS. 1-52*b*. Further, the kit can include a vibration and/or acoustic reducing method, as disclosed and described above with respect to FIGS. 1-52*b*, that is configured to allow the paintball equipment and/or user 10 to operate at reduced vibration and/or sound levels. The exact components included in the kit will vary depending on the design of marker 50, paintball hopper 63, paintball pod harness 772, goggle system 762 and/or other paintball equipment, but will include one or more of the methods described and set forth with respect to FIGS. 1-52*b*.

Another aspect of the present invention discloses a kit for retrofitting a compressed gas regulator 866 for a paintball marker 50. The kit includes a velocity control method, as disclosed and described above with respect to FIGS. 1-52*b*, that is configured to allow marker 50 to expel a plurality of projectiles between a defined range of velocity settings, within a range of operational modes. A component controller or circuit board can be included in the kit for allowing a user to selectively configure, program, and/or re-program the velocity control method, operational modes and/or functional operations. The exact components included in the kit will vary depending on the design of marker 50, paintball hopper 63, paintball pod harness 772, goggle system 762 and/or other paintball equipment, but will include one or more of the methods described and set forth with respect to FIGS. 1-52*b*.

Those skilled in the art would recognize that the described components, features and/or members of the above described paintball equipment may be configured, laid out, or connected in a different manner or configuration; and the described components, features and/or members can be combined or separated into single components, features and/or members. The described components, features and/or members may be duplicated or copied in plural forms in the above described paintball equipment. Also, the described components, features and/or members may be connected directly to power source 68 or have a separate source of power.

Those skilled in the art would also recognize that the described modes, methods, and/or manners of the above described paintball equipment may be configured, laid out, or formulated in a different style or configuration; and the described modes, methods, and/or manners can be combined or separated into single modes, methods, and/or manners. The described modes, methods, and/or manners may be duplicated or copied in plural forms in the above described paintball equipment.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A projectile accelerator, comprising:

a controller configured to function in an inconsistent manner within a range of energy settings that fall below an upper energy setting, where said upper energy setting falls below the maximum energy setting of said projectile accelerator, and where said inconsistent manner comprises expelling projectiles at reduced energy settings that are not consistent with said upper energy setting.

2. The projectile accelerator of claim 1, further comprising one or more actuators configured to adjust one or more operating parameters of said projectile accelerator to expel projectiles in said inconsistent manner.

3. The projectile accelerator of claim 1, further comprising one or more actuators in communication with one or more circuit boards, wherein said one or more circuit boards are operable to change one or more operational parameters of said projectile accelerator through said one or more actuators to expel projectiles in said inconsistent manner.

4. The projectile accelerator of claim 1, further comprising one or more actuators configured to change one or more operational parameters of said projectile accelerator through positioning of one or more operational members of said projectile accelerator to expel projectiles in said inconsistent manner.

5. The projectile accelerator of claim 1, further comprising one or more circuit boards in communication with said controller, wherein said circuit boards are operable to change one or more operational parameters of said projectile accelerator to expel projectiles in said inconsistent manner.

6. The projectile accelerator of claim 1, further comprising one or more sensors in communication with said controller, wherein said sensors are operable to detect a sensed value of one or more operational parameters of said projectile accelerator to expel projectiles in said inconsistent manner.

7. The projectile accelerator of claim 1, further comprising adjusting an energy supply of said projectile accelerator to expel projectiles in said inconsistent manner.

8. The projectile accelerator of claim 1, further comprising adjusting the release of an energy supply of said projectile accelerator to expel projectiles in said inconsistent manner.

9. The projectile accelerator of claim 1, further comprising adjusting a path of an energy supply of said projectile accelerator to expel projectiles in said inconsistent manner.

10. The projectile accelerator of claim 1, further comprising adjusting an energy supply level of said projectile accelerator to expel projectiles in said inconsistent manner.

11. The projectile accelerator of claim 1, further comprising one or more restriction members configured to adjust one or more operating parameters of said projectile accelerator to expel projectiles in said inconsistent manner.

12. The projectile accelerator of claim 1, further comprising one or more supply regulators configured to adjust one or more operating parameters of said projectile accelerator to expel projectiles in said inconsistent manner.

13. The projectile accelerator of claim 1, further comprising adjusting spring energy of said projectile accelerator to expel projectiles in said inconsistent manner.

14. The projectile accelerator of claim 1, further comprising one or more sensors in communication with said controller, wherein said sensors are operable to change one or more operational parameters of said projectile accelerator to expel projectiles in said inconsistent manner.

15. A method, comprising:

configuring a projectile accelerator to expel projectiles in an inconsistent manner at energy saving settings that are below an upper energy setting, where said upper energy setting falls below the maximum energy setting of said projectile accelerator; and providing a controller configured to allow selection of energy settings in said inconsistent manner that are not consistent with said upper energy setting.

16. The method of claim 15, further comprising the step of adjusting a timed release of energy supplied to control projectiles expelled in said inconsistent manner as a function of said controller.

17. The method of claim 15, further comprising the step of adjusting an energy supply to control projectiles expelled in said inconsistent manner as a function of said controller.

18. The method of claim 15, further comprising the step of adjusting an energy level to control projectiles expelled in said inconsistent manner as a function of said controller.

19. A kit for retrofitting a projectile accelerator, comprising:

a controller configured to allow said projectile accelerator to expel projectiles in an inconsistent manner at energy saving settings that are below an upper energy setting, where said upper energy setting falls below a maximum energy setting of said projectile accelerator; and an adjustment mechanism allowing selection of energy settings of said projectile accelerator in said inconsistent manner.

20. The kit for retrofitting a projectile accelerator of claim 19, wherein said controller comprises a secondary control on said projectile accelerator having a main controller to expel projectiles in said inconsistent manner.

* * * * *